US007211373B2

(12) United States Patent
Ohzeki et al.

(10) Patent No.: US 7,211,373 B2
(45) **Date of Patent: *May 1, 2007**

(54) PHOTOTHERMOGRAPHIC MATERIAL

(75) Inventors: Tomoyuki Ohzeki, Kanagawa (JP); Kohzaburoh Yamada, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/403,005

(22) Filed: Apr. 1, 2003

(65) Prior Publication Data

US 2004/0023174 A1 Feb. 5, 2004
US 2005/0158675 A9 Jul. 21, 2005

Related U.S. Application Data

(63) Continuation-in-part of application No. 10/262,955, filed on Oct. 3, 2002, now Pat. No. 6,787,298, and a continuation-in-part of application No. 10/102,886, filed on Mar. 22, 2002, now Pat. No. 6,764,816.

(30) Foreign Application Priority Data

| | | |
|---|---|---|
| Mar. 23, 2001 | (JP) | 2001-86161 |
| Oct. 3, 2001 | (JP) | 2001-307828 |
| Apr. 2, 2002 | (JP) | 2002-100160 |
| Apr. 4, 2002 | (JP) | 2002-102319 |
| Apr. 8, 2002 | (JP) | 2002-105496 |
| Apr. 11, 2002 | (JP) | 2002-108857 |
| Apr. 16, 2002 | (JP) | 2002-113416 |
| Oct. 30, 2002 | (JP) | 2002-316275 |
| Oct. 30, 2002 | (JP) | 2002-316276 |
| Oct. 30, 2002 | (JP) | 2002-316277 |
| Oct. 30, 2002 | (JP) | 2002-316317 |

(51) Int. Cl.
*G03C 1/498* (2006.01)
*G03C 1/10* (2006.01)
*G03C 1/34* (2006.01)

(52) U.S. Cl. ..... 430/619; 430/264; 430/572; 430/576; 430/578; 430/580; 430/581; 430/583; 430/592; 430/595; 430/603; 430/611; 430/614; 430/620

(58) Field of Classification Search ..... 430/619, 430/572, 576, 578, 580, 581, 583, 592, 595, 430/603, 955, 611, 264, 614, 584, 620
See application file for complete search history.

(56) References Cited

U.S. PATENT DOCUMENTS

| | | | | |
|---|---|---|---|---|
| 2,910,377 | A | 10/1959 | Owen | |
| 3,152,904 | A | 10/1964 | Sorensen et al. | |
| 3,457,075 | A | 7/1969 | Mogan et al. | |
| 4,562,143 | A * | 12/1985 | Hirabayashi et al. | 430/353 |
| 5,677,121 | A * | 10/1997 | Tsuzuki | 430/619 |
| 5,686,228 | A * | 11/1997 | Murray et al. | 430/350 |
| 5,843,632 | A | 12/1998 | Eshelman et al. | |
| 5,958,668 | A * | 9/1999 | Matsumoto et al. | 430/619 |
| 6,054,260 | A | 4/2000 | Adin et al. | |
| 6,174,663 | B1 | 1/2001 | Kato | |
| 6,203,972 | B1 | 3/2001 | Kato et al. | |
| 6,297,001 | B1 * | 10/2001 | Takiguchi et al. | 430/619 |
| 6,413,711 | B1 * | 7/2002 | Kimura | 430/619 |
| 6,534,251 | B1 * | 3/2003 | Maeda et al. | 430/350 |
| 6,764,816 | B2 * | 7/2004 | Ohzeki | 430/619 |
| 2003/0194638 | A1 * | 10/2003 | Goto et al. | 430/264 |
| 2003/0207221 | A1 | 11/2003 | Yamada et al. | |

FOREIGN PATENT DOCUMENTS

| | | |
|---|---|---|
| EP | 1111448 | 6/2001 |
| EP | 1136875 | 9/2001 |

OTHER PUBLICATIONS

Hackh's Chemical Dictionary, Julius Grant, Fourth Edition, pp. 573-574.*

* cited by examiner

*Primary Examiner*—Thorl Chea
(74) *Attorney, Agent, or Firm*—Margaret A. Burke; Sheldon J. Moss

(57) ABSTRACT

A photothermographic material comprising a photosensitive silver halide, a non-photosensitive organic silver salt, a reducing agent for a silver ion and a binder on one surface of a support, wherein a silver behenate-content of the non-photosensitive organic silver salt is 40 to 70 mol %, and the photothermographic material comprises a compound that can be one-electron-oxidized to provide a one-electron oxidation product, which further releases at least 1 electron, one of during and after a subsequent reaction.

12 Claims, No Drawings

PHOTOTHERMOGRAPHIC MATERIAL

CROSS-REFERENCE TO RELATED APPLICATIONS

This application is a continuation-in-part of application Ser. No. 10/102,886, filed on Mar. 22, 2002, now U.S. Pat. No. 6,764,816 and is a continuation-in-part of Ser. No. 10/262,955 filed on Oct. 3, 2002 now U.S. Pat. No. 6,787,298 now published as U.S. 2003/0194638.

BACKGROUND OF THE INVENTION

1. Field of the Invention

The present invention relates to a photothermographic material, and particularly to a photothermographic material suitable for medical imaging, industrial photographic imaging, graphic arts and COM.

2. Description of the Related Art

In recent years, dry photographic development processing has been strongly required in fields of medical imaging, graphic arts, etc. from the viewpoints of environmental preservation and space saving. In that fields, digitalization has been in progress and systems have been expanded their applications rapidly, in which image information is scanned into a computer, saved, modified if necessary, moved to a desired place via data communications and outputted on a photosensitive material by a laser image setter or a laser imager, and then the photosensitive material is developed to provide an image. The photosensitive material is required to record the image information by laser exposure with high intensity and to form a clear black-toned image with high resolution and sharpness. As such digital recording imaging materials, various hard copying systems using a pigment or a dye such as inkjet printers and electrophotographies have been distributed for common image formation. However, the systems are insufficient in image qualities (sharpness, granularity, gradation and color tone) and a recording speed (sensitivity) for the medical imaging, and do not attained a level that they are alternative to conventional, wet-developing silver salt films for medical use.

Photothermographic imaging systems using an organic silver salt are described in U.S. Pat. Nos. 3,152,904 and 3,457,075; and D. H. Klosterboer, *Thermally Processed Silver Systems in Imaging Processes and Materials,* Neblette 8th Ed., Edited by J. Sturge, V. Walworth and A. Shepp, Chapter 9, Page 279, 1989.

Photothermographic materials generally comprises a photosensitive layer, in which a photosensitive silver halide, a reducing agent, a silver salt such as an organic silver salt that can be reduced, and an optional agent for controlling color tone of developed silver are dispersed in a matrix of a binder. Used as the binder are polymers having a glass transition point lower than the heat-developing temperature. In general, polyvinylbutyral is used as the binder, and an image-forming layer is formed by the steps of: dissolving the binder in an organic solvent such as methyl ethyl ketone (hereinafter referred to as MEK); dispersing or dissolving the photosensitive silver halide, the reducing agent, the organic silver salt, etc. therein; applying the resultant to a support into a film; and drying the film. Also photothermographic materials using polymer latex as the binder have been developed in recent years.

When the photothermographic materials are heated at such a high temperature as 80° C. or more after exposure, a black-toned silver image is formed by a redox reaction between the reducing agent and the silver halide or the silver salt that can be reduced as an oxidizing agent. The redox reaction is accelerated by catalytic activity of a silver halide latent image formed by the exposure, and as a result, the black-toned silver image is formed in the exposed region. The photothermographic materials are disclosed in many references including U.S. Pat. No. 2,910,377 and JP-B No. 43-4924. However, the photosensitive silver halide, the organic silver salt, the reducing agent, etc. are remained in the photothermographic materials even after the thermal developing, whereby the photothermographic materials are seriously disadvantageous in that printout and fogging is increased during storage of the image.

Generally used as the laser are gas lasers ($Ar^+$, He—Ne, He—Cd), YAG lasers, dye lasers, semiconductor lasers, etc. The semiconductor lasers may be used in combination with a second harmonic-generating device. Emission wavelength region of the laser may be in a wide range of blue to infrared region. Among the lasers, infrared semiconductor lasers can stably emit light with reduced costs to be particularly suitable for designing a laser image output system, which is compact and excellent in operationality and which can be used in any installation location with ease. The photothermographic materials are thus required to have infrared photosensitivity, and various efforts have been made to increase the sensitivity to the infrared radiation. However, infrared spectral sensitizing components are generally unstable and decomposed during the storage of the photosensitive material to reduce the sensitivity. Thus, the photosensitive materials with infrared spectral sensitization have been required to be improved in storage stability in addition to the sensitivity.

Organic solution application-type photosensitive materials, particularly such that uses polyvinylbutyral as the binder, result in a remarkable change of the sensitivity during the storage as compared with aqueous solution application-type photosensitive materials using the polymer latex. This instability was considered to be caused by a residual organic solvent from comparing both. Under the circumstances, technologies for increasing the sensitivity with excellent storage stability are required, particularly in the case of using the organic solvent for application.

SUMMARY OF THE INVENTION

An object of the present invention is to solve the above mentioned problems, thereby providing a photothermographic material excellent in sensitivity, storage stability, and light-fastness (or printout resistance) of an image.

1) A first aspect of the invention is to provide a photothermographic material comprising a photosensitive silver halide, a non-photosensitive organic silver salt, a reducing agent for a silver ion and a binder on one surface of a support, wherein a silver behenate-content of the non-photosensitive organic silver salt is 40 to 70 mol %, and the photothermographic material comprises a compound that can be one-electron-oxidized to provide a one-electron oxidation product, which releases 1 or more electrons in or after a subsequent reaction.
2) A second aspect of the invention is to provide a photothermographic material comprising a photosensitive silver halide, a non-photosensitive organic silver salt, a reducing agent for a silver ion and a binder on one surface of a support, wherein the photothermographic material comprises a spectral sensitizing dye represented by any one of the following general formulae (3a) to (3d), and a compound that can be one-electron-oxidized to provide a one-electron oxidation product, which releases 1 or more electrons in or after a subsequent reaction.

Formula (3a)

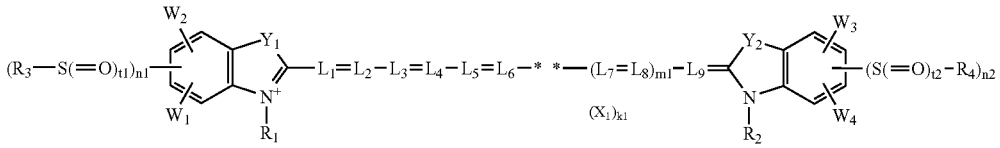

Formula (3b)

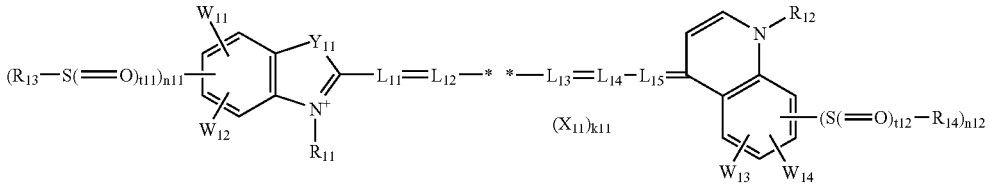

Formula (3c)

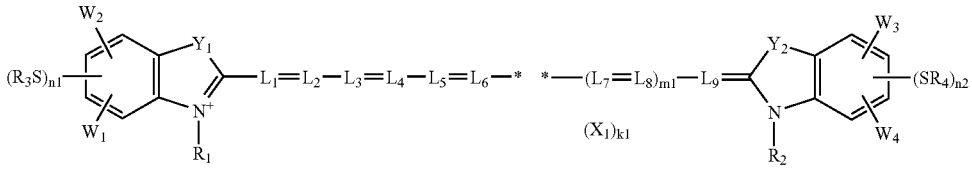

Formula (3d)

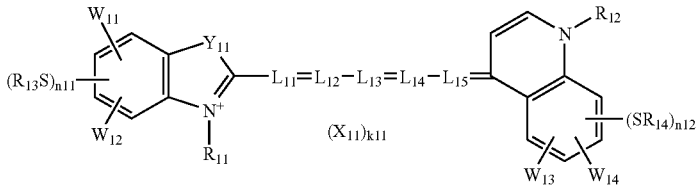

In the general formulae (3a) to (3d), $Y_1$, $Y_2$ and $Y_{11}$ each represent an oxygen atom, a sulfur atom, a selenium atom or a —CH═CH— group; $L_1$ to $L_9$ and $L_{11}$ to $L_{15}$ each represent a methine group; $R_1$, $R_2$, $R_{11}$ and $R_{12}$ each represent an aliphatic group; $R_3$, $R_4$, $R_{13}$ and $R_{14}$ each represent a lower alkyl group, a cycloalkyl group, an alkenyl group, an aralkyl group, an aryl group or a heterocyclic group; $W_1$, $W_2$, $W_3$, $W_4$, $W_{11}$, $W_{12}$, $W_{13}$ and $W_{14}$ each represent a hydrogen atom or a substituent; alternatively, $W_1$ and $W_2$, $W_3$ and $W_4$, $W_{11}$ and $W_{12}$, and $W_{13}$ and $W_{14}$ may bond together to be a nonmetallic atomic group forming a condensed ring, respectively; alternatively, $R_3$ and $W_1$, $R_3$ and $W_2$, $R_{13}$ and $W_{11}$, $R_{13}$ and $W_{12}$, $R_4$ and $W_3$, $R_4$ and $W_4$, $R_{14}$ and $W_{13}$, and $R_{14}$ and $W_{14}$ may bond together to be a nonmetallic atomic group forming a 5- or 6-membered condensed ring, respectively; $X_1$ and $X_{11}$ each represent an ion neutralizing a charge of the spectrally sensitizing dye; $k_1$ and $k_{11}$ each represent a number of the ion; m1 represents 0 or 1; $n_1$, $n_2$, $n_{11}$ and $n_{12}$ each represent 0, 1 or 2, at least one of $n_1$ and $n_2$, and at least one of $n_{11}$ and $n_{12}$ being 1 or 2 respectively; and t1, t2, t11 and t12 each represent 1 or 2.

3) A third aspect of the invention is to provide a photothermographic material comprising a photosensitive silver halide, a non-photosensitive organic silver salt, a reducing agent for a silver ion and a binder on one surface of a support, wherein an emulsion grain of the photosensitive silver halide is added in a step of preparing the non-photosensitive organic silver salt, and the photothermographic material comprises a compound that can be one-electron-oxidized to provide a one-electron oxidation product, which releases 1 or more electrons in or after a subsequent reaction.

DETAILED DESCRIPTION OF THE INVENTION

The present invention will be described in detail below.

1. Photothermographic Material

The photothermographic material of the invention has an image-forming layer comprising a photosensitive silver halide, a non-photosensitive organic silver salt, a reducing agent and a binder. It is preferred that a compound of any one of Types 1 to 5 is contained in the image-forming layer or a layer adjacent thereto. The image-forming layer may have a structure of single layer or multi-layer. Further, the photothermographic material may comprise a surface protective layer on the image-forming layer, and may comprise a back layer, a back protective layer, etc. on the other side.

Structure and preferred components of each layer will be described in detail below.

1-1. Image-forming Layer 1-1-1. Compounds of Types 1 to 5

The compounds of Types 1 to 5 are described in detail. Each compound of Types 1 to 5 can be one-electron-oxidized to provide a one-electron oxidation product, which can release further 1 or more electrons in or after the subsequent reaction.

The compound of Type 1 can be one-electron-oxidized to provide a one-electron oxidation product, which can release further 2 or more electrons in or after a subsequent bond cleavage reaction.

The compound of Type 2 can be one-electron-oxidized to provide a one-electron oxidation product, which can release further 1 electron in or after a subsequent bond cleavage reaction. The compound of Type 2 has 2 or more adsorbable groups to the silver halide.

The compound of Type 3 can be one-electron-oxidized to provide a one-electron oxidation product, which can release further 1 or more electron after a subsequent bond formation.

The compound of Type 4 can be one-electron-oxidized to provide a one-electron oxidation product, which can release further 1 or more electron after a subsequent ring cleavage reaction.

The compound of Type 5 is represented by X—Y, in which X represents a reducing group and Y represents a leaving group. The reducing group represented by X can be one-electron-oxidized to provide a one-electron oxidation product, which can be converted into an X radical by eliminating the leaving group of Y in a subsequent X—Y bond cleavage reaction. The X radical can release further 1 electron.

Each compound of Types 1 to 5 preferably has a sensitizing dye moiety.

Each compound of Types 1 and 3 to 5 preferably has a group adsorbable to the silver halide.

It is more preferred that the compound has an adsorbable group to the silver halide.

In the compound of Type 1, the term "the bond cleavage reaction" specifically means a cleavage reaction of a bond of carbon-carbon, carbon-silicon, carbon-hydrogen, carbon-boron, carbon-tin or carbon-germanium. Cleavage of a carbon-hydrogen bond may be followed after the cleavage reaction.

The compound of Type 1 can be one-electron-oxidized to be converted into the one-electron oxidation product, and thereafter can release further 2 or more electrons, preferably 3 or more electrons with the bond cleavage reaction. In other words, the compound of Type 1 is such a compound that can be 2 or more-electron-oxidized, preferably 3 or more-electron-oxidized, after the one-electron oxidation.

The compound of Type 1 is preferably represented by any one of general formulae (A), (B), (1), (2) or (3).

Formula (A)

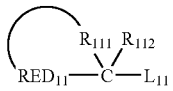

Formula (B)

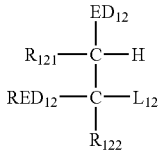

Froumula (1)

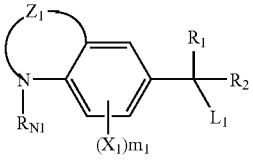

-continued

Froumula (2)

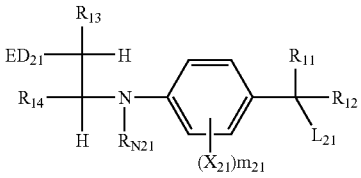

Froumula (3)

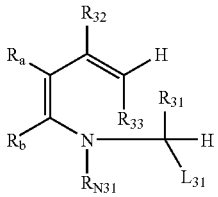

In the general formula (A), $RED_{11}$ represents a reducing group that can be one-electron-oxidized, and $L_{11}$ represents a leaving group.

$R_{112}$ represents a hydrogen atom or a substituent.

$R_{111}$ represents a nonmetallic atomic group forming a particular, 5- or 6-membered ring structure with a carbon atom C and $RED_{11}$.

The particular, 5- or 6-membered ring structure corresponds to a tetrahydro-, hexahydro- or octahydro-derivative of a 5- or 6-membered aromatic ring including aromatic heterocycles.

In the general formula (B), $RED_{12}$ represents a reducing group that can be one-electron-oxidized, and $L_{12}$ represents a leaving group.

$R_{121}$ and $R_{122}$ each represent a hydrogen atom or a substituent. $ED_{12}$ represents an electron-donating group.

In the general formula (B), $R_{121}$ and $RED_{12}$, $R_{121}$ and $R_{122}$, and $ED_{12}$ and $RED_{12}$ may bond together to form a ring structure, respectively.

In the compound represented by the general formula (A) or (B), the reducing group of $RED_{11}$ or $RED_{12}$ is one-electron-oxidized, and thereafter the leaving group of $L_{11}$ or $L_{12}$ is spontaneously eliminated, thus a C (carbon atom)-$L_{11}$ bond or a C (carbon atom)-$L_{12}$ bond is cleaved, in the bond cleavage reaction. Further 2 or more, preferably 3 or more electrons can be released with the bond cleavage reaction.

In the general formula (1), $Z_1$ represents an atomic group forming a 6-membered ring with a nitrogen atom and 2 carbon atoms in a benzene ring; $R_1$, $R_2$ and $R_{N1}$ each represent a hydrogen atom or a substituent; $X_1$ represents a substituent linkable to the benzene ring; $m_1$ represents an integer of 0 to 3; and $L_1$ represents a leaving group.

In the general formula (2), $ED_{21}$ represents an electron-donating group; $R_{11}$, $R_{12}$, $R_{N21}$, $R_{13}$ and $R_{14}$ each represent a hydrogen atom or a substituent; $X_{21}$ represents a substituent linkable to a benzene ring; $m_{21}$ represents an integer of 0 to 3; and $L_{21}$ represents a leaving group.

$R_{N21}$, $R_{13}$, $R_{14}$, $X_{21}$ and $ED_{21}$ may bond to each other to form a ring structure.

In the general formula (3), $R_{32}$, $R_{33}$, $R_{31}$, $R_{N31}$, $R_a$ and $R_b$ each represent a hydrogen atom or a substituent; and $L_{31}$ represents a leaving group.

Incidentally, $R_a$ and $R_b$ bond together to form an aromatic ring when $R_{N31}$ is not an aryl group.

After the compound represented by the general formula (1), (2) or (3) is one-electron-oxidized, the leaving group of $L_1$, $L_{21}$ or $L_{31}$ is spontaneously eliminated, thus a C (carbon atom)-$L_1$ bond, a C (carbon atom)-$L_{21}$ bond or a C (carbon atom)-$L_{31}$ bond is cleaved, in the bond cleavage reaction. Further 2 or more, preferably 3 or more electrons can be released with the bond cleavage reaction.

First, the compound represented by the general formula (A) will be described in detail below.

In the general formula (A), the reducing group of $RED_{11}$. can be one-electron-oxidized and can bond to after-mentioned $R_{111}$ to form the particular ring structure. Specifically, the reducing group may be a divalent group provided by removing 1 hydrogen atom from the following monovalent group at a position suitable for ring formation.

The monovalent group may be an alkylamino group; an arylamino group such as an anilino group and a naphthylamino group; a heterocyclic amino group such as a benzthiazolylamino group and a pyrrolylamino group; an alkylthio group; an arylthio group such as a phenylthio group; a heterocyclic thio group; an alkoxy group; an aryloxy group such as a phenoxy group; a heterocyclic oxy group; an aryl group such as a phenyl group, a naphthyl group and an anthranil group; or an aromatic or nonaromatic heterocyclic group, containing at least one heteroatom selected from the group consisting of a nitrogen atom, a sulfur atom, an oxygen atom and a selenium atom, which has a 5- to 7-membered, monocyclic or condensed ring structure such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxazine ring, a phenothiazine ring, a benzothiazoline ring, a pyrrole ring, an imidazole ring, a thiazoline ring, a piperidine ring, a pyrrolidine ring, a morpholine ring, a benzimidazole ring, a benzimidazoline ring, a benzoxazoline ring and a methylenedioxyphenyl ring. $RED_{11}$ is hereinafter described as the monovalent group for convenience. The monovalent groups may have a substituent.

EXAMPLEs of the substituent include halogen atoms; alkyl groups including aralkyl groups, cycloalkyl groups, active methine groups, etc.; alkenyl groups; alkynyl groups; aryl groups; heterocyclic groups, which may bond at any position; heterocyclic groups containing a quaternary nitrogen atom such as a pyridinio group, an imidazolio group, a quinolinio group and an isoquinolinio group; acyl groups; alkoxycarbonyl groups; aryloxycarbonyl groups; carbamoyl groups; a carboxy group and salts thereof; sulfonylcarbamoyl groups; acylcarbamoyl groups; sulfamoylcarbamoyl groups; carbazoyl groups; oxalyl groups; oxamoyl groups; a cyano group; carbonimidoyl groups; thiocarbamoyl groups; a hydroxy group; alkoxy groups, which may contain a plurality of ethyleneoxy groups or propyleneoxy groups as a repetition unit; aryloxy groups; heterocyclic oxy groups; acyloxy groups; alkoxy or aryloxy carbonyloxy groups; carbamoyloxy groups; sulfonyloxy groups; amino groups; alkyl, aryl or heterocyclic amino groups; acylamino groups; sulfoneamide groups; ureide groups; thioureide groups; imide groups; alkoxy or aryloxy carbonylamino groups; sulfamoylamino groups; semicarbazide groups; thiosemicarbazide groups; hydrazino groups; ammonio groups; oxamoylamino groups; alkyl or aryl sulfonylureide groups; acylureide groups; acylsulfamoylamino groups; a nitro group; a mercapto group; alkyl, aryl or heterocyclic thio groups; alkyl or aryl sulfonyl groups; alkyl or aryl sulfinyl groups; a sulfo group and salts thereof; sulfamoyl groups; acylsulfamoyl groups; sulfonylsulfamoyl groups and salts thereof; groups containing a phosphoric amide or phosphate ester structure; etc.

The substituents may be further substituted by the substituent.

In the general formula (A), the leaving group of $L_{11}$ can be eliminated by the bond cleavage after the reducing group of $RED_{11}$ is one-electron-oxidized. Specific examples of the leaving group include a carboxy group and salts thereof, silyl groups, a hydrogen atom, triarylboron anions, trialkylstannyl groups, trialkylgermyl groups and a —$CR_{C1}R_{C2}R_{C3}$ group.

When $L_{11}$ represents a salt of a carboxy group, specific examples of a counter ion to form the salt include alkaline metal ions such as $Li^+$, $Na^+$, $K^+$ and $Cs^+$, alkaline earth metal ions such as $Mg^{2+}$, $Ca^{2+}$ and $Ba^{2+}$, heavy metal ions such as $Ag^+$ and $Fe^{2+/3+}$, ammonium ions, phosphonium ions, etc.

When $L_{11}$ represents a silyl group, the silyl group is specifically a trialkylsilyl group, an aryldialkylsilyl group, a triarylsilyl group, etc. The alkyl group may be a methyl group, an ethyl group, a benzyl group, a t-butyl group, etc. and the aryl group may be a phenyl group, etc. in the silyl group.

When $L_{11}$ represents a triarylboron anion, the aryl group is preferably a phenyl group, which may have a substituent with examples the same as those of the substituent on $RED_{11}$.

When $L_{11}$ represents a trialkylstannyl group or a trialkylgermyl group, each alkyl group thereof has 1 to 24 carbon atom and is normal, branched or cyclic. The alkyl group may have a substituent with examples the same as those of the substituent on $RED_{11}$.

When $L_{11}$ represents a —$CR_{C1}R_{C2}R_{C3}$ group, $R_{C1}$, $R_{C2}$ and $R_{C3}$ independently represent a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxy group. $R_{C1}$, $R_{C2}$ and $R_{C3}$ may bond to each other to form a ring structure, and may have a substituent.

EXAMPLEs of the substituent on $R_{C1}$, $R_{C2}$ and $R_{C3}$ are the same as those of the substituent on $RED_{11}$.

Incidentally, when one of $R_{C1}$, $R_{C2}$ and $R_{C3}$ is a hydrogen atom or an alkyl group, there is no case where the other two of them are a hydrogen atom or an alkyl group.

$R_{C1}$, $R_{C2}$ and $R_{C3}$ are preferably an alkyl group, an aryl group (particularly a phenyl group), an alkylthio group, an arylthio group, an alkylamino group, an arylamino group, a heterocyclic group, an alkoxy group or a hydroxy group, respectively. Specific examples thereof include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group, a hydroxy group, etc.

EXAMPLEs of the ring structure formed by $R_{C1}$, $R_{C2}$ and $R_{C3}$ include a 1,3-dithiolane-2-yl group, a 1,3-dithiane-2-yl group, an N-methyl-1,3-thiazolidine-2-yl group, an N-benzyl-benzothiazolidine-2-yl group, etc.

Preferred examples of the —$CR_{C1}R_{C2}R_{C3}$ group include a trityl group, a tri-(p-hydroxyphenyl)methyl group, a 1,1-diphenyl-1-(p-dimethylaminophenyl)methyl group, a 1,1-diphenyl-1-(methylthio)methyl group, a 1-phenyl-1,1-(dimethylthio)methyl group, a 1,3-dithiolane-2-yl group, a 2-phenyl-1,3-dithiolane-2-yl group, a 1,3-dithiane-2-yl group, a 2-phenyl-1,3-dithiane-2-yl group, a 2-methyl-1,3-dithiane-2-yl group, an N-methyl-1,3-thiazolidine-2-yl group, a 2-methyl-3-methyl-1,3-thiazolidine-2-yl group, an N-benzyl-benzothiazolidine-2-yl group, a 1,1-diphenyl-1-dimethylaminomethyl group, a 1,1-diphenyl-1-morpholinomethyl group, etc.

It is also preferred that the —$CR_{C1}R_{C2}R_{C3}$ group is the same as a residue provided by removing $L_{11}$ from the general formula (A) as a result of selecting each of $R_{C1}$, $R_{C2}$ and $R_{C3}$ as above.

In the general formula (A), $R_{112}$ represents a hydrogen atom or a substituent linkable to a carbon atom. When $R_{112}$ represents a substituent linkable to a carbon atom, examples of the substituent may be the same as those of the substituent on $RED_{11}$.

Incidentally, there is no case where $R_{112}$ represents the same group as $L_{11}$.

In the general formula (A), $R_{111}$ represents a nonmetallic atomic group to form a particular, 5- or 6-membered ring structure with a carbon atom (C) and $RED_{11}$. The particular, 5- or 6-membered ring structure formed by $R_{111}$ corresponds to a tetrahydro-, hexahydro- or octahydro-derivative of a 5- or 6-membered aromatic ring including aromatic heterocycles.

The tetrahydro-, hexahydro- or octahydro-derivative means a ring structure derived by partly hydrogenating carbon-carbon double bonds and/or carbon-nitrogen double bonds of an aromatic ring or an aromatic heterocycle. The tetrahydro-derivative means a ring structure derived by hydrogenating 2 double bonds of carbon-carbon or carbon-nitrogen. The hexahydro-derivative means a ring structure derived by hydrogenating 3 double bonds of carbon-carbon or carbon-nitrogen. The octahydro-derivative means a ring structure derived by hydrogenating 4 double bonds of carbon-carbon or carbon-nitrogen. The aromatic ring is hydrogenated to converted into a partly hydrogenated, nonaromatic ring structure.

Specifically, examples of a 5-membered, monocyclic ring include a pyrrolidine ring, an imidazolidine ring, a thiazolidine ring, a pyrazolidine ring, an oxazolidine ring, etc., corresponding to a tetrahydro-derivative of an aromatic ring of a pyrrole ring, an imidazole ring, a thiazole ring, a pyrazole ring, an oxazole ring, etc.

EXAMPLEs of a 6-membered, monocyclic ring include a piperidine ring, a tetrahydropyridine ring, a tetrahydropyrimidine ring, a piperazine ring, etc., corresponding to a tetrahydro- or hexahydro-derivative of an aromatic ring of a pyridine ring, a pyridazine ring, a pyrimidine ring, a pyrazine ring, etc.

EXAMPLEs of a 6-membered, condensed ring include a tetralin ring, a tetrahydroquinoline ring, a tetrahydroisoquinoline ring, a tetrahydroquinazoline ring, a tetrahydroquinoxaline ring, etc., corresponding to a tetrahydro-derivative of an aromatic ring of a naphthalene ring, a quinoline ring, an isoquinoline ring, a quinazoline ring, a quinoxaline ring, etc.

EXAMPLEs of a tricyclic ring include a tetrahydrocarbazole ring corresponding to a tetrahydro-derivative of a carbazole ring, an octahydrophenanthridine ring corresponding to an octahydro-derivative of a phenanthridine ring, etc.

These ring structures may further have a substituent with examples the same as those of the substituent on $RED_{11}$.

The substituents on the ring structure may bond together to further form a ring, which is a nonaromatic, carbocyclic ring or a heterocycle.

Next, preferred embodiments of the compound represented by the general formula (A) will be described.

In the general formula (A), $L_{11}$ is preferably a carboxy group or a salt thereof, or a hydrogen atom, more preferably a carboxy group or a salt thereof.

A counter ion of the salt is preferably an alkaline metal ion or an ammonium ion, the most preferably an alkaline metal ion, preferably $Li^+$, $Na^+$ or $K^+$ ion.

When $L_{11}$ represents a hydrogen atom, the compound represented by the general formula (A) preferably has a base moiety.

After the compound represented by the general formula (A) is oxidized, the base moiety acts to eliminate the hydrogen atom of $L_{11}$ and to release an electron.

The base is specifically a conjugate base of an acid with a pKa value of approximately 1 to 10. For example, the base moiety may contain a structure of a nitrogen-containing heterocycle such as pyridine, imidazole, benzoimidazole and thiazole; aniline; trialkylamine; an amino group; a carbon acid such as an active methylene anion; a thioacetic acid anion; carboxylate (—$COO^-$); sulfate (—$SO_3^-$); amineoxide (>$N^+(O^-)$—); and derivatives thereof. The base is preferably a conjugate base of an acid with a pKa value of approximately 1 to 8, more preferably carboxylate, sulfate or amineoxide, particularly preferably carboxylate.

When these bases have an anion, the compound of the general formula (A) may have a counter cation. EXAMPLEs of the counter cation include alkaline metal ions, alkaline earth metal ions, heavy metal ions, ammonium ions, phosphonium ions, etc.

The base moiety may be at an optional position of the compound represented by the general formula (A). The base moiety may be connected to $RED_{11}$, $R_{111}$ or $R_{112}$ in the general formula (A), and to a substituent thereon.

When $L_{11}$ represents a hydrogen atom, the hydrogen atom is connected to the base moiety preferably through 8 or less linking atom, more preferably through 5 to 8 linking atoms.

The linking atoms mean atoms connecting the hydrogen atom to a main atom of the base moiety (an atom having an anion or a lone electron pair) by covalent bonds. For example, 2 atoms of —C—$O^-$ in carboxylate and 2 atoms of S—$O^-$ in sulfate are counted as the linking atoms.

Further, the carbon atom represented by C in the general formula (A) is also added to the number of the linking atoms.

In the general formula (A), when $L_{11}$ is a hydrogen atom, $RED_{11}$ is an anilino group or a derivative thereof, and the nitrogen atom of $RED_{11}$ forms a 6-membered monocyclic saturated ring structure with $R_{111}$, such as a piperidine ring, a piperazine ring, a morpholine ring, a thiomorpholine ring and a selenomorpholine ring, it is preferable that the compound of the general formula (A) has an adsorbable group to the silver halide, and it is more preferable that the compound further has a base moiety connected to the hydrogen atom through 8 or less linking atom.

In the general formula (A), $RED_{11}$ is preferably an alkylamino group, an arylamino group, a heterocyclic amino group, an aryl group, or an aromatic or nonaromatic, heterocyclic group. The heterocyclic group is preferably a tetrahydroquinolinyl group, a tetrahydroquinoxalinyl group, a tetrahydroquinazolinyl group, an indolyl group, an indolenyl group, a carbazolyl group, a phenoxadinyl group, a phenothiadinyl group, a benzothiazolinyl group, a pyrrolyl group, an imidazolyl group, a thiazolidinyl group, a benzoimidazolyl group, a benzoimidazolinyl group, a 3,4-methylenedioxyphenyl-1-yl group, etc.

$RED_{11}$ is more preferably an arylamino group, particularly an anilino group, or an aryl group, particularly a phenyl group.

When $RED_{11}$ is an aryl group, it is preferred that the aryl group has at least one electron-donating group. The number of the electron-donating group is preferably 4 or less, more preferably 1 to 3.

The electron-donating group is a hydroxy group; an alkoxy group; a mercapto group; a sulfoneamide group; an acylamino group; an alkylamino group; an arylamino group; a heterocyclic amino group; an active methine group; an electron-excess, aromatic, heterocyclic group such as an indolyl group, a pyrrolyl group, an imidazolyl group, a benzimidazolyl group, a thiazolyl group, a benzthiazolyl group and an indazolyl group; a nitrogen-containing, non-aromatic heterocyclic group that substitutes at the nitrogen atom, such as a pyrrolidinyl group, an indolinyl group, a piperidinyl group, a piperazinyl group and a morpholino group; etc.

The active methine group is a methine group having 2 electron-withdrawing groups, and the electron-withdrawing group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The 2 electron-withdrawing groups may bond together to form a ring structure.

When $RED_{11}$ is an aryl group, a substituent on the aryl group is more preferably an alkylamino group, a hydroxy group, an alkoxy group, a mercapto group, a sulfoneamide group, an active methine group or a nitrogen-containing, nonaromatic heterocyclic group that substitutes at the nitrogen atom, further preferably an alkylamino group, a hydroxy group, an active methine group or a nitrogen-containing, nonaromatic heterocyclic group that substitutes at the nitrogen atom, the most preferably an alkylamino group or a nitrogen-containing, nonaromatic heterocyclic group that substitutes at the nitrogen atom.

In the general formula (A), $R_{112}$ is preferably a hydrogen atom; an alkyl group; an aryl group such as a phenyl group; an alkoxy group such as a methoxy group, an ethoxy group and a benzyloxy group; a hydroxy group; an alkylthio group such as a methylthio group and a butylthio group; an amino group; an alkylamino group; an arylamino group; or a heterocyclic amino group. $R_{112}$ is more preferably a hydrogen atom, an alkyl group, an alkoxy group, a hydroxy group, a phenyl group or an alkylamino group.

In the general formula (A), $R_{111}$ is preferably a nonmetallic atomic group that forms, with a carbon atom (C) and $RED_{11}$, the following particular 5- or 6-membered ring structure: a tetrahydro-derivative of a 5-membered, monocyclic aromatic ring of a pyrrole ring, an imidazole ring, etc., such as a pyrrolidine ring and an imidazolidine ring; a tetrahydro- or hexahydro-derivative of a 6-membered, monocyclic aromatic ring of a pyridine ring, a pyridazine ring, a pyrimidine ring, a pyrazine ring, etc., such as a piperidine ring, a tetrahydropyridine ring, a tetrahydropyrimidine ring and a piperazine ring; a tetrahydro-derivative of a 6-membered, condensed aromatic ring of a naphthalene ring, a quinoline ring, an isoquinoline ring, a quinazoline ring, a quinoxaline ring, etc., such as a tetralin ring, a tetrahydroquinoline ring, a tetrahydroisoquinoline ring, a tetrahydroquinazoline ring and a tetrahydroquinoxaline ring; a tetrahydro-derivative of a tricyclic aromatic ring of a carbazole ring, etc., such as a tetrahydro carbazole ring; an octahydro-derivative of a tricyclic aromatic ring of a phenanthridine ring, etc., such as an octahydro phenanthridine ring; etc.

The ring structure formed by $R_{111}$ is more preferably a pyrrolidine ring, an imidazolidine ring, a piperidine ring, a tetrahydropyridine ring, a tetrahydropyrimidine ring, a piperazine ring, a tetrahydroquinoline ring, a tetrahydroquinazoline ring, a tetrahydroquinoxaline ring or a tetrahydrocarbazole ring, particularly preferably a pyrrolidine ring, a piperidine ring, a piperazine ring, a tetrahydroquinoline ring, a tetrahydroquinazoline ring, a tetrahydroquinoxaline ring or a tetrahydrocarbazole ring, the most preferably a pyrrolidine ring, a piperidine ring or a tetrahydroquinoline ring.

The general formula (B) will be described in detail below.

In the general formula (B), $RED_{12}$ and $L_{12}$ are the same as $RED_{11}$ and $L_{11}$ in the general formula (A) with respect to the meanings and preferred embodiments, respectively.

Incidentally, $RED_{12}$ is a monovalent group except for the case of forming a ring structure mentioned below. Specific examples of $RED_{12}$ are the same as above-mentioned examples of the monovalent group to provide $RED_{11}$.

$R_{121}$ and $R_{122}$ are the same as $R_{112}$ in the general formula (A) with respect to the meanings and preferred embodiments, respectively. $ED_{12}$ represents an electron-donating group.

Each combination of $R_{121}$ and $RED_{12}$, $R_{121}$ and $R_{122}$, and $ED_{12}$ and $RED_{12}$ may bond together to form a ring structure.

In the general formula (B), the electron-donating group represented by $ED_{12}$ is a hydroxy group; an alkoxy group; a mercapto group; an alkylthio group; an arylthio group; a heterocyclic thio group; a sulfoneamide group; an acylamino group; an alkylamino group; an arylamino group; a heterocyclic amino group; an active methine group; an electron-excess, aromatic heterocyclic group such as an indolyl group, a pyrrolyl group and an indazolyl group; a nitrogen-containing, nonaromatic heterocyclic group that substitutes at the nitrogen atom, such as a pyrrolidinyl group, a piperidinyl group, an indolinyl group, a piperazinyl group and a morpholino group; or an aryl group having a substituent composed thereof, such as a p-hydroxyphenyl group, a p-dialkylaminophenyl group, an o,p-dialkoxyphenyl group and a 4-hydroxynaphthyl group.

The active methine group is the same as above-mentioned active methine group that acts as a substituent on $RED_{11}$ when $RED_{11}$ is an aryl group.

$ED_{12}$ is preferably a hydroxy group; an alkoxy group; a mercapto group; a sulfoneamide group; an alkylamino group; an arylamino group; an active methine group; an electron-excess aromatic heterocyclic group; a nitrogen-containing, nonaromatic heterocyclic group that substitutes at the nitrogen atom; or a phenyl group having a substituent composed thereof. More preferred are a hydroxy group; a mercapto group; a sulfoneamide group; an alkylamino group; an arylamino group; an active methine group; a nitrogen-containing, nonaromatic heterocyclic group that substitutes at the nitrogen atom; and a phenyl group having a substituent composed thereof, such as a p-hydroxyphenyl group, a p-dialkylaminophenyl group and an o,p-dialkoxyphenyl group.

In the general formula (B), each combination of $R_{121}$ and $RED_{12}$, $R_{122}$ and $R_{121}$, and $ED_{12}$ or $RED_{12}$ may bond together to form a ring structure.

The ring structure is a 5- to 7-membered, monocyclic or condensed, substituted or unsubstituted, carbocyclic or heterocyclic, nonaromatic ring. Specific examples of a ring structure formed by $R_{121}$ and $RED_{12}$ include a pyrrolidine ring, a pyrroline ring, an imidazolidine ring, an imidazoline ring, a thiazolidine ring, a thiazoline ring, a pyrazolidine ring, a pyrazoline ring, an oxazolidine ring, an oxazoline ring, an indane ring, a piperidine ring, a piperazine ring, a morpholine ring, a tetrahydropyridine ring, a tetrahydropyrimidine ring, an indoline ring, a tetralin ring, a tetrahydroquinoline ring, a tetrahydroisoquinoline ring, a tetrahydroquinoxaline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazine ring, a 2,3-dihydrobenzofuran ring, 2,3-dihydrobenzothiophene ring, etc.

When $ED_{12}$ and $RED_{12}$ form a ring structure, $ED_{12}$ preferably represents an amino group, an alkylamino group or an arylamino group, and specific examples of the ring structure include a tetrahydropyrazine ring, a piperazine ring, a tetrahydroquinoxaline ring, a tetrahydroisoquinoline ring, etc.

Specific examples of the ring structure formed by $R_{122}$ and $R_{121}$ include a cyclohexane ring, a cyclopentane ring, etc.

The compound represented by the general formula (A) is more preferably represented by one of the following general formulae (10) to (12), and the compound represented by the general formula (B) is more preferably represented by one of the following general formulae (13) and (14).

Froumula (10)

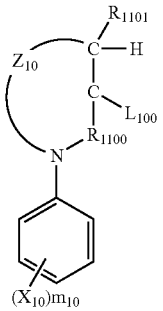

Froumula (11)

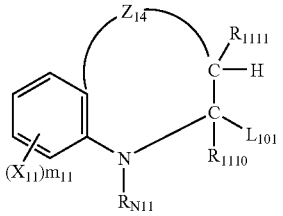

Froumula (12)

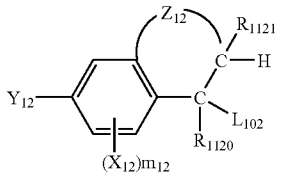

Froumula (13)

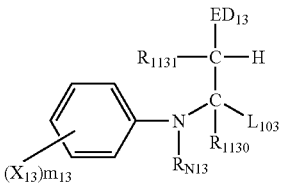

-continued

Froumula (14)

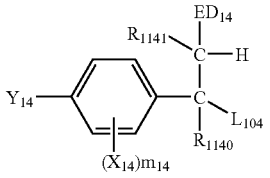

$L_{100}$, $L_{101}$, $L_{102}$, $L_{103}$ and $L_{104}$ in the general formulae (10) to (14) are the same as $L_{11}$ in the general formula (A) with respect to the meanings and preferred embodiments, respectively.

$R_{1100}$ and $R_{1101}$, $R_{1110}$ and $R_{1111}$, $R_{1120}$ and $R_{1121}$, $R_{1130}$ and $R_{1131}$, and $R_{1140}$ and $R_{1141}$ are the same as $R_{122}$ and $R_{121}$ in the general formula (B) with respect to the meanings and preferred embodiments, respectively.

$ED_{13}$ and $ED_{14}$ are the same as $ED_{12}$ in the general formula (B) with respect to the meanings and preferred embodiments, respectively.

$X_{10}$, $x_{11}$, $X_{12}$, $X_{13}$ and $X_{14}$ each represent a substituent connectable to a benzene ring. $m_{10}$, $m_{11}$, $m_{12}$, $m_{13}$ and $m_{14}$ each represent an integer of 0 to 3, and when they are 2 or 3, a plurality of $X_{10}$'s, $X_{11}$'s, $X_{12}$'s, $X_{13}$'s and $X_{14}$'s may be the same or different groups, respectively.

$Y_{12}$ and $Y_{14}$ each represent an amino group; an alkylamino group; an arylamino group; a nitrogen-containing, nonaromatic heterocyclic group that substitutes at the nitrogen atom, such as a pyrrolyl group, a piperidinyl group, an indolinyl group, a piperazino group and a morpholino group; a hydroxy group; or an alkoxy group.

$Z_{10}$, $Z_{11}$ and $Z_{12}$ each represent a nonmetallic atomic group forming a particular ring structure.

The particular ring structure formed by $Z_{10}$ corresponds to a tetrahydro- or hexahydro-derivative of a 5- or 6-membered, monocyclic or condensed, nitrogen-containing, aromatic heterocycle. Specific examples thereof include a pyrrolidine ring, an imidazolidine ring, a thiazolidine ring, a pyrazolidine ring, a piperidine ring, a tetrahydropyridine ring, a tetrahydropyrimidine ring, a piperazine ring, a tetrahydroquinoline ring, a tetrahydroisoquinoline ring, a tetrahydroquinazoline ring, a tetrahydroquinoxaline ring, etc.

The particular ring structure formed by $Z_{11}$ is a tetrahydroquinoline ring or a tetrahydroquinoxaline ring.

The particular ring structure formed by $Z_{12}$ is a tetralin ring, a tetrahydroquinoline ring or a tetrahydroisoquinoline ring.

$R_{N11}$ and $R_{N13}$ each represent a hydrogen atom or a substituent connectable to a nitrogen atom. The substituent is specifically an alkyl group, an alkenyl group, an alkynyl group, an aryl group, a heterocyclic group or an acyl group, preferably an alkyl group or an aryl group.

The substituent connectable to a benzene ring represented by $X_{10}$, $X_{11}$, $X_{12}$, $X_{13}$ and $X_{14}$ has the same examples as the substituent on $RED_{11}$ in the general formula (A).

The substituent is preferably a halogen atom; an alkyl group; an aryl group; a heterocyclic group; an acyl group; an alkoxy carbonyl group; an aryloxycarbonyl group; a carbamoyl group; a cyano group; an alkoxy group, which may contain a plurality of ethyleneoxy groups or propyleneoxy groups as a repetition unit; an alkyl, aryl, or heterocyclic amino group; an acylamino group; a sulfoneamide group; an ureide group; a thiouredide group; an imide group; an alkoxy or aryloxy carbonylamino group; a nitro group; an alkyl, aryl or heterocyclic thio group; an alkyl or aryl sulfonyl group; or a sulfamoyl group.

Each of $m_{10}$, $m_{11}$, $m_{12}$, $m_{13}$ and $m_{14}$ is preferably an integer of 0 to 2, more preferably 0 or 1.

Each of $Y_{12}$ and $Y_{14}$ is preferably an alkylamino group, an arylamino group, a nitrogen-containing nonaromatic heterocyclic group that substitutes at the nitrogen atom, a hydroxy group, or an alkoxy group, more preferably an alkylamino group, a 5 to 6-membered nitrogen-containing nonaromatic heterocyclic group that substitutes at the nitrogen atom, or a hydroxy group, the most preferably an alkylamino group (particularly a dialkylamino group), or a 5 to 6-membered nitrogen-containing nonaromatic heterocyclic group that substitutes at the nitrogen atom.

In the general formula (13), $R_{1131}$ and $X_{13}$, $R_{1131}$ and $R_{N13}$, $R_{1130}$ and $X_{13}$, or $R_{1130}$ and $R_{N13}$ may bond together to form a ring structure, respectively.

In the general formula (14), $R_{1141}$ and $X_{14}$, $R_{1141}$ and $R_{1140}$, $ED_{14}$ and $X_{14}$, or $R_{1140}$ and $X_{14}$ may bond together to form a ring structure, respectively.

The ring structure is a carbocyclic or heterocyclic, 5- to 7-membered, monocyclic or condensed, substituted or unsubstituted, nonaromatic ring structure. In the general formula (13), preferred are the case where $R_{1131}$ and $X_{13}$ bond together to form a ring structure, the case where $R_{1131}$ and $R_{N13}$ bond together to form a ring structure, and the case where no ring structure is formed.

Specific examples of the ring structure formed by $R_{1131}$ and $X_{13}$ in the general formula (13) include an indoline ring (in this case, $R_{1131}$ being a single bond), a tetrahydroquinoline ring, a tetrahydroquinoxaline ring, a 2,3-dihydrobenzo-1,4-oxazine ring, a 2,3-dihydrobenzo-1,4-thiazine ring, etc.

Particularly preferred are an indoline ring, a tetrahydroquinoline ring and a tetrahydroquinoxaline ring.

Specific examples of the ring structure formed by $R_{1131}$ and $R_{N13}$ in the general formula (13) include a pyrrolidine ring, a pyrroline ring, an imidazolidine ring, an imidazoline ring, a thiazolidine ring, a thiazoline ring, a pyrazolidine ring, a pyrazoline ring, an oxazolidine ring, an oxazoline ring, a piperidine ring, a piperadine ring, a morpholine ring, a tetrahydropyridine ring, a tetrahydropyrimidine ring, an indoline ring, a tetrahydroquinoline ring, a tetrahydroisoquinoline ring, a tetrahydroquinoxaline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazine ring, a 2,3-dihydrobenzofuran ring, a 2,3-dihydrobenzothiophene ring, etc.

Particularly preferred are a pyrrolidine ring, a piperidine ring, a tetrahydroquinoline ring and a tetrahydroquinoxaline ring.

In the general formula (14), preferred are the case where $R_{1141}$ and $X_{14}$ bond together to form a ring structure, the case where $ED_{14}$ and $X_{14}$ bond together to form a ring structure, and the case where no ring structure is formed.

Specific examples of the ring structure formed by $R_{1141}$ and $X_{14}$ in the general formula (14) include an indane ring, a tetralin ring, a tetrahydroquinoline ring, a tetrahydroisoquinoline ring, an indoline ring, etc.

Specific examples of the ring structure formed by $ED_{14}$ and $X_{14}$ in the general formula (14) include a tetrahydroisoquinoline ring, a tetrahydrocinnoline ring, etc.

Next, the general formulae (1) to (3) will be described below.

In the general formulae (1) to (3), $R_1$, $R_2$, $R_{11}$, $R_{12}$ and $R_{31}$ independently represent a hydrogen atom or a substituent, and they are the same as $R_{112}$ in the general formula (A) with respect to the meanings and preferred embodiments, respectively.

$L_1$, $L_{21}$ and $L_{31}$ independently represent a leaving group with examples the same as those of $L_{11}$ in the general formula (A).

$X_1$ and $X_{21}$ independently represent a substituent connectable to a benzene ring, with examples the same as those of the substituent on $RED_{11}$ in the general formula (A).

Each of $m_1$ and $m_{21}$ is an integer of 0 to 3, preferably an integer of 0 to 2, more preferably 0 or 1.

$R_{N1}$, $R_{N21}$ and $R_{N31}$ each represent a hydrogen atom or a substituent connectable to a nitrogen atom. The substituent is preferably an alkyl group, an aryl group or a heterocyclic group, and may further have a substituent with examples the same as those of the substituent on $RED_{11}$ in the general formula (A).

Each of $R_{N1}$, $R_{N21}$ and $R_{N31}$ is preferably a hydrogen atom, an alkyl group or an aryl group, more preferably a hydrogen atom or an alkyl group.

$R_{13}$, $R_{14}$, $R_{32}$, $R_{33}$, $R_a$ and $R_b$ independently represent a hydrogen atom or a substituent connectable to a carbon atom, with examples the same as those of the substituent on $RED_{11}$ in the general formula (A).

The substituent is preferably an alkyl group, an aryl group, an acyl group, an alkoxycarbonyl group, a carbamoyl group, a cyano group, an alkoxy group, an acylamino group, a sulfoneamide group, a ureide group, a thiouredide group, an alkylthio group, an arylthio group, an alkylsulfonyl group, an arylsulfonyl group, or a sulfamoyl group.

In the general formula (1), $Z_1$ represents an atomic group forming a 6-membered ring with a nitrogen atom and 2 carbon atoms in a benzene ring.

The 6-membered ring formed by $Z_1$ is a nonaromatic heterocycle condensed with the benzene ring in the general formula (1). The ring structure containing the nonaromatic heterocycle and the benzene ring to be condensed may be specifically a tetrahydroquinoline ring, a tetrahydroquinoxaline ring, or a tetrahydroquinazoline ring, which may have a substituent with examples and preferred embodiments the same as those of the substituent represented by $R_{112}$ in the general formula (A)

In the general formula (1), $Z_1$ is preferably an atomic group that forms a tetrahydroquinoline ring or a tetrahydroquinoxaline ring with a nitrogen atom and 2 carbon atoms in a benzene ring.

In the general formula (2), $ED_{21}$ is an electron-donating group, and the same as $ED_{12}$ in the general formula (B) with respect to the meanings and preferred embodiments.

In the general formula (2), any two of $R_{N21}$, $R_{13}$, $R_{14}$, $X_{21}$ and $ED_{21}$ may bond together to form a ring structure.

The ring structure formed by $R_{N21}$ and $X_{21}$ is preferably a 5- to 7-membered, carbocyclic or heterocyclic, nonaromatic ring structure condensed with a benzene ring, and specific examples thereof include a tetrahydroquinoline ring, a tetrahydroquinoxaline ring, an indoline ring, a 2,3-dihydro-5,6-benzo-1,4-thiazine ring, etc. Preferred are a tetrahydroquinoline ring, a tetrahydroquinoxaline ring and an indoline ring.

When $R_{N31}$ is a group other than an aryl group in the general formula (3), $R_a$ and $R_b$ bond together to form an aromatic ring.

The aromatic ring is an aryl group such as a phenyl group and a naphthyl group, or an aromatic heterocyclic group such as a pyridine ring group, a pyrrole ring group, a quinoline ring group and an indole ring group, preferably an aryl group.

The aromatic ring group may have a substituent, which is the same as the substituent represented by $X_1$ in the general formula (1) with respect to the examples and preferred embodiments.

In the general formula (3), $R_a$ and $R_b$ preferably bond together to form an aromatic ring, particularly a phenyl group.

In the general formula (3), $R_{32}$ is preferably a hydrogen atom, an alkyl group, an aryl group, a hydroxy group, an alkoxy group, a mercapto group or an amino group. When $R_{32}$ is a hydroxy group, $R_{33}$ is preferably an electron-withdrawing group.

The electron-withdrawing group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group, preferably an acyl group, an alkoxycarbonyl group, a carbamoyl group or a cyano group.

The compound of Type 2 will be described below.

The compound of Type 2 can be one-electron-oxidized to provide a one-electron oxidation product. The one-electron oxidation product can release further 1 electron in or after a bond cleavage reaction, in other words, can be further one-electron-oxidized.

The bond cleavage reaction is a cleavage reaction of a bond of carbon-carbon, carbon-silicon, carbon-hydrogen, carbon-boron, carbon-tin or carbon-germanium. Cleavage of a carbon-hydrogen bond may be caused with the cleavage reaction.

The compound of Type 2 has 2 or more, preferably 2 to 6, more preferably 2 to 4, adsorbent groups to the silver halide. The adsorbable group is further preferably a mercapto-substituted, nitrogen-containing, heterocyclic group.

The number of the adsorbent groups is preferably 2 to 6, more preferably 2 to 4. The adsorbable group will hereinafter be described.

The compound of Type 2 is preferably represented by the following general formula (C).

Froumula (C)

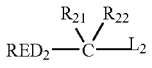

In the compound represented by the general formula (C), the reducing group of $RED_2$ is one-electron-oxidized, and thereafter the leaving group of $L_2$ is spontaneously eliminated, thus a C (carbon atom)-$L_2$ bond is cleaved, in the bond cleavage reaction. Further 1 electron can be released with the bond cleavage reaction.

In the general formula (C), $RED_2$ is the same as $RED_{12}$ in the general formula (B) with respect to the meanings and preferred embodiments.

$L_2$ is the same as $L_{11}$ in the general formula (A) with respect to the meanings and preferred embodiments.

Incidentally, when $L_2$ is a silyl group, the compound of the general formula (C) has 2 or more mercapto-substituted, nitrogen-containing, heterocyclic groups as the adsorbent groups.

$R_{21}$ and $R_{22}$ each represent a hydrogen atom or a substituent, and are the same as $R_{112}$ in the general formula (A) with respect to the meanings and preferred embodiments.

$RED_2$ and $R_{21}$ may bond together to form a ring structure.

The ring structure is a 5- to 7-membered, monocyclic or condensed, carbocyclic or heterocyclic, nonaromatic ring, and may have a substituent.

Incidentally, there is no case where the ring structure corresponds to a tetrahydro-, hexahydro- or octahydro-derivative of an aromatic ring or an aromatic heterocycle.

The substituent has the same examples as above-mentioned substituent on $RED_{11}$ in the general formula (A).

The ring structure is preferably such that corresponds to a dihydro-derivative of an aromatic ring or an aromatic heterocycle, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, a 1,2-dihydroquinoxaline ring, etc.

Preferred are a 2-imidazoline ring, a 2-thiazoline ring, an indoline ring, a benzoimidazoline ring, a benzothiazoline ring, a benzoxazoline ring, a 1,2-dihydro pyridine ring, a 1,2-dihydroquinoline ring, a 1,2-dihydroquinazoline ring and a 1,2-dihydroquinoxaline ring, more preferred are an indoline ring, a benzoimidazoline ring, a benzothiazoline ring and a 1,2-dihydroquinoline ring, particularly preferred is an indoline ring.

The compound of Type 3 will be described below.

The compound of Type 3 can be one-electron-oxidized to provide a one-electron oxidation product, which can release further 1 or more electron after a subsequent bond formation. In the bond formation, a bond of carbon-carbon, carbon-nitrogen, carbon-sulfur, carbon-oxygen, etc. is formed.

It is preferable that the one-electron oxidation product releases 1 or more electron after an intramolecular bond-forming reaction between the one-electron-oxidized portion and a reactive site in the same molecular such as a carbon-carbon double bond, a carbon-carbon triple bond, an aromatic group and a benzo-condensed, nonaromatic heterocyclic group.

Though the one-electron oxidation product derived from the compound of Type 3 by one-electron oxidation is generally a cation radical, it may be converted into a neutral radical by elimination of a proton.

This one-electron oxidation product of the cation radical or the neutral radical is subjected to the intramolecular reaction with the carbon-carbon double bond, the carbon-carbon triple bond, the aromatic group, or the benzo-condensed, nonaromatic heterocyclic group, whereby a bond of carbon-carbon, carbon-nitrogen, carbon-sulfur, carbon-oxygen, etc. is formed to provide another ring structure.

In the compound of Type 3, further 1 or more electron is released at the same time as or after the intramolecular reaction.

In more detail, the compound of Type 3 is one-electron-oxidized, then subjected to the bond formation to provide the radical having the ring structure, and oxidized such that further 1 electron is released directly from the radical or with elimination of a proton.

Thus-provided 2-electron oxidation product may be subjected to hyfrolysis reaction, or tautomerization reaction with proton shift, and then may be further oxidized and release further 1 or more, generally 2 or more electrons directly.

The 2-electron oxidation product may be further oxidized such that further 1 or more, generally 2 or more electrons is released directly therefrom without the tautomerization reaction.

The compound of Type 3 is preferably represented by the following general formula (D).

$$RED_3—L_3Y_3 \quad \text{Formula (D)}$$

In the general formula (D), $RED_3$ represents a reducing group that can be one-electron-oxidized, and $Y_3$ represents a reactive group that reacts with the one-electron-oxidized $RED_3$, specifically an organic group containing a carbon-carbon double bond, a carbon-carbon triple bond, an aromatic group or a benzo-condensed, nonaromatic heterocyclic group.

$L_3$ represents a linking group that connects $RED_3$ and $Y_3$.

In the general formula (D), $RED_3$ has the same meanings as $RED_{12}$ in the general formula (B).

In the general formula (D), $RED_3$ is preferably an arylamino group, a heterocyclic amino group, an aryloxy group, an arylthio group, an aryl group, or an aromatic or nonaromatic heterocyclic group that is preferably a nitrogen-containing heterocyclic group. $RED_3$ is more preferably an arylamino group, a heterocyclic amino group, an aryl group, or an aromatic or nonaromatic heterocyclic group. Preferred as the heterocyclic group are a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrole ring group, an imidazole ring group, a thiazole ring group, a benzoimidazole ring group, a benzoimidazoline ring group, a benzothiazoline ring group, a 3,4-methylenedioxyphenyl-1-yl group, etc.

Particularly preferred as $RED_3$ are an arylamino group (particularly an anilino group), an aryl group (particularly a phenyl group), and an aromatic or nonaromatic heterocyclic group.

The aryl group represented by $RED_3$ preferably has at least one electron-donating group.

The electron-donating group is a hydroxy group; an alkoxy group; a mercapto group; an alkylthio group; a sulfoneamide group; an acylamino group; an alkylamino group; an arylamino group; a heterocyclic amino group; an active methine group; an electron-excess, aromatic heterocyclic group such as an indolyl group, a pyrrolyl group and an indazolyl group; a nitrogen-containing, nonaromatic heterocyclic group that substitutes at the nitrogen atom such as a pyrrolidinyl group, an indolinyl group, a piperidinyl group, a piperazinyl group, a morpholino group and a thiomorpholino group; etc.

The active methine group is a methine group having 2 electron-withdrawing groups, and the electron-withdrawing group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The 2 electron-withdrawing groups may bond together to form a ring structure.

When $RED_3$ is an aryl group, more preferred as a substituent on the aryl group are an alkylamino group, a hydroxy group, an alkoxy group, a mercapto group, a sulfoneamide group, an active methine group, and a nitrogen-containing, nonaromatic heterocyclic group that substitutes at the nitrogen atom, furthermore preferred are an alkylamino group, a hydroxy group, an active methine group, and a nitrogen-containing, nonaromatic heterocyclic group that substitutes at the nitrogen atom, and the most preferred are an alkylamino group, and a nitrogen-containing, nonaromatic heterocyclic group that substitutes at the nitrogen atom.

When the reactive group represented by $Y_3$ in the general formula (D) is an organic group containing a carbon-carbon double bond or a carbon-carbon triple bond having a substituent, preferred as the substituent are an alkyl group preferably having 1 to 8 carbon atom; an aryl group preferably having 6 to 12 carbon atoms; an alkoxycarbonyl group preferably having 2 to 8 carbon atoms; a carbamoyl group; an acyl group; an electron-donating group; etc.

The electron-donating group is an alkoxy group preferably having 1 to 8 carbon atom; a hydroxy group; an amino group; an alkylamino group preferably having 1 to 8 carbon atom; an arylamino group preferably having 6 to 12 carbon atoms; a heterocyclic amino group preferably having 2 to 6 carbon atoms; a sulfoneamide group; an acylamino group; an active methine group; a mercapto group; an alkylthio group preferably having 1 to 8 carbon atom; an arylthio group preferably having 6 to 12 carbon atoms; or an aryl group having a substituent composed thereof, in which the aryl moiety preferably has 6 to 12 carbon atoms.

The hydroxy group may be protected by a silyl group, and examples of the silyl-protected group include a trimethylsilyloxy group, a t-butyldimethylsilyloxy group, a triphenylsilyloxy group, a triethylsilyloxy group, a phenyldimethylsilyloxy group, etc. EXAMPLEs of the group containing carbon-carbon double bond or carbon-carbon triple bond include a vinyl group, an ethynyl group, etc.

When $Y_3$ is an organic group containing carbon-carbon double bond having a substituent, more preferred as the substituent are an alkyl group, a phenyl group, an acyl group, a cyano group, an alkoxycarbonyl group, a carbamoyl group and an electron-donating group. The electron-donating group is preferably an alkoxy group; a hydroxy group that may be protected by a silyl group; an amino group; an alkylamino group; an arylamino group; a sulfoneamide group; an active methine group; a mercapto group; an alkylthio group; or a phenyl group having the electron-donating group as a substituent.

Incidentally, when the organic group containing the carbon-carbon double bond has a hydroxy group as a substituent, $Y_3$ contains a moiety of $>C_1{=}C_2(—OH)—$, which may be tautomerized into a moiety of $>C_1H—C_2({=}O)—$.

In this case, it is preferred that a substituent on the $C_1$ carbon is an electron-withdrawing group, and as a result, $Y_3$ has a moiety of an active methylene group or an active methine group.

The electron-withdrawing group, which can provide such a moiety of an active methylene group or an active methine group, may be the same as above-mentioned electron-withdrawing group on the methine group of the active methine group.

When $Y_3$ is an organic group containing a carbon-carbon triple bond having a substituent, preferred as the substituent are an alkyl group, a phenyl group, an alkoxycarbonyl group, a carbamoyl group, an electron-donating group, etc. The electron-donating group is preferably an alkoxy group, an amino group, an alkylamino group, an arylamino group, a heterocyclic amino group, a sulfoneamide group, an acylamino group, an active methine group, a mercapto group, an alkylthio group, or a phenyl group having the electron-donating group as a substituent.

When $Y_3$ is an organic group containing an aromatic group, preferred as the aromatic group are an aryl group, particularly a phenyl group, having an electron-donating group as a substituent, and an indole ring group. The electron-donating group is preferably a hydroxy group, which may be protected by a silyl group; an alkoxy group;

an amino group; an alkylamino group; an active methine group; a sulfoneamide group; or a mercapto group.

When $Y_3$ is an organic group containing a benzo-condensed, nonaromatic heterocyclic group, preferred as the benzo-condensed, nonaromatic heterocyclic group are groups having an aniline moiety, such as an indoline ring group, a 1,2,3,4-tetrahydroquinoline ring group, a 1,2,3,4-tetrahydroquinoxaline ring group and a 4-quinolone ring group.

In the general formula (D), the reactive group of $Y_3$ is more preferably an organic group containing a carbon-carbon double bond, an aromatic group, or a benzo-condensed, nonaromatic heterocyclic group.

Furthermore preferred are an organic group containing a carbon-carbon double bond; a phenyl group having an electron-donating group as a substituent; an indole ring group; and a benzo-condensed, nonaromatic heterocyclic group having an aniline moiety.

The carbon-carbon double bond more preferably has at least one electron-donating group as a substituent.

It is also preferred that the reactive group represented by $Y_3$ in the general formula (D) contains a moiety the same as the reducing group represented by $RED_3$ as a result of selecting the reactive group as above.

In the general formula (D), $L_3$ represents a linking group that connects $RED_3$ and $Y_3$, specifically a single bond, an alkylene group, an arylene group, a heterocyclic group, —O—, —S—, —$NR_N$—, —C(═O)—, —$SO_2$—, —SO—, —P(═O)—, or a combination thereof.

$R_N$ represents a hydrogen atom, an alkyl group, an aryl group or a heterocyclic group.

The linking group represented by $L_3$ may have a substituent with examples the same as those of the substituent on $RED_{11}$ in the general formula (A).

The linking group represented by $L_3$ may bond to each of $RED_3$ and $Y_3$ at an optional position such that the linking group substitutes optional 1 hydrogen atom of each $RED_3$ and $Y_3$.

In the general formula (D), when a cation radical ($X^{+}$•) provided by oxidizing $RED_3$ or a radical (X•) provided by eliminating a proton therefrom reacts with the reactive group represented by $Y_3$ to form a bond, it is preferable that they form a 3 to 7-membered ring structure containing the linking group represented by $L_3$.

Thus, the radical ($X^{+}$• or X•) and the reactive group of Y are preferably connected though 3 to 7 atoms.

Preferred examples of $L_3$ include a single bond; alkylene groups, particularly a methylene group, an ethylene group or a propylene group; arylene groups, particularly a phenylene group; a —C(═O)— group; a —O— group; a —NH— group; —N(alkyl)- groups; and divalent linking groups of combinations thereof.

The compound represented by the general formula (D) preferably represented by any one of the following general formulae (D-1) to (D-4).

Froumula (D-1)

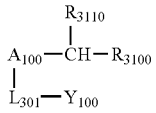

-continued

Froumula (D-2)

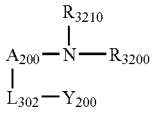

Froumula (D-3)

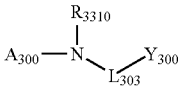

Froumula (D-4)

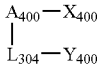

In the general formulae (D-1) to (D-4), $A_{100}$, $A_{200}$ and $A_{400}$ each represent an arylene group or a divalent heterocyclic group, and $A_{300}$ represents an aryl group or a heterocyclic group. These ring groups are the same as $RED_3$ in the general formula (D) with respect to the preferred embodiments.

$L_{301}$, $L_{302}$, $L_{303}$ and $L_{304}$ each represent a linking group, which is the same as $L_3$ in the general formula (D) with respect to the meanings and preferred embodiments.

$Y_{100}$, $Y_{200}$, $Y_{300}$ and $Y_{400}$ each represent a reactive group, which is the same as $Y_3$ in the general formula (D) with respect to the meanings and preferred embodiments.

$R_{3100}$, $R_{3110}$, $R_{3200}$, $R_{3210}$ and $R_{3310}$ each represent a hydrogen atom or a substituent.

$R_{3100}$ and $R_{3110}$ are preferably a hydrogen atom, an alkyl group or an aryl group, respectively.

$R_{3200}$ and $R_{3310}$ are preferably a hydrogen atom, respectively.

$R_{3210}$ is preferably a substituent, which is preferably an alkyl group or an aryl group.

$R_{3110}$ and $A_{100}$, $R_{3210}$ and $A_{200}$, and $R_{3310}$ and $A_{300}$ may bond together to form a ring structure, respectively.

The ring structure is preferably a tetralin ring, an indane ring, a tetrahydroquinoline ring, an indoline ring, etc.

$X_{400}$ represents a hydroxy group, a mercapto group or an alkylthio group, preferably a hydroxy group or a mercapto group, more preferably a mercapto group.

Among the compounds represented by any of the general formulae (D-1) to (D-4), more preferred are the compounds represented by the general formula (D-2), (D-3) or (D-4)

Furthermore preferred are the compound represented by the general formula (D-2) or (D-3).

Next, the compound of Type 4 will be described below.

The compound of Type 4 has a reducing group-substituted ring structure. After the reducing group is one-electron-oxidized, the compound can release further 1 or more electron with a ring structure cleavage reaction.

In the compound of Type 4, the ring structure is cleaved after the one-electron oxidation. The ring cleavage reaction proceeds as follows.

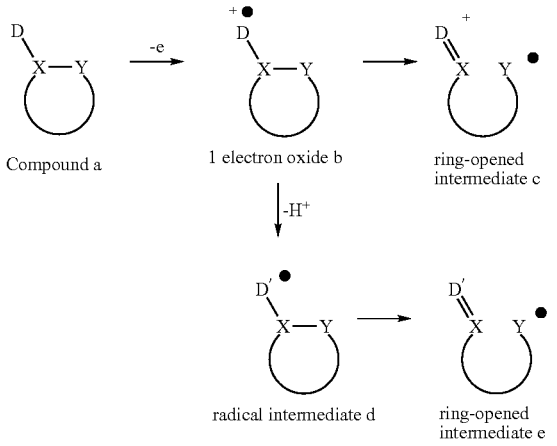

In the formula, Compound a is the compound of Type 4.

In Compound a, D represents a reducing group, and X and Y each represent an atom forming a bond in the ring structure, which is cleaved after the one-electron oxidation.

First, Compound a is one-electron-oxidized to generate one-electron oxidation product b. Then, the X—Y bond is cleaved with conversion of the D—X single bond into a double bond, whereby Ring-opened intermediate c is provided. Alternatively, there is a case where one-electron oxidation product b is converted into Radical intermediate d with deprotonation, and Ring-opened intermediate e is provided in the same manner.

Subsequently, further 1 or more electron is released form thus-provided Ring-opened intermediate c or e.

The ring structure in the compound of Type 4 is a 3 to 7-membered, carbocyclic or heterocyclic, monocyclic or condensed, saturated or unsaturated, nonaromatic ring.

The ring structure is preferably a saturated ring structure, more preferably 3- or 4-membered ring. Preferred examples of the ring structure include a cyclopropane ring, a cyclobutane ring, an oxirane ring, an oxetane ring, an aziridine ring, an azetidine ring, an episulphide ring and a thietane ring.

More preferred are a cyclopropane ring, a cyclobutane ring, an oxirane ring, an oxetane ring and an azetidine ring, particularly preferred are a cyclopropane ring, a cyclobutane ring and an azetidine ring.

The ring structure may have a substituent.

The compound of Type 4 is preferably represented by the following general formula (E) or (F).

Froumula (E)

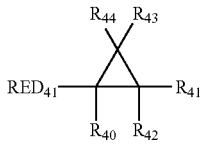

Froumula (F)

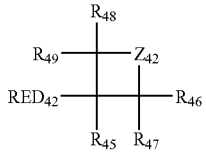

In the general formulae (E) and (F), $RED_{41}$ and $RED_{42}$ are the same as $RED_{12}$ in the general formula (B) with respect to the meanings and preferred embodiments, respectively. $R_{40}$ to $R_{44}$ and $R_{45}$ to $R_{49}$ each represent a hydrogen atom or a substituent with examples the same as those of the substituent on $RED_{12}$.

In the general formula (F), $Z_{42}$ represents —$CR_{420}R_{421}$—, —$NR_{423}$—, or —O—. $R_{420}$ and $R_{421}$ each represent a hydrogen atom or a substituent, and $R_{423}$ represents a hydrogen atom, an alkyl group, an aryl group or a heterocyclic group.

In the general formula (E), $R_{40}$ is preferably a hydrogen atom, an alkyl group, an alkenyl group, an alkynyl group, an aryl group, a heterocyclic group, an alkoxy group, an amino group, an alkylamino group, an arylamino group, a heterocyclic amino group, an alkoxycarbonyl group, an acyl group, a carbamoyl group, a cyano group or a sulfamoyl group, more preferably a hydrogen atom, an alkyl group, an aryl group, a heterocyclic group, an alkoxy group, an alkoxycarbonyl group, an acyl group or a carbamoyl group, most preferably a hydrogen atom, an alkyl group, an aryl group, a heterocyclic group, an alkoxycarbonyl group or a carbamoyl group.

It is preferred that at least one of $R_{41}$ to $R_{44}$ is a donor group, and it is also preferred that both of $R_{41}$ and $R_{42}$, or both of $R_{43}$ and $R_{44}$ are an electron-withdrawing group. It is more preferred that at least one of $R_{41}$ to $R_{44}$ is a donor group. It is furthermore preferred that at least one of $R_{41}$ to $R_{44}$ is a donor group and $R_{41}$ to $R_{44}$ other than the donor group are selected from a hydrogen atom and an alkyl group.

The donor group is a hydroxy group, an alkoxy group, an aryloxy group, a mercapto group, an acylamino group, a sulfonylamino group, an active methine group, or a group selected from the groups preferred for $RED_{41}$ and $RED_{42}$.

The donor group is preferably an alkylamino group; an arylamino group; a heterocyclic amino group; a 5-membered, monocyclic or condensed, aromatic heterocyclic group having one nitrogen atom in the ring; a nitrogen-containing, nonaromatic heterocyclic group that substitutes at the nitrogen atom; or a phenyl group having at least one electron-donating group as a substituent, wherein the electron-donating group is a hydroxy group, an alkoxy group, an aryloxy group, an amino group, an alkylamino group, an arylamino group, a heterocyclic amino group, or a nitrogen-containing, nonaromatic heterocyclic group that substitutes at the nitrogen atom.

The donor group is more preferably an alkylamino group; an arylamino group; 5-membered, aromatic heterocyclic group having one nitrogen atom in the ring, wherein the aromatic heterocycle is an indole ring, a pyrrole ring or a carbazole ring; or a phenyl group having an electron-donating group as a substituent, particularly a phenyl group having 3 or more alkoxy groups, a hydroxy group, an alkylamino group or an arylamino group.

The donor group is particularly preferably an arylamino group; 5-membered, aromatic heterocyclic group having one nitrogen atom in the ring, such as a 3-indolyl group; or a phenyl group having an electron-donating group as a substituent, particularly a phenyl group having a trialkoxyphenyl group, an alkylamino group or an arylamino group.

The electron-withdrawing group may be the same as above-mentioned electron-withdrawing group on the methine group of the active methine group.

In the general formula (F), $R_{45}$ is the same as $R_{40}$ in the general formula (E) with respect to the preferred embodiments.

Each of $R_{46}$ to $R_{49}$ is preferably a hydrogen atom, an alkyl group, an alkenyl group, an alkynyl group, an aryl group, a heterocyclic group, a hydroxy group, an alkoxy group, an amino group, an alkylamino group, an arylamino group, a heterocyclic amino group, a mercapto group, an arylthio group, an alkylthio group, an acylamino group or a sulfoneamino group, more preferably a hydrogen atom, an alkyl group, an aryl group, a heterocyclic group, an alkoxy group, an alkylamino group, an arylamino group or a heterocyclic amino group.

Each of $R_{46}$ to $R_{49}$ is particularly preferably a hydrogen atom, an alkyl group, an aryl group, a heterocyclic group, an alkylamino group or an arylamino group in the case where $Z_{42}$ is —$CR_{420}R_{421}$—, a hydrogen atom, an alkyl group, an aryl group or a heterocyclic group in the case where $Z_{42}$ is —$NR_{423}$—, a hydrogen atom, an alkyl group, an aryl group or a heterocyclic group in the case where $Z_{42}$ is —O—.

$Z_{42}$ is preferably —$CR_{420}R_{421}$— or —$NR_{423}$—, more preferably —$NR_{423}$—.

Each of $R_{420}$ and $R_{421}$ is preferably a hydrogen atom, an alkyl group, an alkenyl group, an alkynyl group, an aryl group, a heterocyclic group, a hydroxy group, an alkoxy group, an amino group, a mercapto group, an acylamino group or a sulfoneamino group, more preferably a hydrogen atom, an alkyl group, an aryl group, a heterocyclic group, an alkoxy group or an amino group.

$R_{423}$ is preferably a hydrogen atom, an alkyl group, an aryl group or an aromatic heterocyclic group, more preferably a methyl group, an ethyl group, an isopropyl group, a t-butyl group, a t-amyl group, a benzyl group, a diphenylmethyl group, an aryl group, a phenyl group, a naphthyl group, a 2-pyridyl group, a 4-pyridyl group or a 2-thiazolyl group.

The substituent represented by each of $R_{40}$ to $R_{49}$, $R_{420}$, $R_{421}$ and $R_{423}$ preferably has 40 or less carbon atoms, more preferably has 30 or less carbon atoms, particularly preferably 15 or less carbon atoms.

The substituents of $R_{40}$ to $R_{49}$, $R_{420}$, $R_{421}$ and $R_{423}$ may bond to each other or to the other portion such as $RED_{41}$, $RED_{42}$ and $Z_{42}$, to form a ring.

Each compound of Types 1, 3 and 4 used in the invention preferably has the adsorbable group to the silver halide, or a spectral sensitizing dye moiety, more preferably has the adsorbable group to the silver halide.

The compound of Type 2 has 2 or more adsorbable group to the silver halide.

Each compound of Types 1 to 4 further more preferably has 2 or more mercapto groups-substituted, nitrogen-containing, heterocyclic group as the adsorbent group.

In the compounds of Types 1 to 4 used in the invention, the adsorbable group to the silver halide is such a group that is directly adsorbed on the silver halide or promotes adsorption of the compound onto the silver halide. Specifically, the adsorbable group is a mercapto group or a salt thereof; a thione group (—C(═S)—); a heterocyclic group containing at least one atom selected from the group consisting of a nitrogen atom, a sulfur atom, a selenium atom and a tellurium atom; a sulfide group; a cationic group; or an ethynyl group.

Incidentally, the adsorbable group in the compound of Type 2 is not a sulfide group.

The mercapto group or a salt thereof used as the adsorbable group may be a mercapto group or a salt thereof itself, and is more preferably a heterocyclic group, an aryl group or an alkyl group having a mercapto group or a salt thereof as a substituent.

The heterocyclic group is a 5- to 7-membered, monocyclic or condensed, aromatic or nonaromatic, heterocyclic group. EXAMPLEs thereof include an imidazole ring group, a thiazole ring group, an oxazole ring group, a benzimidazole ring group, a benzthiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, etc.

The heterocyclic group may contain a quaternary nitrogen atom, and in this case, the mercapto group bonding to the heterocyclic group may be dissociated into a mesoion. Such heterocyclic group may be an imidazolium ring group, a pyrazolium ring group, a thiazolium ring group, a triazolium ring group, a tetrazolium ring group, a thiadiazolium ring group, a pyridinium ring group, a pyrimidinium ring group, a triazinium ring group, etc. Preferred among them is a triazolium ring group such as a 1,2,4-triazolium-3-thiolate ring group.

EXAMPLEs of the aryl group include a phenyl group and a naphthyl group.

EXAMPLEs of the alkyl group include straight, branched or cyclic alkyl groups having 1 to 30 carbon atom.

When the mercapto group forms a salt, a counter ion of the salt may be a cation of an alkaline metal, an alkaline earth metal, a heavy metal, etc. such as $Li^+$, $Na^+$, $K^+$, $Mg^{2+}$, $Ag^+$ and $Zn^{2+}$; an ammonium ion; a heterocyclic group containing a quaternary nitrogen atom; a phosphonium ion; etc.

Further, the mercapto group used as the adsorbable group may be tautomerized into a thione group. Specific examples of the thione group include a thioamide group (herein a —C(═S)—NH— group); and groups containing a structure of the thioamide group, such as linear or cyclic thioamide groups, a thiouredide group, a thiourethane group and a dithiocarbamic acid ester group.

EXAMPLEs of the cyclic thioamide group include a thiazolidine-2-thione group, an oxazolidine-2-thione group, a 2-thiohydantoin group, a rhodanine group, an isorhodanine group, a thiobarbituric acid group, a 2-thioxo-oxazolidine-4-one group, etc.

The thione group used as the adsorbent group, as well as the thione group derived from the mercapto group by tautomerization, may be a linear or cyclic, thioamide, thiouredide, thiourethane or dithiocarbamic acid ester group that cannot be tautomerized into the mercapto group or has no hydrogen atom at α-position of the thione group.

The heterocyclic group containing at least one atom selected from the group consisting of a nitrogen atom, a sulfur atom, a selenium atom and tellurium atom, which is used as the adsorbent group, is a nitrogen-containing heterocyclic group having a —NH— group that can form a silver imide (>NAg) as a moiety of the heterocycle; or a heterocyclic group having a —S— group, a —Se— group, a —Te— group or a ═N— group that can form a coordinate bond with a silver ion as a moiety of the heterocycle. EXAMPLEs of the former include a benzotriazole group, a triazole group, an indazole group, a pyrazole group, a tetrazole group, a benzimidazole group, an imidazole group, a purine group, etc. EXAMPLEs of the latter include a thiophene group, a thiazole group, an oxazole group, a benzothiazole group, a benzoxazole group, a thiadiazole group, an oxadiazole group, a triazine group, a selenazole group, a benzselenazole group, a tellurazole group, a benztellurazole group, etc. The former is preferable.

The sulfide group used as the adsorbable group may be any group with a —S— moiety, and preferably has a moiety of: alkyl or alkylene-S-alkyl or alkylene; aryl or arylene-S-alkyl or alkylene; or aryl or arylene-S-aryl or arylene.

The sulfide group may form a ring structure, and may be a —S—S— group.

Specific examples of the ring structure include groups with a thiolane ring, a 1,3-dithiolane ring, a 1,2-dithiolane ring, a thiane ring, a dithiane ring, a tetrahydro-1,4-thiazine ring (a thiomorpholine ring), etc.

Particularly preferred as the sulfide group are groups having a moiety of alkyl or alkylene-S-alkyl or alkylene.

The cationic group used as the adsorbable group is a quaternary nitrogen-containing group, specifically a group with an ammonio group or a quaternary nitrogen-containing heterocyclic group.

Incidentally, there is no case where the cationic group partly composes an atomic group forming a dye structure, such as a cyanine chromophoric group.

The ammonio group may be a trialkylammonio group, a dialkylarylammonio group, an alkyldiarylammonio group, etc., and examples thereof include a benzyldimethylammonio group, a trihexylammonio group, a phenyldiethylammonio group, etc.

EXAMPLEs of the quaternary nitrogen-containing heterocyclic group include a pyridinio group, a quinolinio group, an isoquinolinio group, an imidazolio group, etc. Preferred are a pyridinio group and an imidazolio group, and particularly preferred is a pyridinio group.

The quaternary nitrogen-containing heterocyclic group may have an optional substituent. Preferred as the substituent in the case of the pyridinio group and the imidazolio group are alkyl groups, aryl groups, acylamino groups, a chlorine atom, alkoxycarbonyl groups and carbamoyl groups. Particularly preferred as the substituent in the case of the pyridinio group is a phenyl group.

The ethynyl group used as the adsorbable group means a —C≡CH group, in which the hydrogen atom may be substituted.

The adsorbable group may have an optional substituent.

Specific examples of the adsorbable group further include groups described in pages 4 to 7 of a specification of JP-A No. 11-95355.

Preferred as the adsorbable group used in the invention are mercapto-substituted, nitrogen-containing, heterocyclic groups such as a 2-mercaptothiadiazole group, a 3-mercapto-1,2,4-triazole group, a 5-mercaptotetrazole group, a 2-mercapto-1,3,4-oxadiazole group, a 2-metrcaptobenzaxole group, a 2-mercaptobenzthiazole group and a 1,5-dimethyl-1,2,4-triazolium-3-thiolate group; and nitrogen-containing heterocyclic groups having a —NH— group that can form a silver imide (>NAg) as a moiety of the heterocycle, such as a benzotriazole group, a benzimidazole group and an indazole group.

Particularly preferred are a 5-mercaptotetrazole group, a 3-mercapto-1,2,4-triazole group and a benzotriazole group, and the most preferred are a 3-mercapto-1,2,4-triazole group and a 5-mercaptotetrazole group.

It is particularly preferred that the compound used in the invention has 2 or more mercapto group as a moiety.

The mercapto group (—SH) may be converted into a thione group in the case where it can be tautomerized.

The compound may have 2 or more adsorbent groups containing above-mentioned mercapto or thione group as a moiety, such as a cyclic thioamide group, an alkylmercapto group, an arylmercapto group and a heterocyclic mercapto group. Further, the compound may have 1 or more adsorbable group containing 2 or more mercapto or thione groups as a moiety, such as a dimercapto-substituted, nitrogen-containing, heterocyclic group.

EXAMPLEs of the adsorbable group containing 2 or more mercapto group, such as a dimercapto-substituted, nitrogen-containing, heterocyclic group, include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, a 2,7-dimercapto-5-methyl-s-triazolo(1,5-A)-pyrimidine group, a 2,6,8-trimercaptopurine group, a 6,8-dimercaptopurine group, a 3,5,7-trimercapto-s-triazolotriazine group, a 4,6-dimercaptopyrazolo pyrimidine group, a 2,5-dimercapto-imidazole group, etc. Particularly preferred are a 2,4-dimercaptopyrimidine group, a 2,4-dimercaptotriazine group, and a 3,5-dimercapto-1,2,4-triazole group.

The adsorbable group may be connected to any position of the compound represented by each of the general formulae (A) to (F) and (1) to (3). Preferred portions, which the adsorbable group bonds to, are $RED_{11}$, $RED_{12}$, $RED_2$ and $RED_3$ in the general formulae (A) to (D), $RED_{41}$, $R_{41}$, $RED_{42}$, and $R_{46}$ to $R_{48}$ in the general formulae (E) and (F), and optional portions other than $R_1$, $R_2$, $R_{11}$, $R_{12}$, $R_{31}$, $L_1$, $L_{21}$ and $L_{31}$ in the general formulae (1) to (3). Further, more preferred portions are $RED_{11}$ to $RED_{42}$ in the general formulae (A) to (F).

The spectral sensitizing dye moiety is a group containing a spectral sensitizing dye chromophore, a residual group provided by removing an optional hydrogen atom or substituent from a spectral sensitizing dye compound.

The spectral sensitizing dye moiety may be connected to any position of the compound represented by each of the general formulae (A) to (F) and (1) to (3). Preferred portion, which the spectral sensitizing dye moiety bonds to, are $RED_{11}$, $RED_{12}$, $RED_2$ and $RED_3$ in the general formulae (A) to (D), $RED_{41}$, $R_{41}$, $RED_{42}$, and $R_{46}$ to $R_{48}$ in the general formulae (E) and (F), and optional portions other than $R_1$, $R_2$, $R_{11}$, $R_{12}$, $R_{31}$, $L_1$, $L_{21}$ and $L_{31}$ in the general formulae (1) to (3). Further, more preferred portions are $RED_{11}$ to $RED_{42}$ in the general formulae (A) to (F).

The spectral sensitizing dye is preferably such that typically used in color sensitizing techniques. EXAMPLEs thereof include cyanine dyes, composite cyanine dyes, merocyanine dyes, composite merocyanine dyes, homopolar cyanine dyes, styryl dyes, and hemicyanine dyes.

Typical spectral sensitizing dyes are disclosed in Research Disclosure, Item 36544, September 1994.

The dyes can be synthesized by one skilled in the art according to procedures described in the above Research Disclosure and F. M. Hamer, *The Cyanine dyes and Related Compounds,* Interscience Publishers, New York, 1964.

Further, dyes described in pages 4 to 7 of a specification of JP-A No. 11-95355 (U.S. Pat. No. 6,054,260) may be used in the invention.

The total number of carbon atoms in the compounds of Types 1 to 4 used in the invention is preferably 10 to 60, more preferably 10 to 50, furthermore preferably 11 to 40, particularly preferably 12 to 30.

When a silver halide photosensitive material using the compounds of Types 1 to 4 is exposed, the compound is one-electron-oxidized. After the subsequent reaction, the compound is further oxidized while releasing 1 or more electron, or 2 or more electrons depending on Type. An oxidation potential in the first one-electron oxidation is preferably 1.4 V or less, more preferably 1.0 V or less.

This oxidation potential is preferably 0 V or more, more preferably 0.3 V or more. Thus, the oxidation potential is preferably approximately 0 to 1.4 V, more preferably approximately 0.3 to 1.0 V.

The oxidation potential may be measured by a cyclic voltammetry technique. Specifically, a sample is dissolved in a solution of acetonitrile/water containing 0.1 M lithium perchlorate=80/20 (volume %), nitrogen gas is passed through the resultant solution for 10 minutes, and then the oxidation potential is measured at 25° C. at a potential scanning rate of 0.1 V/second by using a glassy carbon disk as a working electrode, using a platinum wire as a counter electrode, and using a calomel electrode (SCE) as a reference electrode. The oxidation potential per SCE is obtained at peak potential of cyclic voltammetric curve.

In the case where the compound of Types 1 to 4 is one-electron-oxidized and release further 1 electron after the subsequent reaction, an oxidation potential in the subsequent oxidation is preferably −0.5 to −2 V, more preferably −0.7 to −2 V, furthermore preferably −0.9 to −1.6 V.

In the case where the compound of Types 1 to 4 is one-electron-oxidized and release further 2 or more electrons after the subsequent reaction, oxidation potentials in the subsequent oxidation are not particularly limited. The oxidation potentials in the subsequent oxidation often cannot be measured precisely, because an oxidation potential in releasing the second electron cannot be clearly differentiated from an oxidation potential in releasing the third electron.

Specific examples of the compounds of Types 1 to 4 used in the invention are illustrated below without intention of restricting the scope of the invention.

1

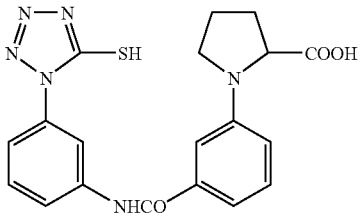

2

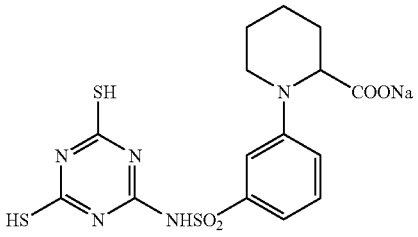

3

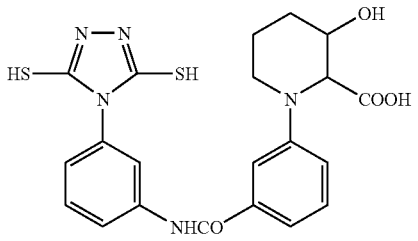

-continued

4

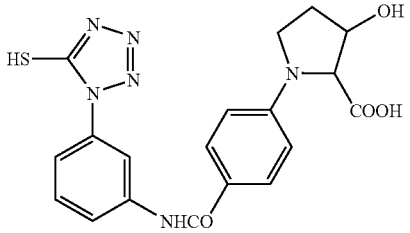

5

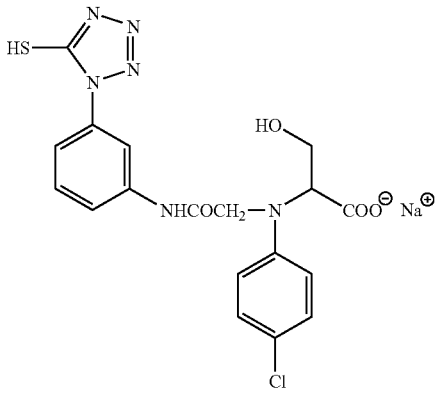

6

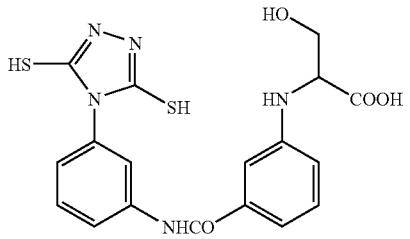

7

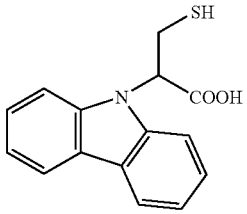

8

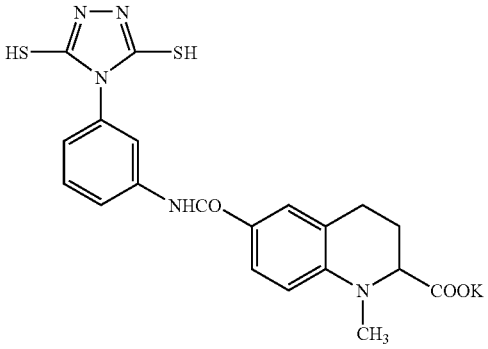

-continued
9
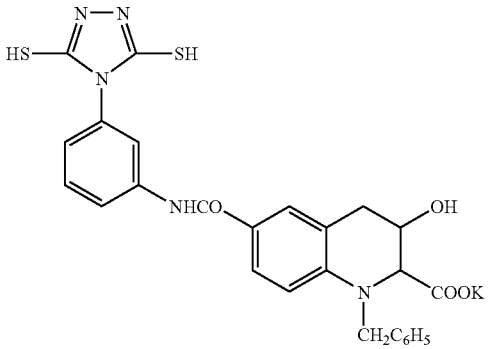
10
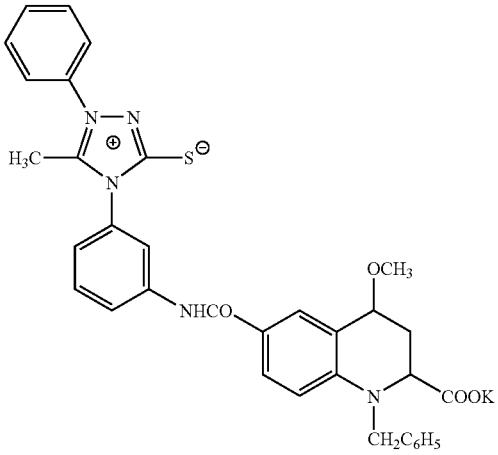
11
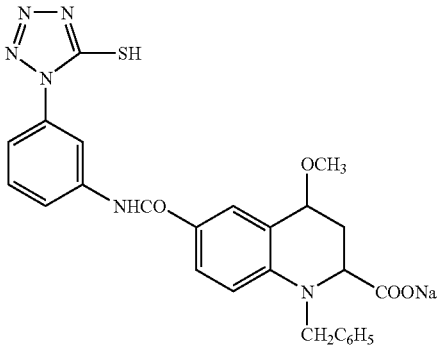
12
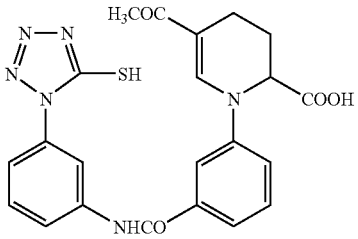
13
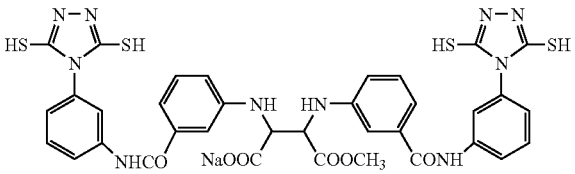
-continued
14
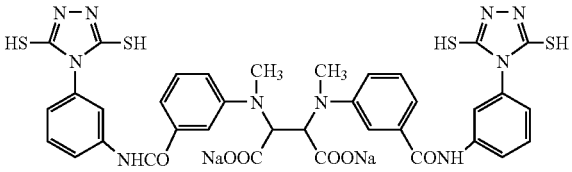
15
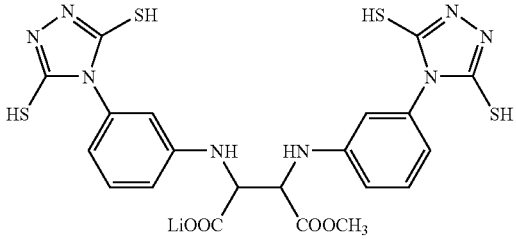
16
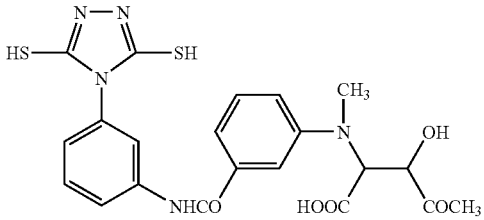
17
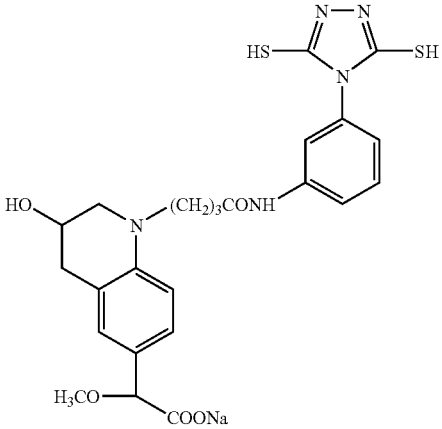
18
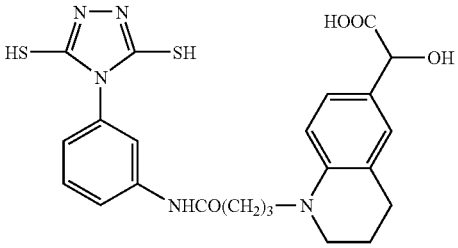
19
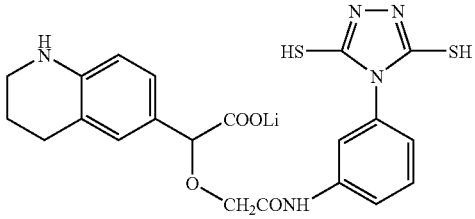

-continued
20
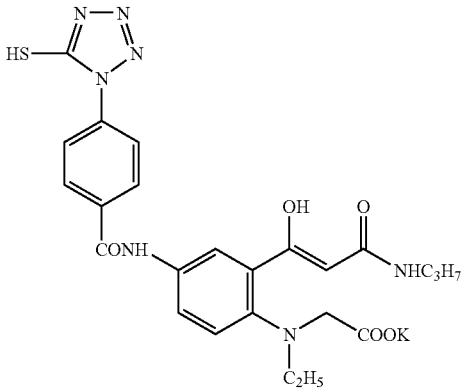
21
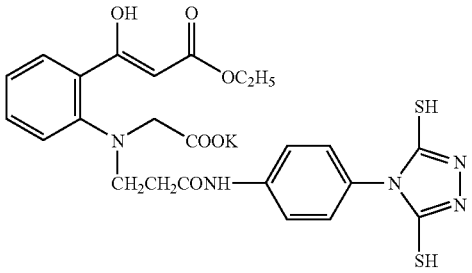
22
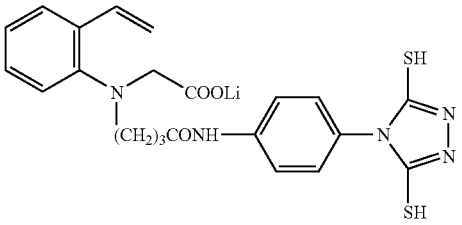
23
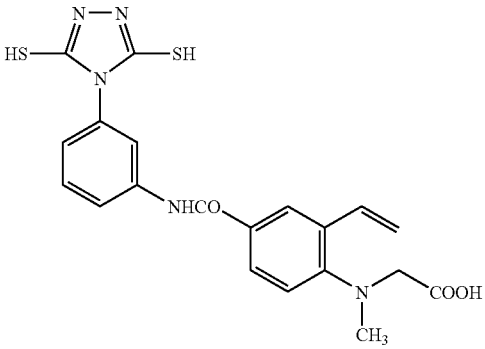
24
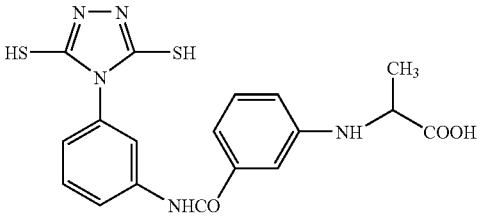
-continued
25
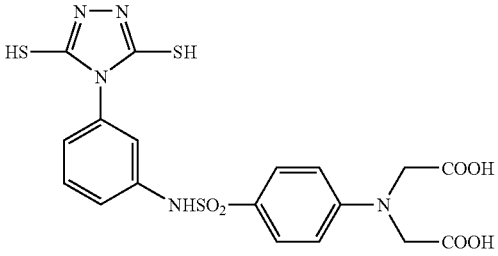
26
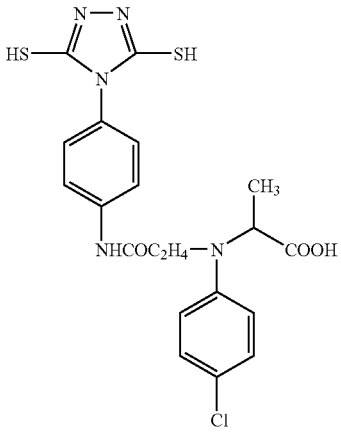
27
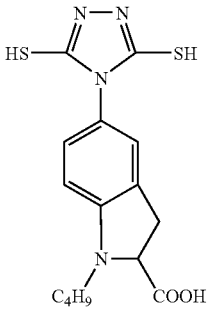
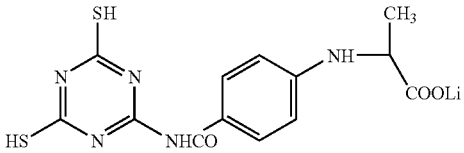
29
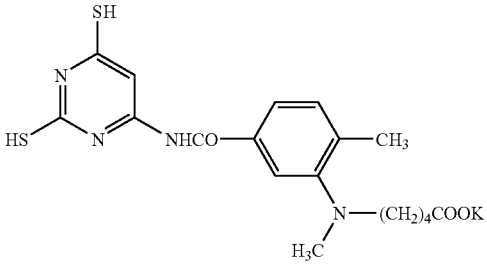

-continued
30
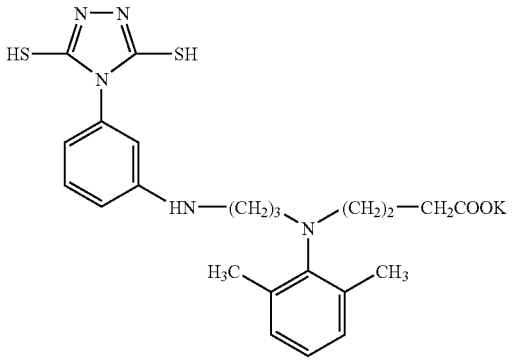
31
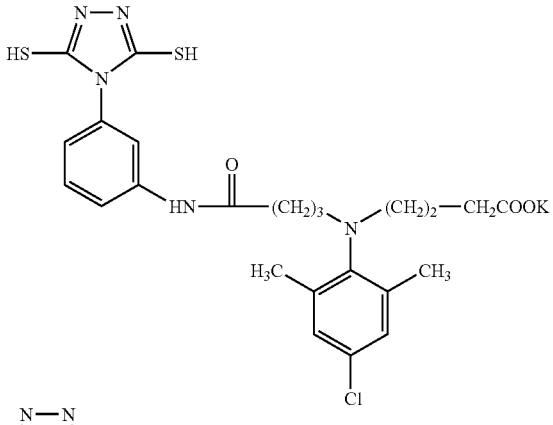
32
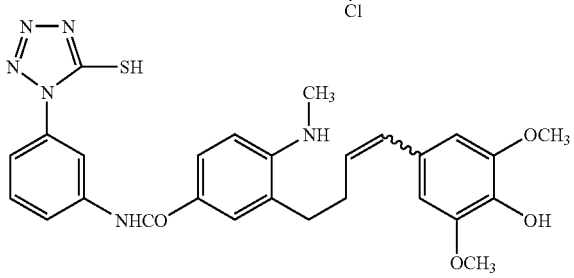
(cis or trans)
33
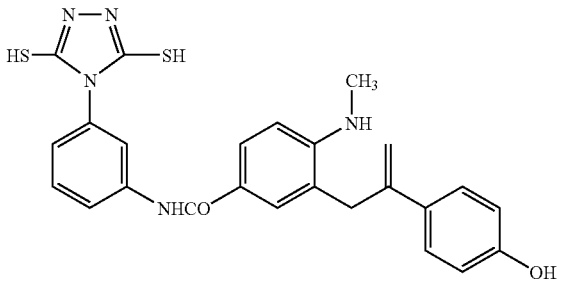
34
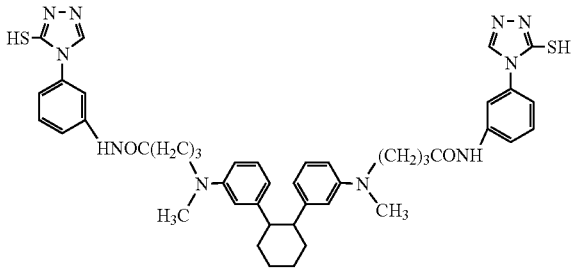
-continued
35
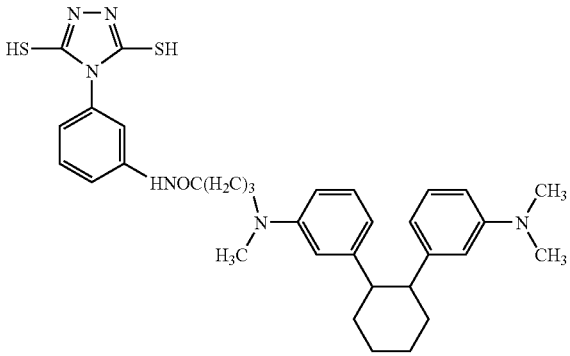
36
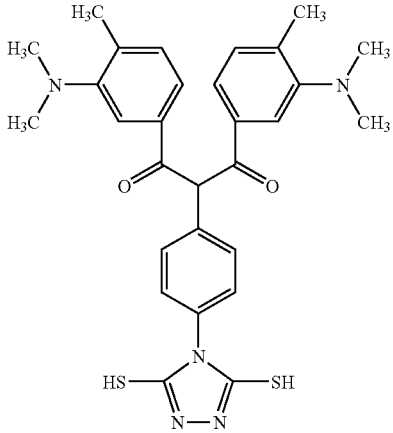
37
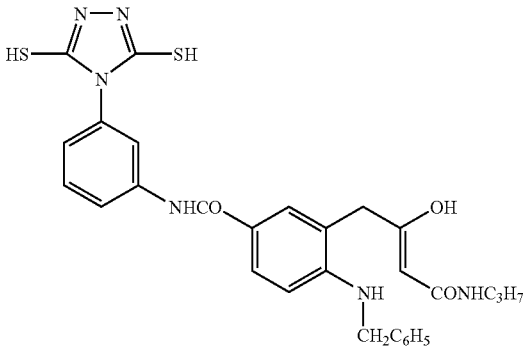
38
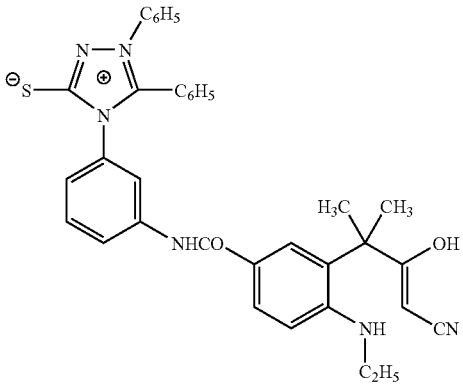

-continued
39
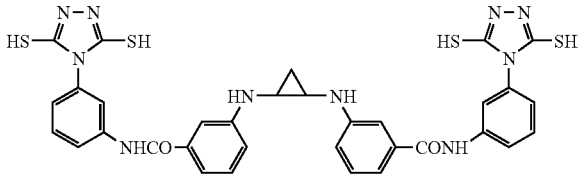
40
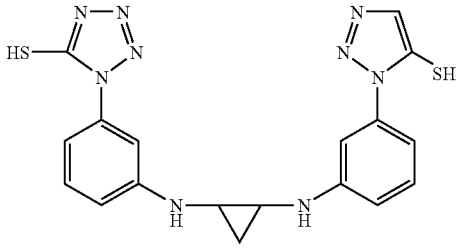
41
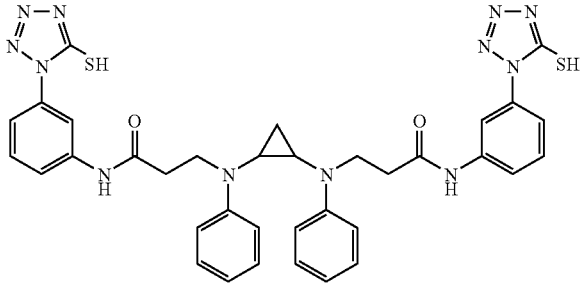
42
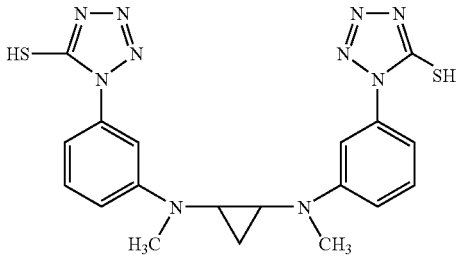
43
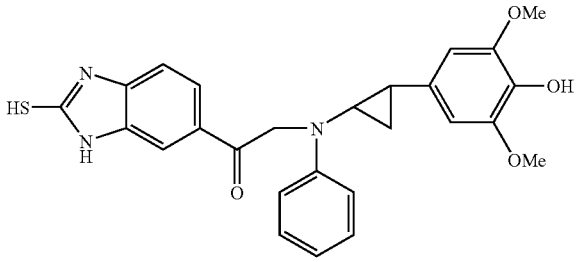
44
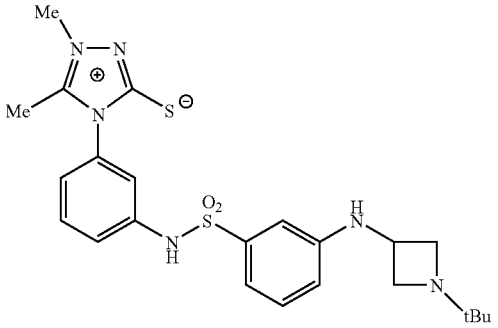
-continued
45
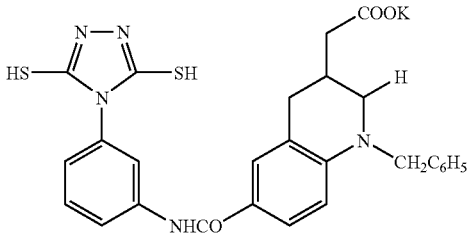
46
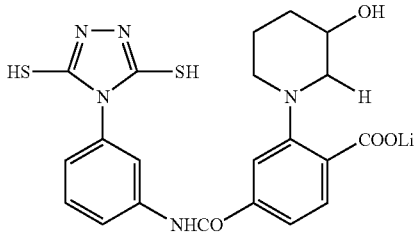
47
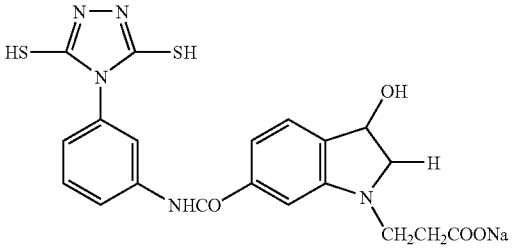
48
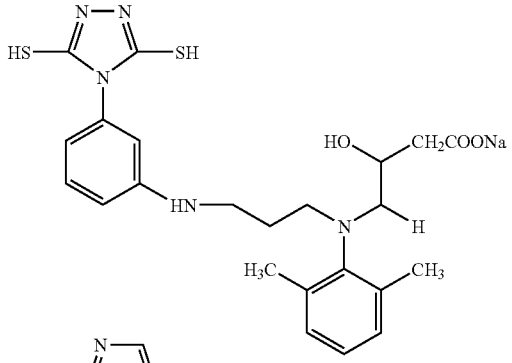
49
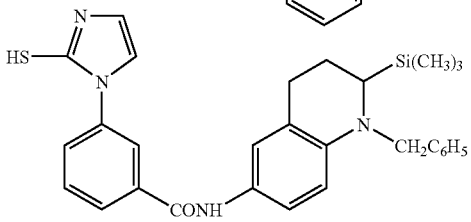
50
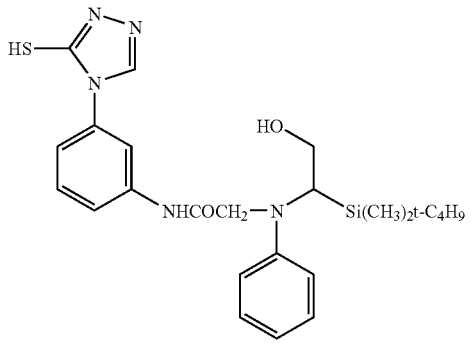

-continued

51

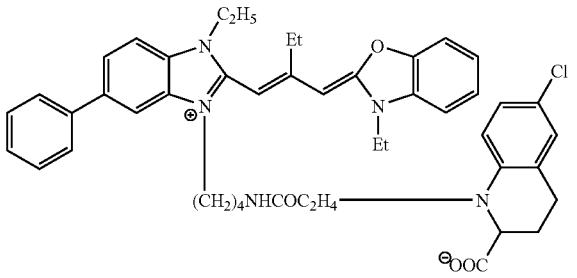

52

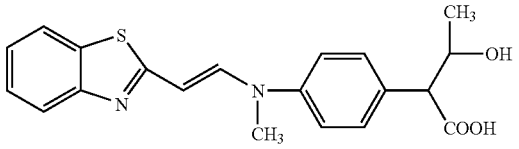

53

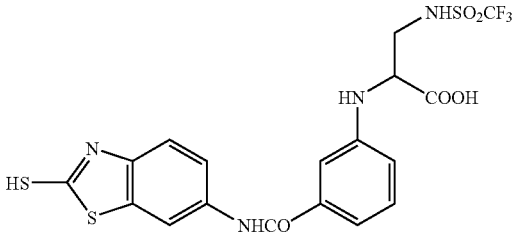

54

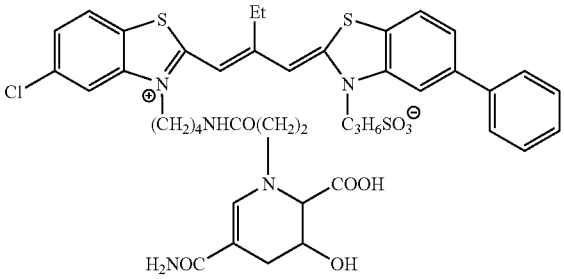

55

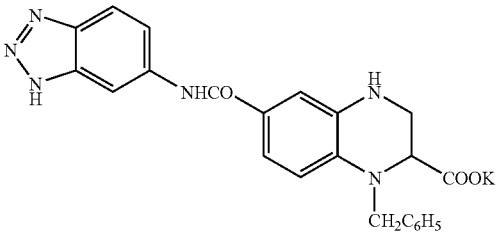

56

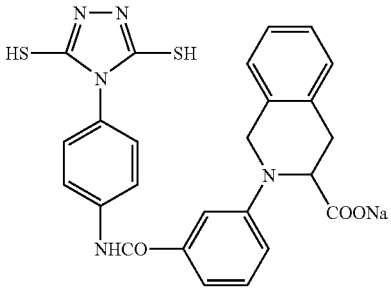

-continued

57

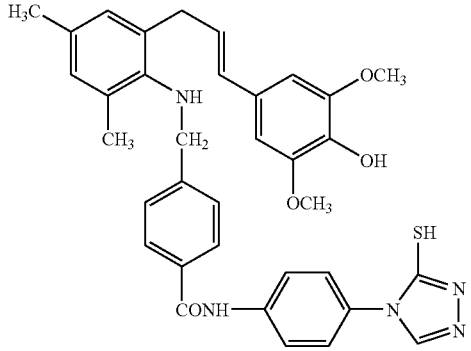

58

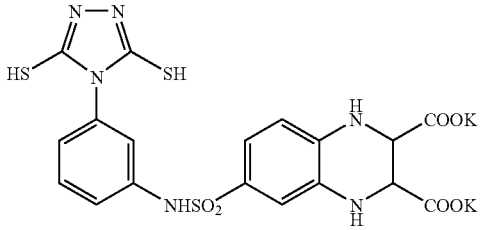

59

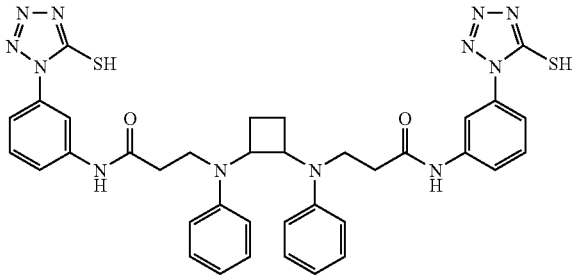

The compounds of Types 1 to 4 used in the invention are the same as compounds described in detail in Japanese Patent Application Nos. 2002-192373, 2002-188537, 2002-188536 and 2001-272137, respectively.

The specific examples of the compounds of Types 1 to 4 used in the invention further include compound examples disclosed in the specifications.

Synthesis examples of the compounds of Types 1 to 4 used in the invention may be the same as described in the specifications.

Next, the compound of Type 5 will be described.

The compound of Type 5 is represented by X—Y, in which X represents a reducing group and Y represents a leaving group. The reducing group represented by X can be one-electron-oxidized to provide a one-electron oxidation product, which can be converted into an X radical by eliminating the leaving group of Y with a subsequent X—Y bond cleavage reaction. The X radical can release further 1 electron.

The oxidation reaction of the compound of Type 5 may be represented by the following formula.

$$X-Y \xrightarrow[(-e^-)]{\text{oxidize}} (X-Y)^{+*} \xrightarrow{\text{split}} X^* + Y^+ \xrightarrow[\text{release}(-e)]{\text{1 electron}} X^+$$

The compound of Type 5 exhibits an oxidation potential of preferably 0 to 1.4 V, more preferably 0.3 to 1.0 V.

The radical X generated in the formula exhibits an oxidation potential of preferably −0.7 to −2.0 V, more preferably −0.9 to −1.6 V.

The compound of Type 5 is preferably represented by the following general formula (G).

Froumula (G)

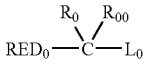

In the general formula (G), $RED_0$ represents a reducing group, $L_0$ represents a leaving group, and $R_0$ and $R_{00}$ each represent a hydrogen atom or a substituent.

$RED_0$ and $R_0$, and $R_0$ and $R_{00}$ may be bond together to form a ring structure, respectively.

$RED_0$ is the same as $RED_2$ in the general formula (C) with respect to the meanings and preferred embodiments.

$R_0$ and $R_{00}$ are the same as $R_{21}$ and $R_{22}$ in the general formula (C) with respect to the meanings and preferred embodiments, respectively. Incidentally, $R_0$ and $R_{00}$ are not the same as the leaving group of $L_0$ respectively, except for a hydrogen atom.

$RED_0$ and $R_0$ may bond together to form a ring structure with examples and preferred embodiments the same as those of the ring structure formed by bonding $RED_2$ and $R_{21}$ in the general formula (C).

EXAMPLEs of the ring structure formed by bonding $R_0$ and $R_{00}$ each other include a cyclopentane ring, a tetrahydrofuran ring, etc.

In the general formula (G), $L_0$ is the same as $L_2$ in the general formula (C) with respect to the meanings and preferred embodiments.

The compound represented by the general formula (G) preferably has an adsorbable group to the silver halide or a spectrally sensitizing dye moiety. However, the compound does not have 2 or more adsorbable group when $L_0$ is a group other than a silyl group.

Incidentally, the compound may have 2 or more sulfide group as the adsorbent group, not depending on $L_0$.

The adsorbable group to the silver halide in the compound represented by the general formula (G) may be the same as those in the compounds of Types 1 to 4, and further may be a selenoxo group (—C═Se—), a telluroxo group (—C═Te—), a seleno group (—Se—), a telluro group (—Te—), or an active methine group.

The selenoxo group (—C═Se—) and the telluroxo group (—C═Te—) are an Se or Te derivative of a group containing a thione group (—C═S—), respectively. The selenoxo group and the telluroxo group may contain a selenoamide group (—C═Se—NH—) or a telluramide group (—C═Te—NH—), as well as the above-described thione group.

The seleno group (—Se—) and the telluro group (—Te—) are an Se or Te derivative of a group containing a sulfide group (—S—), respectively. EXAMPLEs thereof include Se or Te-substituted derivatives of groups containing a sulfide group.

The active methine group is a methine group having 2 electron-withdrawing groups as a substituent, and the electron-withdrawing group is an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The 2 electron-withdrawing groups may bond together to form a ring structure.

The adsorbable group in the compound represented by the general formula (G) is preferably a mercapto group or a salt thereof; a thione group (—C═S—); a heterocyclic group containing at least one atom selected from the group consisting of a nitrogen atom, a sulfur atom, a selenium atom and a tellurium atom; or a sulfide group. Further preferred are a mercapto-substituted, nitrogen-containing, heterocyclic group; and a nitrogen-containing heterocyclic group having a —NH— group that can form a silver imide (>NAg) as a moiety of the heterocycle. These groups are the same as those described with respect to the compounds of Types 1 to 4.

The adsorbable group may connect to any position in the compound represented by the general formula (G), and connects preferably to $RED_0$ or $R_0$, more preferably to $RED_0$.

The spectral sensitizing dye moiety in the compound represented by the general formula (G) is the same as in the compounds of Types 1 to 4.

Specific examples of the compound represented by the general formula (G) are illustrated below without intention of restricting the scope of the invention.

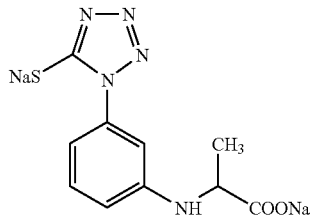

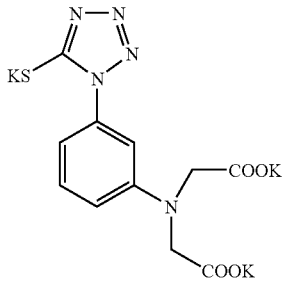

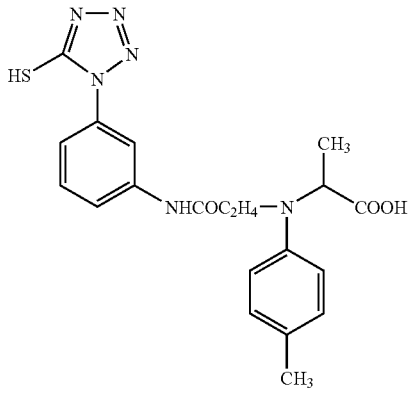

G-3

-continued
G-4
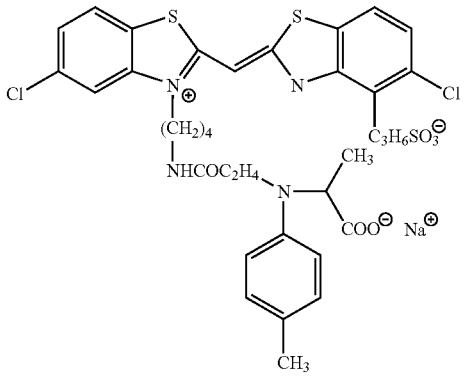
G-5
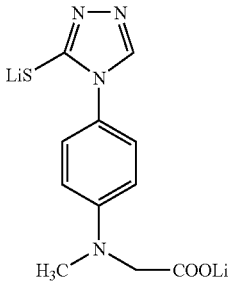
G-6
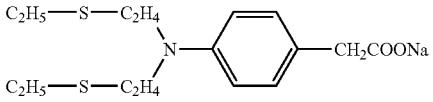
G-7
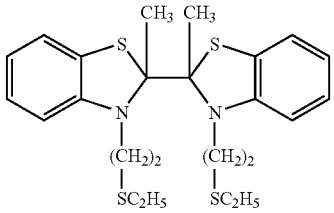
G-8
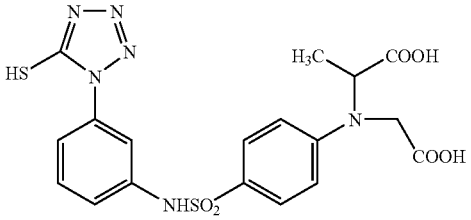
G-9
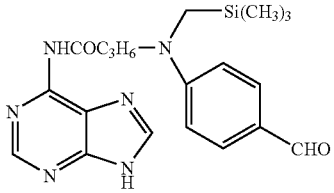
G-10
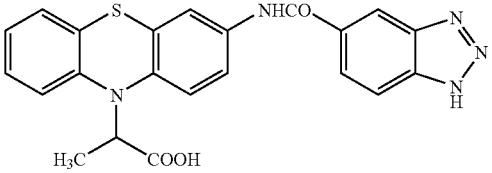
-continued
G-11
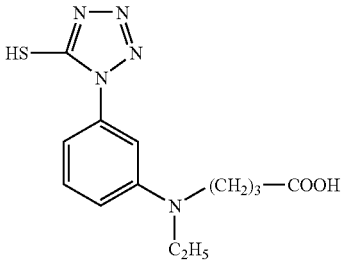
G-12
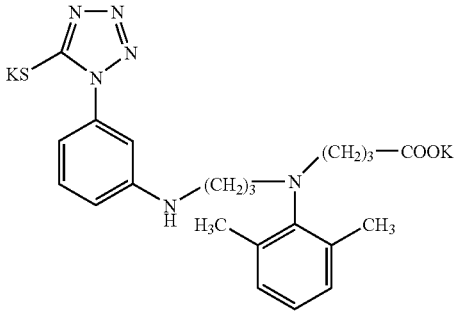
G-13
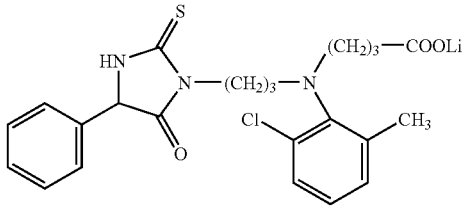
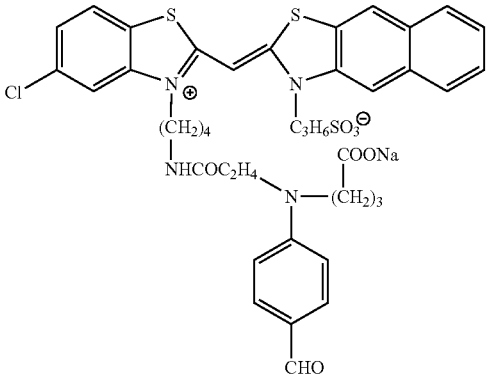
G-15
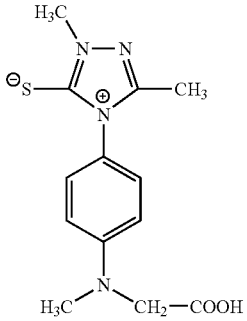

-continued

G-16

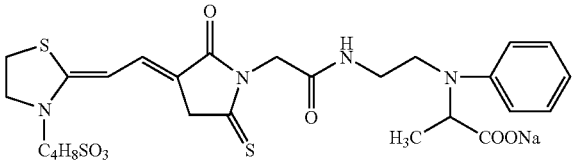

G-17

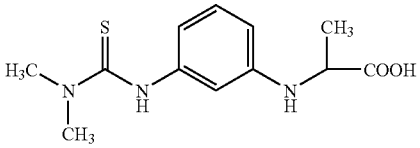

G-18

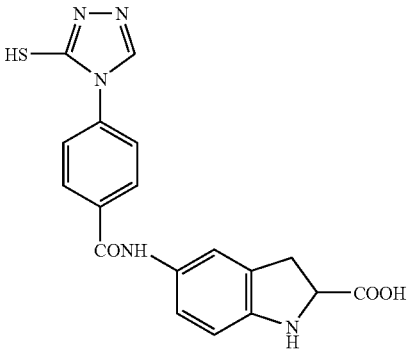

G-19

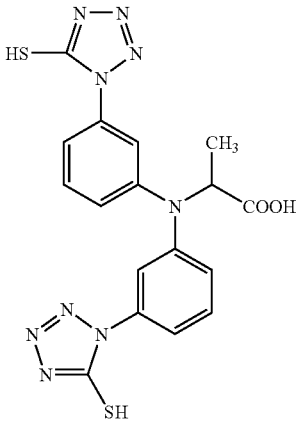

G-20

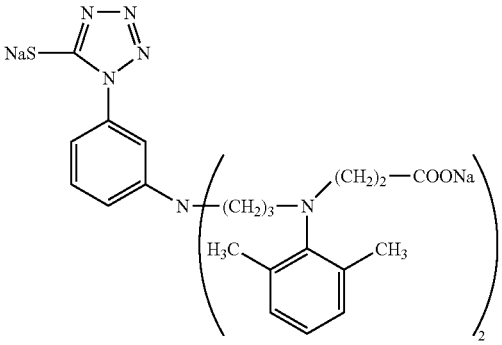

-continued

G-21

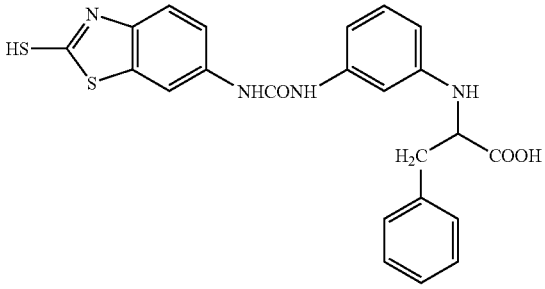

G-22

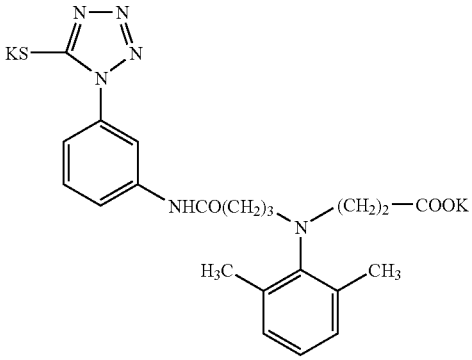

G-23

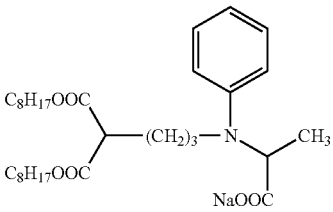

G-24

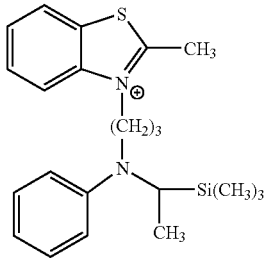

Specific examples of the compound represented by the general formula (G) further include examples of compound referred to as "1 photon 2 electron sensitizer" or "deprotonating electron-donating sensitizer" described in JP-A No. 9-211769 (Compound PMT-1 to S-37 in Tables E and F, pages 28 to 32); JP-A No. 9-211774; JP-A No. 11-95355 (Compound INV 1 to 36); JP-W No. 2001-500996 (Compound 1 to 74, 80 to 87, and 92 to 122); U.S. Pat. Nos. 5,747,235 and 5,747,236; EP No. 786692 A1 (Compound INV 1 to 35); EP No. 893732 A1; U.S. Pat. Nos. 6,054,260 and 5,994,051; etc.

The compounds of Types 1 to 5 may be used at any time during preparation of the photosensitive silver halide emulsion and production of the photothermographic material. For example, the compound may be used, in a photosensitive silver halide grains-forming step, in a desalination step, in a chemical sensitization step, before application, etc. The compound may be added in numbers, in these steps. The compound is preferably added, after the photosensitive silver halide grains-forming step and before the desalination step; in the chemical sensitization step (just before the chemical sensitization to immediately after the chemical sensitization); or before the application. The compound is more preferably added, just before the chemical sensitization step to before mixing with the non-photosensitive organic silver salt.

It is preferred that the compound of Types 1 to 5 used in the invention is dissolved in water, a water-soluble solvent such as methanol and ethanol, or a mixed solvent thereof, to be added.

In the case where the compound is dissolved in water and solubility of the compound is increased by increasing or decreasing a pH value of the solvent, the pH value may be increased or decreased to dissolve and add the compound.

The compound of Types 1 to 5 used in the invention is preferably added to the image-forming layer comprising the photosensitive silver halide and the non-photosensitive organic silver salt. The compound may be added to a surface protective layer, an intermediate layer, etc. as well as the image-forming layer, to be diffused to the image-forming layer in the application step.

The compound may be added before or after addition of a sensitizing dye. A mol value of the compound per 1 mol of the silver halide is preferably $1\times10^{-9}$ to $5\times10^{-1}$ mol, more preferably $1\times10^{-8}$ to $5\times10^{-2}$ mol, in a layer comprising the photosensitive silver halide emulsion.

1-1-2. Spectral Sensitizing Dyes Represented by General Formulae (3a) to (3d)

The photosensitive silver halide used in the invention may be spectral sensitized by a spectral sensitizing dye represented by any one of the following general formulae (3a) to (3d). The spectral sensitizing dyes represented by the general formula (3a) to (3d) will be described in detail below.

Formula (3a)

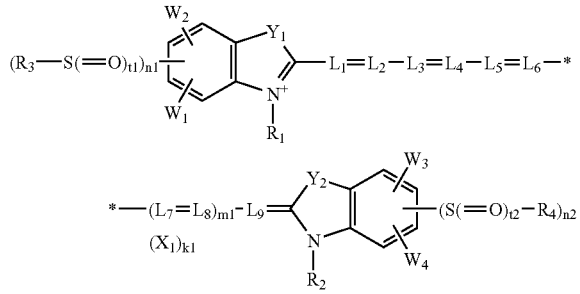

Formula (3b)

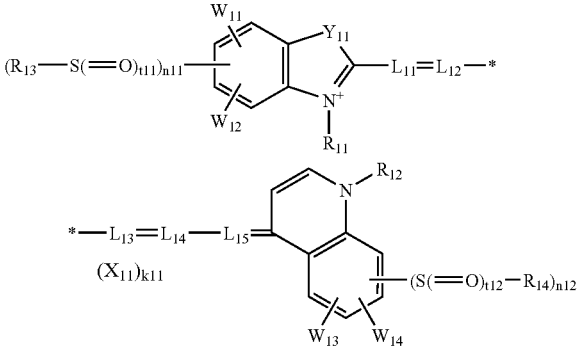

-continued

Formula (3c)

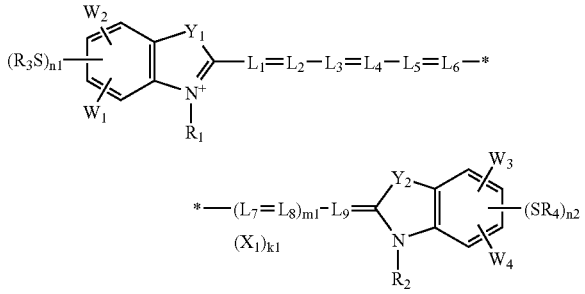

Formula (3d)

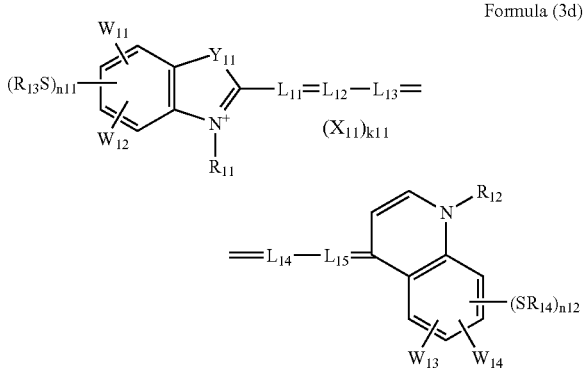

In the general formulae (3a) to (3d) $Y_1$, $Y_2$ and $Y_{11}$ each represent an oxygen atom, a sulfur atom, a selenium atom or a —CH═CH— group, and $L_1$ to $L_9$ and $L_{11}$ to $L_{15}$ each represent a methine group. $R_1$, $R_2$, $R_{11}$ and $R_{12}$ each represent an aliphatic group. $R_3$, $R_4$, $R_{13}$ and $R_{14}$ each represent a lower alkyl group, a cycloalkyl group, an alkenyl group, an aralkyl group, an aryl group or a heterocyclic group. $W_1$, $W_2$, $W_3$, $W_4$, $W_{11}$, $W_{12}$, $W_{13}$ and $W_{14}$ each represent a hydrogen atom or a substituent. Alternatively, $W_1$ and $W_2$, $W_3$ and $W_4$, $W_{11}$ and $W_{12}$, and $W_{13}$ and $W_{14}$ may bond together to be a nonmetallic atomic group forming a condensed ring, respectively. Alternatively, $R_3$ and $W_1$, $R_3$ and $W_2$, $R_{13}$ and $W_{11}$, $R_{13}$ and $W_{12}$, $R_4$ and $W_3$, $R_4$ and $W_4$, $R_{14}$ and $W_{13}$, and $R_{14}$ and $W_{14}$ may bond together to be a nonmetallic atomic group forming a 5- or 6-membered condensed ring, respectively. $X_1$ and $X_{11}$ each represent an ion necessary for neutralizing a charge of the spectral sensitizing dye. k1 and k11 each represent a number of the ion necessary for neutralizing a charge of the spectral sensitizing dye. m1 represents 0 or 1. n1, n2, n11 and n12 each represent 0, 1 or 2. Incidentally, at least one of n1 and n2, and at least one of n11 and n12 are 1 or 2, respectively. t1, t2, t11 and t12 each represent an integer of 1 or 2.

In the general formulae (3a) to (3d), examples of the aliphatic group represented by $R_1$, $R_2$, $R_{11}$ and $R_{12}$ include branched or straight alkyl groups with 1 to 10 carbon atom, such as a methyl group, an ethyl group, a propyl group, a butyl group, a pentyl group, an iso-pentyl group, a 2-ethylhexyl group, an octyl group and a decyl group; alkenyl groups with 3 to 10 carbon atoms, such as a 2-propenyl group, a 3-butenyl group, a 1-methyl-3-propenyl group, a 3-pentenyl group, a 1-methyl-3-butenyl group and a 4-hexenyl group; and aralkyl groups with 7 to 10 carbon atoms, such as a benzyl group and a phenethyl group.

The aliphatic groups exemplified above may have a substituent with examples including lower alkyl groups such as a methyl group, an ethyl group and a propyl group;

halogen atoms such as a fluorine atom, a chlorine atom and a bromine atom; a vinyl group; aryl groups such as a phenyl group, a p-tolyl group and a p-bromophenyl group; a trifluoromethyl group; alkoxy groups such as a methoxy group, an ethoxy group and a methoxyethoxy group; aryloxy groups such as a phenoxy group and a p-tolyloxy group; a cyano group; sulfonyl groups such as a methanesulfonyl group, a trifluoromethanesulfonyl group and a p-toluenesulfonyl group; alkoxycarbonyl groups such as an ethoxycarbonyl group and a butoxycarbonyl group; amino groups such as an amino group and a biscarboxymethylamino group; aryl groups such as a phenyl group and a carboxyphenyl group; heterocyclic groups such as a tetrahydrofurfuryl group and a 2-pyrrolidinone-1-yl group; acyl groups such as an acetyl group and a benzoyl group; ureide groups such as an ureide group, a 3-methylureide group and a 3-phenylureide group; thiouredide groups such as a thiouredide group and a 3-methylthiouredide group; alkylthio groups such as a methylthio group and an ethylthio group; arylthio groups such as a phenylthio group; heterocyclic thio groups such as a 2-thienylthio group, a 3-thienylthio group and a 2-imidazolylthio group; carbonyloxy groups such as an acetyloxy group, a propanoyloxy group and a benzoyloxy group; acylamino groups such as an acetylamino group and a benzoylamino group; thioamide groups such as a thioacetoamide group and a thiobenzoylamino group; and hydrophilic groups.

EXAMPLEs of the hydrophilic group include a sulfo group; a carboxy group; a phosphono group; a sulfate group; a hydroxy group; a mercapto group; a sulfino group; carbamoyl groups such as a carbamoyl group, an N-methylcarbamoyl group and an N,N-tetramethylenecarbamoyl group; sulfamoyl groups such as a sulfamoyl group and an N,N-3-oxapentamethyleneaminosulfonyl group; sulfoneamide groups such as a methanesulfoneamide group and a butanesulfoneamide group; sulfonylaminocarbonyl groups such as a methanesulfonylaminocarbonyl group and an ethanesulfonylaminocarbonyl group; acylaminosulfonyl groups such as an acetoamidosulfonyl group and a methoxyacetoamidosulfonyl group; acylaminocarbonyl groups such as an acetoamidocarbonyl group and a methoxyacetoamidocarbonyl group; sulfinylaminocarbonyl groups such as a methanesulfonylaminocarbonyl group and an ethanesulfinylaminocarbonyl group; etc.

Specific examples of the aliphatic group having the hydrophilic group as a substituent include a carboxymethyl group, a carboxyethyl group, a carboxybutyl group, a carboxypentyl group, a 3-sulfatebutyl group, a 3-sulfopropyl group, a 2-hydroxy-3-sulfopropyl group, a 4-sulfobutyl group, a 5-sulfopentyl group, a 3-sulfopentyl group, a 3-sulfinobutyl group, a 3-phosphonopropyl group, a hydroxyethyl group, an N-methanesulfonylcarbamoylmethyl group, a 2-carboxy-2-propenyl group, an o-sulfobenzyl group, a p-sulfophenethyl group, a p-carboxybenzyl group, etc.

The lower alkyl group represented by $R_3$, $R_4$, $R_{13}$ and $R_{14}$ is a straight or branched alkyl group with 5 or less carbon atoms, and specific examples thereof include a methyl group, an ethyl group, a propyl group, a butyl group, a pentyl group, an isopropyl group, etc. EXAMPLEs of the cycloalkyl group include a cyclopropyl group, a cyclobutyl group, a cyclopentyl group, etc. EXAMPLEs of the alkenyl group include a 2-propenyl group, a 3-butenyl group, a 1-methyl-3-propenyl group, a 3-pentenyl group, a 1-methyl-3-butenyl group, a 4-hexenyl group, etc. EXAMPLEs of the aralkyl group include a benzyl group, a phenethyl group, a p-methoxyphenylmethyl group, an o-acetylaminophenylethyl group, etc. The aryl group may be substituted or unsubstituted, and examples thereof include a phenyl group, a 2-naphthyl group, a 1-naphthyl group, an o-tolyl group, an o-methoxyphenyl group, a m-chlorophenyl group, a m-bromophenyl group, a p-tolyl group, a p-ethoxyphenyl group, etc. The heterocyclic group may be substituted or unsubstituted, and examples thereof include a 2-furyl group, a 5-methyl-2-furyl group, a 2-thienyl group, a 3-thienyl group, a 2-imidazolyl group, a 2-methyl-1-imidazolyl group, a 4-phenyl-2-thiazolyl group, a 5-hydroxy-2-benzothiazolyl group, a 2-pyridyl group, a 1-pyrrolyl group, etc.

Each of these groups may have a substituent with examples including lower alkyl groups such as a methyl group and an ethyl group; lower alkoxy groups such as a methoxy group and an ethoxy group; a hydroxy group; halogen atoms such as a fluorine atom, a chlorine atom, a bromine atom and an iodine atom; aryl groups such as a phenyl group, a tolyl group and a chlorophenyl group; a mercapto group; lower alkylthio groups such as a methylthio group and an ethylthio group; etc.

Specific examples of the substituent represented by each of $W_1$ to $W_4$ and $W_{11}$ to $W_{14}$ include alkyl groups such as a methyl group, an ethyl group, a butyl group and an isobutyl group; aryl groups, which may be monocyclic or polycyclic, such as a phenyl group and a naphthyl group; heterocyclic groups such as a thienyl group, a furyl group, a pyridyl group, a carbazolyl group, a pyrrolyl group and an indolyl group; halogen atoms such as a fluorine atom, a chlorine atom and a bromine atom; a vinyl group; an aryl group such as a phenyl group, a p-tolyl group and a p-bromophenyl group; a trifluoromethyl group; alkoxy groups such as a methoxy group, an ethoxy group and a methoxyethoxy group; aryloxy groups such as a phenoxy group and a p-tolyloxy group; sulfonyl groups such as a methanesulfonyl group and a p-toluenesulfonyl group; alkoxycarbonyl groups such as an ethoxycarbonyl group and a butoxycarbonyl group; amino groups such as an amino group and a biscarboxymethylamino group; aryl groups such as a phenyl group and a carboxyphenyl group; heterocyclic groups such as a tetrahydrofurfuryl group and a 2-pyrrolidinone-1-yl group; acyl groups such as an acetyl group and a benzoyl group; ureide groups such as an ureide group, a 3-methylureide group and a 3-phenylureide group; thiouredide groups such as a thiouredide group and a 3-methylthiouredide group; alkylthio groups such as a methylthio group and an ethylthio group; arylthio groups such as a phenylthio group; a hydroxy group; a styryl group; etc.

These groups may have a substituent with examples the same as those of the substituent on the aliphatic group represented by $R_1$, etc. Specific examples of the substituted alkyl group include a 2-methoxyethyl group, a 2-hydroxyethyl group, a 3-ethoxycarbonylpropyl group, a 2-carbamoylethyl group, a 2-methanesulfonylethyl group, a 3-methanesulfonylaminopropyl group, a benzyl group, a phenethyl group, a carboxymethyl group, a carboxyethyl group, aryl groups, a 2-furylethyl group, etc. Specific examples of the substituted aryl group include a p-carboxyphenyl group, a p-N,N-dimethylaminophenyl group, a p-morpholinophenyl group, a p-methoxyphenyl group, a 3,4-dimethoxyphenyl group, a 3,4-methylenedioxyphenyl group, a 3-chlorophenyl group, a p-nitrophenyl group, etc. Specific examples of the substituted heterocyclic group include a 5-chloro-2-pyridyl group, a 5-ethoxycarbonyl-2-pyridyl group, a 5-carbamoyl-2-pyridyl group, etc.

The condensed ring formed by $W_1$ and $W_2$, $W_3$ and $W_4$, $W_{11}$ and $W_{12}$, $W_{13}$ and $W_{14}$, $R_3$ and $W_1$, $R_3$ and $W_2$, $R_{13}$ and $W_{11}$, $R_{13}$ and $W_{12}$, $R_4$ and $W_3$, $R_4$ and $W_4$, $R_{14}$ and $W_{13}$, and $R_{14}$ and $W_{14}$, respectively may be, for example, a 5- or 6-membered, saturated or unsaturated, condensed, carbocyclic ring. The condensed ring may have a substituent at an optional position, examples of the substituent being the same as those of above-mentioned substituent on the aliphatic group.

In the general formulae (3a) to (3d), the methine groups represented by $L_1$ to $L_9$ and $L_{11}$ to $L_{15}$ are independently a substituted or unsubstituted methine group. Specific examples of a substituent on the methine group include substituted or unsubstituted, lower alkyl groups such as a methyl group, an ethyl group, an iso-propyl group and a benzyl group; alkoxy groups such as a methoxy group and an ethoxy group; aryloxy groups such as a phenoxy group and a naphthoxy group; aryl groups such as a phenyl group, a naphthyl group, a p-tolyl group and a o-carboxyphenyl group; —N($V_1$, $V_2$); —SR; and heterocyclic groups such as a 2-thienyl group, a 2-furyl group and an N,N'-bis (methoxyethyl)barbituric acid group. R represents a lower alkyl group, an aryl group or a heterocyclic group as above. $V_1$ and $V_2$ each represent a substituted or unsubstituted, lower alkyl group or aryl group. $V_1$ and $V_2$ may bond together to form a 5- or 6-membered, nitrogen-containing heterocycle. Further, the methine group may bond to the other methine group, adjacent thereto or connecting thereto with 1 methine group between, to form a 5- or 6-membered ring.

When the compounds represented by the general formulae (3a) to (3d) have a group with a cation or anion charge, the compounds may comprise an equivalent counter ion of an anion or a cation to counterbalance the charge. In the case where the ion necessary for neutralizing the charge, represented by each of $X_1$ and $X_{11}$, is a cation, specific examples of the cation include proton; organic ammonium ions such as a triethylammonium ion and a triethanol ammonium ion; and inorganic cations such as a lithium cation, a sodium cation and a potassium cation. Specific examples of an acid anion represented by each of $X_1$ and $X_{11}$ include halogen ions such as a chlorine ion, a bromine ion and an iodine ion; a p-toluenesulfonate ion; a perchlorate ion; a boron tetrafluoride ion; a sulfate ion; a methylsulfate ion; an ethylsulfate ion; a methanesulfonate ion; and a trifluoromethanesulfonate ion.

Specific examples of the sensitizing dyes represented by the general formulae (3a) to (3d) are illustrated below without intention of restricting the scope of the invention.

No. 1

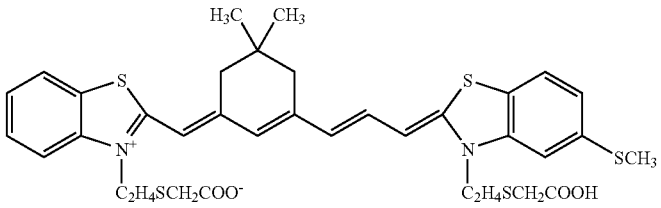

No. 2

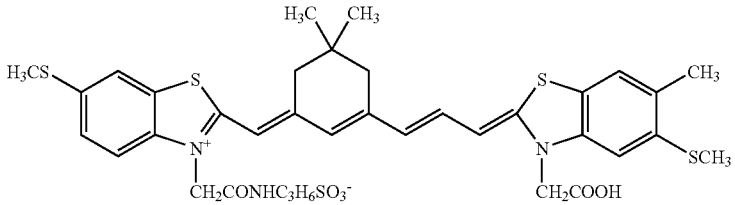

No. 3

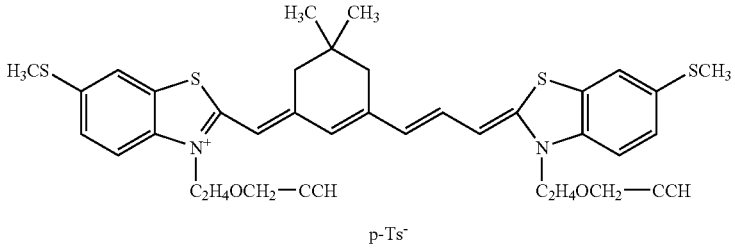

No. 4

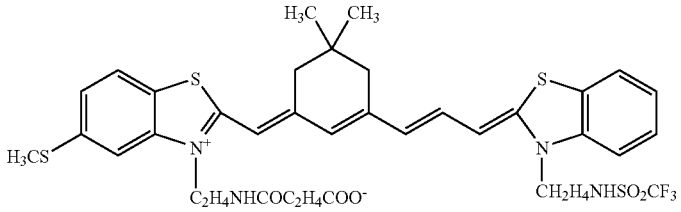

-continued
No. 5
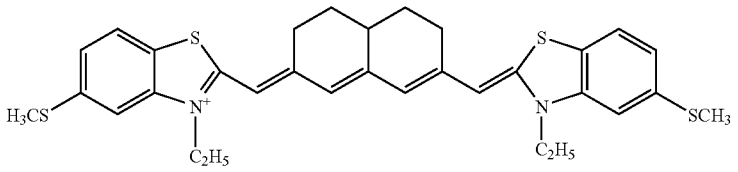
p-Ts⁻
No. 6
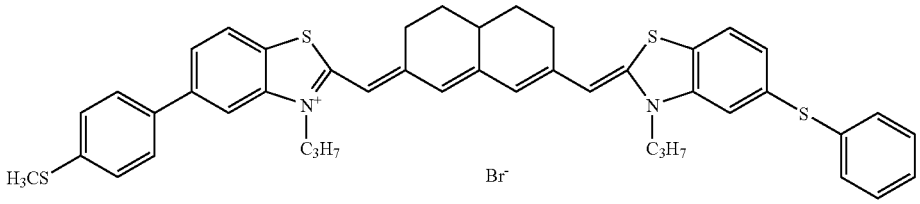
Br⁻
No. 7
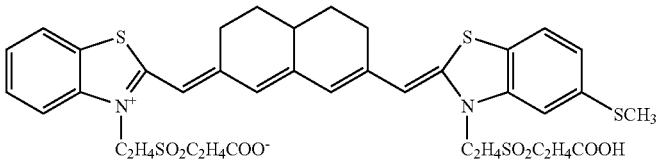
No. 8
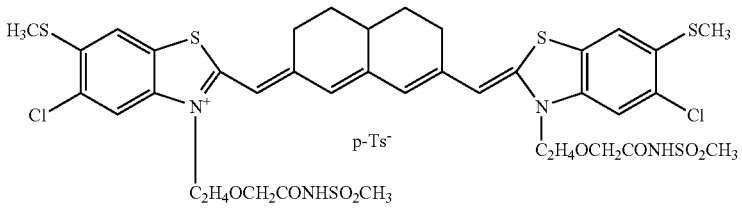
p-Ts⁻
No. 9
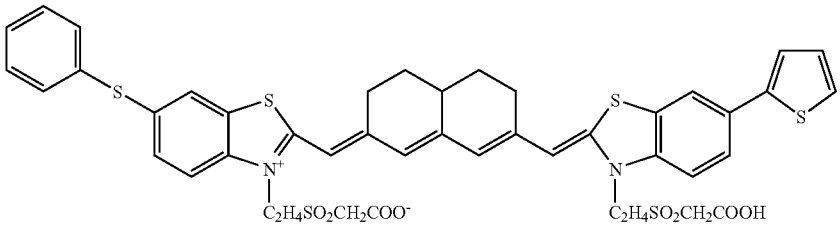
No. 10
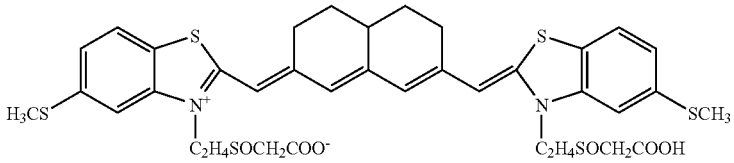
No. 11
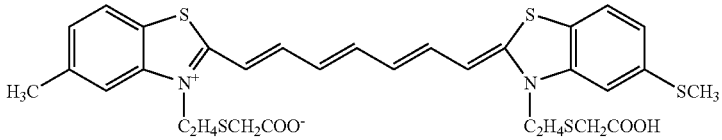
No. 12
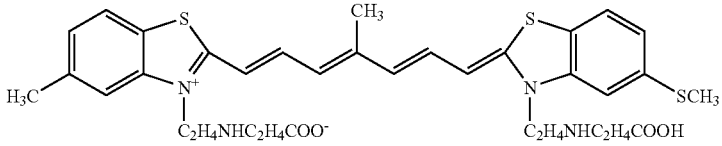

-continued
No. 13
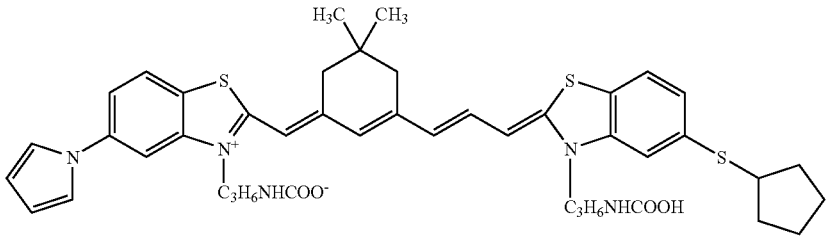
No. 14
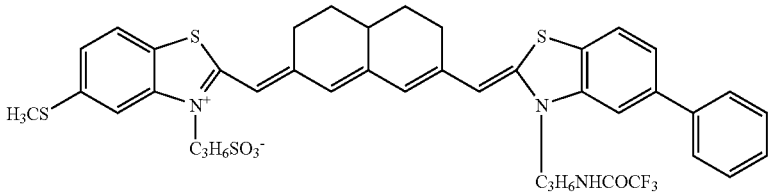
No. 15
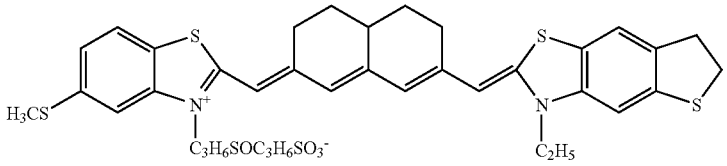
No. 16
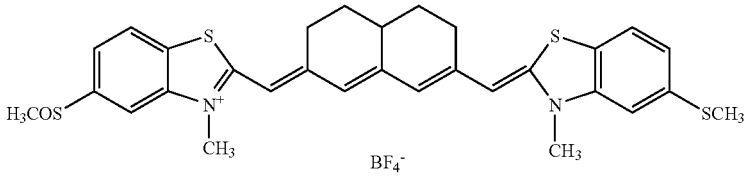
No. 17
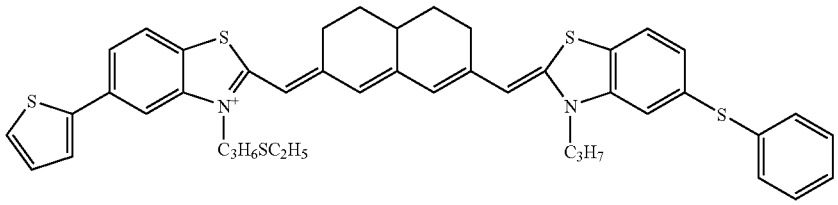
No. 18
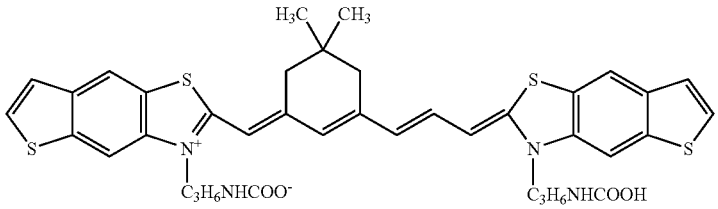
No. 19
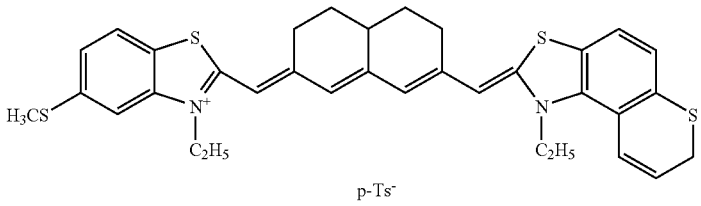

-continued
No. 20
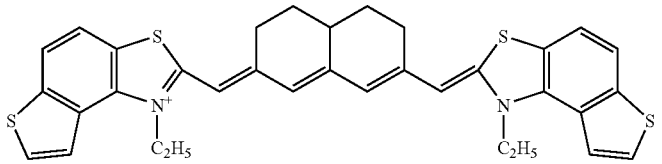
p-Ts⁻
No. 21
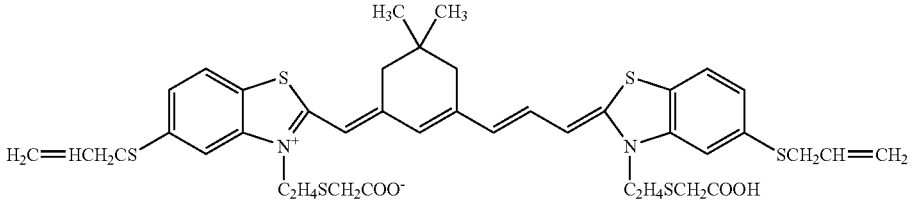
No. 22
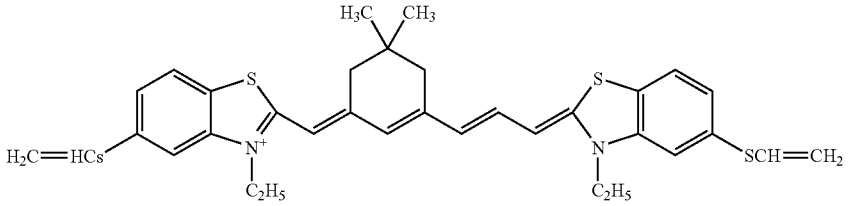
p-Ts⁻
No. 23
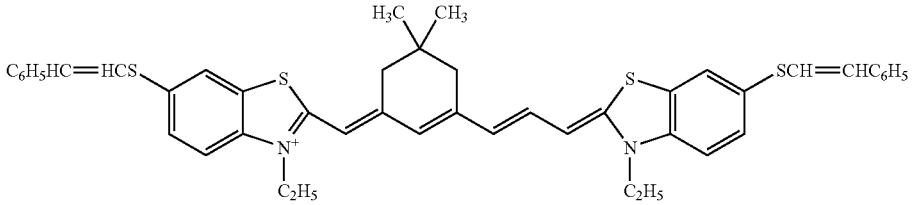
p-Ts⁻
No. 24
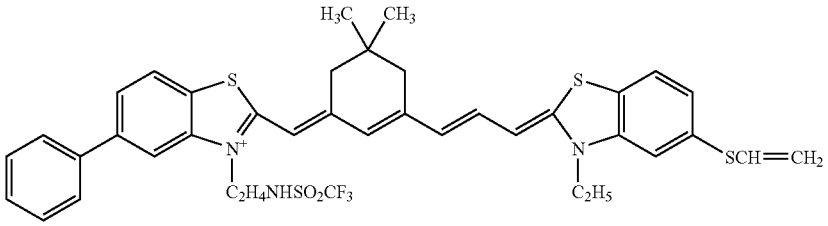
p-Ts⁻
No. 25
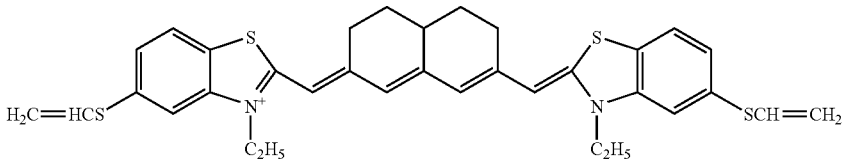
p-Ts⁻
No. 26
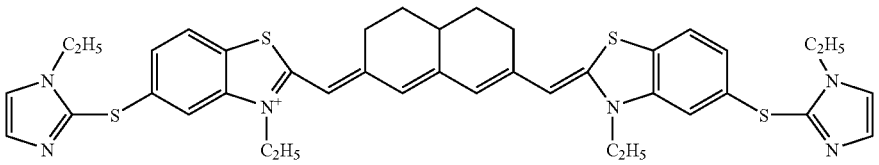
I⁻

-continued
No. 27
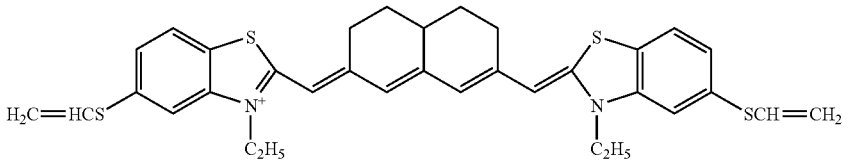
$BF_4^-$
No. 28
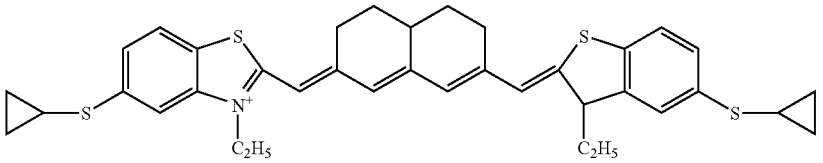
$BF_4^-$
No. 29
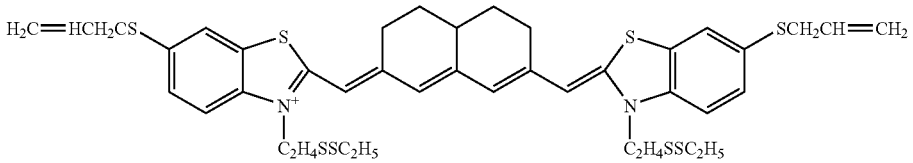
p-$Ts^-$
No. 30
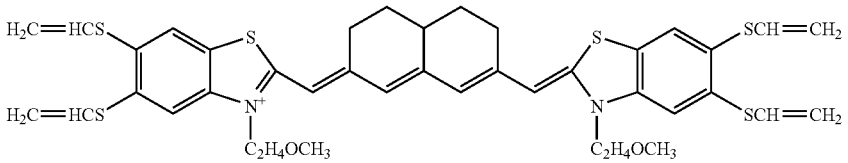
p-$Ts^-$
No. 31
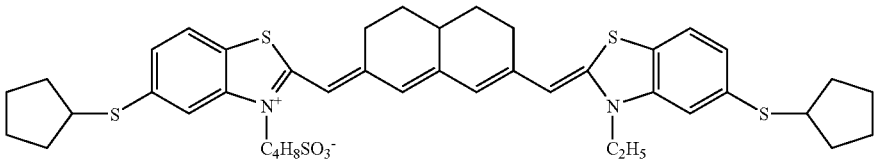
No. 32
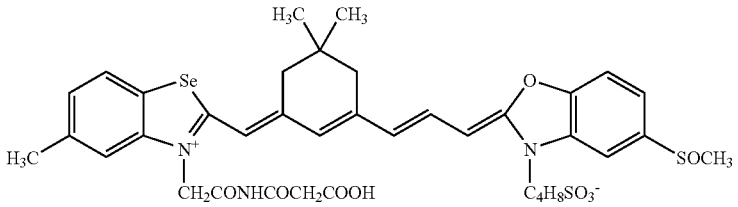
No. 33
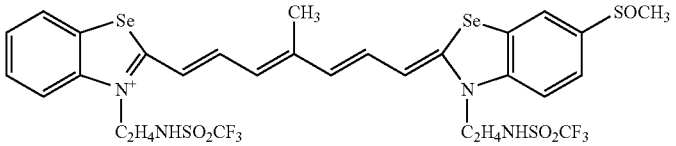
p-$Ts^-$ -continued
No. 34
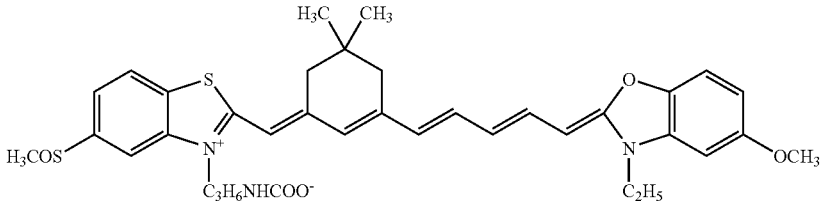
No. 35
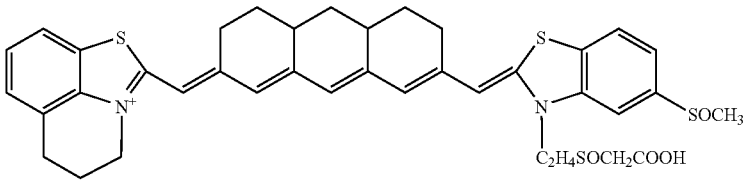
p-Ts-
No. 36
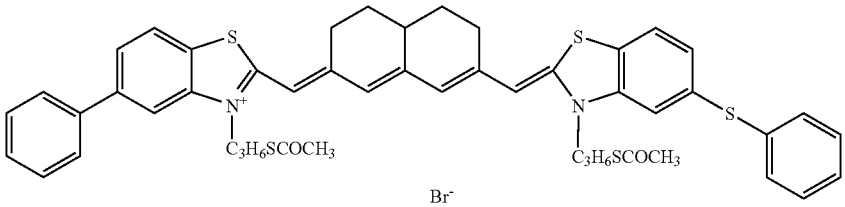
Br-
No. 37
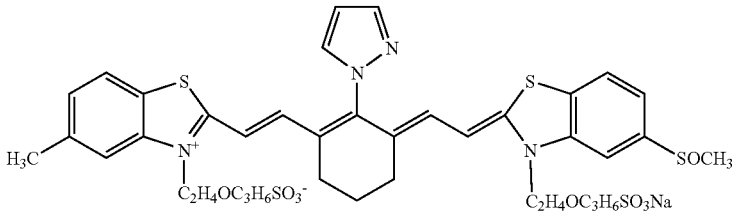
No. 38
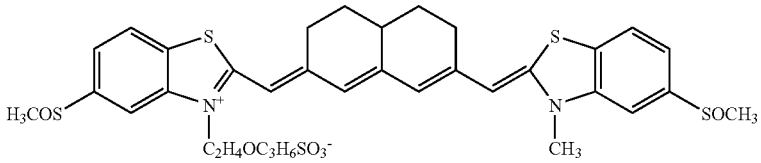
No. 39
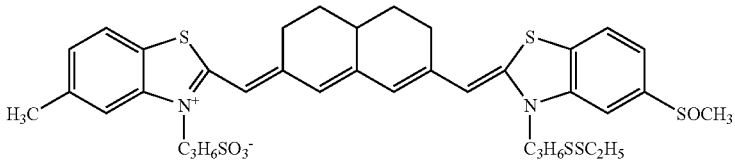
No. 40
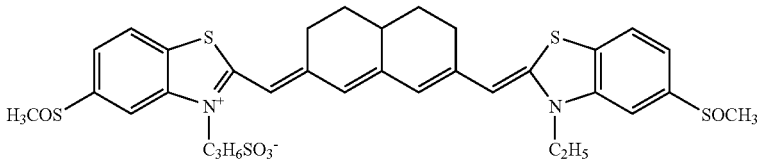
No. 41
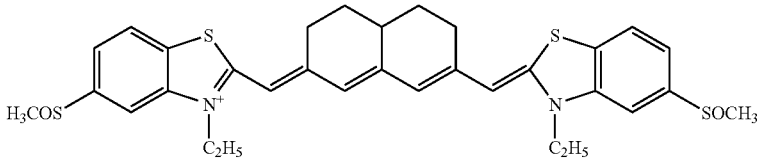
BF4-

-continued
No. 42
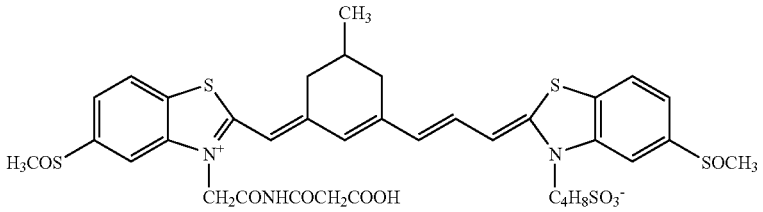
No. 43
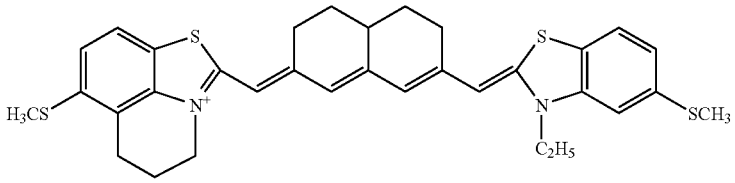
p-Ts$^-$
No. 44
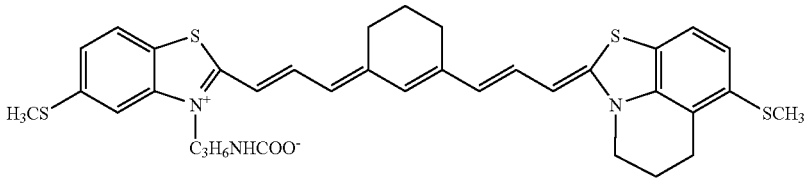
No. 45
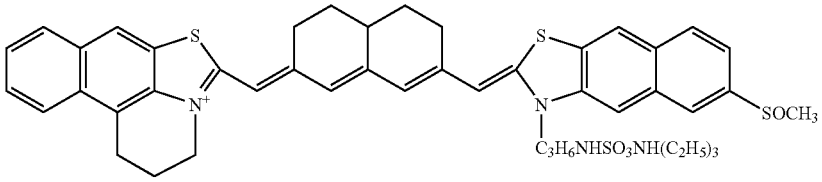
p-Ts$^-$
No. 46
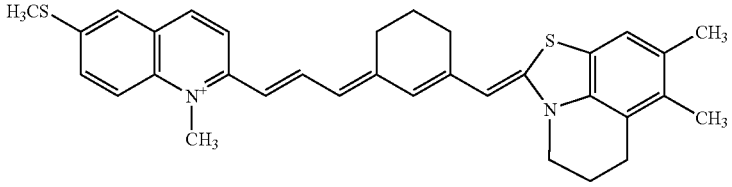
$BF_4^-$
No. 47
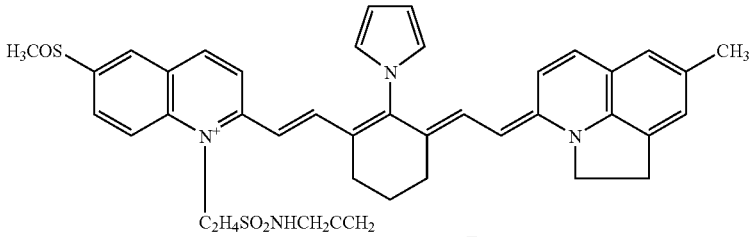
p-Ts$^-$
No. 48
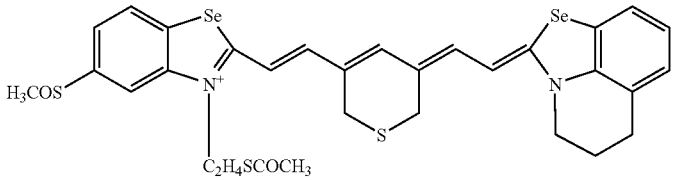
p-Ts$^-$ -continued
No. 49
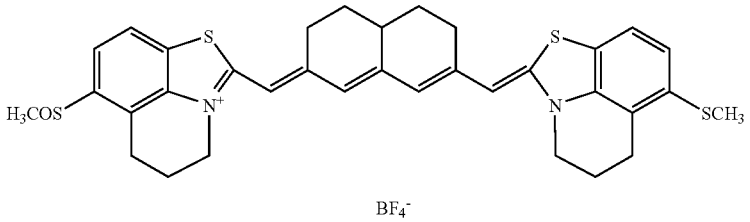
No. 50
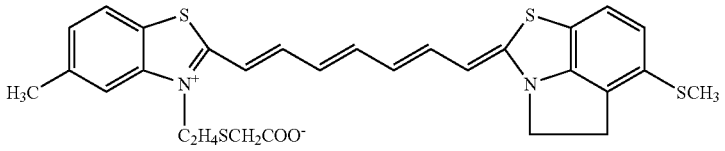
No. 51
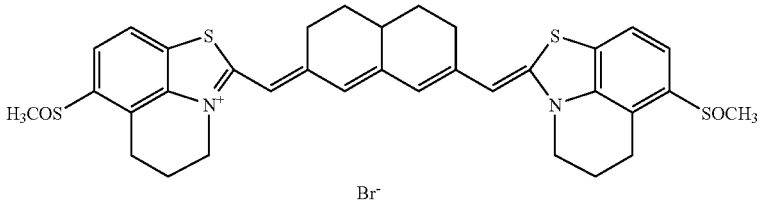
No. 52
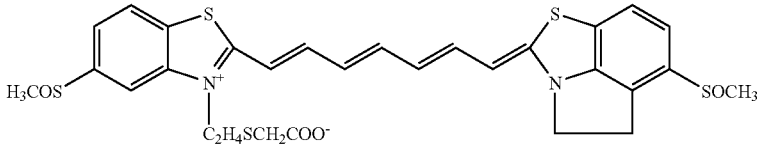
No. 53
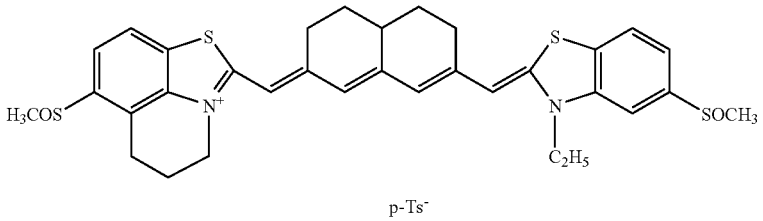
No. 54
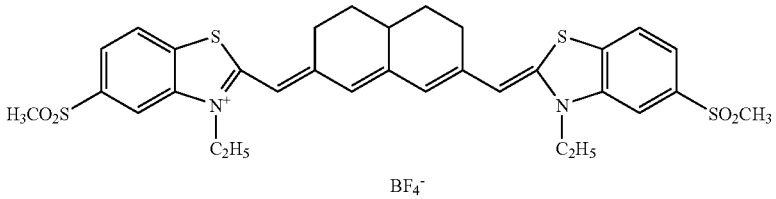
No. 55
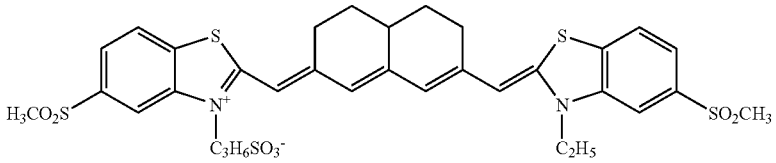
No. 56
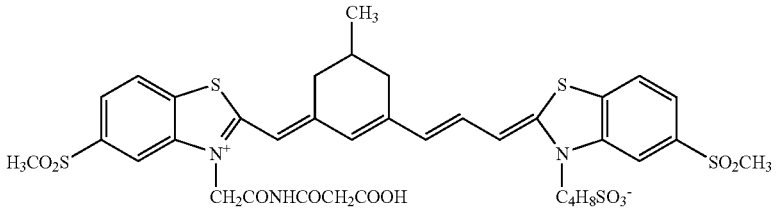

Infrared sensitizing dyes represented by the general formulae (3a) to (3d) used in the invention may be synthesized by methods described, for example, in F. M. Hamer, *The Chemistry of Heterocyclic Compounds,* Vol. 18, *The Cyanine Dyes and Related Compounds,* A. Weissberger ed., Interscience, New York, 1964; JP-A Nos. 3-138638 and 10-73900; JP-W No. 9-510022; U.S. Pat. No. 2,734,900; British Patent No. 774779; and Japanese Patent Application Nos. 10-269843 and 11-58686.

In this invention, the infrared sensitizing dyes represented by the general formulae (3a) to (3d) may be used singly, or in combination with each other. A mol value of the singly used dye or the total of the dyes used in combination is $1\times10^{-6}$ to $5\times10^{-3}$ mol, preferably $1\times10^{-5}$ to $2.5\times10^{-3}$ mol, more preferably $4\times10^{-5}$ to $1\times10^{-3}$ mol, per 1 mol of the silver halide, in the silver halide emulsion. In the invention, in the case of using a plurality of sensitizing dyes in combination, the sensitizing dyes may be used with an optional mixing ratio in the silver halide emulsion.

The sensitizing dyes and methods for adding the sensitizing dyes are described in: JP-A No. 11-65021, Paragraphs 0103 to 0109; JP-A No. 10-186572, compounds represented by general formula (II); JP-A No. 11-119374, dyes represented by general formula (I) and Paragraph 0106; U.S. Pat. Nos. 5,510,236; 3,871,887, dyes described in EXAMPLE 5; JP-A No. 2-96131; JP-A No. 59-48753, dyes disclosed therein; EP 0803764A1, Page 19, Line 38 to Page 20, Line 35; Japanese Patent Application Nos. 2000-86865, 2000-102560 and 2000-205399; etc. These sensitizing dyes may be used singly or in combination of a plurality thereof. In the invention, the sensitizing dye is added to the silver halide emulsion preferably after the desalination step to the application step, more preferably after the desalination step and before the finish of chemical ripening.

A supersensitizer may be used in the invention to increase spectral sensitization efficiency. EXAMPLEs of the supersensitizer used in the invention include compounds disclosed in EP-A No. 587,338; U.S. Pat. Nos. 3,877,943 and 4,873,184; JP-A Nos. 5-341432, 11-109547 and 10-111543; etc.

In the invention, a conventionally known sensitizing dye may be used with the spectral sensitizing dye of the general formulae (3a) to (3d) for the photosensitive silver halide. The known sensitizing dyes and methods for adding the dyes are described in: JP-A No. 11-65021, Paragraphs 0103 to 0109; JP-A No. 10-186572, compounds represented by general formula (II); JP-A No. 11-119374, dyes represented by general formula (I) and Paragraph 0106; U.S. Pat. Nos. 5,510,236; 3,871,887, dyes described in EXAMPLE 5; JP-A No. 2-96131; JP-A No. 59-48753, dyes disclosed therein; EP 0803764A1, Page 19, Line 38 to Page 20, Line 35; Japanese Patent Application Nos. 2000-86865, 2000-102560 and 2000-205399; etc. These sensitizing dyes may be used singly or in combination of a plurality thereof. The sensitizing dye is preferably added to the silver halide emulsion after the desalination step to the application step.

1-1-3. Antifoggant

1) A Compound of General Formula (PO)

It is preferable that the photothermographic material according to the invention comprises a compound as represented by the following general formula (PO) as an antifoggant:

$$Q\text{-}(Y)_n\text{—}C(Z_1)(Z_2)X \qquad \text{(PO)}$$

wherein Q represents a heterocyclic group;

Y represents a divalent connecting group;

n represents 0 or 1;

$Z_1$ and $Z_2$ each represent a halogen atom; and

X represents a hydrogen atom or an electron-withdrawing group.

In the general formula (PO), Q is preferably a nitrogen-containing heterocyclic group containing from 1 to 3 nitrogen atoms and, particularly preferably, a 2-pyridyl group or a 2-quinolyl group.

X is preferably an electron-withdrawing group, more preferably a member selected from the group consisting of: a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group and particularly preferably a halogen atom. Among such halogen atoms, a chlorine atom, a bromine atom and an iodine atom are preferable, a chlorine atom and a bromine atom are more preferable, and a bromine atom is most preferable.

Y is preferably a member selected from the group consisting of: —C(═O)—, —SO— and —$SO_2$—, more preferably —C(═O)— or —$SO_2$— and particularly preferably —$SO_2$—.

n represents 0 or 1 and is preferably 1.

Compounds which are represented by the general formula (PO) are given below, but the invention is by no means limited thereto.

(PO-1)

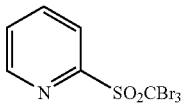

(PO-2)

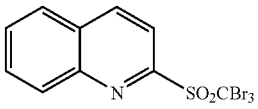

(PO-3)

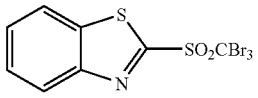

(PO-4)

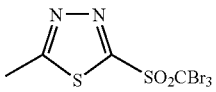

(PO-5)

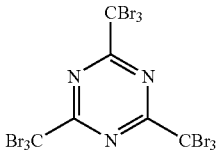

(PO-6)

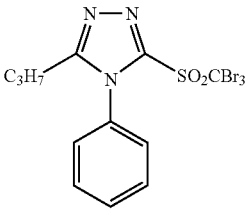

-continued (PO-7)

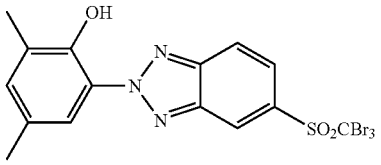

Each of compounds as represented by the general formula (PO) is used preferably in the range of from $1\times10^{-4}$ mol to 1 mol, more preferably in the range of from $1\times10^{-3}$ mol to 0.5 mol and further more preferably in the range of from $1\times10^{-2}$ mol to 0.2 mol, per 1 mol of a non-photosensitive silver salt of an image forming layer in each case.

2) A Compound of General Formula (PR)

It is preferable that the photothermographic material according to the invention comprises a compound as represented by the following general formula (PR) as an antifoggant:

Formula (PR)

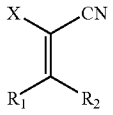

Wherein $R_1$ represents a hydroxyl group or its metal salt;

$R_2$ represents an alkyl group or aryl group;

X represents an electron-withdrawing group, or X and $R_2$ can each other form a ring having an electron-withdrawing group.

The electron-withdrawing group represented by X is explained thereafter.

The electron-withdrawing group X is preferable an electron-withdrawing as —COOR(for example, R is H, $CH_3$, —$CH_2CH_3$). Hammett's constant σ p of —COOH is 0.43, and 0.39 for —$COOCH_3$, 0.45 for —$COOC_2H_5$. In present invention, the σ p value of the electron-withdrawing group X is preferable greater than 0.39. Such examples of electron-withdrawing group are cyano group, alkoxycarbonyl group, metalloxycarbonyl group, hydroxycarbonyl group, nitro group, acetyl group, perfuoroalkyl group, alkylsulfonyl group, arylsulfonyl group, and the group which has been described in Lange, "Handbook of chemistry", 14ed., Magroghhill co., Chap.9, page 2–7, 1992.

$R_1$ is preferable a hydroxyl group or its metal salt, for example, OM1 (wherein M1 is metal cation group.). M1 is preferable a 1 valence cation like that $Li^+$, $Na^+$, $K^+$, $Fe^+$, but also can be 2 or 3 valences cation.

$R_2$ represents an alkyl group or aryl group. When $R_2$ represents an alkyl group, total carbon number of $R_2$ is 1 to 20, preferably 1 to10, most preferably 1 to4. Most preferable alkyl group is methyl group. When $R_2$ represents an aryl group, total carbon number of $R_2$ is 5 to 10, preferably 5 to10, most preferably 6 to 10. Most preferable aryl group is phenyl group.

X and $R_2$ can each other form a ring having an electron-withdrawing group. The preferable ring is 5, 6, or 7 membered ring. Such examples of ring are lactone ring or cyclohexen ring indicated below by compound No.PR-08.

Propen-nitryl compounds in the present invention can be prepared by the procedure described in later.

Useful compounds in the present invention are given below, but the invention is not limited thereto. Most of these compounds can be also [Enol] form and [keto] tautomeric form, so that the formula described below are indicated only by [enol] form.

PR-01

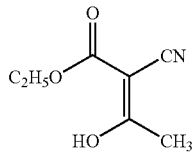

PR-02

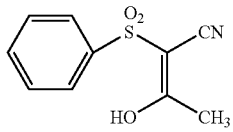

PR-03

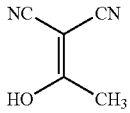

PR-04

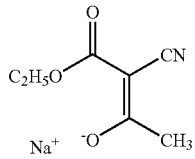

PR-05

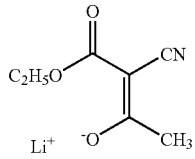

PR-06

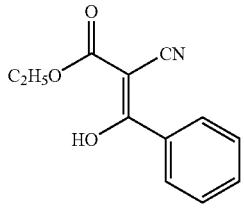

PR-07

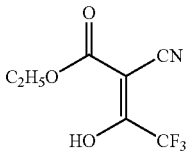

PR-08

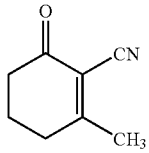

The compound of the present invention is different to the compound describe in U.S. Pat. No. 5,545,515, in which the terminal position of acrylonitrile group (that is as same position as $R_2$ of present invention) is hydrogen atom. As different to that prior arts, the compound of the present invention does not have hydrogen atom in the present of $R_2$.

As the result of the difference of the $R_2$, the compound of the present invention have an effect of lowering fogging without achieving ultra-high contrast.

The compound of general formula (PR) in the present invention can be contained in the image-forming layer and the other layers such as undercoating layer, intermediate layer, surface protect layer, and so on, but it is preferable to be contained in the adjacent layer to the layer containing a photosensitive silver halide.

The amount of the compound of general formula (PR) added in these layers is in the range of from $1\times10^{-7}$ mol/m$^2$ to $1\times10^{-1}$ mol/m$^2$, preferably $1\times10^{-6}$ mol/m$^2$ to $1\times10^{-2}$ mol/m$^2$, more preferably $1\times10^{-5}$ mol/m$^2$ to $5\times10^{-3}$ mol/m$^2$.

It is preferred that the compound of general formula (PR) used in the present invention is dissolved in alcohols (methanol, ethanol, propanol, fluorinated alcohol), ketones (acetone, methyl ethyl ketone), dimethyl formamide , dimethyl sulfoxide, or methyl cellosolve.

It is also possible to use the compounds as emulsion dispersions prepared by dissolving them in oil, such a dibutyl phthalate, tridresyl phosphate, gylceryl triacetate or diethyl phthalate, together with an auxiliary solvent, such as ethyl acetate or cyclohexanone, and then mechanicaly emulsifing the dissolved compounds in accordance with a well-known emulsification dispersion method. In addition, they can be used as solid dispersions prepared by dispersing their powders into water by use of a ball mill, a colloid mill or ultraonic waves.

1-1-4. Photosensitive Silver Halide

1) Halogen Composition

A halogen composition of a photosensitive silver halide according to the invention is not particularly limited whereupon silver chloride, silver chlorobromide, silver bromide, silver iodobromide, silver iodochlorobromide and silver iodide can be used. Among these halides, silver bromide and silver iodobromide are preferable. A distribution of the halogen composition in a grain may be uniform, stepwise or continuously changed. Further, a silver halide grain having a core/shell structure can also preferably be used. As for a structure thereof, a twofold to fivefold structure is preferable. A core/shell grain having a twofold to fourfold structure can more preferably be used. Still further, a technique of localizing silver chloride, silver chlorobromide, silver bromide, silver iodobromide, silver chloroiodobromide and silver iodide therein can also preferably be used.

2) Grain Size

When a grain size of the silver halide according to the invention is large, transparency of a layer, after an image is formed therein, becomes deteriorated, which is not preferable. The grain size thereof is preferably 0.20 μm or less, more preferably in the range of from 0.01 μm to 0.15 μm and further more preferably in the range of from 0.02 μm to 0.12 μm. The term "grain size" as used herein is intended to mean an average diameter of a circle converted such that it has a same area as a projection area (a projection area of a main plane in case of a tabular grain) measured under an electron microscope.

3) Coating Quantity

A quantity of the silver halide grain to be applied is, in terms of silver, in the range of from 0.03 g/m$^2$ to 0.6 g/m$^2$, preferably in the range of from 0.05 g/m$^2$ to 0.4 g/m$^2$ and more preferably in the range of from 0.07 g/m$^2$ to 0.3 g/m$^2$. Whereas, the quantity of the silver halide grain to be applied is in the range of from 0.01 mol to 0.5 mol, preferably in the range of from 0.02 mol to 0.3 mol and more preferably in the range of from 0.03 mol to 0.2 mol, per 1 mol of a non-photosensitive organic silver salt to be described below in each case.

4) Method of Forming Grain

A method of forming the photosensitive silver halide is well known to those in the art. For example, methods described in Research Disclosure No. 17029, June, 1978 and U.S. Pat. No. 3,700,458 can be used. Specifically, used is a method in which first a photosensitive silver halide is prepared by adding a silver-supplying compound and a halogen-supplying compound to a solution containing gelatin or any one of other polymers and, then, an organic silver salt is added to the thus-prepared photosensitive silver halide. Further, a method described in JP-A No. 11-119374, paragraphs [0217] to [0224] and methods described in JP-A No. 11-352627 and Japanese Patent Application No. 2000-42336 are also preferable.

For example, a so-called halidation method in which a part of silver of an organic silver salt is halogenated by an organic or inorganic halide is also preferably used. Although the organic halide used for this method is not particularly limited so long as it can react with the organic silver salt to generate a silver halide, examples of such organic halides include an N-halogenoimide (N-bromosuccinimide or the like), a halogenated quaternary nitrogen compound (tetrabutyl ammonium bromide) and an associate (pyridinium bromide perbromide) of a halogenated quaternary nitrogen salt with a halogen molecule. As for the inorganic halide, although it is not particularly limited so long as it can react with the organic silver salt to generate the silver halide, examples of such inorganic halides include an alkali metal halide or an ammonium halide (sodium chloride, lithium bromide, potassium iodide or ammonium bromide), an alkali earth metal halide (calcium bromide or magnesium chloride), a transition metal halide (ferric chloride or cupric bromide), a metal complex having a halogen ligand (sodium bromoiridate or ammonium chlororhodate) and a halogen molecule (bromine, chlorine or iodine); on this occasion, a desired organic or inorganic halide may simultaneously be used therewith. A quantity of the halide to be added at the time of halidation is preferably in the range of from 1 mmol to 500 mmol and more preferably in the range of from 10 mmol to 250 mmol in terms of the halogen atom, per 1 mol of the organic silver salt in each case.

The photosensitive silver halide grain may be desalted by any one of well-known water-rinsing methods such as noodle and flocculation methods; however, according to the invention, such desalination may be performed or not performed.

5) Grain Shape

As for shapes of the silver halide grains, cubic, octahedral, tetradecahedral, dodecahedral, tabular, spherical, rod-like and potato-like grains are mentioned. Particularly, dodecahedral, tetradecahedral and tabular grains are preferable. A connected grain as shown by R. L. Jenkins, the Journal of Photographic Science, Vol. 28 (1980), p. 164—FIG. 1 is mentioned as an example of a preferred shape. A tabular grain as shown in FIG. 1 is also favorably used. The silver halide grain having a rounded corner is also preferably used. Although no particular limit is imposed on face indices (Miller indices) of an outer surface of the photosensitive silver halide grain, the silver halide grain preferably has a high proportion of {100} face featuring high spectral sensitization efficiency upon adsorption of a spectral sensitizing dye. The proportion of {100} face is preferably 50% or more, more preferably 65% or more and most preferably 80% or more. The proportion of Miller index {100} face can be determined by the method described in T. Tani, J. Imaging Sci., 29, 165 (1985), utilizing adsorption dependency of {111} face and {100} face upon adsorption of a sensitizing dye.

6) Heavy Metal

A photosensitive silver halide grain according to the invention may contain a metal or a metal complex belonging to the groups 8 to 10 in the periodic table (showing the groups 1 to 18). As for a central metal in the metal complex belonging to the groups 8 to 10 in the periodic table, iridium, rhodium and ruthenium are preferable. These metal complexes may be used as one kind, or two or more kinds of complexes having a same metal or different metals simultaneously in combination. A preferable content ratio of these metals or metal complexes is in the range of from $1\times10^{-9}$ mol to $1\times10^{-3}$ mol, per 1 mol of silver. These heavy metals, the complexes thereof and addition methods thereof are described in JP-A Nos. 7-225449, 11-65021, paragraphs [0018] to [0024] and 11-119374, paragraphs [0227] to [0240].

According to the invention, the silver halide grain having a hexacyano metal complex on an outermost surface thereof is preferable. EXAMPLEs of such hexacyano metal complexes include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. According to the invention, the hexacyano Fe complex is preferable.

Although a counter cation of the hexacyano metal complex is not important because the hexacyano metal complex exists in ionic form in an aqueous solution, it is preferable to use an alkali metal ion such as a sodium ion, a potassium ion, a rubidium ion, a cesium ion or a lithium ion; an ammonium ion; and an alkyl ammonium ion (for example, a tetramethyl ammonium ion, a tetraethyl ammonium ion, a tetrapropyl ammonium ion or a tetra (n-butyl) ammonium ion), which are easily mixable with water and appropriate for a precipitation operation of a silver halide emulsion.

The hexacyano metal complex can be mixed with water, a mixed solvent of water and an appropriate organic solvent mixable with water (for example, alcohols, ethers, glycols, ketones, esters, and amides), or gelatin and, then, added.

A quantity of the hexacyano metal complex to be added is preferably in the range of from $1\times10^{-5}$ mol to $1\times10^{-2}$ mol and more preferably in the range of from $1\times10^{-4}$ mol to $1\times10^{-3}$ mol, per 1 mol of silver in each case.

In order to allow the hexacyano metal complex to be present on the outermost surface of the silver halide grain, the hexacyano metal complex is directly added in any stage of: before a loading step which is from completion of an addition of an aqueous silver nitrate solution to be used for grain formation to before a chemical sensitization step in which chalcogen sensitization such as sulfur sensitization, selenium sensitization or tellurium sensitization, or noble metal sensitization such as gold sensitization is performed; during a washing step; during a dispersion step; and before the chemical sensitization step is performed. To inhibit the growth of the silver halide grain, the hexacyano metal complex is preferably added immediately after the grain is formed and, accordingly, preferably before the emulsion formtion step is completed.

Further, addition of the hexacyano metal complex may be started after 96% by weight of an entire quantity of silver nitrate to be added for the grain formation is added, preferably started after 98% by weight thereof is added, and more preferably started after 99% by weight thereof is added.

When any of these hexacyano metal complexes is added after an addition of the aqueous silver nitrate solution which is performed immediately before grain formation is completed, the hexacyano metal complex can be adsorbed on the outermost surface of the silver halide grain whereupon most of such hexacyano metal complexes each form an insoluble salt with a silver ion on a grain surface. Since a silver salt of hexacyano Fe (II) is a more insoluble salt than AgI, it can prevent redissolving to be caused by fine grains. As a result, it has become possible to manufacture a silver halide fine grain having a small grain size.

The silver halide according to the invention preferably contains iridium. A portion thereof which contains iridium is not particularly limited and also an iridium compound may be added in any stage at the time the silver halide grain is formed. For example, the iridium compound may be present at an initial stage of a grain formation step or added at a later stage of the grain formation step.

The iridium compound to be used in the invention may be of a water-soluble type. EXAMPLEs of such water-soluble iridium compounds include an iridium (III) halide, a iridium (IV) halide and an iridium complex salt having a halogen, any of amines, oxalate or the like as a ligand. EXAMPLEs of such salts include hexachloroiridium (III), a hexachloroiridium (IV) complex salt, hexamineiridium (III) and a hexamineiridium (IV) complex salt, trioxalateiridium (III) and a trioxalateiridium (IV) complex salt. According to the invention, a combination of a trivalent compound and a tetravalent compound selected from thereamong may be used. These iridium compounds may each be dissolved in water or other appropriate solvents to form an iridium compound solution and, then, used. In order to stabilize the thus-formed iridium compound solution, a method ordinarily employed may be used. Particularly, an aqueous solution of a hydrogen halide (for example, hydrochloric acid or hydrobromic acid) or an aqueous solution of an alkali halide (for example, KCl, NaCl, KBr or NaBr) may be added to the iridium compound solution. Instead of using the water-soluble iridium compound, a separate silver halide grain which has previously been doped with iridium may be used at the time the silver halide grain is formed, thereby allowing the iridium compound to be dissolved in the system. A quantity of iridium used in the silver halide according to the invention is preferably in the range of from $1\times10^{-7}$ mol to $1\times10^{-2}$ mol and more preferably in the range of from $1\times10^{-6}$ mol to $1\times10^{-3}$ mol, per 1 mol of the silver halide in each case.

Other metal atoms to be contained in the silver halide according to the invention, a desalting method and a chemical sensitization method of the silver halide emulsion are described in JP-A No. 11-84574, paragraphs [0046] to [0050], JP-A No. 11-65021, paragraphs [0025] to [0031] and JP-A No. 11-119374, paragraphs [0242] to [0250].

7) Gelatin

Various kinds of gelatin can be used as gelatin to be contained in the photosensitive silver halide emulsion according to the invention. For the necessity of maintaining an excellent dispersion state of the photosensitive silver halide emulsion in a coating solution containing an organic silver salt, it is preferable to use low molecular weight gelatin having a molecular weight of in the range from 10,000 to 1,000,000. Further, gelatin which has been subjected to a phthalization treatment is preferably used. These types of gelatin may be used in a grain formation stage or at the time of dispersing after a desalting treatment is performed; however, it is preferable to use the low molecular weight gelatin at the time of dispersing.

8) Supersensitizing Agent

According to the invention, a supersensitizing agent can be used for improving spectral sensitization efficiency. As for such supersensitizing agents according to the invention, mentioned are compounds described in EP-A No. 587,338A, U.S. Pat. Nos. 3,877,943 and 4,873,184, JP-A Nos. 5-341432, 11-109547 and 10-111543.

9) Chemical Sensitization

It is preferable that the photosensitive silver halide grain according to the invention is chemically sensitized by a sulfur sensitization method, a selenium sensitization method or a tellurium sensitization method. As for compounds preferably used in the sulfur sensitization method, the selenium sensitization method or the tellurium sensitization method, known compounds, for example, such compounds as described in JP-A No. 7-128768 can be used. Particularly according to the invention, the tellurium sensitization is preferable, and compounds described in the references cited in paragraph [0030] of JP-A No. 11-65021 and compounds represented by the general formulas (II), (III) and (IV) of JP-A No. 5-313284 are more preferable.

A quantity of the sulfur, selenium or tellulium sensitizer to be used varies depending on the silver halide grain to be used, a chemical ripening condition and the like, but is approximately in the range of from $1\times10^{-8}$ mol to $1\times10^{-2}$ mol and preferably in the range of from $1\times10^{-7}$ mol to $1\times10^{-3}$ mol, per 1 mol of silver halide in each case.

The photosensitive silver halide grain according to the invention may chemically be sensitized simultaneously with the chalcogen sensitization and gold sensitization. It is preferable that a gold sensitizer has an oxidation number of gold of either 1 or 3. Preferable specific examples of such gold sensitizers include chloroauric acid, bromoauric acid, potassium chloroaurate, potassium bromoaurate, auric trichloride, potassium auric thiocyanate, potassium iodoaurate, tetracyanoauric acid, ammonium aurothiocyanate and pyridyl trichloro gold. The gold sensitizers described in U.S. Pat. No. 5,858,637 and Japanese Patent Application No. 2001-79450 are favorably used.

A quantity to be added of the gold sensitizer which is simultaneously used is, though varying depending on various types of conditions, approximately in the range of from $1\times10^{-7}$ mol to $1\times10^{-3}$ mol and more preferably $1\times10^{-6}$ mol to $5\times10^{-4}$ mol, per 1 mol of silver halide.

In the invention, the chemical sensitization is capable of being performed at any time so long as it is performed during a time period of after grain formation and before coating. The timing of performing the chemical sensitization can be after desalting, but in one case of (1) before spectral sensitization, (2) simultaneously with spectral sensitization, (3) after spectral sensitization or (4) immediately before coating.

Conditions of chemical sensitization according to the invention are not particularly limited; however, when they are described in terms of approximate numbers, a pH is from 5 to 8, a pAg is from 6 to 11 and a temperature is from 40° C. to 95° C.

The silver halide emulsion according to the invention may be added with thiosulfonic acid compound by a method described in EP-A No. 293,917.

The photosensitive silver halide grain according to the invention may be subjected to reductive sensitization. As for reductive sensitizers, ascorbic acid and thiourea dioxide are preferable; as for other reductive sensitizers, stannous chloride, aminoiminomethane sulfinic acid, a hydrazine derivative, a borane compound, a silane compound and a polyamine compound can preferably be used. A reductive sensitizer may be added at any stage of a photosensitive emulsion production step, that is, from a step of crystal growth till a preparation step immediately before coating. Further, it is preferable that the reductive sensitization is performed by ripening the grains while keeping the emulsion at pH 7 or more, or at pAg 8.3 or less. It is also preferable that the reductive sensitization is performed by introducing a single addition portion of silver ion during the formation of the grains.

10) Combination of Different Kinds of Silver Halides

In the photothermographic material according to the invention, one kind of photosensitive silver halide emulsion may be used, or two or more kinds of silver halide emulsions (for example, those having different average grain sizes, halogen compositions, crystal habits or chemical sensitization conditions from one another) may be used in combination. Using plural types of photosensitive silver halides having different sensitivity from one another allows gradation to be adjusted. Related technologies are described, for example, in JP-A Nos. 57-119341, 53-106125, 47-3929, 48-55730, 46-5187, 50-73627 and 57-150841. Sensitivity difference among individual emulsions is preferably 0.2 log E or more.

1-1-5 Compound Represented by General Formula (T)

It is preferable that the photothermographic material according to the invention comprises a compound represented by the following general formula (T):

Formula (T)

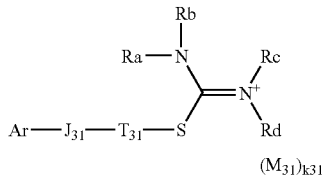

wherein Ar represents an aromatic hydrocarbon group or an aromatic heterocyclic group;

$T_{31}$ represents a divalent connecting group comprising an aliphatic hydrocarbon group or a connecting group;

$J_{31}$ represents a divalent connecting group containing at least one member selected from the group consisting of: an oxygen atom, a sulfur atom and a nitrogen atom or a connecting group;

Ra, Rb, Rc and Rd are each represent a member selected from the group consisting of: a hydrogen atom, an acyl group, an aliphatic hydrocarbon group, an aryl group and a heterocyclic group, wherein Ra and Rb, Rc and Rd, Ra and Rc, or Rb and Rd can, in each combination, be connected with each other to form a nitrogen-containing heterocyclic group;

$M_{31}$ represents an ion necessary for canceling an electric charge in a molecule; and $k_{31}$ represents a number of the ion necessary for canceling the electric charge in the molecule.

EXAMPLEs of such divalent connecting groups each comprising an aliphatic hydrocarbon group represented by $T_{31}$ include a linear, branched or cyclic alkylene group (having preferably from 1 to 20 carbon atoms, more preferably from 1 to 16 carbon atoms and further more preferably from 1 to 12 carbon atoms), an alkenyl group (having preferably from 2 to 20 carbon atoms, more preferably from 2 to 16 carbon atoms and further more preferably from 2 to 12 carbon atoms) and an alkynyl group (having preferably from 2 to 20 carbon atoms, more preferably from 2 to 16 carbon atoms and further more preferably from 2 to 12 carbon atoms) which may have a substituent; examples of such substituents include, as aliphatic hydrocarbons, a linear, branched or cyclic alkyl group (having preferably from 1 to 20 carbon atoms, more preferably from 1 to 16 carbon atoms and further more preferably from 1 to 12 carbon atoms), an alkenyl group (having preferably from 2 to 20 carbon atoms, more preferably from 2 to 16 carbon atoms and further more preferably from 2 to 12 carbon atoms) and an alkynyl group (having preferably from 2 to 20 carbon atoms, more preferably from 2 to 16 carbon atoms and further more preferably from 2 to 12 carbon atoms); as an aryl group, an aryl group of a single ring or a condensed ring having from 6 to 20 carbon atoms (for example, a phenyl group or a naphthyl group; preferably, a phenyl group); and, as a heterocyclic group, a 3- to 10-membered saturated or unsaturated heterocyclic group (for example, a 2-thiazolyl group, a 1-piperadinyl group, a 2-pyridyl group, a 3-pyridyl group, a 2-furyl group, a 2-thienyl group, a 2-benzimidazolyl group or a carbazolyl group) whereupon a heterocycle in any of these groups may be a single ring or form a condensed ring with any of other rings. Each of these groups may have a substituent in an arbitrary position whereupon examples of such substituents include an alkyl group (inclusive of a cycloalkyl group and an alalkyl group; having preferably from 1 to 20 carbon atoms, more preferably from 1 to 12 carbon atoms and particularly preferably from 1 to 8 carbon atoms; examples of such alkyl groups include a methyl group, an ethyl group, an n-propyl group, an isopropyl group, an n-butyl group, a tert-butyl group, an n-heptyl group, an n-octyl group, an n-decyl group, an n-undecyl group, an n-hexadecyl group, a cyclopropyl group, a cyclopentyl group, a cyclohexyl group, a benzyl group and a phenethyl group), an alkenyl group (having preferably from 2 to 20 carbon atoms, more preferably from 2 to 12 carbon atoms and particularly preferably from 2 to 8 carbon atoms; examples of such alkenyl groups include a vinyl group, an allyl group, a 2-butenyl group and 3-pentenyl group), an alkynyl group (having preferably from 2 to 20 carbon atoms, more preferably from 2 to 12 carbon atoms and particularly preferably from 2 to 8 carbon atoms; examples of such alkynyl groups include a propargyl group and a 3-pentynyl group), an aryl group (having preferably from 6 to 30 carbon atoms, more preferably from 6 to 20 carbon atoms and particularly preferably from 6 to 12 carbon atoms; examples of such aryl groups include a phenyl group, a p-tolyl group, an o-aminophenyl group and a naphthyl group), an amino group (having preferably from 0 to 20 carbon atoms, more preferably from 0 to 10 carbon atoms and particularly preferably from 0 to 6 carbon atoms; examples of such amino groups include an amino group, a methylamino group, an ethylamino group, a dimethylamino group, a diethylamino group, a diphenylamino group and a dibenzylamino group), an imino group (having preferably from 1 to 20 carbon atoms, more preferably from 1 to 18 carbon atoms and particularly preferably from 1 to 12 carbon atoms; examples of such imino groups include a methylimino group, an ethylimino group, a propylimino group and a phenylimino group), an alkoxy group (having preferably from 1 to 20 carbon atoms, more preferably from 1 to 12 carbon atoms and particularly preferably from 1 to 8 carbon atoms; examples of such alkoxy groups include a methoxy group, an ethoxy group and a butoxy group), an aryloxy group (having preferably from 6 to 20 carbon atoms, more preferably from 6 to 16 carbon atoms and particularly preferably from 6 to 12 carbon atoms; examples of such aryloxy groups include a phenyloxy group and 2-naphthyloxy group), an acyl group (having preferably from 1 to 20 carbon atoms, more preferably from 1 to 16 carbon atoms and particularly preferably from 1 to 12 carbon atoms; examples of such acyl groups include an acetyl group, a benzoyl group, a formyl group and a pivaloyl group), an alkoxycarbonyl group (having preferably from 2 to 20 carbon atoms, more preferably from 2 to 16 carbon atoms and particularly preferably from 2 to 12 carbon atoms; examples of such alkoxycarbonyl groups include a methoxycarbonyl group and an ethoxycarbonyl group), an aryloxycarbonyl group (having preferably from 7 to 20 carbon atoms, more preferably from 7 to 16 carbon atoms and particularly preferably from 7 to 10 carbon atoms; examples of such aryloxycarbonyl groups include a phenyloxycarbonyl group), an acyloxy group (having preferably from 1 to 20 carbon atoms, more preferably from 1 to 16 carbon atoms and particularly preferably from 1 to 10 carbon atoms; examples of such acyloxy groups include an acetoxy group and a benzoyloxy group), an acylamino group (having preferably from 1 to 20 carbon atoms, more preferably from 1 to 16 carbon atoms and particularly preferably from 1 to 10 carbon atoms; examples of such acylamino groups include an acetylamino group and a benzoylamino group), an alkoxycarbonylamino group (having preferably from 2 to 20 carbon atoms, more preferably from 2 to 16 carbon atoms and particularly preferably from 2 to 12 carbon atoms; examples of such alkoxycabonylamino groups include a methoxycarbonylamino group), an aryloxycarbonylamino group (having preferably from 7 to 20 carbon atoms, more preferably from 7 to 16 carbon atoms and particularly preferably from 7 to 12 carbon atoms; examples of such aryloxycabonylamino groups include a phenyloxycarbonylamino group), a sulfonylamino group (having preferably from 1 to 20 carbon atoms, more preferably from 1 to 16 carbon atoms and particularly preferably from 1 to 12 carbon atoms; examples of such sulfonylamino groups include a methane sulfonylamino group and a benzene sulfonylamino group), a sulfamoyl group (having preferably from 0 to 20 carbon atoms, more preferably from 0 to 16 carbon atoms and particularly preferably from 0 to 12 carbon atoms; examples of such sulfamoyl groups include a sulfamoyl group, a methyl sulfamoyl group, a dimethyl sulfamoyl group and a phenyl sulfamoyl group), a carbamoyl group (having preferably from 1 to 20 carbon atoms, more preferably from 1 to 16 carbon atoms and particularly preferably from 1 to 12 carbon atoms; examples of such carbamoyl groups include a carbamoyl group, a methyl carbamoyl group, a diethyl carbamoyl group and a phenyl carbamoyl group), an alkylthio group (having preferably from 1 to 20 carbon atoms, more preferably from 1 to 16 carbon atoms and particularly preferably from 1 to 12 carbon atoms; examples of such alkylthio groups include a methylthio group and an ethylthio group), an arylthio group (having preferably from 6 to 20 carbon atoms, more preferably from 6 to 16 carbon atoms and particularly preferably from 6 to 12 carbon atoms; examples of such arylthio groups include a phenylthio group), a sulfonyl group (having preferably from 1 to 20 carbon atoms, more preferably from 1 to 16 carbon atoms and particularly preferably from 1 to 12 carbon atoms; examples of such sulfonyl groups include a methane sulfonyl group and tosyl group), a sulfinyl group (having preferably from 1 to 20 carbon atoms, more preferably from 1 to 16 carbon atoms and particularly preferably from 1 to 12 carbon atoms; examples of such sulfinyl groups include a methane sulfinyl group and a benzene sulfinyl group), a ureido group (having preferably from 1 to 20 carbon atoms, more preferably from 1 to 16 carbon atoms and particularly preferably from 1 to 12 carbon atoms; examples of such ureido groups include a ureido group, a methyl ureido group and a phenyl ureido group), a phosphoric acid amide group (having preferably from 1 to 20 carbon atoms, more preferably from 1 to 16 carbon atoms and particularly preferably from 1 to 12 carbon atoms; examples of such phosphoric acid amide groups include a diethyl phosphoric acid amide group and a phenyl phosphoric acid amide group), a hydroxyl group, a mercapto group, a halogen atom (for example, a fluorine atom, a chlorine atom, a bromine atom and an iodine atom), a cyano group, a sulfo group, a sulfino group, a carboxyl group, a phosphono group, a phosphino group, a nitro group, a hydroxamic acid group, a hydrazino group and a heterocyclic group (for example, an imidazolyl group, a benzimidazolyl group, a thiazolyl group, a benzthiazolyl group, a carbazolyl group, a pyridyl group, a furyl group, a piperidyl group and a morpholino group).

Among these substituents, a hydroxyl group, a mercapto group, a sulfo group, a sulfino group, a carboxyl group, a phosphono group and a phosfino group which are each capable of forming a salt may be the salt thereof. Also, these substituents may be further substituted by a separate substituent and, when there are two or more such separate substituents, they may be same with or different from one another. EXAMPLEs of the separate substituents include an alkyl group, alalkyl group, an alkoxy group, an aryl group, an alkylthio group, an acyl group, an acylamino group, an imino group, a sulfamoyl group, a sulfonyl group, a sulfonylamino group, a ureido group, an amino group, a halogen atom, a nitro group, a heterocyclic group, an alkoxycarbonyl group, a hydroxyl group, a sulfo group, a carbamoyl group, a carboxyl group whereupon, among these groups, an alkyl group, an alkoxy group, an aryl group, an alkylthio group, an acyl group, an acylamino group, an imino group, a sufonylamino group, a ureido group, an amino group, a halogen atom, a nitro group, a heterocyclic group, an alkoxycarbonyl group, a hydroxyl group, a sulfo group, a carbamoyl group and a carboxyl group are more preferable and, among other things, an alkyl group, an alkoxy group, an aryl group, an alkylthio group, an acylamino group, an imino group, a ureido group, an amino group, a heterocyclic group, an alkoxycarbonyl group, a hydroxyl group, a sulfo group, a carbamoyl group and a carboxyl group are further more preferable. An amidino group may contain a substituent whereupon examples of such substituents include an alkyl group (such as a methyl group, an ethyl group, a pyridylmethyl group, a benzyl group, a phenethyl group, a carboxybenzyl group or an aminophenylmethyl group), an aryl group (such as a phenyl group, a p-tolyl group, a naphthyl group, an o-aminophenyl group or an o-methoxyphenyl group) and a heterocyclic group (such as a 2-thiazolyl group, a 2-pyridyl group, a 3-pyridyl group, a 2-furyl group, a 3-furyl group, a 2-thieno group, a 2-imidazolyl group, a benzthiazolyl group or a carbazolyl group).

EXAMPLEs of divalent connecting groups, each having at least one member selected from the group consisting of: an oxygen atom, a sulfur atom and a nitrogen atom, represented by $J_{31}$ include the following groups and combinations thereof:

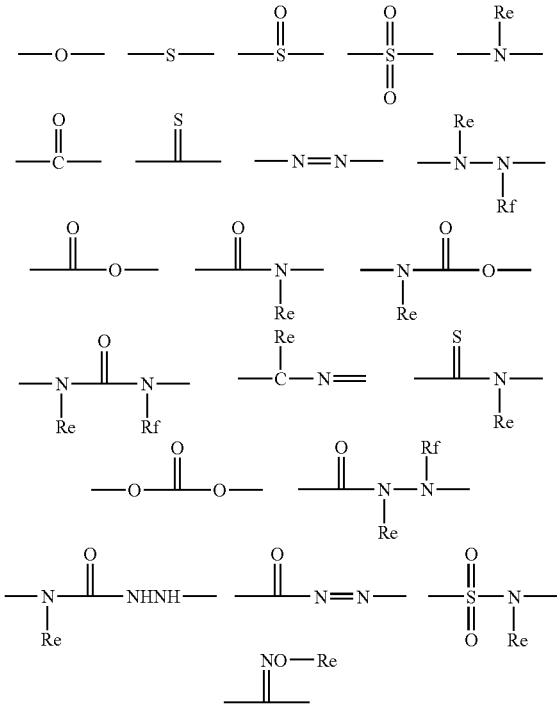

In the above-described groups, definitions of Re and Rf are equivalent to those described in Ra to Rd.

The aromatic hydrocarbon as represented by Ar is an aryl group of a single ring or a condensed ring having preferably from 6 to 30 carbon atoms and more preferably from 6 to 20 carbon atoms whereupon examples of such aryl groups include a phenyl group and a naphthyl group and, a phenyl group is particularly preferable therebetween. The aromatic heterocyclic group represented by Ar is a 5- to 10-membered unsaturated heterocyclic group containing at least one atom selected from the group consisting of: N, O and S whereupon a heterocycle in each of such heterocyclic groups may be a single ring or may further form a condensed ring with another ring. The hetero ring in each of the heterocyclic groups is preferably a 5- or 6-membered aromatic heterocycle or a benzo-condensed ring thereof, more preferably a 5- or 6-membered aromatic heterocycle containing a nitrogen atom or a benzo-condensed ring thereof, and further more preferably a 5- or 6-membered aromatic heterocycle containing one or two nitrogen atoms or a benzo-condensed ring thereof.

Specific examples of heterocyclic groups include respective groups derived from thiophene, furan, pyrrole, imidazole, pyrazole, pyridine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, benzthiazoline, benztriazole, tetrazaindene and carbazole. EXAMPLEs of preferable heterocyclic groups include respective groups derived from imidazole, pyrazole, pyridine, pyrazine, indole, indazole, thiadiazole, oxadiazole, quinoline, phenazine, tetrazole, thiazole, oxazole, benzimidazole, benzoxazole, benzthiazole, benzthiazoline, benztriazole, tetrazaindene and carbazole. EXAMPLEs of more preferable heterocyclic groups include respective groups derived from imidazole, pyridine, pyrazine, quinoline, phenazine, tetrazole, thiazole, benzoxazole, benzimidazole, benzthiazole, benzthiazoline, benztriazole, and carbazole.

The aromatic hydrocarbon group and the aromatic heterocyclic group represented by Ar may contain a substituent whereupon examples of such substituents are same as those described in $T_{31}$, respectively, and same applies to preferable ranges thereof. These substituents may further be substituted by a separate substituent and, when there are two or more of such separate substituents, they may be same with or different from one another. The group represented by Ar is preferably an aromatic heterocyclic group.

Aliphatic hydrocarbon groups, aryl groups and heterocyclic groups represented by Ra, Rb, Rc and Rd are same as those described in $T_{31}$, respectively, and same applies to preferable ranges thereof. The acyl group represented by each of Ra, Rb, Rc and Rd is an aliphatic or aromatic group having from 1 to 12 carbon atoms whereupon specific examples of such aliphatic or aromatic groups include an acetyl group, a benzoyl group, a formyl group and a pivaloyl group. The nitrogen-containing heterocyclic group to be formed by connecting Ra and Rb, Rc and Rd, Ra and Rc, or Rb and Rd, within each combination, is a 3- to 10-membered saturated or unsaturated heterocyclic group (for example, respective groups derived from a piperidine ring, a piperazine ring, an acridine ring, a pyrrolidine ring, a pyrrole ring, and a morpholine ring).

Specific examples of acid ions as anions each necessary for canceling the electric charge in the molecule as represented by $M_{31}$ include a halogen ion (such as an chlorine ion, a bromine ion or an iodine ion), a p-toluene sulfonic acid ion, a perchloric acid ion, a boron tetrafluoride ion, a sulfuric acid ion, a methyl sulfuric acid ion, an ethyl sulfuric acid ion, a methane sulfonic acid ion and a trifluoromethane sulfonic acid ion.

Following examples of compounds as represented by the general formula (T) are given to illustrate the invention and should not be interpreted as limiting it in any way:

T-1

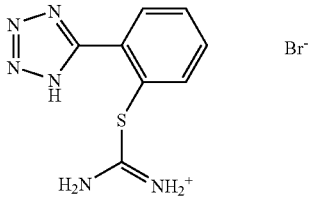

T-2

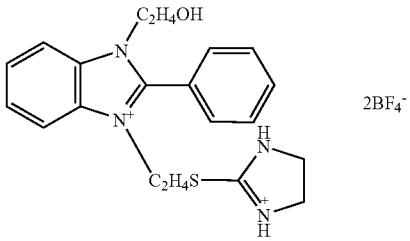

T-3

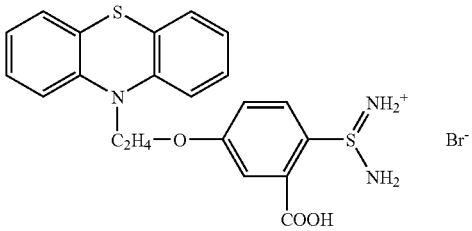

-continued

T-4

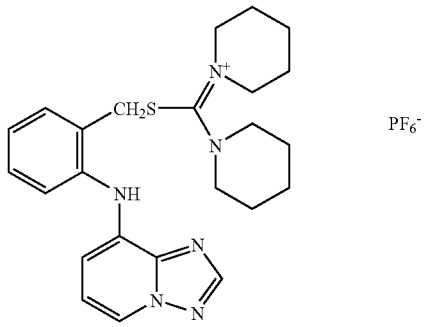

T-5

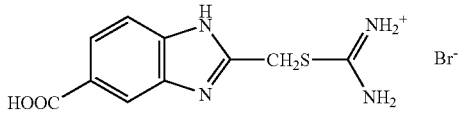

T-6

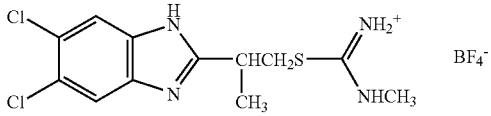

T-7

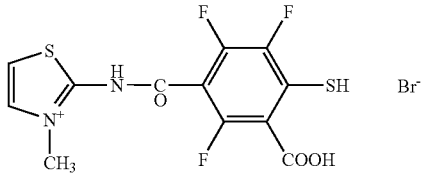

T-8

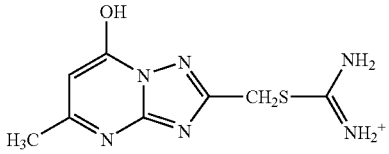

T-9

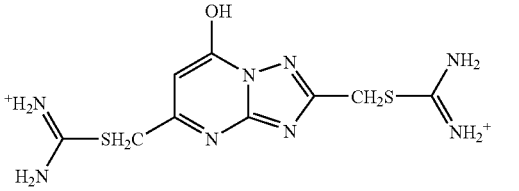

T-10

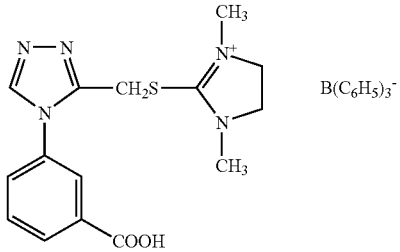

-continued
T-11
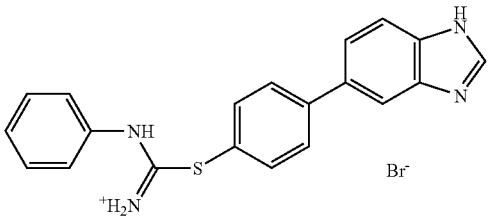
T-12
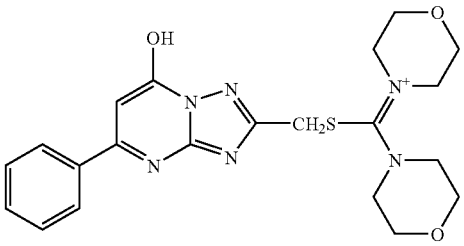
T-13
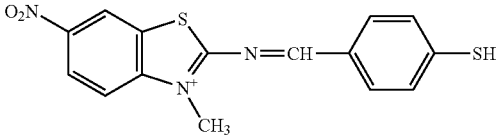
T-14
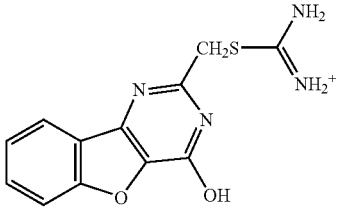
T-15
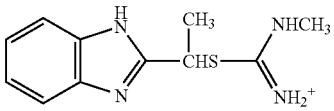
T-16
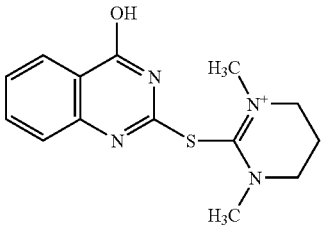
T-17
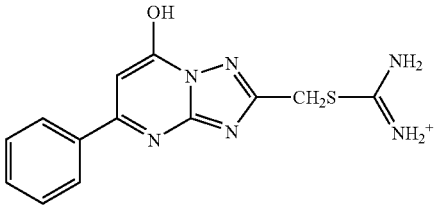
-continued
T-18
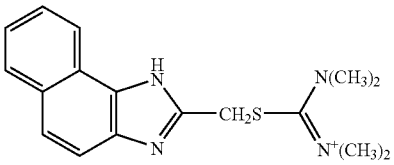
T-19
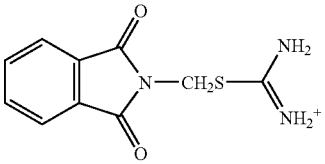
T-20
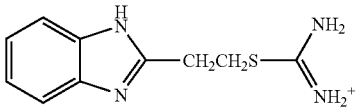
T-21
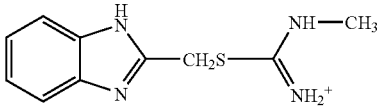
T-22
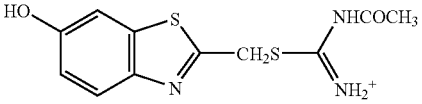
T-23
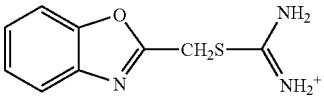
T-24
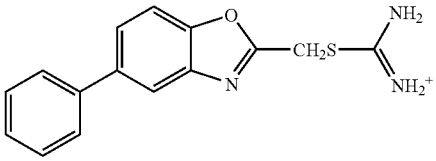
T-25
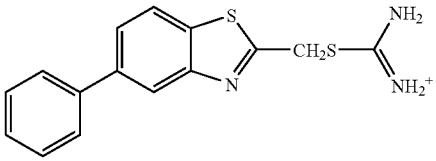
T-26
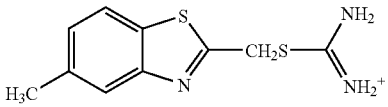
T-27
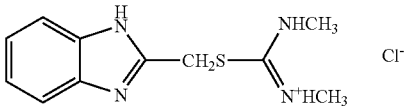

-continued

T-28

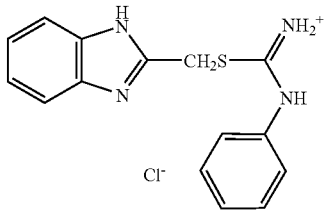

T-29

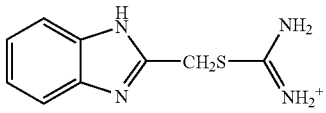

T-30

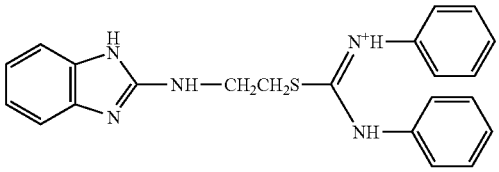

T-31

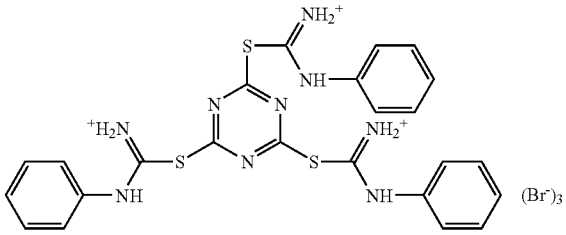

T-32

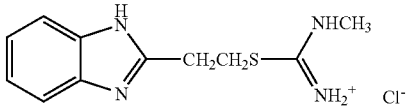

T-33

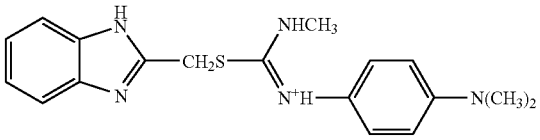

T-34

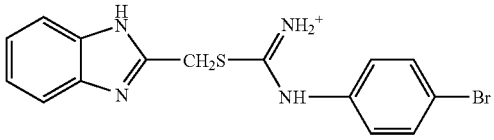

T-35

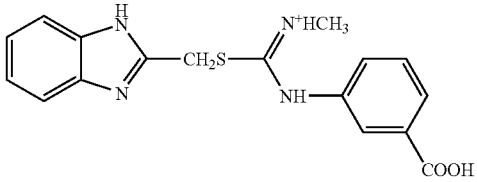

T-36

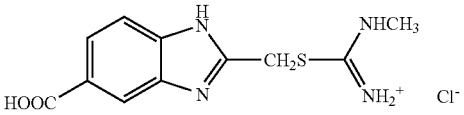

As for the compounds as represented by the general formula (T) according to the invention, a commercially available compound may be used or a compound may be synthesized by a known method, for example, a method described in Shin Jikken Kagaku Koza (New Experimental Chemistry Course) vol. 14 (III), edited by The Chemical Society of Japan, pp. 1739 to 1741 (1978).

Any of the compounds as represented by the general formula (T) according to the invention can be added either to a photosensitive layer or to a non-photosensitive layer in the photothermographic material; however, it is preferable that such compound is added to the photosensitive layer.

A quantity to be added of the compound as represented by the general formula (T) is, although varying depending on the desired purpose, in the range of from $1\times10^{-4}$ mol to 1 mol, preferably in the range of from $1\times10^{-3}$ mol to 0.3 mol and more preferably in the range of from $1\times10^{-3}$ mol to 0.1 mol, per 1 mol of Ag in each case. Further, the compound as represented by the general formula (T) may be used by either one kind or two or more kinds in combination.

The compound as represented by the general formula (T) can be dissolved in water or an appropriate organic solvent such as any one of alcohols (for example, methanol, ethanol, propanol and fluorinated alcohol), any one of ketones (for example, acetone and methyl ethyl ketone), dimethyl formamide, dimethyl sulfoxide and methyl cellosolve and, then, used. Further, the compound can be dissolved in oil such as dibutyl phthalate, tricresyl phosphate, glyceryl triacetate or diethyl phthalate, or an auxiliary solvent such as ethyl acetate or cyclohexanone by a well known emulsify-dispersing method to mechanically prepare an emulsify-dispersion and, then, used. Still further, the compound in power form can be dispersed in water by using a ball mill, a colloid mill, a sand grinder mill, a Manton-Gaulin type homogenizer, a microfluidizer or ultrasonic wave by means of a method known as a solid dispersing method and, then, used. Furthermore, when the compound is dispersed in solid fine grain form, a dispersing aid may be used.

The compound as represented by the general formula (T) acts as a supersensitizing agent and effectively enhances sensitivity while employing in combination with a smaller portion of a spectral sensitizer. Any one of other known supersensitizers may be used on combination with the compound as represented by the general formula (T). EXAMPLEs of the supersensitizers which can be used include compounds described in EP-A No. 587,338, U.S. Pat. Nos. 3,877,943 and 4,873,184, JP-A Nos. 5-341432, 11-109547 and 10-111543, and the like.

1-1-6 Macrocyclic Compound Containing Hetero Atom

It is preferable that the photothermographic material according to the invention comprises a macrocyclic compound containing a hetero atom.

The macrocyclic compound containing the hetero atom to be used in the invention is a macrocyclic compound of a 9 or more-membered ring containing, as a hetero atom, at least one member selected from the group consisting of: a nitrogen atom, an oxygen atom, a sulfur atom and a selenium atom. Further, the macrocyclic compound is preferably a 12- to 24-membered ring and more preferably a 15- to 21-membered ring.

Such macrocyclic compounds, which are typically known as crown ethers as given below, were synthesized by Pederson in 1967 and, since a unique report thereon was issued, many compounds of the type have been synthesized. These compounds are described in detail, for example, in C. J. Pederson, Journal of American Chemical Society, vol. 86

(2496), 7017 to 7036 (1967); G. W. Gokel, S. H. Korzeniowski, "Macrocyclic polyether synthesis", Springer-Vergal (1982); Oda, Shono and Tabuse (ed.), "Chemistry of Crown Ether", Kagaku Dojin (1978); Tabuse (ed.), "Host-Guest", Kyoritsu Shuppan Co., Ltd. (1979); and Sasaki and Koga, "Organic Synthetic Chemistry", vol. 45 (6), 571 to 582 (1987).

Specific examples of the macrocyclic compounds each containing a hetero atom are given below to illustrate the invention and should not be interpreted as limiting it in any way.

C-1

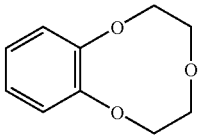

C-2

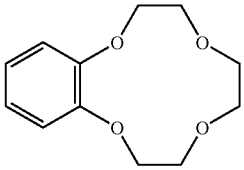

C-3

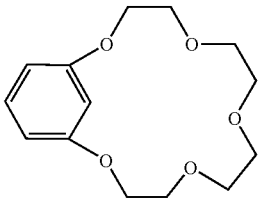

C-4

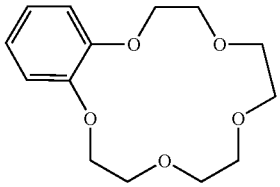

C-5

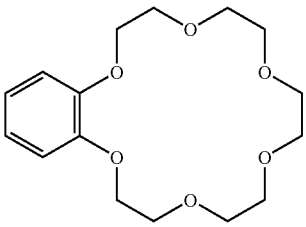

C-6

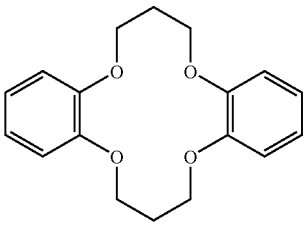

-continued

C-7

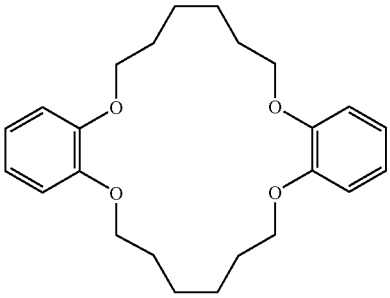

C-8

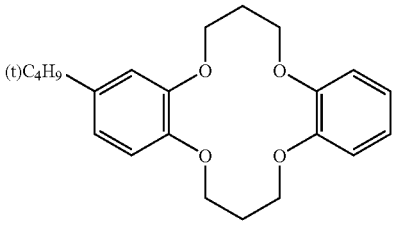

C-9

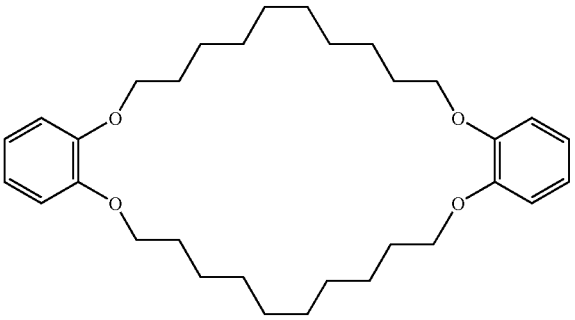

C-10

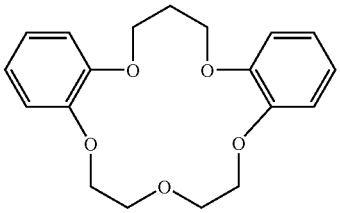

C-11

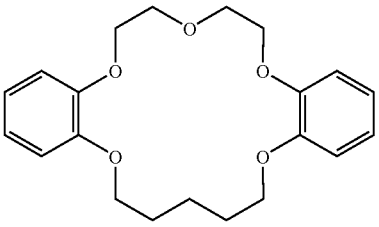

-continued
C-12
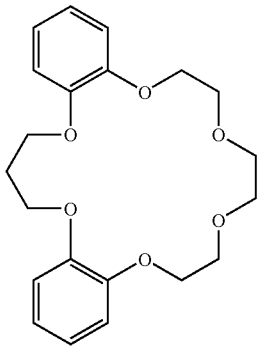
C-13
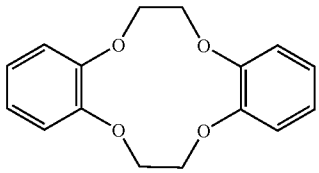
C-14
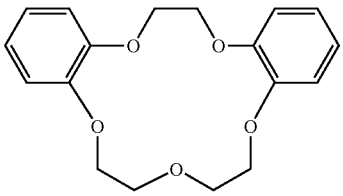
C-15
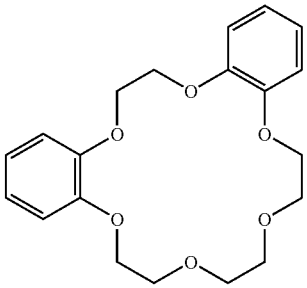
C-16
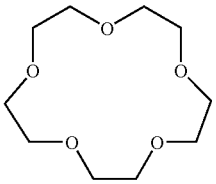
C-17
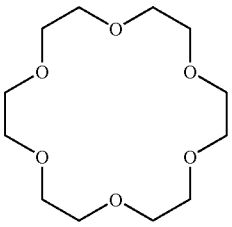
-continued
C-18
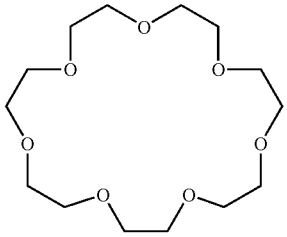
C-19
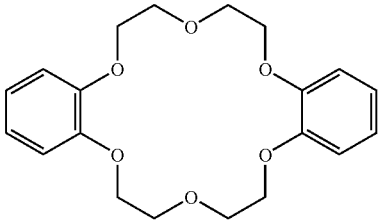
C-20
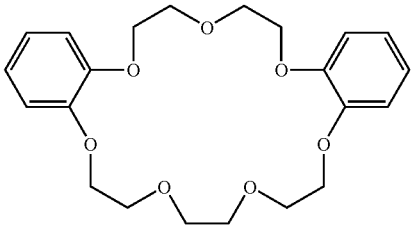
C-21
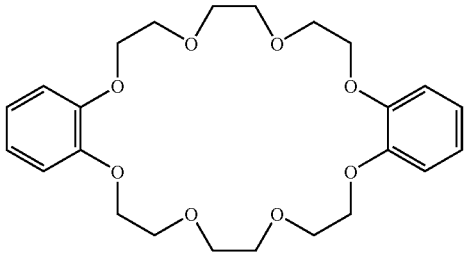
C-22
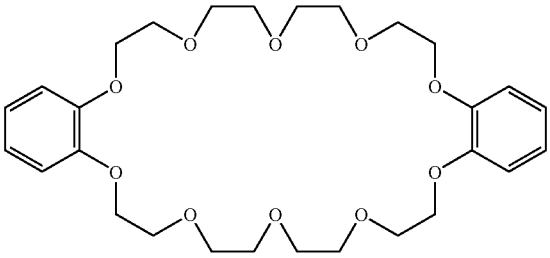
C-23
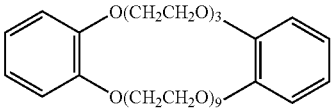
C-24
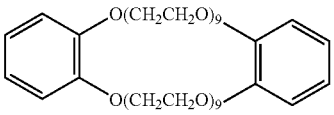

-continued
C-25
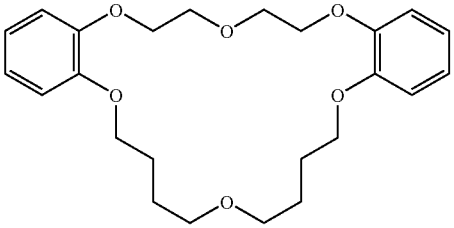
C-26
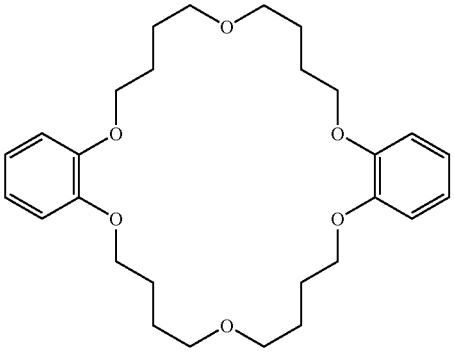
C-27
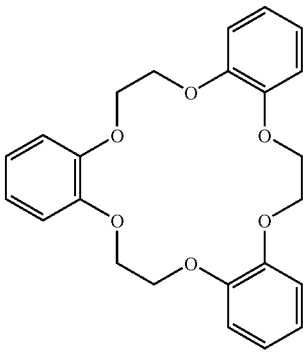
C-28
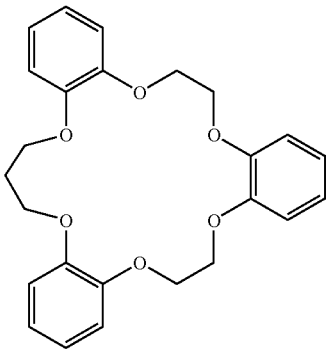
C-29
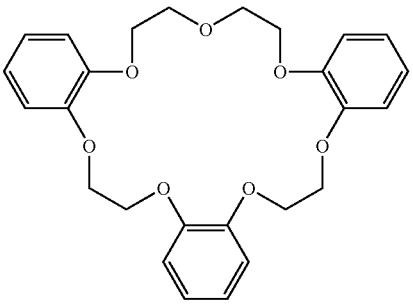
-continued
C-30
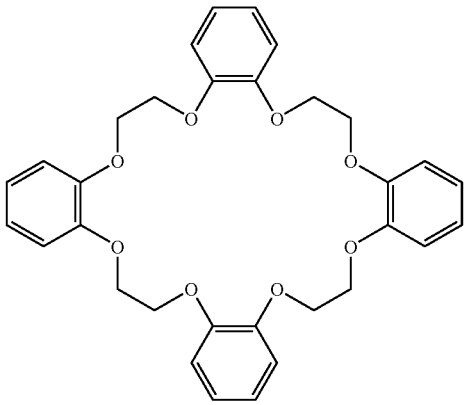
C-31
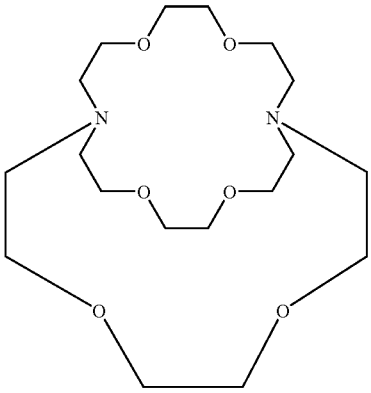
C-32
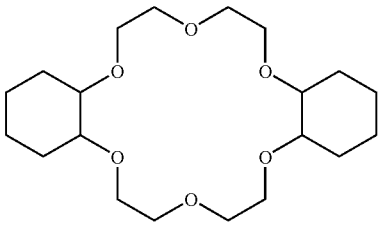
C-33
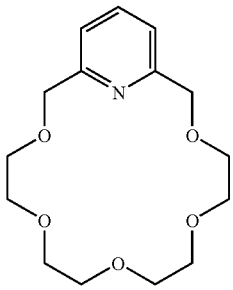
C-34
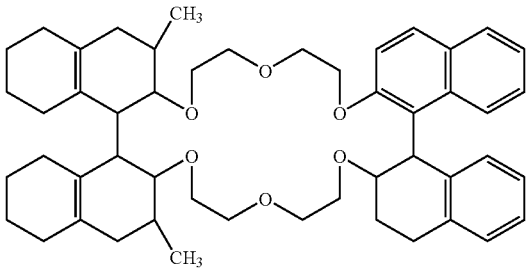

-continued

C-35

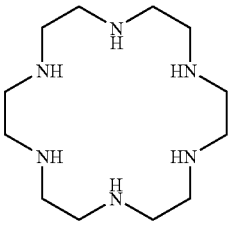

C-36

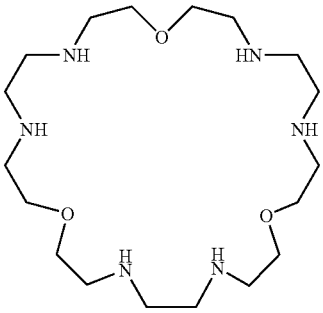

C-37

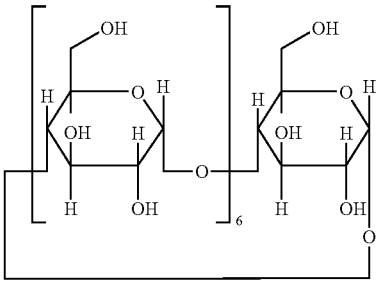

C-38

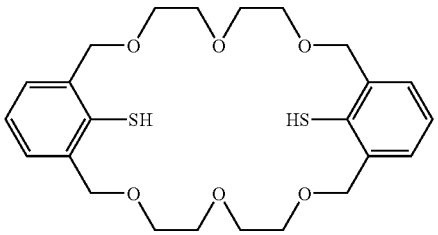

C-39

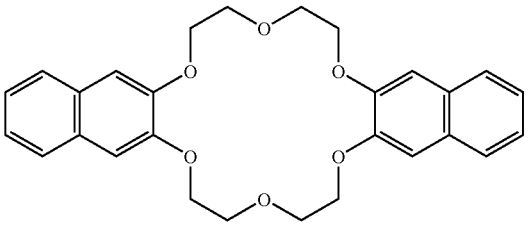

C-40

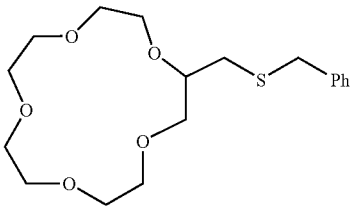

-continued

C-41

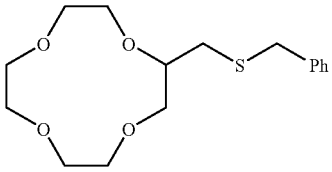

C-42

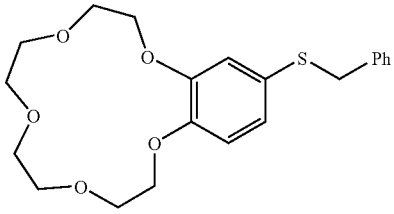

C-43

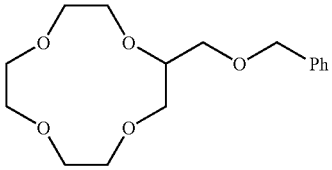

C-44

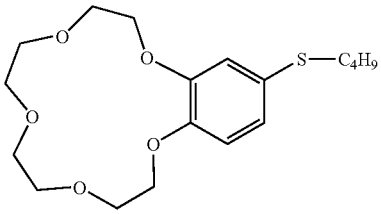

C-45

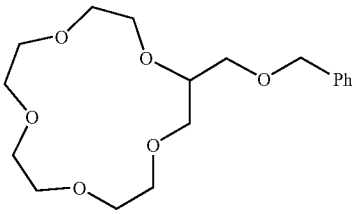

Mechanism of an effect of the combination of the compound as represented by the general formula (T) and the macrocyclic compound containing the hetero atom is not conspicuous; however, it is considered that a quantity of a sensitizing dye to be adsorbed is increased by using the macrocyclic compound whereupon light absorption of a desired wavelength is enhanced and, accordingly, an effect of supersensitization of the compound as represented by the general formula (T) is further promoted, thereby allowing a sensitization effect to be obtained.

Although an effect of these macrocyclic compounds to a conventional silver halide photosensitive material using an ordinary gelatin matrix is described in the specification of the foregoing patent, it is surprising that a same effect as in the conventional silver halide photosensitive material can also be noticed in the photothermographic material which has a substantially different constitution from that of the conventional silver halide photosensitive material.

The reason why these macrocyclic compounds particularly exhibit a great effect in the photothermographic material is not clear, but it is conceived that, since one of other silver sources (such as organic silver salt and silver complex of toner) than the silver halide is present in a layer of the photothermographic layer while it is not present in a photosensitive layer of the conventional photosensitive material, adsorption of the sensitizing dye to the silver halide is more likely to be deteriorated than in the conventional silver halide photosensitive material whereupon the macrocyclic compound containing the hetero atom acts on both the sensitizing dye and the silver halide, thereby promoting adsorption of the sensitizing dye to the silver halide.

The macrocyclic compound having the hetero atom can exert a predetermined effect by being added at any stage during a period of time from after a preparation step of the silver halide till a preparation step of a coating solution. However, it is preferable that the macrocyclic compound is added prior to an addition of the sensitizing dye.

In order to further increase the effect thereof in the photothermographic material, it is preferable that iodine is incorporated in a surface of a photosensitive silver halide. It is necessary to take an appropriate measure for strengthening adsorption more than that in an ordinary system in which gelatin is employed.

When the macrocyclic compound having the heterocycle is added to the photosensitive layer of the photothermographic material, the macrocyclic compound is first ordinarily dissolved in an organic solvent such as methanol, ethanol or a fluorinated alcohol or water and, thereafter, added thereto. In a case in which the macrocyclic compound has weak solubility against such organic solvent or water, the macrocyclic compound is dissolved by adding a resolvent such as potassium acetate, potassium iodide, potassium fluoride, potassium p-toluene sulfonate, $KBF_4$, $KPF_6$, $NH_4BF_4$ or $NH_4PF_6$ to the organic solvent or water and, then, added thereto. These resolvents are used in ion form or other appropriate states which each form an inclusion compound with the macrocyclic compound containing the hetero atom. Any type of the resolvent is permissible so long as it improves the solubility of the macrocyclic compound and takes effect after such addition. A quantity of the resolvent to be added is in the range of from $1\times10^{-4}$ mol to 1.0 mol and preferably in the range of from $1\times10^{-3}$ mol to 0.2 mol, per 1 mol of silver in each case.

1-1-7. Compounds Represented by Formula (M)

The present photothermographic material preferably contains a compound represented by the following formula (M).

Formula (M)

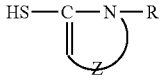

In the above formula, Z represents an atomic group forming a 5- or 6-membered aromatic heterocyclic ring. R represents a hydrogen atom, an alkyl group, an aralkyl group, an alkoxy group or an aryl group.

Z in formula (M) is a group of atoms forming a 5- or 6-membered aromatic heterocyclic ring. It is appropriate that Z contain atoms selected from carbon, oxygen, nitrogen, sulfur selenium or tellurium. In addition, Z may have at least one substituent. Two of these substituents may combine with each other to form a cyclic structure and complete a condensed ring together with the cyclic structure formed by Z. EXAMPLEs of an aromatic heterocyclic ring include an imidazole ring, a pyrazole ring, a triazole ring and a tetrazole ring. In particular, imidazole, triazole and tetrazole rings are preferred. Of these rings, an imidazole ring is the most advantageous.

R in formula (M) represents a hydrogen atom, an alkyl group, an aralkyl group, an alkoxy group or an aryl group. Each of these alkyl, aralkyl, alkoxy and aryl groups may have a group capable of substituting.

EXAMPLEs of an alkyl group as R include a methyl group, an ethyl group, a propyl group and a cyclohexyl group. EXAMPLEs of an aralkyl group as R include a benzyl group. EXAMPLEs of an alkoxy group as R include a methoxy group and an ethoxy group. EXAMPLEs of an aryl group as R include a phenyl group and a naphthyl group. EXAMPLEs of a substituent the group represented by R may have include an amino group, an amido group, a sulfonamido group (e.g., methylsulfonamido), an ureid group, an urethane group (e.g., methyl urethane and ethyl urethane) an aryloxy group (e.g., phenoxy, naphthoxy), a sulfamoyl group, a carbamoyl group (e.g., ethylcarbamoyl, phenylcarbamoyl), an aryl group (e.g., phenyl, naphthyl), an alkylthio group (e.g., methythio, hexylthio), an arylthio group (e.g., phenylthio), a hydroxyl group, a halogen atom (e.g., fluorine, chlorine, bromine, iodine), a sulfonic acid group, a carboxylic acid group, a cyano group, a carboxyl group or a carboxylate group, and a phosphonamido group and a substitutal alkyl group a amino group, an amido group, a sulfonamido group, an ureid group, an urethane group an aryloxy group, a sulfamoyl group, a carbamoyl group, an aryl grou, an alkylthio group, an arylthio group, a hydroxyl group, a halogen atom, a sulfonic acid group, a carboxylic acid group, a cyano group, a carboxyl group or a salt thereof, and a phosphonamido group. These groups each may further have a substituent. EXAMPLEs of such a substituent include the groups recited as examples of R and their substituents as recited above.

R is preferably a hydrogen atom, or a substituted or unsubstituted phenyl or alkyl group.

The suitable total number of carbon atoms contained in R is from 0 to 20. In particular, a hydrogen atom or a substituted or unsubstituted phenyl group is preferred as R.

Of the compounds represented by formula (M), 2-mercaptobenzimidazoles and 1-phenyl-5-mercaptotetrazoles are preferred over the others. In particular, 2-mercpato-6-methylbenzimidazole is advantageous.

EXAMPLEs of a compound represented by formula (M) are illustrated below, but these examples should not be construed as limiting the scope of the invention.

M-1

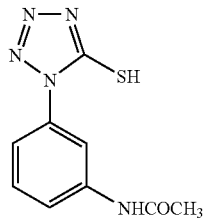

M-2

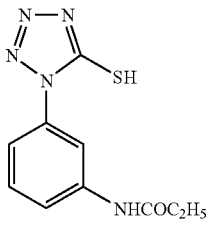

-continued
M-3
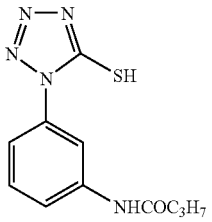
M-4
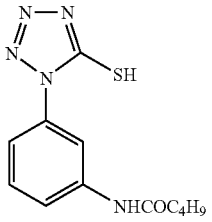
M-5
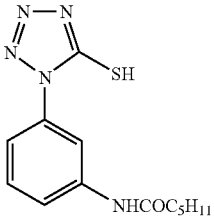
M-6
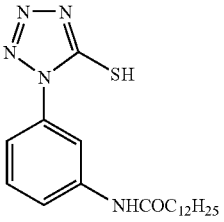
M-7
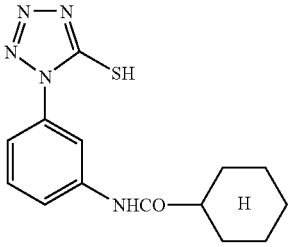
M-8
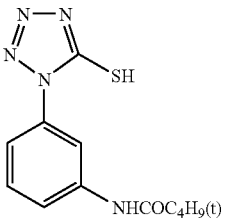
-continued
M-9
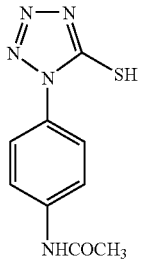
M-10
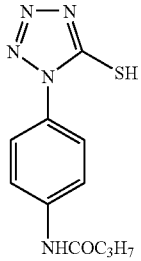
M-11
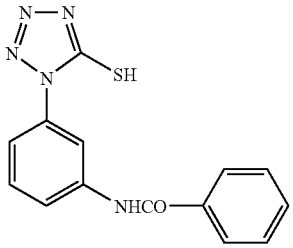
M-12
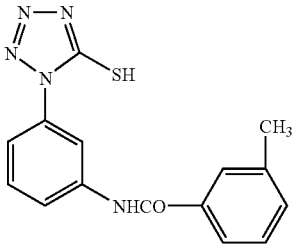
M-13
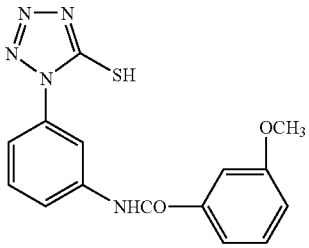
M-14
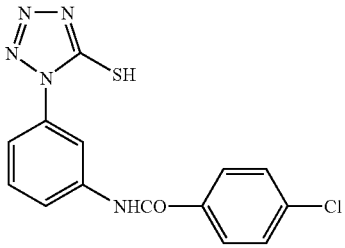

-continued
M-15
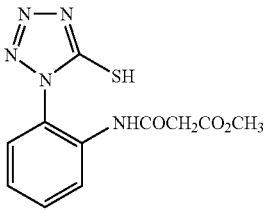
M-16
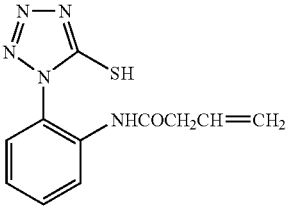
M-17
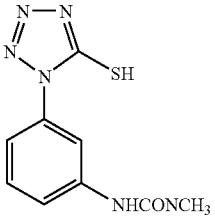
M-18
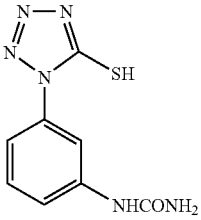
M-19
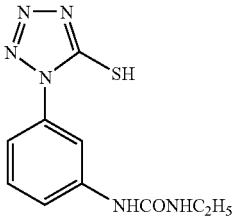
M-20
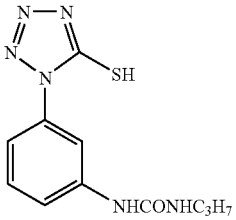
M-21
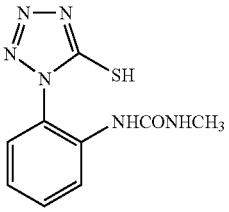
-continued
M-22
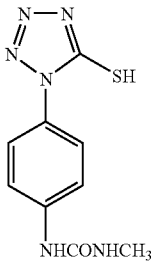
M-23
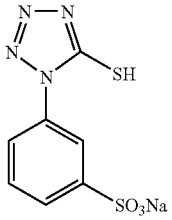
M-24
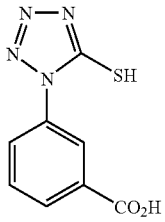
M-25
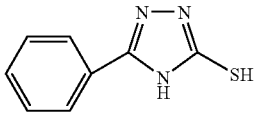
M-26
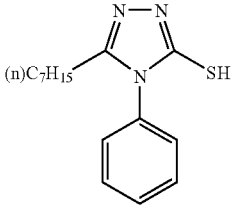
M-27
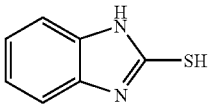
M-28
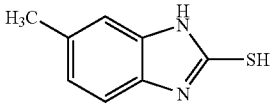
M-29
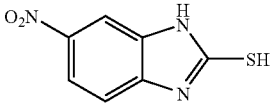
M-30
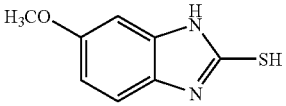

-continued
M-31
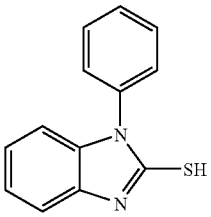
M-32
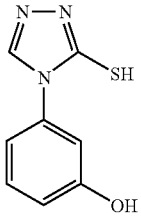
M-33
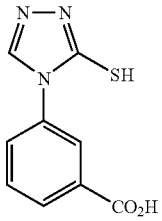
M-34
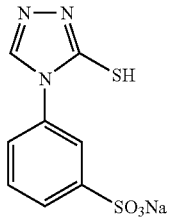
M-35
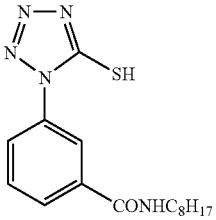
M-36
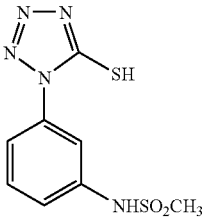
M-37
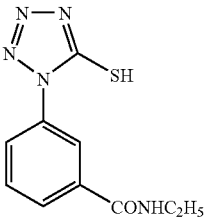
-continued
M-38
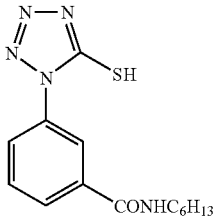
M-39
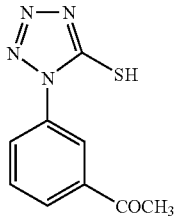
M-40
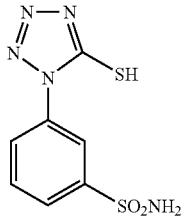
M-41
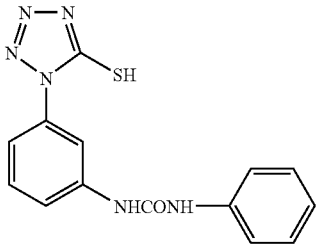
M-42
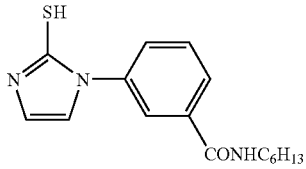
M-43
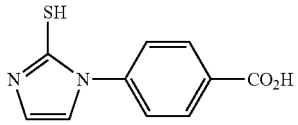
M-44
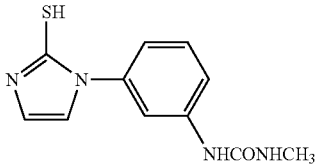
M-45
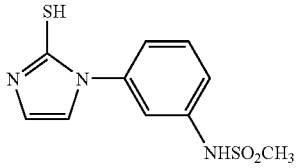

-continued
M-46
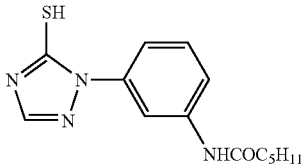
M-47
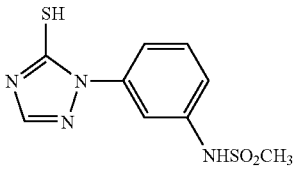
M-48
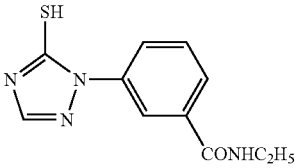
M-49
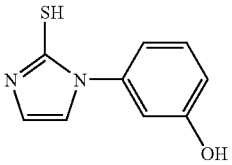
M-50
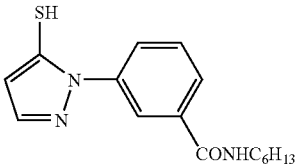
M-51
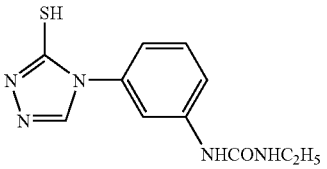
M-52
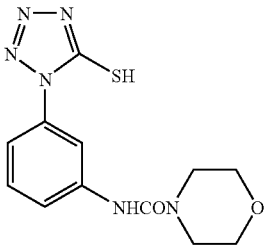
M-53
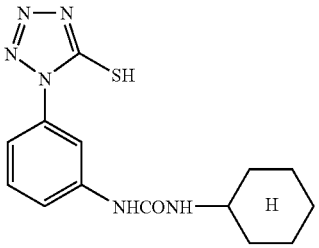
-continued
M-54
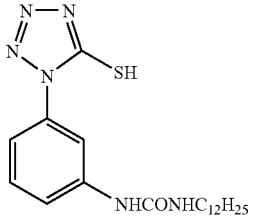
M-55
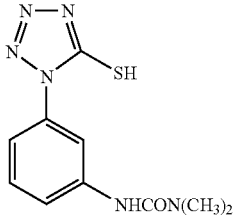
M-56
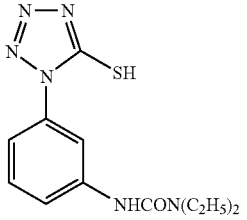
M-57
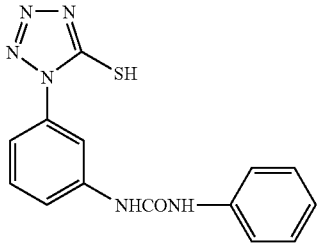
M-58
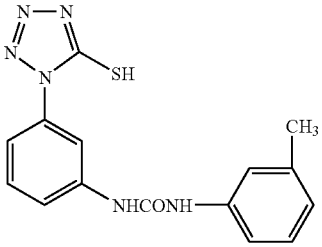
M-59
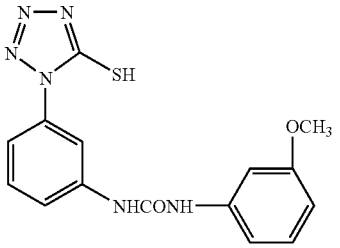

-continued

M-60

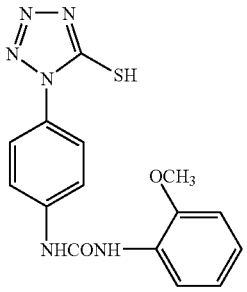

M-61

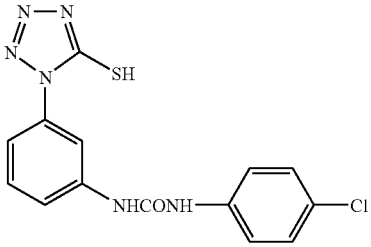

M-62

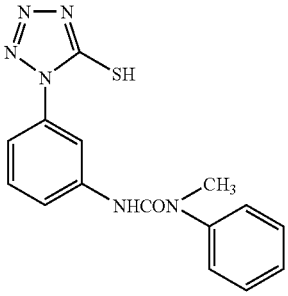

M-63

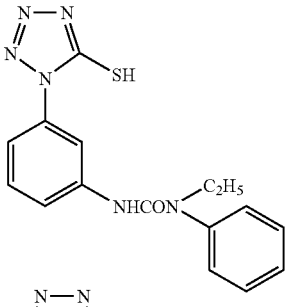

M-64

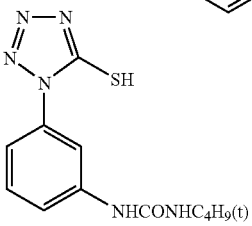

M-65

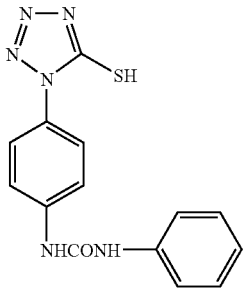

-continued

M-66

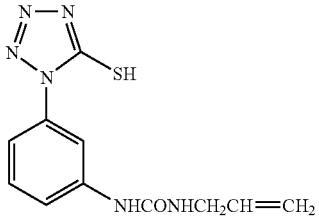

M-67

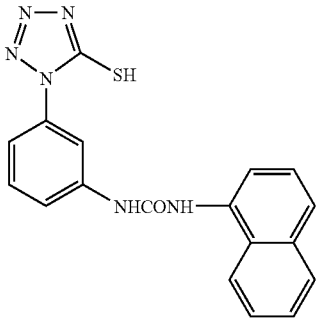

Each of the compounds represented by formula (M) can be used in a state that it is dissolved in water or an appropriate solvent, such as alcohol (e.g., methanol, ethanol, propanol, fluorinated alcohol), ketones (e.g., acetone, methyl ethyl ketone), dimethylformamide, dimethylsulfoxide or methyl cellosolve.

It is also possible to use the compounds as emulsion dispersions prepared by dissolving them in oil, such as dibutyl phthalate, tricresyl phosphate, glyceryl triacetate or diethyl phthalate, together with an auxiliary solvent, such as ethyl acetate or cyclohexanone, and then mechanically emulsifying the dissolved compounds in accordance with a well-known emulsification dispersion method. In addition, they can be used as solid dispersions prepared by dispersing their powders into water by use of a ball mill, a colloid mill or ultrasonic waves.

The compounds represented by formula (M) can be incorporated into any of layers arranged on the silver halide-containing layer side of a support, but it is preferable to incorporate them into a silver halide emulsion-containing layer or a layer adjacent thereto.

In addition, it is appropriate to add the compounds represented by formula (M) in an amount of $1\times10^{-4}$ to $5\times10^{-1}$ mole, preferably $5\times10^{-4}$ to $5\times10^{-2}$ mole, per mole of silver halide.

1-1-8. Light-insensitive Organic Silver Salt

1) Composition of Organic Silver Salt

A light-insensitive organic silver salt usable in the invention has a silver behenate content of 40 to 70 mole %. The remainder of the light-insensitive organic silver salt preferably includes silver salts of long-chain aliphatic carboxylic acids containing 10 to 30, especially 15 to 28, carbon atoms. These organic silver salts are comparatively stable to light but form silver images when they are heated up to 80° C. or higher in the presence of exposed light-sensitive silver halide and a reducing agent. The organic silver salts may be any of organic substances capable of providing reducible silver ions. Such light-insensitive organic silver salts are described in JP-A No.10-62899, par. Nos. 0048-0049, EP-A1 No.0803764, p. 18, line 24, to p. 19, line 37, EP-A1 No. 0962812, and JP-A Nos.11-349591, 2000-7683 and 2000-

72711. Silver salts of organic acids, especially silver salts of long-chain aliphatic carboxylic acids (containing 10 to 30, preferably 15 to 28 carbon atoms), are used to advantage. Suitable examples of organic silver salts include silver behenate, silver arachidate, silver stearate, silver oleate, silver laurate, silver caproate, silver myristate, silver palmitate, and mixtures of two or more of these salts.

The shape of such an organic silver salt is not particularly restricted, but it is preferably an acicular shape having a minor axis and a major axis. In the field of silver halide photographic light-sensitive materials, it is well known that the grain size of silver salt crystals and the covering power thereof are in inverse proportion. This relation is also held in the present photothermographic material, and suggests that the greater the organic silver salt grains as the image-forming component of the photothermographic material, the lower the covering power and the lower the image density. Therefore, it is preferable to reduce the size of the organic silver salt grains. More specifically, the suitable lengths of minor and major axes for the invention are from 0.01 to 0.15 μm and from 0.10 to 5.0 μm, respectively. And it is preferable that the lengths of minor and major axes be from 0.01 to 0.15 μm and 0.10 to 4.0 μm, respectively.

In the invention, it is appropriate that the organic silver salt grains have a monodisperse size distribution. The term "monodisperse" as used herein means that the values obtained by dividing standard deviations of the lengths of minor and major axes by average lengths of minor and major axes, respectively, and expressed in percentage are preferably 100% or below, far preferably 80% or below, particularly prefeably 50% or below.

The shape of an organic silver salt can be determined from transmission electron microscope images of a dispersion of the organic silver salt. As another method for determining the monodisperse degree, there is the method of determining the standard deviation concerning a volume weighted average diameter. In this case, the value obtained by dividing the standard deviation concerning a volume weighted average diameter by the volume weighted average diameter (variation coefficient) is, on a percentage basis, preferably 100% or below, far preferably 80% or below, particularly preferably 50% or below. For determination of such a value, a commercially available laser-beam scattering grain size analyzer can be used.

2) Method of Preparing Organic Silver Salt and Method of Mixing with Light-sensitive Silver Halide It is preferred in particular that the present silver halide grains are formed in the absence of light-insensitive organic silver salts and then subjected to chemical sensitization. This is because there are cases where sufficient sensitivity cannot be attained with a method of forming silver halide by adding a halogenation agent to an organic silver salt, or the so-called conversion method.

Organic silver salts are prepared by adding alkali metal salts (e.g., sodium hydroxide, potassium hydroxide) to organic acids to convert at least a part of the organic acids into alkali metal soap of the organic acids, and then by adding thereto a water-soluble silver salt (e.g., silver nitrate). Light-sensitive silver halides may be added at any stage in the process of preparing the organic silver salts. As main mixing processes, there are (A) a process in which silver halides are added to organic acids in advance, admixed with alkali metal salts, and then admixed with a water-soluble silver salt; (B) a process in which alkali metal soap prepared from organic acids is mixed with silver halides, and thereto a water-soluble silver salt is added; (C) a process in which alkali metal soap is prepared from organic acids, a part thereof is converted into the silver salt, and then silver halides are added thereto, and further the remaining part is converted into the silver salt; and (D) a process in which organic silver salts are formed, and then mixed with silver halides. Of these processes, (B) and (C) are preferred over the others.

In all of those processes, the salt formation is carried out in a water solvent, followed by dewatering and drying steps. Thereafter, the salts formed are dispersed again into a solvent, such as MEK. Therein, it is appropriate that the drying step be carried out using an airflow-type flash jet dryer under a condition that the partial pressure of oxygen is controlled to 15 volume % or below, preferably from 15 volume % to 0.01 volume %, far preferably from 10 volume % to 0.01 volume %.

The organic silver salts can be used in desired amounts, but the suitable amount for using them is from 0.1 to 5 g/m$^2$, preferably from 1 to 3 g/m$^2$, on a silver coverage basis.

1-1-9. Reducing Agent

The present photothermographic material contains a reducing agent for organic silver salts. Any of substances capable of reducing silver ion, preferably organic substances having such capabilities, can be used as the reducing agent. Although reducing agents used in usual photographic development, such as phenidone, hydroquinone and catechol, are also effective, the hindered phenols represented by the following formula (R) are used to advantage in the invention. These compounds are illustrated below in detail.

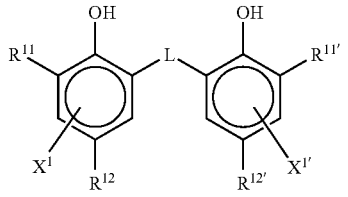

In formula (R), $R^{11}$ and $R^{11'}$ each represent a 1–20C alkyl group independently. $R^{12}$ and $R^{12'}$ independently represent a hydrogen atom or a group capable of substituting for a hydrogen on a benzene ring. L represents a linkage group —S— or —CHR$^{13}$—. $R^{13}$ represents a hydrogen atom or a 1–20C alkyl group. $X^1$ and $X^{1'}$ independently represent a hydrogen atom or a group capable of substituting for a hydrogen atom on a benzene ring.

Each of those substituents are illustrated below in detail.

1) $R^{11}$ and $R^{11'}$ $R^{11}$ and $R^{11'}$ are each independently a substituted or unsubstituted alkyl group containing 1 to 20 carbon atoms. The alkyl group is not particularly restricted as to its substituents, but it can preferably have as its substituent(s) an aryl group, a hydroxyl group, an alkoxy group, an aryloxy group, an alkylthio group, an arylthio group, an acylamino group, a sulfonamido group, a sulfonyl group, a phosphoryl group, an acyl group, a carbamoyl group, an ester group or/and a halogen atom.

2) $R^{12}$ and $R^{12'}$, $X^1$ and $X^{1'}$ $R^{12}$ and $R^{12'}$ each represent a hydrogen atom or a group capable of substituting for a hydrogen on a benzene ring independently.

$X^1$ and $X^{1'}$ also independently represent a hydrogen atom or a group capable of substituting for a hydrogen atom on a benzene ring.

Suitable examples of groups capable of substituting for hydrogen atoms on the benzene rings respectively include an alkyl group, an aryl group, a halogen atom, an alkoxy group and an acylamino group.

3) L

L represents a linkage group —S— or —$CHR^{13}$—. $R_{13}$ represents a hydrogen atom or an alkyl group containing 1 to 20 carbon atoms. The alkyl group may have a substituent or substituents.

EXAMPLEs of an unsubstituted alkyl group represented by $R^{13}$ include a methyl group, an ethyl group, a propyl group, a butyl group, a heptyl group, an undecyl group, an isopropyl group, a 1-ethylpentyl group and 2,4,4,-trimethylpentyl group.

The substituent(s) the alkyl group can have are the same as in the case of $R^{11}$, and examples thereof include a halogen atom, an alkoxy group, an alkylthio group, an aryloxy group, an arylthio group, an acylamino group, a sulfonamido group, a sulfonyl group, a phosphoryl group, an oxycarbonyl group, a carbamoyl group and a sulfamoyl group.

4) Preferred Substituents

The substituents preferred as $R^{11}$ and $R^{11'}$ are secondary or tertiary alkyl groups containing 3 to 15 carbon atoms, with examples including an isopropyl group, an isobutyl group, a t-butyl group, a t-amyl group, a t-octyl group, a cyclohexyl group, a cyclopentyl group, a 1-methylcyclohexyl group and a 1-methylcyclopropyl group. Of these groups, tertiary alkyl groups containing 4 to 12 carbon atoms, especially a t-butyl group, a t-amyl group and a 1-methylcyclohexyl group, are preferred over the others. In particular, a t-butyl group is advantageous over the others.

The substituents preferred as $R^{12}$ and $R^{12'}$ are alkyl groups containing 1 to 20 carbon atoms, with examples including a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group and a methoxyethyl group. Of these groups, a methyl group, an ethyl group, a propyl group, an isopropyl group and a t-butyl group are preferred over the others.

The substituents preferred as $X^1$ and $X^{1'}$ include a hydrogen atom, a halogen atom and an alkyl group. In particular, it is advantageous that both $X^1$ and $X^{1'}$ are hydrogen atoms.

L is preferably a linkage group —$CHR^{13}$—.

$R^{13}$ is preferably a hydrogen atom or an alkyl group containing 1 to 15 carbon atoms. Suitable examples of such an alkyl group include a methyl group, an ethyl group, a propyl group, an isopropyl group and a 2,4,4-trimethylpentyl group. In particular, a hydrogen atom, a methyl group, a propyl group and an isopropyl group are preferred as $R^{13}$.

When $R^{13}$ is a hydrogen atom, $R^{12}$ and $R^{12'}$ are preferably alkyl groups containing 2 to 5 carbon atoms, far preferably ethyl and propyl groups, particularly preferably ethyl groups.

When $R^{13}$ is a primary or secondary alkyl group containing 1 to 8 carbon atoms, $R^{12}$ and $R^{12'}$ are preferably methyl groups. EXAMPLEs of a primary or secondary 1–8C alkyl group suitable for $R^{13}$ include a methyl group, an ethyl group, a propyl group and an isopropyl group. Of these groups, methyl, ethyl and propyl groups are preferred as $R^{13}$.

When all of $R^{11}$, $R^{11'}$, $R^{12}$ and $R^{12'}$ are methyl groups, $R^{13}$ is preferably a secondary alkyl group. In this case, the secondary alkyl group of $R^{13}$ is preferably an isopropyl group, an isobutyl group or a 1-ethylpentyl group, and far preferably an isopropyl group.

Heat developing capabilities of the reducing agents represented by formula (R) vary with combinations of $R^{11}$, $R^{11'}$, $R^{12}$, $R^{12'}$ and $R^{13}$. As the heat developing capability can be adjusted by using in combination with two or more of the reducing agents in various mixing ratios, the combined use of at least two reducing agents may be preferable depending on the intended purpose.

EXAMPLEs of a compound represented by formula (R) according to the invention are illustrated below, but these examples should not be interpreted as limiting the scope of the invention.

(I-1)

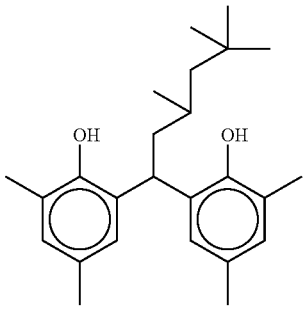

(I-2)

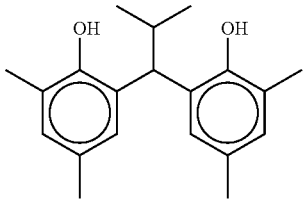

(I-3)

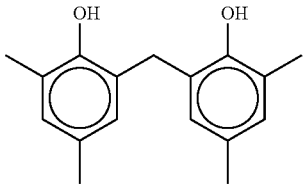

(I-4)

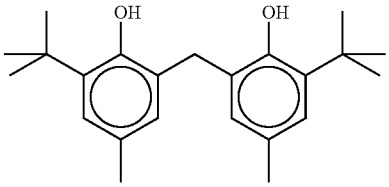

(I-5)

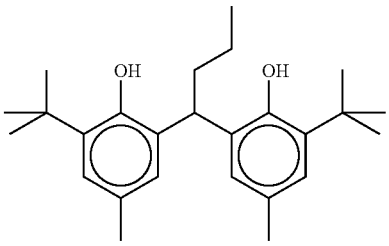

(I-6)

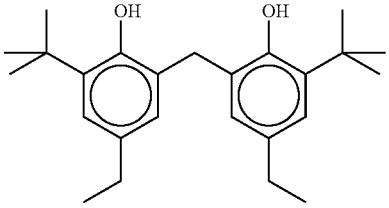

-continued
(I-7)
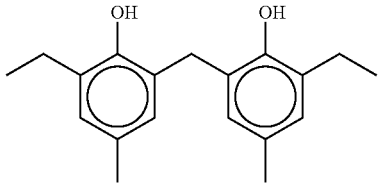
(I-8)
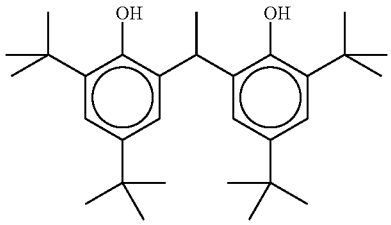
(I-9)
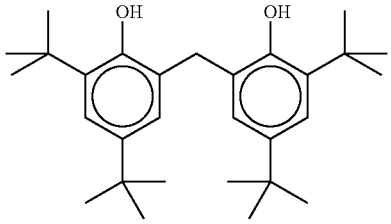
(I-10)
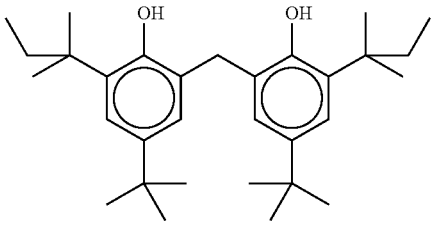
(I-11)
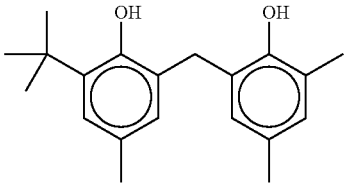
(I-12)
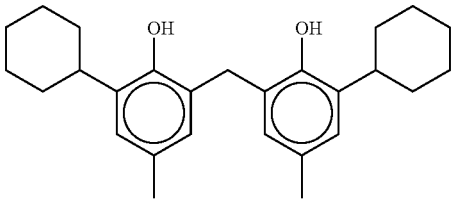
(I-13)
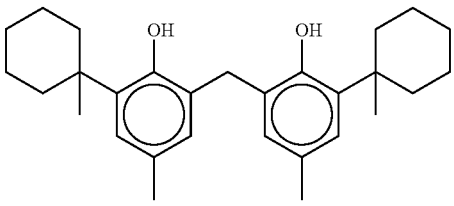
-continued
(I-14)
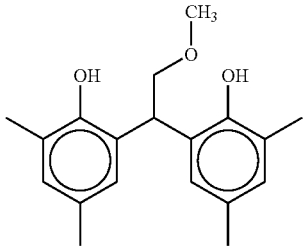
(I-15)
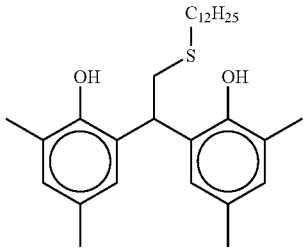
(I-16)
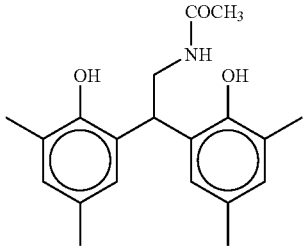
(I-17)
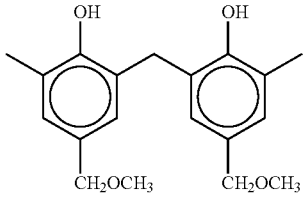
(I-18)
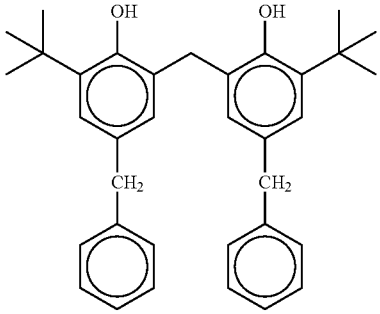
(I-19)
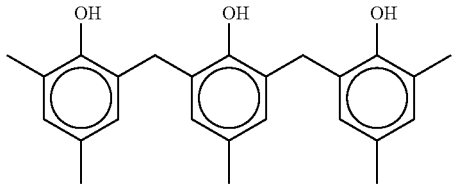

-continued (I-20)

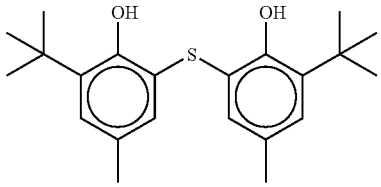

The suitable amount of reducing agent(s) added in the invention is from 0.01 to 5.0 g/m$^2$, preferably from 0.1 to 3.0 g/m$^2$. And it is appropriate that the reducing agent be contained in a proportion of 5 to 50 mole %, preferably 10 to 40 mole %, to one mole of silver on the side of the image-forming layer.

Although the present reducing agent(s) can be added to an image-forming layer containing organic silver salts and light-sensitive silver halide or the layers adjacent thereto, it is preferable to add them to the image-forming layer. The present reducing agents can be added to a coating composition in any manner. For instance, they may be added in the form of a solution, an emulsion dispersion or a dispersion of fine solid particles.

1-1-10. Toner

It is preferable to add a toner to the present photothermographic material. Descriptions of a toner can be found in JP-A No.10-62899, par. Nos.0054-0055, EP-A1 No.0803764, p. 21, lines 23–48, JP-A No.2000-356317, and Japanese Patent Application No.2000-187298. EXAMPLEs of a toner preferred in particular include phthalazinones (including phthalazinone and phthalazinone derivatives or metal salts thereof, such as 4-(1-naphthyl)phthalazinone, 6-chlorophthalazinone, 5,7-dimethoxyphthalazinone and 2,3-dihydro-1,4-phthalazinedione); combinations of phthalazinones and phthalic acids (such as phthalic acid, 4-methylphthalic acid, 4-nitrophthalic acid, diammonium phthalate, sodium phthalate, potassium phthalate and tetrachlorophthalic anhydride); and phthalazines (including phthalazine and phthalazine derivatives or metal salts thereof, such as 4-(1-naphthyl)phthalazine, 6-isopropylphthalazine, 6-t-butylphthalazine, 6-chlorophthalazine, 5,7-dimethoxyphthalazine and 2,3-dihydrophthalazine). In the case of combining toners with silver halides having high iodide contents, combinations of phthalazines and phthalic acids are used to particular advantage.

The suitable amount of toners added is from 0.1 to 50 mole %, preferably from 0.5 to 20 mole %, to one mole of silver in the image-forming layer.

1-1-11. Binder

Binders used in the invention can be selected arbitrarily from natural or synthetic resins, such as gelatin, polyvinyl alcohol, polyvinyl acetal, polyvinyl chloride, polyvinyl acetate, cellulose acetate, polyolefin, polyester, polystyrene, polyacrylonitrile, polycarbonate, polyvinyl butyral, butyl ethyl cellulose, methacrylate copolymers, maleic anhydride ester copolymers, polystyrene, and butadine-styrene copolymers.

In particular, it is preferable to contain polyvinyl butyral in the binder used in the present image-forming layer. More specifically, the proportion of polyvinyl butyral to the total binder components in the image-forming layer is adjusted to at least 50% by weight. As a matter of course, the polyvinyl butyral usable in the image-forming layer includes copolymers and terpolymers of vinyl butyral. The suitable total amount of polyvinyl butyrals is from 50 to 100 weight %, preferably from 70 to 100 weight %, of the total binder components in the photosensitive layer. The suitable Tg of the binder is from 40 to 90° C., preferably from 50 to 80° C. Tg used herein stands for a glass transition temperature.

The total amount of binders used in the image-forming layer is an amount sufficient for holding all the components of the image-forming layer inside the image-forming layer. In other words, the binders are used in an amount range that they can function effectively. The effective amount range can be determined properly by persons skilled in the arts. As a guide in the case of holding at least organic silver salts, the suitable ratio of binders to organic silver salts is from 15:1 to 1:3, particularly preferably from 8:1 to 1:2, by weight.

1-1-12. Other Antifoggants

Examples of antifoggants and stabilizers or precursors thereof suitable for independent use or combined use with the present halogeno-compounds represented by formula (PO) include the thiazolium salts disclosed in U.S. Pat. Nos. 2,131,038 and 2,694,716, the azaindenes disclosed in U.S. Pat. Nos. 2,886,487 and 2,444,605, the compounds disclosed in JP-A No.9-329865 and U.S. Pat. No. 6,083,681, the mercury salts disclosed in U.S. Pat. No. 2,728,663, the urazoles disclosed in U.S. Pat. No. 3,287,135, the sulfocatechols disclosed in U.S. Pat. No. 3,235,652, the oximes, the nitrones and nitroindazoles disclosed in GBP No.623,448, the polyvalent metal salts disclosed in U.S. Pat. No. 2,839,405, the thiuronium salts disclosed in U.S. Pat. No. 3,220,839, the palladium, platinum and gold salts disclosed in U.S. Pat. Nos. 2,566,263 and 2,597,915, the halogen-substituted organic compounds disclosed in U.S. Pat. Nos. 4,108,665 and 4,442,202, the triazines disclosed in U.S. Pat. Nos. 4,128,557, 4,137,079, 4,138,365 and 4,459,350, and the phosphorus compounds disclosed in U.S. Pat. No. 4,411,985.

The present photothermographic material may contain azolium salts for the purpose of fog prevention. EXAMPLEs of an azolium salt usable for such a purpose include the compounds represented by formula (XI) in JP-A No.59-193447, the compounds disclosed in JP-B No.55-12581, and the compounds represented by formula (II) in JP-A No.60-153039. Although the azolium salts may be added to any part of the photothermographic material, it is preferable to add them to a layer arranged on the photosensitive layer side, especially to the layer containing organic silver salts.

As to the addition time of azolium salts, the salts may be added at any stage in the process of preparing a coating composition. In the case of adding azolium salts to the organic silver salt-containing layer, the azolium salts may be added at any stage during a period from the preparation of the organic silver salts to the preparation of the coating composition. However, it is preferable that the azolium salts be added during the period from the conclusion of the preparation of organic silver salts to the instant preceding the coating operation. The azolium salts may be added according to any method. For instance, a method of adding them in the form of a powder, a solution or a dispersion of fine particles can be adopted. On the other hand, a mixture may be prepared from the azolium salts and other additives, such as a sensitizing dye, a reducing agent and a toning agent, and added as a solution thereof.

In the invention, the azolium salts may be added in any amount, but it is appropriate to add them in an amount of $1\times10^{-6}$ mole to 2 moles, preferably $1\times10^{-3}$ mole to 0.5 mole, per mole of silver.

In the present photothermographic material, other organic halogeno-compounds may be used together with the halogeno-compounds containing heterocyclic groups as their mother nuclei. EXAMPLEs of such compounds include the compounds disclosed in JP-A Nos.50-119624, 50-120328, 51-121332, 54-58022, 56-70543, 56-99335, 59-90842, 61-129642, 62-129845, 6-208191, 7-5621, 7-2781, 8-15809, 9-160167, 9-244177, 9-2244178, 9-258367, 9-265150, 9-319022, 10-171063, 11-212211, 11-231460 and 11-242304, and U.S. Pat. Nos. 5,340,712, 5,369,000 and 5,464,737.

In some cases, it is advantageous that the present photothermographic material contains in its photosensitive layer a mercury(II) salt as an antifoggant. The mercury(II) salts appropriate for this purpose are mercury(II) acetate and mercury(II) bromide. The suitable amount of mercury used in the invention is in the range of 1 nanomole to 1 millimole, preferably 10 nanomoles to 100 micromoles, per mole of coated silver.

1-1-13. Benzoic Acids

The present photothermographic material may contain benzoic acids for the purposes of sensitivity increase and fog prevention. The benzoic acids used for these purposes may include any of benzoic acid derivatives. EXAMPLEs of a benzoic acid derivative having a favorable structure include the compounds disclosed in U.S. Pat. Nos. 4,784,939 and 4,152,160, and JP-A Nos.9-281687, 9-329864 and 9-329865. The benzoic acids used in the invention may be added to any part of the photothermographic material, but it is preferable to add them to a layer arranged on the photosensitive layer side, particularly to the organic silver salt-containing layer. As to the addition time of benzoic acids, the acids may be added at any stage in the process of preparing a coating composition. In the case of adding benzoic acids to the organic silver salt-containing layer, the benzoic acids may be added at any stage during a period from the preparation of the organic silver salts to the preparation of the coating composition. However, it is preferable that the benzoic acids be added during the period from the conclusion of the preparation of organic silver salts to the instant preceding the coating operation. The benzoic acids may be added according to any method. For instance, a method of adding them in the form of a powder, a solution or a dispersion of fine particles can be adopted. On the other hand, a mixture may be prepared from the benzoic acids and other additives, such as a sensitizing dye, a reducing agent and a toning agent, and added as a solution thereof.

In the invention, the benzoic acids may be added in any amount, but it is appropriate to add them in an amount of 1 micromole to 2 moles, preferably 1 millimole to 0.5 mole, per mole of silver.

1-1-14. Mercapto, Thione and Disulfide Compounds

In the invention, mercapto compounds, thione compounds and disulfide compounds can be used for the purposes of retarding or accelerating development to control the development, enhancing the efficiency of spectral sensitization and improving keeping qualities before and after development. Of such compounds, the compounds represented by Ar-SM or Ar-S—S-Ar are preferred. In formulae, Ar is an aromatic or condensed aromatic ring containing at least one nitrogen, sulfur, oxygen, selenium or tellurium atom. Suitable examples of such rings include benzimidazole, naphthimidazole, benzothiazole, naphthothiazole, benzoxazole, naphthoxazole, benzoselenazole, benzotellurazole, imidazole, oxazole, pyrazole, triazole, thiadiazole, tetrazole, triazine, pyrimidine, pyridazine, pyrazine, pyridine, purine, quinoline and quinazoline. Of these rings, benzimidazole, benzothiazole and benzotellurazole are preferred over the others.

Those aromatic rings may have substituents. Suitable examples of such substituents include halogen atoms (e.g., Br, Cl), a hydroxyl group, an amino group, a carboxyl group, alkyl groups (e.g., those containing 1 to 4 carbon atoms), alkoxy groups (e.g., those containing 1 to 4 carbon atoms) and aryl groups (which may be substituted).

The suitable amount of those compounds added is in the range of 0.001 to 1 mole, preferably 0.003 to 0.1 mole, per mole of silver in the image-forming layer.

1-1-15. Other Additives

1) Plasticizer and Lubricant

The plasticizers and the lubricants disclosed in JP-A No.11-65021, par. No. 0117, can be used in the present photothermographic material also. As to the slip additive, those disclosed in JP-A No.11-84573, par. Nos.0061-0064, and Japanese Patent Application No.11-106881, par. Nos.0049-0062, are usable in the invention also.

2) Development Accelerator

Development accelerators which can be used appropriately in the present photothermographic material include the sulfonamidophenol compounds represented by formula (A) in JP-A Nos.2000-267222 and 2000-330234, the hindered phenol compounds represented by formula (II) in JP-A No.2001-92075, the hydrazine compounds represented by formula (I) in JP-A Nos.10-62895 and 11-15116 or by formula (1) in Japanese Patent Application No.2001-074278, and the phenol or naphthol compounds represented by formula (2) in Japanese Patent Application No.2000-76240. These development accelerators are used in a proportion of 0.1 to 20 mole %, preferably 0.5 to 10 mole %, far preferably 1 to 5 mole %, to the reducing agent used. The development accelerators can be introduced into the photothermographic material in the same way as in the case of the reducing agent, but it is preferred in particular to add them in the form of a solid dispersion or an emulsion dispersion. In the case of adding the development accelerators as an emulsion dispersion, the emulsion dispersion is preferably an emulsion dispersion prepared with the aid of both a high-boiling solvent in a solid state at room temperature and a low-boiling auxiliary solvent, or the so-called oil-less emulsion dispersion prepared without using any high-boiling solvent.

Of the development accelerators recited above, the hydrazine compounds represented by formula (1) in Japanese Patent Application No.2001-074278 and the phenol or naphthol compounds represented by formula (2) in Japanese Patent Application No.2000-76240 are used to particular advantage in the invention.

3) Hydrogen Bonding Compound

Non-reducing compounds having groups capable of forming hydrogen bonds together with hydroxyl (—OH) groups on the aromatic rings of reducing agents can also be used in the invention.

Examples of a group forming a hydrogen bond together with the hydroxyl group include a phosphoryl group, a sulfoxide group, a sulfonyl group, a carbonyl group, an amido group, an ester group, an urethane group, an ureido group, a tertiary amino group and a nitrogen-containing aromatic group.

Of the compounds having these groups, compounds respectively having a phosphoryl group, a sulfonamido group, an amido group (not having >N—H moiety but being blocked in the form of >N—Ra, wherein Ra is a substituent other than H), an urethane group (not having >N—H moiety but being blocked in the form of >N—Ra, wherein Ra is a substituent other than H) and an ureido group (not having >N—H moiety but being blocked in the form of >N—Ra, wherein Ra is a substituent other than H) are preferred over the others.

Examples of such hydrogen bonding compounds include the compounds disclosed in Japanese Patent Application Nos.2000-192191 and 000-194811.

4) Dyes and Pigments

In the present image-forming layer, various kinds of dyes and pigments can be used from the viewpoints of tone improvement, prevention of interference pattern formation upon exposure to laser beam and neutralization of irradiation.

It is appropriate that the image-forming layer have light absorption of 0.1 to 0.6, preferably 0.2 to 0.5, at the wavelengths of exposure light. When the light absorption is great, the Dmin becomes high and the images obtained are discernible. On the other hand, the small light absorption impairs the sharpness in some cases. In imparting light absorption to the light-sensitive silver halide layer in the invention, although any method may be adopted, the use of dyes is preferred. The dyes used therein may be any dyes as far as they can satisfy the aforementioned absorption requirement. Specifically, pyrazoloazole dyes, anthraquinone dyes, azo dyes, azomethine dyes, oxonol dyes, carbocyanine dyes, styryl dyes, triphenylmethane dyes, indoaniline dyes, indophenol dyes and squarylium dyes are usable for the foregoing purpose.

Examples of dyes used appropriately in the invention include anthraquinone dyes (e.g., Compounds 1 to 9 disclosed in JP-A No.5-341441, Compounds 3-6 to 3-18 and 8-23 to 8-38 disclosed in JP-A No.5-165147), azomethine dyes (e.g., Compounds 17 to 47 disclosed in JP-A No.5-341441), indoaniline dyes (e.g., Compounds 11 to 19 disclosed in JP-A No.5-289227, Compound 47 disclosed in JP-A No.5-341441, and Compounds 2-10 and 2-11 disclosed in JP-A No.5-165147), azo dyes (e.g., Compounds 10 to 16 disclosed in JP-A No.341441) and squarylium dyes (e.g., Compounds 1 to 20 disclosed in JP-A No.10-104779, and Compound 1a to 3d disclosed in U.S. Pat. No. 5,380,630). These dyes may be added in any manner. Specifically, they may be added in the form of a solution, an emulsion or a dispersion of solid fine particles, or in a state of being treated with a polymeric mordant. The suitable amount of these dyes used, though determinable by the desired quantity of the light absorbed, is generally in the range of 1 $\mu g/m^2$ to 1 $g/m^2$.

Further, the light-absorbing substances as disclosed in U.S. Pat. Nos. 3,253,921, 2,274,782, 2,527,583 and 2,956,879 can be included as filter dyes in a surface protective layer. In addition, the dyes can be mordanted as described in U.S. Pat. No. 3,282,699. It is appropriate that the filter dyes be used in an amount to provide an absorbance of 0.1 to 3, particularly preferably 0.2 to 1.5, at the exposure wavelengths.

In the present photothermographic material, it is appropriate that the light absorption by any part other than the layer containing light-sensitive silver halide grains be from 0.1 to 3.0 at the exposure wavelengths, preferably from 0.3 to 2.0 in respect of anti-halation. The part having absorption at the exposure wavelengths is preferably a layer arranged on the side of the support opposing to the layer containing light-sensitive silver halide grains (e.g., a backing layer, an undercoating or subbing layer on the back of the support, a protective layer for a backing layer), or a layer between the support and the layer containing light-sensitive silver halide grains (e.g., an undercoating or subbing layer).

Additionally, the present light-sensitive silver halide grains are spectrally sensitized in the infrared region. In causing the part other than the layer containing light-sensitive silver halide grains to have absorption, any method may be adopted. Therein, however, it is preferable to control the absorption maximum in the visible region to 0.3 or below. The dyes used therefor can be dyes similar to those used for causing the light-sensitive silver halide layer to have absorption, or they may be the same as or different from the dyes used in the light-sensitive silver halide layer.

5) Ultra-high Contrast Promoting Agent

For forming ultra-high contrast images suitable for graphic arts, it is appropriate to add an ultra-high contrast promoting agent to the image-forming layer. Descriptions of ultra-high contrast promoting agents usable in the invention, methods for adding them and their addition amounts can be found in ibid., par. No. 0118, JP-A No.11-223898, par. Nos. 0136-0193, Japanese Patent Application No.11-87297, the compounds of formulae (H), (1) to (3), (A) and (B), and Japanese Patent Application No.11-91652, the compounds of formulae (III) to (IV) (concrete compounds: Ka-21 to Ka-24). And high-contrast promoting accelerators are described in JP-A No.11-65021, par. No. 0102, and JP-A No.11-223898, par. Nos. 0194 and 0195.

When the ultra-high contrast promoting agents are used in the present photothermographic material, it is preferable to use them in combination with acids produced by hydrating diphosphorus pentoxide or salts thereof examples of acids produced by hydrating diphosphorus pentoxide and salts thereof include metaphosphoric acid and salts thereof, pyrophosphoric acid and salts thereof, orthophosphoric acid and salts thereof, triphosphoric acid and salts thereof, tetraphosphoric acid and salts thereof, and hexametaphosphoric acid and salts thereof.

For utilizing formic acid or its salt as a strong fogging substance, it is appropriate to introduce formic acid or its salt in an amount of 5 millimoles or below, preferably 1 millimole or below, per mole of silver to the same side as the image-forming layer containing light-sensitive silver halide.

1-2. Layer Structure

The present photothermographic material can have light-insensitive layers in addition to the image-forming layer. The light-insensitive layers can be classified by their locations under the following four groups: (a) surface protective layers provided on the image-forming layer (on the side distant from the support), (b) interlayers provided between a plurality of image-forming layers and between an image-forming layer and the protective layer, (c) subbing layers provided between an image-forming layer and the support, and (d) backing layers provided on the side opposing to the image-forming layer.

Further, a layer functioning as an optical filter can be provided, and it is classified as the layer belonging to the group (a) or (b). The anti-halation layer is provided as the layer belonging to the group (c) or (d) in the photothermographic material.

1-2-1. Surface Protective Layer

In the present photothermographic material, a surface protective layer can be provided for the purpose of preventing adhesion of the image-forming layer. The surface protective layer may be a single layer or a multiple layer.

The binder used in the surface protective layer may be any polymer. EXAMPLEs of a polymer usable as the binder include polyester, gelatin, polyvinyl alcohol and cellulose derivatives. Of these polymers, cellulose derivatives are preferred over the others. Examples of cellulose derivatives are recited below, but cellulose derivatives usable in the invention should not be construed as being limited to these examples. Specifically, the cellulose derivatives include cellulose acetate, cellulose acetate butyrate, cellulose propionate, hydroxypropyl cellulose, hydroxypropylmethyl cellulose, methyl cellulose, hydroxyethyl cellulose, carboxymethyl cellulose and mixtures of two or more thereof. The suitable thickness of the surface protective layer is from 0.1 to 10 μm, preferably from 1 to 5 μm.

In the surface protective layer, any abherent may be used. EXAMPLEs of an abherent usable herein include wax, liquid paraffin, silica particles, styrene-containing elastomeric block copolymers (e.g., styrene-butadiene-styrene block copolymer, styrene-isoprene-styrene block copolymer), cellulose acetate, cellulose acetate butyrate, cellulose propionate, and mixtures of two or more thereof.

1-2-2. Anti-halation Layer

An anti-halation layer can be provided on the underside of a light-sensitive layer, or the side distant from a light source for exposure. Descriptions of anti-halation layers can be found in JP-A No.11-65021, par. Nos. 0123 and 0124, and JP-A Nos.11-223898, 9-230531, 10-36695, 10-104779, 11-231457, 11-352625 and 11-352626.

The anti-halation layer contains an anti-halation dye having absorption at the wavelengths of exposure light. As the present photothermographic material has the wavelengths of exposure light in the infrared region, infrared absorbing dyes may be used. In this case, it is appropriate that the dyes used have no sub-absorption in the visible region.

In carrying out prevention of halation by use of dyes having side-absorption in the visible region, it is preferable to practically avoid colors of the dyes from remaining after image formation. For this purpose, it is appropriate that a measure to decolor by heat of thermal development be taken. In particular, it is preferred to cause a light-insensitive layer to function as an anti-halation layer by adding thereto a thermally decoloring dye and a base precursor. This art is described in JP-A No.11-231457.

The amount of decoloring dyes added is determined by the usage of the dyes. In general, they are used in an amount to provide an optical density (absorbance) higher than 0.1 when measured at the intended wavelength. And it is preferable that the optical density be in the range of 0.2 to 2. The amount of dyes for attaining such optical densities is generally of the order of 0.001 to 1 $g/m^2$.

Additionally, the optical density after thermal development can be lowered to 0.1 or below by decoloring the dyes in the aforementioned manners. A combination of two or more decoloring dyes may be used in a thermally decolorizable recording material or a photothermographic material. As with the decoloring dyes, two or more base precursors may be used in combination.

In the case of thermal decolorization by the combined use of decoloring dye(s) and base precursor(s), it is advantageous from the viewpoint of thermal decolorization efficiency to further use the substance capable of lowering the melting point by at least 3° C. when mixed with the base precursor(s) (e.g., diphenylsulfone, 4-chlorophenyl(phenyl) sulfone) as disclosed in JP-A No. 11-352626.

1-2-3. Back Layer

The back layer which can be applied to the present invention is described in JP-A No. 11-65021 (paragraphs 0128 to 0130).

The binder of the back layer is transparent or translucent and generally colorless. EXAMPLEs thereof include natural polymers, synthetic resins, polymers or copolymers, and film-forming mediums, such as gelatin, gum arabi, poly (vinyl alcohol), hydroxyethyl cellulose, cellulose acetate, cellulose acetate butyrate, poly(vinylpyrrolidone), casein, starch, poly(acrylic acid), poly(methyl methacrylate), poly (vinyl chloride), poly(methacrylic acid), copoly(styrene-maleic anhydride), copoly(styrene-acrylonitrile), copoly(styrene-butadiene), poly(vinyl acetals) (e.g., poly(vinyl formal), poly(vinyl butyral)), poly(esters), poly(urethanes), phenoxy resin, poly(vinylidene chloride), poly(epoxides), poly(carbonates), poly(vinyl acetate), cellulose esters and poly(amides). The binder may also be formed by coating water, an organic solvent or an emulsion.

In the present invention, a coloring agent having an absorption maximum at 300 to 450 nm may be added for the purpose of improving silver tone or change of image in aging. Examples of the coloring agent include those described in JP-A Nos. 62-210458, 63-104046, 63-103235, 63-208846, 63-306436, 63-314535 and 01-61745, and Japanese Patent Application No. 11-276751. The coloring agent is usually added in the range from 0.1 $mg/m^2$ to 1 $g/m^2$ and the layer to which the coloring agent is added is preferably the back layer provided in the side opposite the light-sensitive layer.

1-2-4. Additives

1) Matting Agent

In the present invention, a matting agent is preferably added to the surface protective layer and the back layer for improving the conveyance property.

The matting degree on the emulsion surface may be any value insofar as a so-called stardust failure of causing a small white spot in the image area and generating light leakage does not occur but is preferably, in terms of the Bekk smoothness, from 200 to 10,000 seconds, more preferably from 300 to 8,000 seconds. The Bekk smoothness can be easily determined according to Japanese Industrial Standard (JIS) P8119, "Test Method for Smoothness of Paper and Paperboard by Bekk Tester", and TAPPI Standard Method T479.

The matting degree of the back layer for use in the present invention is preferably, in terms of the Bekk smoothness, from 10 to 250 seconds, more preferably from 50 to 180 seconds.

In the present invention, the matting agent is preferably incorporated into the outermost surface layer, a layer acting as the outermost surface layer, or a layer close to the outer surface, of the photosensitive material, or is preferably incorporated into a layer acting as a so-called protective layer.

The matting agent which can be used in the present invention is an organic or inorganic fine particle which is insoluble in the coating solvent. A matting agent well-known in the art may be used, such as organic matting agents described in U.S. Pat. Nos. 1,939,213, 2,701,245, 2,322,037, 3,262,782, 3,539,344 and 3,767,448, and inorganic matting agents described in U.S. Pat. Nos. 1,260,772, 2,192,241, 3,257,206, 3,370,951, 3,523,022 and 3,769,020. Specific preferred examples of the organic compound which can be used as the matting agent include water-dispersible vinyl polymers such as polymethyl acrylate, polymethyl methacrylate, polyacrylonitrile, acrylonitrile-α-methylstyrene copolymers, polystyrene, styrene-divinylbenzene copolymers, polyvinyl acetate, polyethylene carbonate and polytetrafluoroethylene; cellulose derivatives such as methyl cellulose, cellulose acetate and cellulose acetate propionate; starch derivatives such as carboxy starch, carboxynitrophenyl starch, urea-formaldehyde-starch reaction products, gelatin hardened with a known hardening agent, and gelatin hardened by coacervation-hardening into a capsule hollow fine particle. Preferred examples of the inorganic compound include silicon dioxide, titanium dioxide, magnesium dioxide, aluminum oxide, barium sulfate, calcium carbonate, silver chloride desensitized by a known method, silver bromide desensitized by a known method, glass and diatomaceous earth. These matting agents may be used as a mixture of different substances, if desired. The size and shape of the matting agent are not particularly limited and a matting agent having an arbitrary particle size may be used. The matting agent used in practicing the present invention preferably has an average particle size of 0.1 to 30 μm. The particle size distribution of the matting agent may be either narrow or wide. On the other hand, the matting agent greatly affects the haze and surface gloss of the photosensitive material and therefore, the particle size, shape and particle size distribution are preferably adjusted as desired during preparation of the matting agent or by mixing a plurality of matting agents.

2) Hardening Agent

In the present invention, a hardening agent may be used for each layer such as photosensitive layer, protective layer and back layer. Preferred examples of the hardening agent include those described in T. H. James, The Theory of the Photographic Process, Fourth Edition, pp. 77–87, Macmillan Publishing Co., Inc. (1977), chrome alum, 2,4-dichloro-6-hydroxy-s-triazine sodium salt, N,N-ethylenebis (vinylsulfonacetamide), N,N-propylenebis (vinylsulfonacetamide), polyvalent metal ion described in ibid., page 78, polyisocyanates described in U.S. Pat. No. 4,281,060 and JP-A No. 6-208193, epoxy compounds described in U.S. Pat. No. 4,791,042, and vinyl sulfone-base compounds described in JP-A No. 62-89048.

The hardening agent is added as a solution. The timing of adding this solution to the coating solution is from 180 minutes before coating to immediately before coating, preferably from 60 minutes to 10 seconds before coating. The mixing method and mixing conditions are not particularly limited as long as the effect of the present invention is satisfactorily brought out.

Specific examples of the mixing method include a method of mixing the solutions in a tank designed to give a desired average residence time which is calculated from the addition flow rate and the amount of solutions fed to the coater, and a method of using a static mixer described, for example, in N. Harnby, M. F. Edwards and A. W. Nienow (translated by Koji Takahashi), Ekitai Kongo Gijutsu (Liquid Mixing Technique), Chap. 8, Nikkan Kogyo Shinbun Sha (1989).

3) Surfactant

In the photothermographic material of the present invention, a surfactant may be used for the purpose of improving coatability, electric charging or the like. EXAMPLEs of the surfactant include nonionic surfactants, anionic surfactants, cationic surfactants and fluorine-containing surfactants, and any of these surfactants can be appropriately used. Specific examples thereof include fluorine-containing polymer surfactants described in JP-A No. 62-170950 and U.S. Pat. No. 5,380,644, fluorine-containing surfactants described in JP-A Nos. 60-244945 and 63-188135, polysiloxane-base surfactants described in U.S. Pat. No. 3,885,965, and polyalkylene oxide and anionic surfactants described in JP-A No. 6-301140.

In the present invention, a fluorine-containing surfactant is preferably used. Specific preferred examples of the fluorine-containing surfactant include compounds described in JP-A Nos. 10-197985, 2000-19680 and 2000-214554. Also, a polymer fluorine-containing surfactant described in JP-A No. 9-281636 is preferably used. In the present invention, the fluorine-containing surfactants described in Japanese Patent Application No. 2000-206560 are particularly preferred.

4) Coating Solvent

Examples of the solvent include those described in Shin Han Yozai Pocketbook (New Edition, Solvent Pocketbook), Ohm Sha (1994), however, the present invention is not limited thereto. The solvent for use in the present invention preferably has a boiling point of 40 to 180° C. Specific examples of the solvent include hexane, cyclohexane, toluene, methanol, ethanol, isopropanol, acetone, methyl ethyl ketone, ethyl acetate, 1,1,1-trichloroethane, tetrahydrofuran, triethylamine, thiophene, trifluoroethanol, perfluoropentane, xylene, n-butanol, phenol, methyl isobutyl ketone, cyclohexanone, butyl acetate, diethyl carbonate, chlorobenzene, dibutyl ether, anisole, ethylene glycol diethyl ether, N,N-dimethylformamide, morpholine, propanesultone, perfluorotributylamine and water. Among these, methyl ethyl ketone is preferred, because this compound has an appropriate boiling point, the resulting coated film can have a uniform surface state, the load of drying is lightened and the amount of residual solvent is small.

After the coating and drying, the amount of the solvent used for the coating and remaining in the coated film is preferably reduced as much as possible. The residual solvent volatilizes into the environment to give an uncomfortable odor at the exposure or heat-development of the photothermographic material and this is not preferred also in view of health.

Particularly, in the photothermographic material of the present invention, the residual solvent relates to the effect of the present invention as proved in EXAMPLEs. It is an unexpected phenomenon that high sensitivity and high stability can be first obtained when the residual solvent amount is smaller than a fixed amount. If the residual solvent amount is large, high sensitivity may be obtained immediately after the coating and production of the photothermographic material, however, the sensitivity decreases during storage. In order to bring out the effect of the present invention, it is important to reduce the residual solvent amount. In the present invention, the residual solvent amount is, in terms of the amount of MEK, preferably from 0.1 to 150 $mg/m^2$, more preferably from 0.1 to 80 $mg/m^2$, still more preferably from 0.1 to 40 $mg/m^2$.

5) Antistatic Agent

In the present invention, an antistatic layer containing a known metal oxide or electrically conducting polymer of various types may also be provided. The antistatic layer may concurrently serve as the above-described undercoat layer or back surface protective layer or may be provided separately. As for the antistatic layer, techniques described in JP-A Nos. 11-65021 (paragraph 0135), 56-143430, 56-143431, 58-62646, 56-120519 and 11-84573 (paragraphs 0040 to 0051), U.S. Pat. No. 5,575,957 and JP-A No. 11-223898 (paragraphs 0078 to 0084) can be applied. 6) Other Additives In the photothermographic material, an antioxidant, a stabilizer, a plasticizer, an ultraviolet absorbent and a coating aid may be further added. A solvent described in JP-A No. 11-65021 (paragraph 0133) may also be added. These various additives are added to either a photosensitive layer or a non-photosensitive layer. These are described in WO98/36322, EP-A No. 803764, and JP-A Nos. 10-186567 and 10-18568.

1-2-5. Support

Examples of the support include polyester film, undercoated polyester film, poly(ethylene terephthalate) film, polyethylene naphthalate film, cellulose nitrate film, cellulose ester film, poly(vinyl acetal) film, polycarbonate film, their related or resinous materials, glass, paper and metals. A flexible substrate, preferably a paper support coated with a partially acetylated or baryta and/or α-olefin polymer, more preferably with an α-olefin polymer having from 2 to 10 carbon atoms, such as polyethylene, polypropylene and ethylene-butene copolymer, may also be used. The support may be transparent or opaque but is preferably transparent.

The support is preferably polyester, particularly polyethylene terephthalate, subjected to a heat treatment in the temperature range from 130 to 185° C. so as to relax the internal stress remaining in the film at the biaxial stretching and thereby eliminate the generation of thermal shrinkage stress during the heat development.

In the case of a photothermographic material for medical uses, the transparent support may be colored with a blue dye (for example, Dye-1 described in EXAMPLE of JP-A No. 8-240877) or may be not colored. Specific examples of the support include those described in JP-A No. 11-65021 (paragraph 0134).

For the support, a technique of undercoating, for example, a water-soluble polyester described in JP-A No. 11-84574, a styrene-butadiene copolymer described in JP-A No. 10-186565, or a vinylidene chloride copolymer described in JP-A No. 2000-39684 and Japanese Patent Application No. 11-106881 (paragraphs 0063 to 0080) is preferably applied.

1-2-6. Coating Method

The photothermographic material of the present invention may be coated by any method. More specifically, various coating operations including extrusion coating, slide coating, curtain coating, dip coating, knife coating, flow coating, and extrusion coating using a hopper of the type described in U.S. Pat. No. 2,681,294 may be used. The extrusion coating or slide coating described in Stephen F. Kistler and Petert M. Schweizer, LIQUID FILM COATING, pp. 399–536, CHAPMAN & HALL (1977) is preferred and the extrusion coating is more preferred.

1-2-7. Other Usable Techniques

Examples of the technique which can be used for the photothermographic material of the present invention include those described in EP-A Nos. 803764 and 883022, WO98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099 and 11-343420, and Japanese Patent Application Nos. 2000-187298, 2000-10229, 2000-47345, 2000-206642, 2000-98530, 2000-98531, 2000-112059, 2000-112060, 2000-112104, 2000-112064 and 2000-171936.

2. Packing Material

The photothermographic material of the present invention is preferably wrapped with a packaging material having a low oxygen permeability and/or vapor permeability so as to suppress fluctuation in the photographic performance during stock storage or, in the case of a roll-form product, to prevent curl or curling habit. The oxygen permeability at 25° C. is preferably 50 ml/atm·m$^2$·day or less, more preferably 10 ml/atm·m$^2$·day or less, still more preferably 1.0 ml/atm·m$^2$·day or less. The vapor permeability is preferably 10 g/atm·m$^2$·day or less, more preferably 5 g/atm·m$^2$·day or less, still more preferably 1□g/atm·m$^2$·day or less. Specific examples of the packaging material having a low oxygen permeability and/or a low vapor permeability include packaging materials described in JP-A Nos. 8-254793 and 2000-206653.

3. Image Forming Method 3-1. Exposure

The photosensitive material of the present invention may be exposed by any method but laser beam is preferred as the exposure light source. Particularly, in the case of giving an exposure amount of bringing a maximum density (Dmax), the light intensity on the photosensitive material surface is preferably from 0.1 to 100 W/mm$^2$, more preferably from 0.5 to 50 W/mm$^2$, and most preferably from 1 to 50 W/mm$^2$.

As the laser beam source, a gas laser (e.g., $Ar^+$, He—Ne, He—Cd), a YAG laser, a dye laser or a semiconductor laser can be used. Also, a semiconductor laser combined with a second harmonic generating device may be used. Although the preferred laser is determined according to the light absorption peak wavelength of spectral sensitizing dye or the like in the photothermographic material, an infrared emission He—Ne laser and an infrared semiconductor laser are preferred. In particular, the infrared semiconductor laser is inexpensive and ensures stable light emission and therefore, this laser is suitable for the design of a compact and handy laser image output system having good operability and capable of being located at any installation site.

Laser beam which is oscillated in longitudinal multiple modes by high frequency superposition may also be preferably used.

3-2. Thermal Development

The photothermographic material of the present invention may be developed by any method but the development is usually performed by raising the temperature of an imagewise exposed photothermographic material. The development temperature is preferably from 80 to 250° C., more preferably from 100 to 140° C. The development time is preferably from 1 to 180 seconds, more preferably from 10 to 90 seconds.

The thermal development system is preferably a plate heater system. The thermal development system using the plate heater is preferably a system described in JP-A No. 11-133572, which is a thermal developing apparatus for obtaining a visible image by bringing a photothermographic material having formed thereon a latent image into contact with a heating unit in the thermal-developing section, wherein the heating unit comprises a plate heater, a plurality of press rollers are disposed to face each other along one surface of the plate heater, and the photothermographic material is passed between the press rollers and the plate heater, thereby performing the thermal development. The plate heater is preferably divided into 2 to 6 stages and the temperature at the leading end is preferably lowered by approximately from 1 to 10° C.

Such a method is described also in JP-A No. 54-30032, where the water content or organic solvent contained in the photothermographic material can be excluded out of the system and the photothermographic material can be prevented from changing in the shape of support, which is otherwise caused by abrupt heating of the photothermographic material.

As another heating method, a backside resistive heating layer described in U.S. Pat. Nos. 4,460,681 and 4,374,921 may be provided and allowed to generate heat by passing an electricity and thereby perform the heating.

3-3. System

EXAMPLEs of the medical-use laser imager equipped with an exposure section and a thermal-development section include Fuji Medical Dry Laser Imager "FM-DPL". This system is described in Fuji Medical Review, No. 8, pp. 39–55 and the technique described therein can be applied. The photothermographic material of the present invention can also be employed as a photothermographic material for a laser imager in the "AD Network" proposed by Fuji Film Medical Co., Ltd. as a network system that meets the DICOM standard.

4. Usage of the Invention

The photothermographic material of the present invention forms a black-and-white image by a silver image and is preferably used as a photothermographic material for medical imaging, industrial photographic imaging, graphic arts or COM.

EXAMPLES

The present invention is described in greater detail below by referring to examples, however, it should be understood that the present invention is not limited thereto.

Example 1

1. Preparation and Undercoating of PET Support 1-1. Film Formation

PET having an intrinsic viscosity IV of 0.66 (measured at 25° C. in phenol/tetrachloroethane=6/4 (by weight)) was obtained in a usual manner using terephthalic acid and ethylene glycol. The resulting PET was pelletized, the pellets obtained were dried at 130° C. for 4 hours and melted at 300° C., and 0.04% by weight of Dye BB having a structure shown below was added thereto. Thereafter, the melt was extruded from a T-die and then cooled, and a non-stretched film having a thickness large enough to give a thickness of 175 μm after the heat setting.

Dye BB:

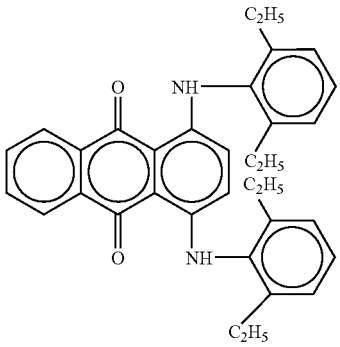

This film was stretched to 3.3 times in the machine direction using rolls having different in the peripheral speed and then stretched to 4.5 times in the cross direction by a tenter. At this time, the temperatures were 110° C. and 130° C., respectively. Subsequently, the film was heat set at 240° C. for 20 seconds and relaxed by 4% in the cross direction at the same temperature. Thereafter, the chuck part of the tenter was slit, both edge parts of the film were knurled, and the film was taken up at 4 kg/cm$^2$ to obtain a roll having a thickness of 175 μm.

1-2. Surface Corona Discharge Treatment

Both surfaces of the support were treated at room temperature at 20 m/min using a solid state corona discharge treating machine "Model 6KVA" (manufactured by Pillar Technologies). From the current and voltage read at this time, it was known that a treatment of 0.375 kV·A·min/m$^2$ was applied to the support. The treatment frequency here was 9.6 kHz and the gap clearance between the electrode and the dielectric roll was 1.6 mm.

2. Preparation and Coating of Coating Solution for Back Layer

In 830 g of MEK, 84.2 g of cellulose acetate butyrate (CAB381-20, produced by Eastman Chemical Co.) and 4.5 g of polyester resin (Vitel PE2200B, produced by Bostic Co.) were added and dissolved while stirring. To the dissolved solution, 0.30 g of Dye 1 was added and further, 43.2 g of methanol having dissolved therein 4.5 g of fluorine-containing surfactant (Surflon KH40, product by Asahi Glass Co., Ltd.) and 2.3 g of fluorine-containing surfactant (Megafac F120K, product by Dainippon Ink & Chemicals Inc.) was added. The resulting solution was thoroughly stirred until these were dissolved. Finally, 75 g of silica (Siloid 64×6000, product by W. R. Grace Co.) dispersed in methyl ethyl ketone to a concentration of 1 wt % using a dissolver-type homogenizer was added and the mixture was stirred to prepare a coating solution for back surface.

The thus-prepared coating solution for back layer was coated by an extrusion coater to a dry thickness of 3.5 μm and dried. Drying was performed using air having a temperature of 100° C. and a dew point of 10° C. for 5 minutes.

3. Image-Forming Layer and Surface Protective Layer 3-1. Preparation of Coating Materials 1) Preparation of Silver Halide Emulsion 1

To a first solution kept at 34° C., which was prepared by dissolving 30 g of phthalated gelatin and 71.4 mg of KBr in 1,500 mL of deionized water and adjusted to a pH of 5.0 with 3 mol/L of nitric acid, a solution obtained by dissolving 27.4 g of KBr and 3.3 g of KI in 275 mL of deionized water and a solution obtained by dissolving 42.5 g of silver nitrate in 364 mL of deionized water were simultaneously added over 9.5 minutes. Thereafter, a solution obtained by dissolving 179 g of KBr and 10 mg of potassium secondary hexachloroiridate in 812 mL of deionized water and a solution obtained by dissolving 127 g of silver nitrate in 1,090 mL of deionized water were simultaneously mixed over 28.5 minutes. Here, the pAg was kept constant using a pAg feedback control loop described in Research Disclosure, No. 17643, and U.S. Pat. Nos. 3,415,650, 3,782,954 and 3,821,002. The obtained emulsion was washed and desalted. The average grain size was measured by a transmission electron microscope (TEM) and found to be 0.045 μm.

In the obtained core/shell type silver iodobromide emulsion, the iodine content in the core was 8 mol %, the iodine content in the shell was 0 mol %, the total iodine content was 2 mol % and the iridium content was $2.1\times10^{-5}$ mol per mol of silver halide.

2) Preparation of Organic Silver Salt Dispersion Solution (Preparation of Organic Silver Salt Dispersion Solution 1)

This is the preparation of an organic silver salt dispersion solution containing photosensitive silver halide grains.

In 13 L of water, 688 g of a fatty acid having a composition comprising 42 mol % of behenic acid, 34 mol % of arachidinic acid and 24 mol % of stearic acid was dissolved at 80° C. and mixed for 15 minutes. Thereafter, a solution obtained by dissolving 89.18 g of NaOH in 1.5 L of water at 80° C. was added and mixed for 5 minutes to form a dispersion solution. To this dispersion solution, a solution obtained by diluting 19 mL of concentrated nitric acid with 50 mL of water was added. The resulting dispersion solution was cooled to 55° C. and stirred for 25 minutes. To this dispersion solution kept at 55° C., a diluted emulsion obtained by dissolving 700 g (containing 1 mol of silver halide) of the silver halide emulsion prepared above in 1.25 L of water at 42° C. was added in an amount corresponding to 0.10 mol as the silver halide amount was added and mixed for 5 minutes. Subsequently, 336.5 g of silver nitrate dissolved in 2.5 L of water was added at 55° C. over 10 minutes. The obtained organic silver salt dispersion was transferred to a washing vessel and after adding deionized water, stirred and then left standing to float and separate the organic silver salt dispersion, and water-soluble salts in the lower part were removed. Subsequently, centrifugal dehydration was performed by repeating washing with deionized water and discharging of water until the electrical conductivity of discharged water became 2 μS/cm. Then, drying with warm air having an oxygen partial pressure of 10% by volume was performed at 45° C. in a circulating dryer until the weight loss did not occur.

(Preparation of Organic Silver Salt Dispersion Solution 2)

This is the preparation of an organic silver salt dispersion solution not containing photosensitive silver halide grain.

In 13 L of water, 118 g of Humko-type fatty acid 9718 (product by Witco, Memphis, Tenn.) and 570 g of Humko-type fatty acid 9022 were dissolved at 80° C. and mixed for 15 minutes. Thereto, a solution obtained by dissolving 89.18 g of NaOH in 1.5 L of water at 80° C. was added and mixed for 5 minutes to form a dispersion solution. To this dispersion solution, a solution obtained by diluting 19 mL of concentrated nitric acid with 50 mL of water was added at 80° C. and the resulting dispersion solution was cooled to 55° C. and stirred for 25 minutes. Thereafter, 336.5 g of silver nitrate dissolved in 2.5 L of water was added at 55° C. over 10 minutes. The obtained organic silver salt dispersion was transferred to a washing vessel and after adding deionized water, stirred and left standing to float and separate the organic silver salt dispersion and water-soluble salts in the lower part were removed. Subsequently, centrifugal dehydration was performed by repeating washing with deionized water and discharging of water until the electrical conductivity of discharged water became 2 μS/cm. Then, drying with warm air having an oxygen partial pressure of 10% by volume was performed at 45° C. in a circulating dryer until the weight loss did not occur.

3) Redispersion of Organic Silver Salt in Organic Solvent (Preparation of Redispersion 1 of Organic Silver Salt)

In 780 g of methyl ethyl ketone (MEK), 209 g of the powdery Organic Silver Salt 1 prepared above and 11 g of polyvinyl butyral powder (Butvar B-79, product by Monsant) were dissolved. The resulting solution was stirred by a dissolver DISPERMAT Model CA-40M manufactured by VMA-GETZMANN and then left standing overnight to obtain a slurry.

This slurry was dispersed through 2 paths in a pressure-type homogenizer Model GM-2 manufactured by SMT Co. to prepare Redispersion 1 of Organic Silver Salt.

(Preparation of Redispersion 2 of Organic Silver Salt)

In 780 g of methyl ethyl ketone (MEK), 209 g of the powdery Organic Silver Salt 2 prepared above and 11 g of polyvinyl butyral powder (Butvar B-79, product by Monsant) were dissolved. Thereto, the silver halide emulsion prepared above was added in an amount corresponding to 0.023 mol as the silver halide amount. The resulting solution was stirred by a dissolver DISPERMAT Model CA-40M manufactured by VMA-GETZMANN and then left standing overnight to obtain a slurry.

This slurry was dispersed through 2 paths in a pressure-type homogenizer Model GM-2 manufactured by SMT Co. to prepare Redispersion 2 of Organic Silver Salt.

4) Preparation of Coating Solution for Image-Forming Layer

The redispersion (507 g) of organic silver salt prepared above was stirred at 13° C. for 15 minutes and thereto, 3.9 mL of a methanol solution containing 10% by weight of pyridinium hydrobromide perbromide (PHP) was added. After stirring for 2 hours, 5.2 mL of a methanol solution containing 11% by weight of calcium bromide was added. The stirring was continued for 30 minutes and then, 117 g of Butvar B-79 was added. After further stirring for 30 minutes, 27.3 g of 1,1-bis(2-hydroxy-3,5-dimethylphenyl)-2-methylpropane and 2.73 g of 3-tribromomethylsulfonyl-naphthalene were added, and stirring was further continued for 15 minutes. Thereafter, Sensitizing Dye 1 was added in an amount of $1\times10^{-3}$ mol per mol of silver halide and the solution was stirred for 15 minutes. Thereto, a solution obtained by dissolving 1.39 g of Desmodur N3300 (aliphatic isocyanate, produced by MOBEY) in 12.3 g of MEK was added and the resulting solution was stirred for 15 minutes and then heated at 21° C. for 15 minutes.

To 100 g of the obtained dispersion solution, Types 1 to 5 of the compound of the present invention of in an amount of $1\times10^{-3}$ mol per mol of silver halide, 0.47 g of 4-chlorobenzophenone-2-carboxylic acid and 0.043 g of 5-methyl-2-mercaptobenzimidazole were added and stirred at 21° C. for 1 hour. Subsequently, 0.368 g of phthalazine, 0.123 g of tetrachlorophthalic acid and 2 g of Dye 1 were added to obtain a coating solution for image-forming layer.

The redispersion of organic silver salt and the compound of Type A or Types 1 to 4 used are shown in Table 1.

5) Preparation of Coating Solution for Surface Protective Layer

In 512 g of MEK, 61 g of methanol, 48 g of cellulose acetate butyrate (CAB171-15, product by Eastman Chemical), 2.08 g of 4-methylphthalic acid, 3.3 g of an MEK solution containing 16% by weight of Fluorine-Containing Polymer Surfactant C, 1.9 g of polymethyl methacrylate (Acryloid A-21, product by Rhom & Haas), 2.5 mL of a methanol solution containing 1% by weight of benzotriazole, and 0.5 g of 1,3-di(vinylsulfonyl)-2-propanol were mixed at room temperature to prepare a coating solution for surface protective layer.

3-2. Preparation of Photothermographic Material

The coating solution for image-forming layer and the coating solution for surface protective layer, which were prepared as above, were simultaneously coated by a dual knife coater on the surface opposite the back layer of the support where the back layer was coated, to prepare Photothermographic Materials 1 to 25. The coating solution for image-forming layer was coated to have a dry thickness of 18.3 μm and the coating solution for surface protective layer was coated to have a dry thickness of 3.4 μm. The coating apparatus used was composed of two knife coating blades standing side by side. The support was cut into a length matching the volume of solution used and then the knives each with a hinge were elevated and disposed at a position on a coater floor. Subsequently, the knives were lowered and fixed to a predetermined position. The height of the knives was adjusted by using a wedge which is controlled by a screw knob and measured by an ammeter. Knife No. 1 was elevated to a space corresponding to the thickness as a total of the thickness of support and the desired wet thickness of image-forming layer (Layer No. 1), and Knife No. 2 was elevated to a height equal to the total thickness of support+wet thickness of image-forming layer (Layer No. 1)+desired thickness of surface protective layer (Layer No. 2). Thereafter, drying was performed using air having a temperature of 75° C. and a dew-point of 10° C. for 15 minutes.

Compounds used in Example 1 are shown below.

Fluorinated Polymer Surfactant C:

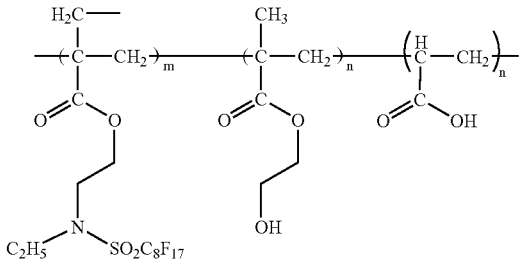

m:n:p=7:2:1

Sensitizing Dye 1:

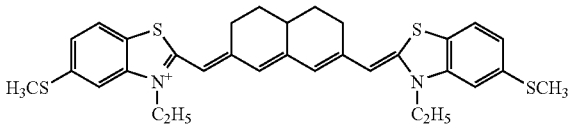

p-Ts⁻

Dye 1:

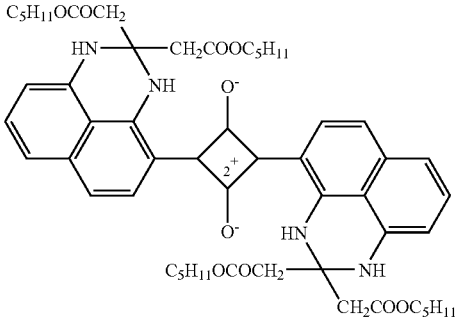

3-3. Measurement of Residual Solvent Amount

The MEK content of the photothermographic material obtained as such was determined under the following conditions and used as the solvent content. The photothermographic material was cut out to a film area of 46.3 $m^2$ and was further cut into pieces of about 5 mm×5 mm. These pieces were housed in a dedicated vial and the vial was tightly sealed by a septum and an aluminum cap and then set in a Head Space Sampler Model HP7694 with gas chromatography (GC) Model 5971, manufactured by Hewlett Packard Co. The detector of GC was a hydrogen flame ion detector (FID) and the column was DB-624 produced by J&W Co. The main measurement conditions were such that the heating condition of the Head Space Sampler was 120° C. for 20 minutes, the GC introduction temperature was 150° C., and the temperature was elevated from 45° C. to 100° C. at 8° C./minute. A calibration curve was prepared using a peak area in chromatogram obtained by housing a fixed amount of MEK diluted with butanol in a dedicated vial and performing the measurement in the same manner as above. The solvent content did not greatly differ according to the sample prepared and was from 10 to 12 mg/$m^2$.

3-4. Exposure and Development Processing

An exposure machine was experimentally produced using, as the exposure light source, a semiconductor laser formed into a longitudinal multiple mode of a wavelength from 800 to 820 nm by means of high frequency superposition. Using this exposure machine, Sample Nos. 1 to 25 prepared above were exposed by scanning the laser ray on the image-forming layer surface. At this time, an image was recorded by setting the scanning laser ray at an incident angle of 75° to the exposed surface of the photosensitive material. Thereafter, each of the samples was thermal-developed at 124° C. for 15 seconds using an automatic developing machine having a heat drum while contacting the protective layer of the photosensitive material with the drum surface. The obtained image was evaluated by a densitometer.

(Sensitivity)

The sensitivity was expressed by a reciprocal of the exposure amount of giving an optical density of fog+1.0 and shown by a relative value to the sensitivity of Sample No. 1 which was taken as 100.

(Dmin)

The density of the non-image area was measured by a Macbeth densitometer.

(Image Preservability)

The thermal-developed samples were each cut into a size of 356×432 mm, stored for 24 hours in an environment of 30° C. and 70% RH under a fluorescent lamp of 1,000 Lux and then evaluated on the increase of fog density in the Dmin area.

The results obtained are shown in Table 1. As seen in these results, the photothermographic material of the present invention maintains low fog density and exhibits high sensitivity and good print-out property after heat development. On the other hand, comparative samples using Redispersion 2 of Organic Acid Salt all have low sensitivity. The compounds of Types 1 to 5 of the present invention exert the sensitizing effect when Redispersion 1 of Organic Acid Salt is used, but exhibit only a slight sensitizing effect when Redispersion 2 of Organic Acid Salt is used.

TABLE 1

| Sample No. | Compound of Types 1 to 5 | Silver Salt of Organic Acid | Dmin | Sensitivity | Print-Out Performance (ΔDmin) | Notes |
|---|---|---|---|---|---|---|
| 1 | — | Redispersion 1 | 0.20 | 100 | 0.15 | Comparison |
| 2 | 3 | " | 0.18 | 305 | 0.08 | Invention |
| 3 | 8 | " | 0.17 | 315 | 0.07 | " |
| 4 | 9 | " | 0.16 | 325 | 0.07 | " |
| 5 | 10 | " | 0.17 | 305 | 0.08 | " |
| 6 | 11 | " | 0.18 | 300 | 0.06 | " |
| 7 | 12 | " | 0.17 | 295 | 0.06 | " |
| 8 | 13 | " | 0.18 | 305 | 0.06 | " |
| 9 | 24 | " | 0.17 | 330 | 0.04 | " |
| 10 | 34 | " | 0.18 | 300 | 0.06 | " |
| 11 | 41 | " | 0.17 | 320 | 0.05 | " |
| 12 | 46 | " | 0.16 | 310 | 0.08 | " |
| 13 | 56 | " | 0.17 | 315 | 0.07 | " |
| 14 | 59 | " | 0.17 | 305 | 0.05 | " |
| 15 | G-1 | " | 0.18 | 300 | 0.07 | " |
| 16 | G-3 | " | 0.16 | 310 | 0.06 | " |
| 17 | G-12 | " | 0.18 | 315 | 0.07 | " |
| 18 | — | Redispersion 2 | 0.16 | 55 | 0.13 | Comparison |
| 19 | 3 | " | 0.17 | 60 | 0.08 | " |
| 20 | 9 | " | 0.18 | 72 | 0.08 | " |
| 21 | 24 | " | 0.17 | 75 | 0.05 | " |
| 22 | 41 | " | 0.18 | 67 | 0.04 | " |
| 23 | G-3 | " | 0.18 | 65 | 0.04 | " |

Example 2

1) Preparation of Photosensitive Silver Halide Emulsion 2

In 900 mL of water, 7.5 g of ossein gelatin having an average molecular weight of 100,000 and 10 mg of potassium bromide were dissolved. The resulting solution was adjusted to a temperature of 35° C. and a pH of 3.0 and thereto, 370 mL of an aqueous solution containing 74 g of silver nitrate and 370 mL of an aqueous solution containing potassium bromide and potassium iodide at a molar ratio of 98/2 and containing iridium chloride in an amount of $1\times10^{-4}$ mol per mol of silver were added by a controlled double jet method over 10 minutes while keeping the pAg at 7.7. Thereafter, 0.3 g of 4-hydroxy-6-methyl-1,3,3a,7-tetrazaindene was added and the pH was adjusted to 5 with NaOH to obtain a cubic silver iodobromide grain having an average grain size of 0.06 μm, a standard deviation in the grain size of 12% and a [100] face percentage of 87%. This emulsion was desalted by adding a gelatin coagulant and thereby flocculating and precipitating silver halide grains, 0.1 g of phenoxyethanol was added thereto, and the pH and the pAg were adjusted to 5.9 and 7.5, respectively, thereby obtaining Photosensitive Silver Halide Emulsion 2.

The temperature of the thus-obtained photosensitive silver halide emulsion was elevated to 55° C. and $5\times10^{-5}$ mol of Compound A was added. Subsequently, $7\times10^{-5}$ mol of ammonium thiocyanate and $5.3\times10^{-5}$ mol of chloroauric acid were added thereto. Furthermore, 0.3 mol % of silver iodide fine grain was added. After ripening for 100 minutes, the emulsion was cooled to 38° C. to complete the chemical sensitization. Here, the amount added is an amount per mol of silver halide.

Compound A:

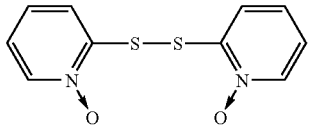

2) Preparation of Powdery Organic Silver Salt (Preparation of Organic Silver Salt 3)

In 4,720 mL of pure water, 111.4 g of behenic acid, 83.3 g of arachidinic acid and 54.9 g of stearic acid were added and dissolved at 80° C. To this mixture, 540.2 mL of an aqueous 1.5N sodium hydroxide solution was added and after 6.9 mL of concentrated nitric acid was added, the resulting solution was cooled to 55° C. to obtain a sodium salt solution of an organic acid. While keeping the sodium salt solution of an organic acid at a temperature of 55° C., Silver Halide Emulsion 2 (containing 0.038 mol of silver) prepared above and 450 mL of pure water were added and the resulting solution was stirred. To this solution, 760.6 mL of a 1 mol/L silver nitrate solution was added over 2 minutes and the solution was further stirred for 20 minutes, thereby obtaining an organic silver salt dispersion. The obtained organic silver salt dispersion was transferred to a washing vessel and after adding deionized water, stirred and then left standing to float and separate the organic silver salt dispersion, and water-soluble salts in the lower part were removed. Subsequently, centrifugal dehydration was performed by repeating washing with deionized water and discharging of water until the electrical conductivity of discharged water became 2 μS/cm. Then, drying with warm air having an oxygen partial pressure of 10% by volume was performed at 40° C. in a circulating dryer until weight loss did not occur and thereby powdery Organic Silver Salt 3 containing photosensitive silver halide was obtained.

(Preparation of Organic Silver Salt 4)

In 4,720 mL of pure water, 111.4 g of behenic acid, 83.3 g of arachidinic acid and 54.9 g of stearic acid were added and dissolved at 80° C. To this solution, 540.2 mL of an aqueous 1.5N sodium hydroxide solution was added and after 6.9 mL of concentrated nitric acid was added, the resulting solution was cooled to 55° C. to obtain a sodium salt of an organic acid. Subsequently, 760.6 mL of a 1 mol/L silver nitrate solution was added over 2 minutes and the solution was further stirred for 20 minutes, thereby obtaining an organic silver salt dispersion. The obtained organic silver salt dispersion was transferred to a washing vessel and after adding deionized water, stirred and then left standing to float and separate the organic silver salt dispersion, and water-soluble salts in the lower part were removed. Thereafter, centrifugal dehydration was performed by repeating washing with deionized water and discharging of water until the electrical conductivity of discharged water became 2 μS/cm. Then, drying with warm air having an oxygen partial pressure of 10% by volume was performed at 40° C. in a circulating dryer until the weight loss did not occur and thereby powdery Organic Silver Salt 4 was obtained.

3) Preparation of Redispersion of Organic Silver Salt

Preparation of Redispersion 3 of Organic Silver Salt:

In 1,457 g of methyl ethyl ketone (MEK), 14.57 g of polyvinyl butyral powder (Butvar B-79, product by Monsant) was dissolved. While stirring the resulting solution by a dissolver-type homogenizer, 500 g of powdery Organic Silver Salt 3 prepared above was gradually added and thoroughly mixed to form a slurry.

This slurry was dispersed using a media dispersing machine filled in 80% by volume with 1-mm Zr beads (product by Toray Industries, Inc.) at a peripheral speed of 13 m and a retention in mill time of 0.5 minutes to obtain Organic Silver Salt Dispersion 3.

(Preparation of Redispersion 4 of Organic Silver Salt)

In 1,457 g of methyl ethyl ketone (MEK), 14.57 g of polyvinyl butyral powder (Butvar B-79, product by Monsant) was dissolved. While stirring the resulting solution with a dissolver-type homogenizer, 500 g of the powdery Organic Silver Salt 4 prepared above was added and Photosensitive Silver Halide Emulsion 2 was further gradually added in an amount corresponding to 0.056 mol as the silver halide amount. The obtained solution was thoroughly mixed to form a slurry.

This slurry was dispersed using a media dispersing machine filled in 80% by volume with 1-mm Zr beads (produced by Toray Industries, Inc.) at a peripheral speed of 13 m and a retention in mill time of 0.5 minutes to obtain Organic Silver Salt Dispersion 4.

4) Preparation of Coating Solution for Image-Forming Layer

In 500 g of the redispersion of the organic silver salt prepared above, 100 g of MEK was added while stirring in a nitrogen stream. The resulting solution was kept at 24° C. Thereto, 2.5 mL of a 10% by weight methanol solution of Antifoggant 1 shown below was added and stirred for 15 minutes. Furthermore, 1.8 mL of a solution containing a dye adsorption promoter below and potassium acetate at a mixing ratio of 1:5 (by weight) and having a dye adsorption promoter concentration of 20% by weight was added and stirred for 15 minutes. Thereafter, 7 mL of a mixed solution of Sensitizing Dye 1 ($1\times10^{-3}$ mol per mol of silver halide), 4-chloro-2-benzoyl benzoic acid and 5-methyl-2-mercaptobenzimidazole as a supersensitizer (mixing ratio: 1:250:20 by weight, concentration of Sensitizing dye 1:0.1 mass methanol solution), and the compound of the present invention (shown in Table 2) were added and stirred for 1 hour. After lowering the temperature to 13° C., the solution was further stirred for 30 minutes. While keeping the solution at 13° C., 48 g of polyvinyl butyral was added and thoroughly dissolved. Thereafter, the following additives were added.

The redispersion of organic silver salt and the compound of Types 1 to 5 used are shown in Table 2.

| | |
|---|---|
| Phthalazine | 1.5 g |
| Tetrachlorophthalic acid | 0.5 g |
| 4-Methylphthalic acid | 0.5 g |
| Dye 2 | 2.0 g |
| Reducing agent (1,1-bis(2-hydroxy-3,5-dimethylphenyl)-3,5,5-trimethylhexane) | 15 g |
| Desmodur N3300 (aliphatic isocyanate, produced by MOBEY) | 1.10 g |
| (2-(tribromomethylsulfonyl)-quinoline) | 1.55 g |
| Antifoggant 2 | 0.9 g |

Dye Adsorption Promoter:

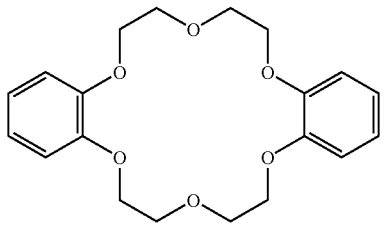

Antifoggant 1:

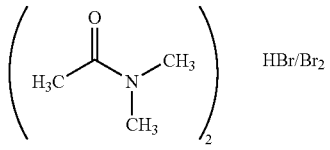

Dye 2:

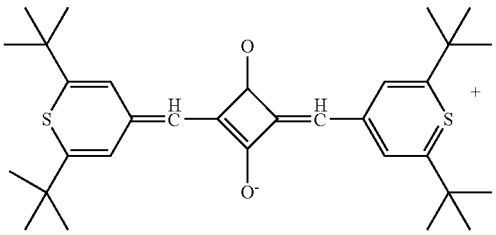

Antifoggant 2:

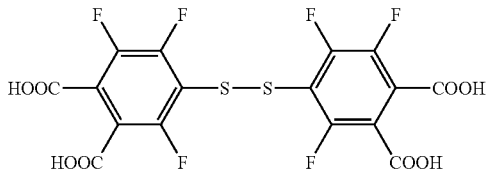

5) Coating

Image-Forming Layer:

The solution for image-forming layer prepared above was coated on the support opposite the back layer of the same support as in Example 1 where the back layer was coated, such that the coated silver amount was 1.8 g/m$^2$ and the coated amount of polyvinyl butyral as the binder was 8.5 g/m$^2$.

Surface Protective Layer:

The coating solution shown below was coated to have a wet thickness of 100 μm.

| | |
|---|---|
| Acetone | 175 ml |
| 2-Propanol | 40 ml |
| Methanol | 15 ml |
| Cellulose acetate | 8 g |
| Phthalazine | 1.5 g |
| 4-Methylphthalic acid | 0.72 g |
| Tetrachlorophthalic acid | 0.22 g |
| Tetrachlorophthalic anhydride | 0.5 g |
| Monodisperse silica having an average particle size of 4 μm (standard deviation: 20%) | 1% by weight based on binder |
| Fluorine-Containing Polymer Surfactant C same as in EXAMPLE 1 | 0.5 g |

6) Evaluation of Performance

The results of evaluation performed in the same manner as in EXAMPLE 1 are shown in Table 2. The sensitivity is shown by a relative sensitivity based on the sensitivity of Sample No. 2-1. Similarly to EXAMPLE 1, the samples of the present invention exhibit high sensitivity and good print-out property of the thermal-developed image. On the other hand, in comparative samples, only a slight sensitizing effect can be obtained even when the compound of Types 1 to 5 was used, and the sensitivity is extremely low as compared with samples of the invention.

TABLE 2

| Sample No. | Compound of Types 1 to 5 | Silver Salt of Organic Acid | Dmin | Sensitivity | Print-Out Performance (ΔDmin) | Notes |
|---|---|---|---|---|---|---|
| 2-1 | — | Redispersion 3 | 0.20 | 100 | 0.18 | Comparison |
| 2-2 | 3 | " | 0.16 | 305 | 0.08 | Invention |
| 2-3 | 9 | " | 0.17 | 315 | 0.07 | " |
| 2-4 | 24 | " | 0.15 | 330 | 0.05 | " |
| 2-5 | 41 | " | 0.14 | 325 | 0.06 | " |
| 2-6 | G-1 | " | 0.16 | 305 | 0.07 | " |
| 2-7 | — | Redispersion 4 | 0.14 | 60 | 0.14 | Comparison |
| 2-8 | 3 | " | 0.16 | 62 | 0.09 | " |
| 2-9 | 9 | " | 0.17 | 65 | 0.08 | " |
| 2-10 | 24 | " | 0.14 | 68 | 0.06 | " |
| 2-11 | 41 | " | 0.15 | 72 | 0.06 | " |
| 2-12 | G-1 | " | 0.16 | 70 | 0.07 | " |

Example 3

1) Preparation of Samples

In the preparation of sample 1 (comparative sample) and sample 9 (present invention) of Example 1, by varying the drying time period, samples having different amounts of a residual solvent (MEK) were prepared. It goes without saying that the shorter the drying time period is, the greater the amount of the residual solvent is, and the longer the drying time period is, the smaller the amount of the residual solvent is.

The amounts of the residual solvent of the obtained samples were measured similarly to Example 1, and results are shown in Table 3.

TABLE 3

| Sample No. | Coating procedure | Drying time period (min) | Amount of residual solvent (MEK: mg/m$^2$) |
|---|---|---|---|
| 3-a | Sample 1 | 30 | 8.0 |
| 3-b | (comparative | 15 | 12.0 |
| 3-c | sample) | 11 | 25 |
| 3-d | | 6 | 63 |
| 3-e | | 4 | 170 |
| 3-f | Sample 9 | 30 | 8.0 |
| 3-g | (present | 15 | 11.5 |
| 3-h | invention) | 11 | 26 |
| 3-I | | 8 | 65 |
| 3-j | | 4 | 175 |

2) Evaluation of Performance (Storage Stability)

The prepared samples were cut to half-cut size sheets, the half-cut size sheets were packed with the following packaging material under an environment of 35□ and 60% RH, preserved for one week, thereafter, similarly to Example 1, subjected to exposure and thermal development, and finally the photographic performances thereof were evaluated.

Packaging material

The packaging material is a laminated material of PET 10 μm/PE 20 μm/Al foil 9 μm/Ny 15 μm/PE containing 3% by weight of carbon 50 μm and has the following characteristics.

Oxygen transmission rate: 0.02 ml/atm/m$^2$/day at 25° C. and moisture transmission rate: 0.10 g/atm/m$^2$/day at 25° C.

Sensitivity change and fog density after the preservation under the above conditions were measured, and regarded as the measure of the storage stability. The smaller the sensitivity change is, the more excellent the storage stability is.

Furthermore, the fog density is preferable to be free from an increase. Results are shown in Table 4.

Δ fog=fog value after the preservation−fog value immediately after coating.

Sensitivity change (%)=(sensitivity after the preservation−sensitivity immediately after coating)/sensitivity immediately after coating.

TABLE 4

| Sample No. | Fog (Dmin) (Immediately after coating) | Change of Fog Density (Δ fog) | Sensitivity (immediately after coating) | Change of sensitivity (%) |
|---|---|---|---|---|
| 3-a | 0.18 | 0 | 105 | −5 |
| 3-b | 0.20 | 0.01 | 100 | −5 |
| 3-c | 0.20 | 0.01 | 100 | −5 |
| 3-d | 0.21 | 0.01 | 98 | −7 |
| 3-e | 0.22 | 0.02 | 95 | −10 |
| 3-f | 0.17 | 0 | 300 | −5 |
| 3-g | 0.18 | 0 | 300 | −5 |
| 3-h | 0.18 | 0 | 300 | −5 |
| 3-I | 0.19 | 0.01 | 294 | −15 |
| 3-j | 0.20 | 0.03 | 256 | −32 |

From results of Tables 3 and 4, it is found that the effects of the invention are effective particularly in a region where an amount of residual solvent is 150 mg/m$^2$ or less, more effective particularly in a region where the amount of residual solvent is 40 mg/m$^2$ or less, that is, the storage stability is preferable.

Example 4

1. Image-forming Layer and Surface Protective Layer 1-1. Preparation of Coating Materials 1) Preparation of Silver Halide Emulsion A first solution was prepared by dissolving 30 g of phthalized gelatin and 71.4 mg of KBr in 1500 mL of deionized water and by adding 3 mol/L of nitric acid to adjust the pH to 5.0. With the first solution being kept at 34 degree centigrade, a solution in which 27.4 g of KBr and 3.3 g of KI were dissolved in 275 mL of deionized water and a solution in which 42.5 g of silver nitrate was dissolved in 364 mL of deionized water were simultaneously added over 9.5 minutes, thereafter a solution in which 179 g of KBr and 10 mg of potassium secondary hexachloroiridium were dissolved in 812 mL of deionized water and a solution in which 127 g of silver nitrate was dissolved in 1090 mL of deionized water were simultaneously mixed over 28.5 minutes. With a pAg feedback control loop disclosed in Research Disclosure No.17643, U.S. Pat. Nos. 3,415,650, 3,782,954, and 3,821,002, the pAg was maintained at a constant value. The emulsion thus obtained was washed with water and desalted. An average particle size due to a transmission electron microscope (TEM) measurement was found to be 0.045 μm.

The obtained core-shell type silver iodobromide emulsion contains 8 mol % iodine in the core, 0 mol % iodine in the shell, 2.0 mol % iodine in total, and $2.1\times10^{-5}$ mol of iridium per mol of silver halide.

2) Preparation of Silver Halide/Organic Silver Salt Dispersion Solution

In 13 L of water, 688 g of fatty acid comprising 42 mol % behenic acid, 34 mol % arachidic acid and 24 mol % stearic acid was dissolved at 80° C. and stirred for 15 minutes followed by adding a solution in which 89.18 g of NaOH was dissolved in 1.5 L of water maintained at 80° C. further followed by mixing for 5 min, and thereby a dispersion solution was obtained. At 80° C., to the dispersion solution, a solution in which 19 mL of concentrated nitric acid was diluted in 50 mL of water was added followed by cooling to 55° C. and by stirring there for 25 minutes, thereafter, while maintaining 55 degree centigrade, an amount equivalent to 0.10 mol silver halide of a diluted emulsion in which 700 g (equivalent to 1 mol of silver halide) of the above iridium-doped silver halide emulsion is dissolved in 1.25 L of water at 42° C. was added to the dispersion solution followed by mixing for 5 minutes. Furthermore, 336.5 g of silver nitrate was dissolved in 2.5 L of water and added at 55° C. over 10 min. Thereafter, the obtained organic silver salt dispersion was transferred to a washing vessel, deionized water was added thereto followed by stirring further followed by leaving stand still, and thereby the organic silver salt dispersion was allowed to float and separate as a supernatant, and aqueous salts below the supernatant were removed. Thereafter, washing with deionized water and draining thereof were repeated until the electric conductivity of drained water became 2 μS/cm, centrifugal dewatering was applied thereto, and afterwards drying was applied at 45° C. until weight loss became zero by use of a circulation dryer with warm air whose oxygen partial pressure was 10% by volume.

3) Re-dispersion of Organic Silver Salt Containing Photosensitive Silver Halide into Organic Solvent In 780 g of methyl ethyl ketone (MEK), 209 g of the above powdery organic silver salt and 11 g of polyvinyl butyral (Butvar B-79, available from Monsanto Corp.) were dissolved, then stirred with a dissolver DISPERSMAT Model CA-40M produced by VMA-GETZMANN Co., and then left for one night at 7° C., and thereby a slurry like liquid was obtained.

The slurry was subjected to a two-pass dispersion with a pressure type homogenizer GM-2 produced by S.M.T Corp, and thereby a dispersion solution of organic silver salt containing photosensitive emulsion was prepared. At this time, the treatment pressure at the first pass is 6000 psi.

4) Preparation of Photosensitive Layer Coating Solution

After 507 g of the above re-dispersion of the organic silver salt containing photosensitive silver halide in the organic solvent was stirred at 13° C. for 15 minutes, 3.9 mL of methanol solution of 10% by weight pyridinium hydrobromide perbromide (PHP) was added. After this mixture were stirred for two hours, 5.2 mL of a methanol solution of 11% by weight calcium bromide was added. After the stirring was continued for 30 minutes, 117 g of Butvar B-79 was added. After further stirring for 30 minutes, 27.3 g of 1,1-bis(2-hydroxy-3, 5-dimethylphenyl)-2-methyl propane was added followed by further stirring for 15 minutes. Thereafter, a sensitizing dye-1 was added by $1\times10^{-3}$ mol per mol of silver halide, followed by stirring for 15 minutes. Subsequently, a solution in which 1.39 g of Desmodur N3300 (aliphatic isocyanate produced by Movey Co.) was dissolved in 12.3 g of MEK was added thereto followed by further stirring for 15 minutes and then drying at 21° C. for 15 minutes.

To 100 g of the dispersion solution, 0.03 mol of a compound of general formula (PO) according to the invention or a comparative compound (described in Table 5) per mol of coated silver amount, a compound according to the invention or types 1 through 5 (described in Table 5), 0.47 g of 4-chlorobenzophenone-2-carboxylic acid, 0.043 g of 5-methyl-2-mercaptobenzimidazole were added and stirred at 21□ for 1 hour. Subsequently, 0.368 g of phthaladine, 0.123 g of tetrachlorophthalic acid and 2 g of the dye-1 were added, and thereby an image-forming layer coating liquid was completed.

5) Preparation of Surface Protective Layer Coating Solution

With 512 g of MEK, 61 g of methanol, 48 g of cellulose acetate butyrate (CAB 171-15, available from Eastman Chemical Corp.), $5\times10^{-4}$ mol/m$^2$ of a compound PR-01 having the general formula (PR), 2.08 g of 4-methyl phthalic acid, 3.3 g of an MEK solution of 16% by weight of fluorinated polymer surfactant C, 1.9 g of polymethylmethacrylic acid (Acryloid A-21, available from Rohm and Haas Co.) and 0.5 g of 1,3-di(vinylsulfonyl)-2-propanol were mixed at room temperature, and thereby a surface protective layer coating solution was prepared.

1-2. Preparation of Photothermographic Material

The photosensitive layer coating solution and surface protective layer coating solution thus prepared were simultaneously coated in plural layers on the surface opposite to a back layer of a simular support as in Exaple 1 had been coated by a dual knife coater, and thereby photothermographic materials 4-1 through 4-25 were prepared. The coating was performed so that a photosensitive layer might have a dry thickness of 18.3 μm and a surface protective layer a dry thickness of 3.4 μm. The coating machine has dual knife-coating blades arranged in series. After the support was cut to a length comparable to a volume of used solution, hinged knives were raised and positioned above a coater bed. Subsequently, the knives were lowered and fixed at a predetermined position. A height of the knives was adjusted with a wedge measured by an ammeter controlled by a screw knob. Knife No. 1 was elevated to a clearance corresponding to a total thickness of a thickness of the support and a desired wet thickness of an image-forming layer (layer No. 1). Knife No.2 was elevated to a height equal to a total thickness of a thickness of the support plus a wet thickness of an image-forming layer (layer No. 1) plus a desired thickness of the surface protective layer (layer No. 2). Thereafter, with drying air of a temperature of 75° C. and a dew point of 10° C., the drying was applied for 15 minutes.

In the following, compounds used in Example 4 are shown.

Comparative Compound-1

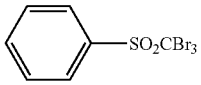

2. Evaluation of Performances 2-1. Measurement of Amount of Residual Solvent

MEK contents of the photothermographic materials thus obtained were measured under the following conditions. The MEK content thus obtained was regarded as a solvent content. A film area of 46.3 cm$^2$ was cut out, this was further finely cut into substantial 5 mm×5 mm pieces and packed in a dedicated vial, then sealed with a septum and an aluminum cap, and the vial was set to a head space sampler Model HP7694 connected to gas chromatography (GC) Model 5971 produced by Hewlett-Packard Corp. For a detector of the GC, a hydrogen flame ionization detector (FID) was used, and, for a column, DB-624 produced by J & W Co. was used. As main measurement conditions, a heating condition of the head space sampler was 120° C. for 20 min, a GC introducing temperature was 150° C., and the temperature was raised at a rate of 8 degree centigrade/min from 45° C. to 100° C. A calibration curve was prepared with a peak area of a chromatogram that was obtained by sampling a fixed amount of a buthanol-diluted MEK solution in a dedicated vial followed by measuring it similarly to the above. There was no particularly large difference found between prepared samples, and the solvent contents were in the range of 10 to 12 mg/m$^2$.

2-2. Exposure and Development

An exposure unit having, as an exposure light source, a vertical multi-mode semiconductor laser with a wavelength of 800 nm to 820 nm by high frequency superposition was made for experimentation. Exposure by laser scanning with this exposure unit was applied from an image-forming layer surface side of each of the above-prepared samples of Nos. 4-1 through 4-25. At this time, an image was recorded with an incident angle of the scanning laser on an exposure surface of the photothermographic material set at 75 degree. Then, by use of an automatic developing unit having a heating drum, in such a way as the protecting layer of the photothermographic material may come into contact with the drum surface, thermal development was conducted at 124° C. for 15 seconds. The resulting image was evaluated with a densitometer.

(Sensitivity)

The sensitivity was expressed with a reciprocal number of an exposure amount that gives a density of a fog density plus 1.0, and the relative sensitivity normalized to the sensitivity of sample No. 4-1 that was assigned to 100 was used.

(Dmin)

A density of a non-imaged portion was measured with a Macbeth densitometer.

(Image Storage Stability)

A thermal-developed sample was cut to half-cut sizes and stored for 24 hours under an environment of 30° C. and 70% RH under illumination of a fluorescent lamp of illuminance of 1000 Lux. Afterwards, an increase of a fog density of the Dmin portion was measured.

Obtained results are shown in Table 5. As shown by the results, the photothermographic materials containing compounds of types 1 through 5 according to the invention and compounds having general formulas (PO) are highly sensitive and excellent in the storage stability of the thermal-developed images.

TABLE 5

| | Compound of type 1 to 5 | | Compound of general | | | Image storage stability | |
|---|---|---|---|---|---|---|---|
| Sample No. | Kind | (*) | formula (PO) | Dmin | Sensitivity | (ΔDmin) | Note |
| 4-1 | — | — | PO-2 | 0.26 | 100 | 0.15 | Comparative example |
| 4-2 | 3 | $1\times10^{-3}$ | PO-2 | 0.15 | 315 | 0.06 | Inventive example |

TABLE 5-continued

| Sample No. | Compound of type 1 to 5 Kind | (*) | Compound of general formula (PO) | Dmin | Sensitivity | Image storage stability (ΔDmin) | Note |
|---|---|---|---|---|---|---|---|
| 4-3 | 8 | $1 \times 10^{-3}$ | PO-2 | 0.16 | 305 | 0.07 | Inventive example |
| 4-4 | 9 | $1 \times 10^{-3}$ | PO-2 | 0.17 | 320 | 0.06 | Inventive example |
| 4-5 | 10 | $1 \times 10^{-3}$ | PO-2 | 0.17 | 315 | 0.06 | Inventive example |
| 4-6 | 11 | $1 \times 10^{-3}$ | PO-2 | 0.18 | 310 | 0.07 | Inventive example |
| 4-7 | 12 | $1 \times 10^{-3}$ | PO-2 | 0.17 | 320 | 0.05 | Inventive example |
| 4-8 | 24 | $1 \times 10^{-3}$ | PO-2 | 0.18 | 322 | 0.05 | Inventive example |
| 4-9 | — | — | PO-1 | 0.21 | 97 | 0.18 | Comparative example |
| 4-10 | 13 | $1 \times 10^{-3}$ | PO-1 | 0.17 | 305 | 0.05 | Inventive example |
| 4-11 | 34 | $1 \times 10^{-3}$ | PO-1 | 0.16 | 320 | 0.07 | Inventive example |
| 4-12 | 41 | $5 \times 10^{-3}$ | PO-1 | 0.16 | 310 | 0.07 | Inventive example |
| 4-13 | 46 | $5 \times 10^{-4}$ | PO-1 | 0.17 | 305 | 0.06 | Inventive example |
| 4-14 | 56 | $5 \times 10^{-4}$ | PO-1 | 0.15 | 300 | 0.08 | Inventive example |
| 4-15 | 59 | $5 \times 10^{-4}$ | PO-1 | 0.18 | 310 | 0.07 | Inventive example |
| 4-16 | G-1 | $2 \times 10^{-3}$ | PO-1 | 0.17 | 320 | 0.07 | Inventive example |
| 4-17 | G-3 | $2 \times 10^{-3}$ | PO-1 | 0.16 | 315 | 0.08 | Inventive example |
| 4-18 | G-12 | $2 \times 10^{-3}$ | PO-1 | 0.17 | 315 | 0.07 | Inventive example |
| 4-19 | — | — | (**) | 0.25 | 90 | 0.25 | Comparative example |
| 4-20 | 3 | $1 \times 10^{-3}$ | (**) | 0.45 | 205 | 0.35 | Comparative example |
| 4-21 | 10 | $1 \times 10^{-3}$ | (**) | 0.52 | 225 | 0.28 | Comparative example |
| 4-22 | 13 | $1 \times 10^{-3}$ | (**) | 0.46 | 210 | 0.35 | Comparative example |
| 4-23 | 24 | $5 \times 10^{-4}$ | (**) | 0.38 | 195 | 0.33 | Comparative example |
| 4-24 | G-3 | $2 \times 10^{-3}$ | (**) | 0.55 | 215 | 0.40 | Comparative example |
| 4-25 | G-12 | $2 \times 10^{-3}$ | (**) | 0.45 | 220 | 0.33 | Comparative example |

(*) Addition amount (mol/mol of silver halide).
(**) Comparative compound-1.

Example 5

1) Preparation of Photosensitive Silver Halide Emulsion

In 900 mL of water, 7.5 g of ossein gelatin having an average molecular weight of 100,000 and 10 mg of potassium bromide were dissolved, and the temperature and pH thereof, respectively, were adjusted to 35° C. and 3.0, thereafter 370 mL of an aqueous solution containing 74 g of silver nitrate, 370 mL of an aqueous solution containing potassium bromide and potassium iodide in molar ratio of (98/2) and iridium chloride of $1\times10^{-4}$ mol per mol of silver were added thereto while maintaining the pAg at 7.7 by means of a controlled double jet method over 10 minutes. Thereafter, 0.3 g of 4-hydroxy-6-methyl-1,3,3a, 7-tetrazaindene was added and the pH was controlled to 5 with NaOH, and thereby cubic particles of silver bromoiodide having an average particle size of 0.06 μm, a standard deviation of particle size of 12%, and a (100) plane ratio of 87% were obtained. To the emulsion, a gelatin coagulant was added, thereby the silver halide particles were allowed to coagulate and precipitate, after desalting is applied, 0.1 g of phenoxyethanol was added, the pH and pAg, respectively, were controlled to 5.9 and 7.5, and thereby a photosensitive silver halide emulsion was obtained.

The photosensitive silver halide emulsion was heated to 55□ and $5\times10^{-5}$ mol of the compound A was added thereto. Subsequently, $7\times10^{-5}$ mol of ammonium thiocyanate and $5.3\times10^{-5}$ mol of chloruaric acid were added. In the next place, 0.3 mol % of fine particles of silver iodide was added. After ripening for 100 minutes followed by cooling to 38 degree centigrade, the chemical sensitization was complete. The above additional amounts were based on one mol of silver of the silver halide.

2) Preparation of Powdery Organic Silver Salt

In 4720 mL of distilled water, 111.4 g of behenic acid, 83.3 g of arachidic acid and 54.9 g of stearic acid were added and dissolved at 80 degree centigrade, thereafter 540.2 mL of a 1.5 N NaOH aqueous solution in water was added and 6.9 mL of concentrated nitric acid was added followed by cooling to 55 degree centigrade, and thereby a sodium salt solution of the organic acid was obtained. While the sodium salt solution of the organic acid was maintained at 55 degree centigrade, the silver halide emulsion (containing 0.038 mol of silver) and 450 mL of distilled water were added followed by stirring for 5 minutes. Subsequently, 760.6 mL of 1 mol/l silver nitrate solution was added over two minutes followed by further stirring for 20 minutes, and thereby an organic silver salt dispersion was obtained. Thereafter, the obtained organic silver salt dispersion was transferred to a washing vessel, deionized water was added thereto, then the leaving standing still, thereby the organic silver salt dispersion was allowed to float and separate as a supernatant, and aqueous salts below the supernatant were removed. Thereafter, washing with deionized water and draining thereof were repeated until the electric conductivity of drained water became 2 μS/cm, centrifugal dewatering was applied thereto, drying was applied at 40° C. with warm air whose oxygen partial pressure was 10% by volume by use of a circulation dryer until weight loss became zero, and thereby powdery organic silver salt containing photosensitive silver halide was obtained.

3) Preparation of Organic Silver Salt Dispersion Containing Photosensitive Silver Halide In 1457 g of methyl ethyl ketone (MEK), 14.57 g of polyvinyl butyral powder (Butvar B-79, available from Monsanto Corp.) was dissolved, while stirring with a dissolver type homogenizer 500 g of the organic silver salt was gradually added followed by thoroughly mixing, and thereby slurry was obtained.

The slurry was dispersed by use of a media disperser 80% by volume packed with 1 mm Zr beads (available from Toray Corp.) under the conditions of a periphery speed of 13 m and a retention in mill time of 0.5 minutes, and thereby an organic silver salt dispersion containing photosensitive silver halide was obtained.

4) Preparation of Image-forming Layer Coating Solution

To 500 g of the organic silver salt dispersion containing photosensitive silver halide, 100 g of MEK was added while stirring in a stream of nitrogen, and the resultant solution was maintained at 24 degree centigrade. A methanol solution of 10% by weight of the antifoggant 1 was added thereto by 2.5 mL followed by stirring for 15 minutes. To this mixture, 1.8 mL of a solution that contains the dye adsorption promoter and potassium acetate at a mixing ratio of 1:5 by mass and a dye adsorption promoter by 20% by weight was added followed by stirring for 15 minutes. Subsequently, $1\times10^{-3}$ mol of spectral sensitizing dye-1 was added per mol of silver halide, 7 mL of a mixed solution of 4-chloro-2-benzoyl succinic acid and 5-methyl-2-mercaptobenzimidazole as a supersensitizer (methanol solution having a mixing ratio=1:250:20 by mass and a concentration of the sensitizing dye-1=0.1% by weight), 0.03 mol per mol of a coated silver amount of a compound according to the general formula (PO) or a comparative compound (described in Table 6) and a compound of types 1 through 5 according to the invention (described in Table 6) were added and stirred for 1 hour, thereafter the temperature was lowered to 13° C. followed by further stirring for 30 minutes. With the temperature maintained at 13 degree centigrade, 48 g of polyvinyl butyral was added and thoroughly dissolved followed by adding the following additives. All of these operations were performed in a stream of nitrogen.

| | |
|---|---|
| Phthaladine | 1.5 g |
| Tetrachlorophthalic acid | 0.5 g |
| 4-methylphthalic acid | 0.5 g |
| Dye-2 | 2.0 g |

-continued

| | |
|---|---|
| Reducing agent (1, 1-bis(2-hydroxy-3, 5-dimethylphenyl)-2-3,5,5-trimethylhexane) | 15 g |
| Desmodur N3300 (aliphatic isocyanate produced by Movey Co.) | 1.10 g |
| Antifoggant 2 | 0.9 g |

5) Coating

Image-forming layer: On a surface opposite to a back layer of a support, which is coated with is the same as the Example 1, the image-forming layer coating solution was coated so that an amount of coated silver might be 1.8 g/m$^2$ and polyvinyl butyral as the binder 8.5 mg/m$^2$.

Surface protective layer: The following coating solution was coated so that a wet coating thickness would be 100 μm.

| | |
|---|---|
| Acetone | 175 ml |
| 2-propanol | 40 ml |
| Methanol | 15 ml |
| Cellulose acetate | 8 g |
| Phthaladine | 1.5 g |
| 4-methyl phthalic acid | 0.72 g |
| Tetrachlorophthalic acid | 0.22 g |
| Anhydrous tetrachlorophthalic acid | 0.5 g |
| Mono-dispersed silica having an average particle size of 4 μm (standard deviation of 20%) | 1% by weight with respect to binder |
| Fluorinated polymer surfactant C (the same as that of Example 1) | 0.5 g |

6) Evaluation of Performance

Results were evaluated as in Example 4 and are shown in Table 6. The sensitivity is shown as a relative value based on the sensitivity of sample No. 5-1. Similar to Example 4, samples according to the invention were high in the sensitivity and excellent in the image storage stability after the thermal development.

TABLE 6

| | Compound of type 1 to 5 | | Compound of general | Performance | | Image storage | |
|---|---|---|---|---|---|---|---|
| Sample No. | Kind | (*) | formula (PO) | Dmin | Sensitivity | stability | Note |
| 5-1 | — | — | PO-2 | 0.23 | 100 | 0.22 | Comparative example |
| 5-2 | 3 | $1\times10^{-3}$ | PO-2 | 0.15 | 305 | 0.08 | Inventive example |
| 5-3 | 8 | $1\times10^{-3}$ | PO-2 | 0.17 | 315 | 0.07 | Inventive example |
| 5-4 | 24 | $1\times10^{-3}$ | PO-2 | 0.16 | 325 | 0.05 | Inventive example |
| 5-5 | 46 | $1\times10^{-3}$ | PO-2 | 0.15 | 320 | 0.06 | Inventive example |
| 5-6 | G-1 | $1\times10^{-3}$ | PO-2 | 0.17 | 312 | 0.08 | Inventive example |
| 5-7 | — | — | PO-1 | 0.22 | 98 | 0.25 | Comparative example |
| 5-8 | 3 | $2\times10^{-3}$ | PO-1 | 0.15 | 320 | 0.08 | Inventive example |
| 5-9 | 8 | $2\times10^{-3}$ | PO-1 | 0.16 | 305 | 0.07 | Inventive example |
| 5-10 | 24 | $2\times10^{-3}$ | PO-1 | 0.15 | 330 | 0.06 | Inventive example |
| 5-11 | 41 | $2\times10^{-3}$ | PO-1 | 0.17 | 315 | 0.08 | Inventive example |
| 5-12 | 46 | $2\times10^{-3}$ | PO-1 | 0.15 | 320 | 0.05 | Inventive example |
| 5-13 | G-3 | $5\times10^{-4}$ | PO-1 | 0.17 | 305 | 0.07 | Inventive example |
| 5-14 | — | — | (**) | 0.28 | 90 | 0.30 | Comparative example |
| 5-15 | 3 | $5\times10^{-4}$ | (**) | 0.47 | 175 | 0.35 | Comparative example |
| 5-16 | 8 | $5\times10^{-4}$ | (**) | 0.52 | 185 | 0.38 | Comparative example |
| 5-17 | 24 | $5\times10^{-4}$ | (**) | 0.62 | 185 | 0.42 | Comparative example |
| 5-18 | 46 | $5\times10^{-4}$ | (**) | 0.45 | 190 | 0.35 | Comparative example |

(*) Addition amount (mol/mol of silver halide).

(**) Comparative compound-1.

Example 6

1) Preparation of Samples

In the preparation of sample 1 (comparative sample) and sample 8 (present invention) of Example 4, by varying the drying time period, samples having different amounts of residual solvent (MEK) were prepared. It goes without saying that the shorter the drying time period was, the greater the amount of the residual solvent was, and the longer the drying time period was, the smaller the amount of the residual solvent was.

The amounts of the residual solvent of the obtained samples were measured as in Example 4, and results are shown in Table 7.

TABLE 7

| Sample No. | Coating prescription | Drying time period (min) | Amount of residual solvent (MEK: mg/m$^2$) |
|---|---|---|---|
| 5-1-a | Sample 1 | 30 | 8.0 |
| 5-1-b | (comparative | 15 | 12.0 |
| 5-1-c | sample) | 11 | 25 |
| 5-1-d | | 6 | 63 |
| 5-1-e | | 4 | 170 |
| 5-8-a | Sample 8 | 30 | 8.0 |
| 5-8-b | (present | 15 | 11.5 |
| 5-8-c | invention) | 11 | 26 |
| 5-8-d | | 8 | 65 |
| 5-8-e | | 4 | 175 |

2) Evaluation of Performance (Storage Stability)

The prepared sample was cut to half-cut size sheets, packed with the following packaging material under an environment of 35° C. and 60% RH, then was preserved for one week, thereafter, similar to Example 4, then subjected to exposure and thermal development, and thereafter the photographic characteristics were evaluated.

Packaging Material

The packaging material was a laminated material of PET 10 μm/PE 20 μm/Al foil 9 μm/Ny 15 μm/PE containing 3% by weight of carbon 50 μm, and has the following characteristics.

Oxygen transmission rate: 0.02 ml/atm/m$^2$/day at 25 degree centigrade

Moisture transmission rate: 0.10 g/atm/m$^2$/day at 25 degree centigrade.

Sensitivity change and fog density after the preservation under the above conditions were measured and regarded as the measures of the storage stability. The smaller the sensitivity change is, the more excellent the storage stability is. Furthermore, the fog density is preferably free from an increase. Results are shown in Table 8.

Δ fog=fog value after the preservation−fog value immediately after coating.

Sensitivity change(%)=(sensitivity after the preservation−sensitivity immediately after coating)/sensitivity immediately after coating.

TABLE 8

| Sample No. | Fog (Dmin) (Immediately after coating) | Change of Fog Density (Δ fog) | Sensitivity (immediately after coating) | Change of sensitivity (%) |
|---|---|---|---|---|
| 5-1-a | 0.2 | 0 | 104 | −5 |
| 5-1-b | 0.22 | 0.01 | 100 | −5 |
| 5-1-c | 0.22 | 0.02 | 98 | −7 |
| 5-1-d | 0.23 | 0.03 | 96 | −9 |
| 5-1-e | 0.25 | 0.03 | 90 | −12 |
| 5-8-a | 0.15 | 0 | 307 | −3 |
| 5-8-b | 0.16 | 0 | 305 | −5 |
| 5-8-c | 0.16 | 0 | 304 | −8 |
| 5-8-d | 0.17 | 0.01 | 298 | −18 |
| 5-8-e | 0.18 | 0.03 | 285 | −23 |

From results of Tables 7 and 8, it is found that the effects of the invention are effective particularly in a region where an amount of residual solvent is 150 mg/m$^2$ or less, more effective particularly in a region where the amount of residual solvent is 40 mg/m$^2$ or less, that is, the storage stability is preferable.

Example 7

1. Image-forming Layer and Surface Protective Layer 1-1. Preparation of Coating Materials 1) Preparation of Silver Halide Emulsion In 1500 mL of deionized water, 30 g of phthalized gelatin and 71.4 mg of KBr were dissolved, the pH thereof was adjusted to 5.0 by adding 3 mol/L of nitric acid, and thereby a first solution was obtained. With the first solution being maintained at 34 degree centigrade, a solution in which 27.4 g of KBr and 3.3 g of KI were dissolved in 275 mL of deionized water and a solution in which 42.5 g of silver nitrate was dissolved in 364 mL of deionized water were simultaneously added over 9.5 minutes. Thereafter, a solution in which 179 g of KBr and 10 mg of potassium secondary hexachloroiridium were dissolved in 812 mL of deionized water and a solution in which 127 g of silver nitrate was dissolved in 1090 mL of deionized water were simultaneously mixed over 28.5 minutes. With a pAg feedback control loop disclosed in Research Disclosure No.17643, U.S. Pat. Nos. 3,415,650, 3,782,954, and 3,821,002, the pAg was maintained at a constant value. Thus obtained emulsion was washed to desalt. An average particle size due to a transmission electron microscope (TEM) measurement was found to be 0.045 μm.

The obtained core-shell type silver iodobromide emulsion contains 8 mol % of core iodine, 0 mol % of shell iodine, 2 mol % of total iodine, and $2.1\times10^{-5}$ mol of iridium per mol of silver halide.

2) Preparation of Silver Halide/Organic Silver Salt Dispersion Solution

In 13 L of water, 688 g of fatty acid comprising 42 mol % of behenic acid, 34 mol % of arachidic acid and 24 mol % of stearic acid was dissolved at 80° C. and stirred for 15 minutes. Thereafter, 89.18 g of NaOH was dissolved in 1.5 L of water at 80° C. and this solution was added to the above solution and mixed for 5 min, and thereby a dispersion solution was formed. At 80° C., to the dispersion solution, a solution in which 19 mL of concentrated nitric acid is diluted in 50 mL of water was added, the dispersion solution was cooled to 55° C. and stirred for 25 minutes, thereafter, while maintaining 55 degree centigrade, an amount equivalent to 0.10 mol of silver halide of a diluted emulsion in which 700 g (equivalent to 1 mol silver halide) of the above iridium-doped silver halide emulsion was dissolved in 1.25 L of water at 42□ was added to the dispersion solution and mixed for 5 minutes. Furthermore, to the dispersion solution, a solution in which 336.5 g of silver nitrate was dissolved in 2.5 L of water was added at 55° C. over 10 minutes. Thereafter, the obtained organic silver salt dispersion was transferred to a washing vessel, deionized water was added followed by stirring further followed by leaving standing still, and thereby the organic silver salt dispersion was allowed to float and separate as a supernatant, and aqueous salts below the supernatant was removed. Thereafter, washing with deionized water and draining thereof were repeated until the electric conductivity of drained water became 2 μS/composite material followed by centrifugal dewatering, thereafter drying was applied at 45° C. until weight loss became zero by use of a circulation dryer with warm air whose oxygen partial pressure was 10% by volume.

3) Re-Dispersion of Organic Silver Salt Containing Photosensitive Silver Halide into Organic Solvent In 780 g of methyl ethyl ketone (MEK), 209 g of the above powdery organic silver salt and 11 g of polyvinyl butyral (Butvar B-79, available from Monsanto Corp.) were dissolved followed by stirring by use of a dissolver DISPERSMAT Model CA-40M produced by VMA-GETZMANN Co. further followed by leaving one night at 7 degree centigrade, and thereby a slurry like solution was obtained.

The slurry was subjected to two-pass dispersion by use of a pressure type homogenizer Model GM-2 produced by S.M.T Corp, and thereby a dispersion solution of organic silver salt containing photosensitive emulsion was prepared. At this time, the treatment pressure at the first pass was 6000 psi.

4) Preparation of Photosensitive Layer Coating Solution

After stirring 507 g of the re-dispersion that was obtained by dispersing the organic silver salt containing photosensitive silver halide in the organic solvent at 13□ for 15 minutes, 3.9 mL of a methanol solution of 10% by weight pyridinium hydrobromide perbromide (PHP) was added. After stirring for two hours, 5.2 mL of a methanol solution of 11% by weight calcium bromide was added. After the stirring was continued for 30 minutes, 117 g of Butvar B-79 was added. After further stirring for 30 minutes, 27.3 g of 1,1-bis(2-hydroxy-3, 5-dimethylphenyl)-2-methyl propane and 2.73 g of 3-tribromomethylsulfonyl-naphthalene were added followed by further stirring for 15 minutes. Thereafter, $1\times10^{-3}$ mol of a sensitizing dye-1 was added per mol of silver halide followed by stirring for 15 minutes. Subsequently, a solution in which 1.39 g of Desmodur N3300 (aliphatic isocyanate produced by Movey Co.) was dissolved in 12.3 g of MEK was added followed by further stirring for 15 minutes and followed by heating at 21° C. for 15 minutes.

To 100 g of the dispersion solution, $1\times10^{-3}$ mol per mol of silver halide of a compound of types 1 through 5 according to the invention (described in Table 9), $2\times10^{-2}$ mol of a compound of general formula (T) (described in Table 9), and $1\times10^{-2}$ mol of a macrocyclic compound containing a hetero atom (described in Table 9), and 0.47 g of 4-chlorobenzophenone-2-carboxylic acid, 0.043 g of 5-methyl-2-mercaptobenzimidazole were added followed by stirring at 21° C. for 1 hour. Subsequently, 0.368 g of phthaladine, 0.123 g of tetrachlorophthalic acid and 2 g of the dye-1 were added, and thereby an image-forming layer coating solution was completed.

5) Preparation of Surface Protective Layer Coating Solution

To 512 g of MEK, 61 g of methanol, 48 g of cellulose acetate butyrate (CAB 171-15, available from Eastman Chemical Corp.), 2.08 g of 4-methyl phthalic acid, 3.3 g of an MEK solution of 16% by weight fluorinated polymer surfactant C, 1.9 g of polymethylmethacrylic acid (Acryloid A-21, available from Rohm and Haas Co.), 2.5 mL of a methanol solution of 1% by weight benzotriazole, and 0.5 g of 1,3-di(vinylsulfonyl)-2-propanol were mixed at room temperature, and thereby a surface protective layer coating solution was prepared.

1-2. Preparation of Photothermographic Material

The photosensitive layer coating solution and surface protective layer coating solution prepared as mentioned above were simultaneously coated in plural layers on a surface opposite to a back layer of a simular support as in Example 1, and thereby photothermographic materials 7-1 through 7-25 were prepared. The coating was performed so that a photosensitive layer might have a dry thickness of 18.3 μm and a surface protective layer a dry thickness of 3.4 μm. This apparatus consists of dual knife-coating blades in series. After the support was cut to a length comparable to the volume of solution used, the hinged knives were raised and placed in position on the coater bed. The knives were then lowered and locked into place. The height of the knives was adjusted with wedges controlled by screw knobs and measured with ammeters. Knife No. 1 was raised to a clearance corresponding to a total height of the thickness of the support plus the desired wet thickness of the image-forming layer (layer No. 1). Knife No. 2 was raised to a height equal to a total height of the thickness of the support plus the wet thickness of the image-forming layer (layer No. 1) plus the desired thickness of the surface protective layer (layer No. 2). Thereafter, with drying air having a drying temperature of 75° C. and a dew temperature of 10° C., the drying was applied for 15 minutes.

2. Evaluation of Performances

1) Measurement of Amount of Residual Solvent

A MEK content of thus obtained photothermographic material was obtained under the following conditions. The MEK content thus obtained was regarded as a solvent content. A film area of 46.3 $cm^2$ was cut out, this was further cut finely into substantial 5 mm×5 mm pieces and packed in a dedicated vial, then sealed with a septum and an aluminum cap. Thereafter, the vial was set to a head space sampler HP7694 Type connected to a gas chromatography (GC) Model 5971 produced by Hewlett-Packard Corp. For a detector of the GC, a hydrogen flame ionization detector (FID) was used, and, for a column, DB-624 produced by J & W Co. was used. As main measurement conditions, a heating condition of the head space sampler was 120° C. for 20 minutes, a GC introducing temperature was 150 degree centigrade, and the temperature was raised from 45° C. held for 3 minutes to 100° C. at a rate of 8 degree centigrade/min. A calibration curve was prepared with a peak area of a chromatogram that was obtained by sampling a fixed amount of a buthanol-diluted MEK solution in a dedicated vial and measuring it as above. There was no particularly large difference found between prepared samples, and the solvent contents were in the range of 10 to 12 $mg/m^2$.

2) Exposure and Development

An exposure unit having, as an exposure light source, a vertical multi-mode semiconductor laser with a wavelength of 800 nm to 820 nm by high frequency superposition was made for experimentation. Exposure by laser scanning with this exposure unit was applied from an image-forming layer surface side of each of the above-prepared samples of Nos. 7-1 through 7-25. At this time, an image was recorded with an incident angle of the scanning laser on an exposure surface of the photosensitive material set at 75 degree. Then, with an automatic developing unit having a heating drum, in such a way as the protective layer of the photosensitive material may come into contact with a drum surface, thermal development was conducted at 124° C. for 15 seconds. The resulting image was evaluated with a densitometer.

(Sensitivity)

The sensitivity is expressed with a reciprocal number of an exposure amount that gives a blackening density of a fog density plus 1.0, and the relative sensitivity normalized to the sensitivity of sample No. 7-1 that was assigned to 100 was used.

(Dmin)

A density of a non-imaged portion was measured with a Macbeth densitometer.

(Image Storage Stability)

A thermal-developed sample was cut to half-cut size sheets and stored for 24 hours under an environment of 30° C. and 70% RH under illumination of a fluorescent lamp at an illuminance of 1000 Lux. Afterwards, an increase in a fog density of the Dmin portion was measured.

Obtained results are shown in Table 9. As the results show, the photothermographic materials according to the invention maintained the low fog density, were high in the sensitivity and excellent in the printout properties after the thermal-development. On the other hand, comparative samples containing a compound having the general formula (T) and a macrocyclic compound, though exhibiting an increase in the sensitivity, were not improved in the printout properties. Furthermore, surprisingly, it was found that the compound having the general formula (T) and the macrocyclic compound, in a system that was sensitized with a compound of types 1 through 5 according to the invention, hardly exhibited the sensitization. In a system that was sensitized with a compound of types 1 through 5 according to the invention, the compound having the general formula (T) and the macrocyclic compound exhibited an improvement in the printout properties as an unexpected effect.

TABLE 9

| Sample No. | Compound of Type 1 through 5 | Compound of general formula (T) | Macrocyclic compound | Dmin | Sensitivity | Printout properties (ΔDmin) | Note |
|---|---|---|---|---|---|---|---|
| 7-1 | — | — | — | 0.20 | 100 | 0.15 | (*) |
| 7-2 | — | 1-23 | S-19 | 0.20 | 220 | 0.18 | (*) |
| 7-3 | — | 1-26 | S-19 | 0.21 | 240 | 0.21 | (*) |
| 7-4 | 24 | — | — | 0.18 | 300 | 0.18 | (*) |
| 7-5 | 41 | — | — | 0.19 | 305 | 0.19 | (*) |
| 7-6 | G-1 | — | — | 0.18 | 295 | 0.18 | (*) |
| 7-7 | 3 | 1-23 | S-19 | 0.16 | 305 | 0.07 | (**) |
| 7-8 | 9 | 1-23 | S-19 | 0.17 | 310 | 0.05 | (**) |
| 7-9 | 13 | 1-23 | S-19 | 0.16 | 315 | 0.06 | (**) |
| 7-10 | 24 | 1-23 | S-19 | 0.16 | 335 | 0.06 | (**) |
| 7-11 | 34 | 1-23 | S-19 | 0.17 | 320 | 0.07 | (**) |
| 7-12 | 41 | 1-23 | S-19 | 0.15 | 330 | 0.05 | (**) |
| 7-13 | G-1 | 1-23 | S-19 | 0.18 | 310 | 0.07 | (**) |
| 7-14 | 3 | 1-26 | S-19 | 0.16 | 300 | 0.06 | (**) |
| 7-15 | 9 | 1-26 | S-19 | 0.17 | 315 | 0.07 | (**) |
| 7-16 | 13 | 1-26 | S-19 | 0.17 | 320 | 0.08 | (**) |
| 7-17 | 24 | 1-26 | S-19 | 0.16 | 335 | 0.07 | (**) |
| 7-18 | 41 | 1-26 | S-19 | 0.17 | 330 | 0.06 | (**) |
| 7-19 | G-1 | 1-26 | S-19 | 0.18 | 310 | 0.08 | (**) |

(*) Comparative example
(**) Present invention

Example 8

1) Preparation of Samples

In the preparation of sample 7-2 (comparative sample) and sample 7-10 (present invention) according to Example 7, by varying the drying time period, samples having different amounts of residual solvent (MEK) were prepared. It goes without saying that the shorter the drying time period is, the greater the amount of the residual solvent is, and the longer the drying time period is, the smaller the amount of the residual solvent is.

The amounts of the residual solvent of the obtained samples were measured as in Example 7, and results are shown in Table 10.

TABLE 10

| Sample No. | Coating prescription | Drying time period (min) | Amount of residual solvent (MEK: mg/m$^2$) |
|---|---|---|---|
| 7-2-a | Sample 2 | 30 | 7.0 |
| 7-2-b | (comparative | 15 | 11.5 |
| 7-2-c | sample) | 11 | 24 |
| 7-2-d | | 6 | 64 |
| 7-2-e | | 4 | 165 |
| 7-10-a | Sample 10 | 30 | 7.5 |
| 7-10-b | (present | 15 | 11.5 |
| 7-10-c | invention) | 11 | 25 |
| 7-10-d | | 8 | 65 |
| 7-10-e | | 4 | 170 |

2) Evaluation of Performance (Storage Stability)

Each of the prepared samples was cut into half-cut size sheets, packed with the following packaging material under an environment of 35° C. and 60% RH and preserved for one week. Thereafter, similarly to Example 7, exposure and thermal development were conducted followed by evaluating the photographic characteristics.

Packaging Material

The packaging material was a laminated material of PET 10 μm/PE 20 μm/Al foil 9 μm/Ny 15 μm/PE containing 3% by weight of carbon 50 μm and had the following characteristics.

Oxygen transmission rate: 0.02 ml/atm/$m^2$/day at 25° C. and moisture transmission rate: 0.10 g/atm/$m^2$/day at 25° C.

Sensitivity change and fog density after the preservation under the above conditions were measured and regarded as the measures of the storage stability. The smaller the sensitivity change is, the more excellent the storage stability is. Furthermore, the fog density is preferably free from an increase. Results are shown in Table 11.

Δ fog=fog value after the preservation−fog value immediately after coating.

Sensitivity change(%)=(sensitivity after the preservation−sensitivity immediately after coating)/sensitivity immediately after coating.

TABLE 11

| Sample No. | Fog (Dmin) (Immediately after coating) | Change of Fog Density (Δ fog) | Sensitivity (immediately after coating) | Change of sensitivity (%) |
|---|---|---|---|---|
| 7-2-a | 0.19 | 0 | 230 | -5 |
| 7-2-b | 0.20 | 0.01 | 220 | -5 |
| 7-2-c | 0.20 | 0.01 | 210 | -5 |
| 7-2-d | 0.21 | 0.01 | 185 | -7 |
| 7-2-e | 0.22 | 0.02 | 170 | -10 |
| 7-10-a | 0.17 | 0 | 320 | -5 |
| 7-10-b | 0.18 | 0 | 305 | -5 |
| 7-10-c | 0.18 | 0 | 300 | -5 |
| 7-10-d | 0.19 | 0.01 | 290 | -15 |
| 7-10-e | 0.20 | 0.02 | 275 | -32 |

From the results of Table 11, it is found that the effects of the invention were particularly effective in a region where an amount of residual solvent was 150 mg/$m^2$ or less, particularly more effective in a region where the amount of residual solvent was 40 mg/$m^2$ or less, that is, the storage stability is preferable.

Example 9

1. Image-forming Layer and Surface Protective Layer 1-1. Preparation of Coating Materials 1) Preparation of Silver Halide Emulsion A In 1500 mL of deionized water, 30 g of phthalized gelatin and 71.4 mg of KBr were dissolved, the pH thereof was adjusted to 5.0 by adding 3 mol/L of nitric acid, and thereby a first solution was obtained. With the first solution being maintained at 34° C., a solution in which 27.4 g of KBr and 3.3 g of KI were dissolved in 275 mL of deionized water and a solution in which 42.5 g of silver nitrate was dissolved in 364 mL of deionized water were simultaneously added over 9.5 min, thereafter a solution in which 179 g of KBr and 10 mg of potassium secondary hexachloroiridium were dissolved in 812 mL of deionized water and a solution in which 127 g of silver nitrate was dissolved in 1090 mL of deionized water were simultaneously mixed over 28.5 min. By use of a pAg feedback control loop disclosed in Research Disclosure No.17643, U.S. Pat. Nos. 3,415,650, 3,782,954, and 3,821,002, the pAg was maintained at a constant value. The emulsion thus obtained was washed to desalt. An average particle size due to a transmission electron microscope (TEM) measurement was found to be 0.045 μm.

The obtained core-shell type silver iodobromide emulsion contained 8 mol % of core iodine, 0 mol % of shell iodine, 2 mol % of total iodine, and $2.1\times10^{-5}$ mol of iridium per mol of silver halide.

2) Preparation of Silver Halide/Organic Silver Salt Dispersion Solution

In 13 L of water, 688 g of fatty acid comprising 42 mol % of behenic acid, 34 mol % of arachidic acid and 24 mol % of stearic acid was dissolved at 80° C. followed by mixing for 15 minutes. Thereafter, to this mixture, a solution in which 89.18 g of NaOH was dissolved in 1.5 L of water at 80° C. was added followed by mixing for 5 minutes, and thereby a dispersion solution was formed. At 80 degree centigrade, to the dispersion solution, a solution in which 19 mL of concentrated nitric acid was diluted in 50 mL of water was added, the dispersion solution was cooled to 55° C. followed by stirring for 25 minutes. Thereafter, while maintaining at 55 degree centigrade, an amount equivalent to 0.10 mol of silver halide of a diluted emulsion in which 700 g (equivalent to 1 mol of silver halide) of the above iridium-doped silver halide emulsion was dissolved in 1.25 L of water at 42° C. was added to the dispersion solution followed by mixing for 5 minutes. Furthermore, 336.5 g of silver nitrate was dissolved in 2.5 L of water and added at 55° C. over 10 minutes. Thereafter, the obtained organic silver salt dispersion was transferred to a washing vessel, deionized water was added followed by stirring further followed by leaving standing still, and thereby the organic silver salt dispersion was allowed to float and separate as a supernatant, and aqueous salts below the supernatant were removed. Thereafter, the washing with deionized water and draining thereof were repeated until the electric conductivity of drained water became 2 μS/cm, centrifugal dewatering was applied thereto, and drying was applied at 45° C. until weight loss became zero by use of a circulation dryer with warm air whose oxygen partial pressure was 10% by volume.

3) Re-dispersion of Organic Silver Salt Containing Photosensitive Silver Halide into Organic Solvent In 780 g of methyl ethyl ketone (MEK), 209 g of the above powdery organic silver salt and 11 g of polyvinyl butyral powder (Butvar B-79, available from Monsanto Corp.) were dissolved followed by stirring with a dissolver DISPERMAT Model CA-40M produced by VMA-GETZMANN Co. then left for one night at 7 degree centigrade, and thereby a slurry like solution was obtained.

The slurry was subjected to two-pass dispersion by use of a pressure type homogenizer Model GM-2 produced by S.M.T Corp, and thereby a dispersion solution of organic silver salt containing photosensitive emulsion was prepared. At this time, the treatment pressure at the first pass was 6000 psi.

4) Preparation of Photosensitive Layer Coating Solution

After 507 g of the re-dispersion that was obtained by re-dispersing the organic silver salt containing photosensitive silver halide in the organic solvent was stirred at 13° C. for 15 minutes, to this mixture, 3.9 mL of a methanol solution containing 10% by weight pyridinium hydrobromide perbromide (PHP) was added. After stirring for two hours, 5.2 mL of a methanol solution of 11% by weight calcium bromide was added. After the stirring had continued for 30 minutes, 117 g of Butvar B-79 was added. After further stirring for 30 minutes, 27.3 g of 1, 1-bis(2-hydroxy-3,5-dimethylphenyl)-2-methyl propane was added followed by further stirring for 15 minutes. Thereafter, 2.73 g of 2-(tribromomethylsulfonyl)quinoline was added followed by stirring for 15 minutes. Subsequently, a solution in which 1.39 g of Desmodur N3300 (aliphatic isocyanate produced by Movey Co.) was dissolved in 12.3 g of MEK was added followed by further stirring for 15 minutes further followed by heating at 21° C. for 15 minutes.

To 100 g of the dispersion solution, 1 mg of a sensitizing dye according to the invention (described in Table 12), and a compound according to the invention (described in Table 12), 0.47 g of 4-chlorobenzophenone-2-carboxylic acid, and 0.043 g of 5-methyl-2-mercaptobenzimidazole were added followed by stirring at 21□ for 1 hour. Subsequently, 0.368 g of phthaladine, 0.123 g of tetrachlorophthalic acid and 2 g of the dye-1 were added, and thereby an image-forming layer coating solution was completed.

5) Preparation of Surface Protective Layer Coating Solution

To 512 g of MEK, 61 g of methanol, 48 g of cellulose acetate butyrate (CAB 171-15, available from Eastman Chemical Corp.), 2.08 g of 4-methyl phthalic acid, 3.3 g of an MEK solution of 16% by weight fluorinated polymer surfactant C, 1.9 g of polymethylmethacrylic acid (Acryloid A-21, available from Rohm and Haas Co.), and 0.5 g of 1,3-di (vinylsulfonyl)-2-propanol were mixed at room temperature, and thereby a surface protective layer coating solution was prepared.

3-2. Preparation of Photothermographic Materials

The photosensitive layer coating solution and surface protective layer coating solution prepared as mentioned above were simultaneously coated in plural layers on a surface opposite to a back layer of a support, on which a back layer was coated, and thus heat developable photosensitive materials 9-1 through 9-25 were prepared. The coating was performed so that a photosensitive layer would have a dry thickness of 18.3 μm and a surface protective layer would have a dry thickness of 3.4 μm. This apparatus consists of dual knife-coating blades in series. After the support was cut to a length comparable to the volume of solution used, the hinged knives were raised and placed in a position on the coater bed. The knives were then lowered and locked into a predetermined place. The height of the knives was adjusted with wedges controlled by screw knobs and measured with ammeters. Knife #1 was raised to a clearance corresponding to a total height of the thickness of the support plus the desired thickness of the image-forming layer (layer No. 1). Knife No. 2 was raised to a height equal to a total height of the thickness of the support plus the wet thickness of the image-forming layer (layer No. 1) plus the desired thickness of the surface protective layer (layer No. 2). Thereafter, with drying air of a temperature of 75° C. and a dew point of 10° C., the drying was applied for 15 minutes.

In the following, compounds used in Embodiment 9 are shown.

Comparative Sensitizing Dye

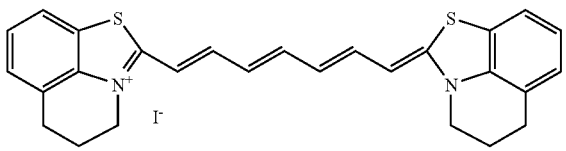

2. Evaluation of Performances

1) Measurement of Amount of Residual Solvent

An MEK contents of thus obtained photothermographic materials were obtained under the following conditions. Thus obtained MEK content was regarded as a solvent content. A film area of 46.3 $cm^2$ was cut out, this was further finely cut into substantial 5 mm×5 mm pieces and packed in a dedicated vial, then sealed with a septum and an aluminum cap. Thereafter, the vial was set to a head space sampler Model HP7694 connected to a gas chromatography (GC) Model 5971 produced by Hewlett-Packard Corp. For a detector of the GC, a hydrogen flame ionization detector (FID) was used, and, for a column, DB-624 produced by J & W Co. was used. As main measurement conditions, heating conditions of the head space sampler were 120□ and 20 min, a GC introducing temperature was 150 degree centigrade, and the temperature was raised from 45□ held for 3 minutes to 100□ at a rate of 8 degree centigrade/min. A calibration curve was prepared with a peak area of a chromatogram that was obtained by sampling a fixed amount of a buthanol-diluted MEK solution in a dedicated vial and measuring it similarly to the above. There was no particularly large difference found between prepared samples, and the solvent contents were in the range of 10 to 12 $mg/m^2$.

2) Exposure and Development

An exposure unit having, as an exposure light source, a vertical multi-mode semiconductor laser with a wavelength of 800 nm to 820 nm by high frequency superposition was made for experimentation. Exposure by laser scanning with this exposure unit was applied from an image-forming layer surface side of each of the above-prepared samples of Nos. 9-1 through 9-25. At this time, an image was recorded with an incident angle of the scanning laser on an exposure surface of the photosensitive material set at 75 degree. Then, by use of an automatic developing unit having a heating drum, in such a way as the protective layer of the photosensitive material may come into contact with a drum surface, thermal development was conducted at 124° C. for 15 seconds. The resulting image was evaluated with a densitometer.

(Sensitivity)

The sensitivity is expressed with a reciprocal number of an exposure amount that gives a blackening density of a fog density plus 1.0, and the relative sensitivity normalized to the sensitivity of sample No.9-1 that was assigned to 100 was used.

(Dmin)

A density of a non-imaged portion was measured with a Macbeth densitometer.

(Image Storage Stability)

A thermal developed sample was cut to half-cut size sheets and stored for 24 hours under an environment of 30° C. and 70% RH under illumination of a fluorescent lamp of illuminance of 1000 Lux. Afterwards, an increase in a fog density of the Dmin portion was measured.

Obtained results are shown in Table 12. As obvious from the results, the photothermographic materials containing compounds of types 1 through 5 according to the invention and spectral sensitizing dyes of general formulas (D-a) through (D-d) were highly sensitive and excellent in the storage stability of the thermal-developed images.

TABLE 12

| Sample No. | Compound of type 1 to 5 Kind | (*) | Sensitizing dye | Dmin | Sensitivity | Image storage stability (ΔDmin) | Note |
|---|---|---|---|---|---|---|---|
| 9-1 | — | — | 5 | 0.20 | 100 | 0.15 | Comparative example |
| 9-2 | 3 | $1 \times 10^{-3}$ | 5 | 0.17 | 325 | 0.06 | Inventive example |
| 9-3 | 8 | $1 \times 10^{-3}$ | 5 | 0.17 | 305 | 0.07 | Inventive example |
| 9-4 | 9 | $1 \times 10^{-3}$ | 5 | 0.18 | 310 | 0.08 | Inventive example |
| 9-5 | 10 | $1 \times 10^{-3}$ | 5 | 0.18 | 320 | 0.05 | Inventive example |
| 9-6 | 11 | $1 \times 10^{-3}$ | 20 | 0.16 | 315 | 0.06 | Inventive example |
| 9-7 | 12 | $1 \times 10^{-3}$ | 20 | 0.17 | 305 | 0.07 | Inventive example |
| 9-8 | 13 | $1 \times 10^{-3}$ | 20 | 0.18 | 295 | 0.05 | Inventive example |
| 9-9 | 24 | $1 \times 10^{-3}$ | 20 | 0.17 | 330 | 0.04 | Inventive example |
| 9-10 | 34 | $1 \times 10^{-3}$ | 41 | 0.17 | 320 | 0.06 | Inventive example |
| 9-11 | 41 | $1 \times 10^{-3}$ | 41 | 0.17 | 320 | 0.05 | Inventive example |
| 9-12 | 46 | $5 \times 10^{-4}$ | 41 | 0.18 | 315 | 0.07 | Inventive example |
| 9-13 | 56 | $5 \times 10^{-4}$ | 41 | 0.17 | 310 | 0.05 | Inventive example |
| 9-14 | 59 | $5 \times 10^{-4}$ | 41 | 0.18 | 325 | 0.06 | Inventive example |
| 9-15 | G-1 | $2 \times 10^{-3}$ | 5 | 0.18 | 300 | 0.07 | Inventive example |
| 9-16 | G-3 | $2 \times 10^{-3}$ | 5 | 0.16 | 310 | 0.06 | Inventive example |
| 9-17 | G-12 | $2 \times 10^{-3}$ | 5 | 0.18 | 315 | 0.07 | Inventive example |
| 9-18 | — | — | (**) | 0.25 | 90 | 0.20 | Comparative example |
| 9-19 | 3 | $1 \times 10^{-3}$ | (**) | 0.30 | 175 | 0.23 | Comparative example |
| 9-20 | 10 | $1 \times 10^{-3}$ | (**) | 0.35 | 190 | 0.25 | Comparative example |
| 9-21 | 13 | $1 \times 10^{-3}$ | (**) | 0.40 | 215 | 0.26 | Comparative example |
| 9-22 | 24 | $5 \times 10^{-4}$ | (**) | 0.35 | 205 | 0.22 | Comparative example |
| 9-23 | G-3 | $2 \times 10^{-3}$ | (**) | 0.5 | 210 | 0.19 | Comparative example |
| 9-24 | — | — | 20 | 0.26 | 95 | 0.15 | Comparative example |
| 9-25 | — | — | 41 | 0.28 | 90 | 0.16 | Comparative example |

(*) Addition amount (mol/mol of silver halide)
(**) Comparative sensitizing dye

Example 10

(Preparation of Silver Halide Emulsions B through I)

In the silver halide emulsion A according to Example 9, the iodine composition between the core and the shell and the addition amount of iridium compound were varied, and thereby the following silver halides B through I were obtained.

TABLE 13

| Em No. | Core Silver ratio | Core Iodine | Core Ir | Shell Silver ratio | Shell Iodine | Shell Ir | Total Iodine | Total Ir |
|---|---|---|---|---|---|---|---|---|
| A | 25% | 8 | 0 | 75% | 0 | $2.8 \times 10^{-5}$ | 2 | $2.1 \times 10^{-5}$ |
| B | 25% | 0 | 0 | 75% | 0 | 0 | 0 | 0 |
| C | 25% | 0 | 0 | 75% | 0 | $2.8 \times 10^{-5}$ | 0 | $2.1 \times 10^{-5}$ |
| D | 25% | 0.8 | 0 | 75% | 0.8 | $2.8 \times 10^{-5}$ | 0.8 | $2.1 \times 10^{-5}$ |

TABLE 13-continued

| Em No. | Core Silver ratio | Core Iodine | Core Ir | Shell Silver ratio | Shell Iodine | Shell Ir | Total Iodine | Total Ir |
|---|---|---|---|---|---|---|---|---|
| E | 25% | 3.5 | 0 | 75% | 3.5 | $1.3 \times 10^{-4}$ | 3.5 | $1 \times 10^{-4}$ |
| F | 50% | 8 | $2 \times 10^{-4}$ | 50% | 0 | 0 | 4 | $1 \times 10^{-4}$ |
| G | 50% | 12 | 0 | 50% | 12 | 0 | 12 | 0 |
| H | 50% | 24 | $2 \times 10^{-4}$ | 50% | 0 | 0 | 12 | $1 \times 10^{-4}$ |
| I | 50% | 3.5 | $2 \times 10^{-4}$ | 50% | 3.5 | 0 | 3.5 | $1 \times 10^{-4}$ |

Similarl to Example 9, although the silver halide emulsions A through I were used, by using the sensitizing dye No.5, photothermographic materials shown in Table 14 were obtained. Performances were evaluated as in Example 9, and results thereof are shown in Table 14.

TABLE 14

| Sample No. | Em No. | Compound of type 1 to 5 Kind | (*) | Dmin | Sensitivity | Image storage stability | Note |
|---|---|---|---|---|---|---|---|
| 1 | A | — | — | 0.20 | 100 | 0.15 | Comparative example |
| 26 | B | — | — | 0.25 | 70 | 0.16 | Comparative example |
| 27 | B | 3 | $1 \times 10^{-3}$ | 0.18 | 155 | 0.10 | Inventive example |
| 28 | B | 10 | $1 \times 10^{-3}$ | 0.19 | 150 | 0.09 | Inventive example |
| 29 | B | G-3 | $1 \times 10^{-3}$ | 0.18 | 145 | 0.08 | Inventive example |
| 30 | C | — | — | 0.22 | 80 | 0.16 | Comparative example |

TABLE 14-continued

| Sample No. | Em No. | Compound of type 1 to 5 Kind | (*) | Dmin | Sensitivity | Image storage stability | Note |
|---|---|---|---|---|---|---|---|
| 31 | C | 8 | $2 \times 10^{-3}$ | 0.17 | 185 | 0.09 | Inventive example |
| 32 | C | 34 | $2 \times 10^{-3}$ | 0.18 | 200 | 0.10 | Inventive example |
| 33 | D | — | — | 0.20 | 105 | 0.15 | Comparative example |
| 34 | D | 9 | $5 \times 10^{-4}$ | 0.15 | 310 | 0.05 | Inventive example |
| 35 | D | 41 | $5 \times 10^{-4}$ | 0.14 | 303 | 0.05 | Inventive example |
| 36 | E | — | — | 0.21 | 95 | 0.17 | Comparative example |
| 37 | E | 13 | $5 \times 10^{-4}$ | 0.17 | 315 | 0.07 | Inventive example |
| 38 | E | G-1 | $5 \times 10^{-4}$ | 0.16 | 325 | 0.06 | Inventive example |
| 39 | F | — | — | 0.23 | 85 | 0.16 | Comparative example |
| 40 | F | 12 | $2 \times 10^{-3}$ | 0.17 | 300 | 0.05 | Inventive example |
| 41 | F | G-12 | $2 \times 10^{-3}$ | 0.15 | 310 | 0.06 | Inventive example |
| 42 | G | — | — | 0.22 | 40 | 0.19 | Comparative example |
| 43 | G | 24 | $1 \times 10^{-3}$ | 0.17 | 120 | 0.10 | Inventive example |
| 44 | G | 41 | $1 \times 10^{-3}$ | 0.15 | 165 | 0.13 | Inventive example |
| 45 | H | — | — | 0.21 | 60 | 0.20 | Comparative example |
| 46 | H | 34 | $1 \times 10^{-3}$ | 0.17 | 185 | 0.11 | Inventive example |
| 47 | H | 46 | $1 \times 10^{-3}$ | 0.15 | 190 | 0.19 | Inventive example |
| 48 | I | — | — | 0.21 | 105 | 0.15 | Comparative example |
| 49 | I | G-1 | $5 \times 10^{-4}$ | 0.17 | 320 | 0.04 | Inventive example |

(*) Addition amount (mol/mol of silver halide)

Similarly to Example 9, the samples according to the invention were high in the sensitivity and excellent in the image storage stability due to the heat development.

Example 11

1) Preparation of Photosensitive Silver Halide Emulsion

In 900 mL of water, 7.5 g of ossein gelatin having an average molecular weight of 100,000 and 10 mg of potassium bromide were dissolved, and temperature and pH thereof, respectively, were adjusted to 35° C. and 3.0, thereafter, 370 mL of an aqueous solution containing 74 g of silver nitrate, 370 mL of an aqueous solution containing potassium bromide and potassium iodide in a. molar ratio of (98/2), and iridium chloride of $1\times10^{-4}$ mol per mol of silver were added thereto while maintaining the pAg at 7.7 by means of a controlled double jet method over 10 minutes. Thereafter, 0.3 g of 4-hydroxy-6-methyl-1,3,3a, 7-tetrazaindene was added and the pH was controlled to 5 with NaOH, and thereby cubic particles of silver bromoiodide having an average particle size of 0.06 μm, a standard deviation of particle size of 12%, and a (100) plane ratio of 87% were obtained. To the emulsion, a gelatin coagulant was added, thereby the silver halide particles were allowed to coagulate and precipitate, after desalting, 0.1 g of phenoxyethanol was added, thereby the pH and pAg, respectively, were adjusted to 5.9 and 7.5, and thereby a photosensitive silver halide emulsion was obtained.

The photosensitive silver halide emulsion was heated to 55° C. and $5\times10^{-5}$ mol of the compound A was added thereto. Subsequently, $7\times10^{-5}$ mol of ammonium thiocyanate and $5.3\times10^{-5}$ mol of chloruaric acid were added. Then, 0.3 mol % of fine particles of silver iodide was added. After ripening for 100 minutes followed by cooling to 38 degree centigrade, the chemical sensitization came to completion. The above additional amounts were based on one mol of silver of the silver halide.

2) Preparation of Powdery Organic Silver Salt

Into 4720 mL of distilled water, 111.4 g of behenic acid, 83.3 g of arachidic acid and 54.9 g of stearic acid were added and dissolved at 80° C., thereafter 540.2 mL of an aqueous 1.5 N NaOH agueous solution was added, 6.9 mL of concentrated nitric acid was added followed by cooling to 55° C., and thereby a solution of sodium salt of organic acid was obtained. With the solution of sodium salt of organic acid maintaining at 55° C., the silver halide emulsion (containing 0.038 mol of silver) and 450 mL of distilled water were added followed by stirring for 5 minutes. Subsequently, 760.6 mL of 1 mol/l silver nitrate solution was added over two minutes followed by further stirring for 20 minutes, and thereby an organic silver salt dispersion was obtained. Thereafter, the obtained organic silver salt dispersion was transferred to a washing vessel, deionized water was added and stirred followed by leaving standing still, and thereby the organic silver salt dispersion was allowed to float and separate as a supernatant, and aqueous salts below the supernatant were removed. Thereafter, washing with deionized water and draining were repeated until the electric conductivity of drained water became 2 μS/cm, centrifugal dewatering was applied thereto, thereafter drying was applied at 40° C. until weight loss became zero by use of a circulation dryer with warm air whose oxygen partial pressure was 10% by volume, and thereby powdery organic silver salt containing photosensitive silver halide was obtained.

3) Preparation of Organic Silver Salt Dispersion Containing Photosensitive Silver Halide In 1457 g of methyl ethyl ketone (MEK), 14.57 g of polyvinyl butyral powder (Butvar B-79, available from Monsanto Corp.) was dissolved, and while stirring with a dissolver type homogenizer, 500 g of the powdery organic silver salt above described was gradually added followed by thoroughly mixing, and thereby slurry was obtained.

The slurry was dispersed by use of a media disperser 80% by volume packed with 1 mm Zr beads (available from Toray Corp.) under the conditions of a periphery speed of 13 m and a retention in mill time of 0.5 minutes, and thereby an organic silver salt dispersion containing photosensitive silver halide was obtained.

4) Preparation of Image-Forming Layer Coating Solution

With 500 g of the organic silver salt dispersion containing the photosensitive silver halide stirring in a stream of nitrogen, 100 g of MEK was added and the resultant solution was held at 24 degree centigrade. A methanol solution of 10% by weight of the following antifoggant 1 was added thereto by 2.5 mL followed by stirring for 15 minutes. Subsequently, 1.8 mL of a solution that contains the dye adsorption promoter and potassium acetate with a mass ratio of 1:5 and 20% by weight of the dye adsorption promoter was added followed by stirring for 15 minutes. Subsequently, 7 mL of a mixed solution of an infra-red sensitizing dye according the invention (described in Table 15), 4-chloro-2-benzoyl succinic acid and 5-methyl-2-mercaptobenzimidazole that is a supersensitizer (methanol solution having a mixing ratio=1:250:20 by mass, respectively, and a concentration of the sensitizing dye=0.1% by weight) and a compound according to the invention (described in Table 15) were added followed by stirring for 1 hour, thereafter the temperature was lowered to 13° C. followed by further stirring for 30 minutes. With the temperature maintained at 13° C., 48 g of polyvinyl butyral was added and thoroughly dissolved, and the following additives were added. All of these operations were performed in a stream of nitrogen.

| | |
|---|---|
| Phthaladine | 1.5 g |
| Tetrachlorophthalic acid | 0.5 g |
| 4-methylphthalic acid | 0.5 g |
| Dye-2 | 2.0 g |
| Reducing agent (1, 1-bis(2-hydroxy-3,5-dimethylphenyl)-3,5,5-trimethylhexane) | 15 g |
| Desmodur N3300 (aliphatic isocyanate produced by Movey Co.) | 1.10 g |
| 2-(tribromomethylsulfonyl)-pyridine | 1.55 g |
| Antifoggant 2 | 0.9 g |

5) Coating

Image-forming layer: On a surface opposite to a back layer of a support, which was coated with a back layer as in Example 9, the image-forming layer coating solution was coated so that an amount of coated silver might be 1.8 g/m$^2$ and that of polyvinyl butyral of the binder 8.5 mg/m$^2$.

Surface protective layer: The following coating solution was coated so that a wet coating thickness would be 100 μm.

| | |
|---|---|
| Acetone | 175 ml |
| 2-propanol | 40 ml |
| Methanol | 15 ml |
| Cellulose acetate | 8 g |
| Phthaladine | 1.5 g |
| 4-methyl phthalic acid | 0.72 g |
| Tetrachlorophthalic acid | 0.22 g |
| Anhydrous tetrachlorophthalic acid | 0.5 g |
| Mono-dispersed silica having an average particle size of 4 μm (standard deviation of 20%) | 1% by weight with respect to binder |
| Fluorinated polymer surfactant C | 0.5 g |

6) Evaluation of Performance

Results were evaluated as in Example 9 and are shown in Table 15. The sensitivity is shown as a relative value based on the sensitivity of sample No. 11-1. Similarly to Example 9, samples according to the invention were high in the sensitivity and excellent in the storage stability after the thermal development.

TABLE 15

| | Compound of type 1 to 5 | | | Performance | | Image storage | |
|---|---|---|---|---|---|---|---|
| Sample No. | Kind | (*) | Sensitizing dye | Dmin | Sensitivity | stability | Note |
| 11-1 | — | — | 5 | 0.2 | 100 | 0.18 | Comparative example |
| 11-2 | 3 | $1 \times 10^{-3}$ | 5 | 0.14 | 305 | 0.05 | Inventive example |
| 11-3 | 8 | $1 \times 10^{-3}$ | 5 | 0.16 | 310 | 0.07 | Inventive example |
| 11-4 | 13 | $1 \times 10^{-3}$ | 5 | 0.17 | 320 | 0.06 | Inventive example |
| 11-5 | 34 | $1 \times 10^{-3}$ | 5 | 0.15 | 300 | 0.08 | Inventive example |
| 11-6 | G-1 | $1 \times 10^{-3}$ | 5 | 0.16 | 305 | 0.07 | Inventive example |
| 11-7 | — | — | 20 | 0.21 | 105 | 0.19 | Comparative example |
| 11-8 | 9 | $2 \times 10^{-3}$ | 20 | 0.14 | 315 | 0.06 | Inventive example |
| 11-9 | 10 | $2 \times 10^{-3}$ | 20 | 0.16 | 307 | 0.05 | Inventive example |
| 11-10 | 46 | $2 \times 10^{-3}$ | 20 | 0.15 | 312 | 0.04 | Inventive example |
| 11-11 | G-3 | $2 \times 10^{-3}$ | 20 | 0.18 | 305 | 0.06 | Inventive example |
| 11-12 | — | — | 41 | 0.22 | 95 | 0.20 | Comparative example |
| 11-13 | 56 | $5 \times 10^{-4}$ | 41 | 0.18 | 315 | 0.06 | Inventive example |
| 11-14 | 24 | $5 \times 10^{-4}$ | 41 | 0.15 | 300 | 0.05 | Inventive example |
| 11-15 | 11 | $5 \times 10^{-4}$ | 41 | 0.16 | 295 | 0.08 | Inventive example |
| 11-16 | 12 | $5 \times 10^{-4}$ | 41 | 0.14 | 312 | 0.07 | Inventive example |
| 11-17 | 41 | $5 \times 10^{-4}$ | 41 | 0.15 | 320 | 0.07 | Inventive example |
| 11-18 | G-12 | $5 \times 10^{-4}$ | 41 | 0.17 | 308 | 0.06 | Inventive example |

(*) Addition amount (mol/mol of silver halide)

Example 12

1) Preparation of Samples

In the preparation of sample 9-1 (comparative sample) and sample 9-9 (present invention) of Example 9, by varying the drying time period, samples having different amounts of residual solvent (MEK) were prepared. It goes without saying that the shorter the drying time period is set, the greater the amount of the residual solvent is, and the longer the drying time period is set, the smaller the amount of the residual solvent is.

The amounts of the residual solvent of the obtained samples were measured as in Example 9, and the results are shown in Table 16.

TABLE 16

| Sample No. | Coating prescription | Drying time period (min) | Amount of residual solvent (MEK: mg/m$^2$) |
|---|---|---|---|
| 9-1-a | Sample 1 | 30 | 8.0 |
| 9-1-b | (comparative | 15 | 12.0 |
| 9-1-c | sample) | 11 | 25 |
| 9-1-d | | 6 | 63 |
| 9-1-e | | 4 | 170 |
| 9-9-a | Sample 9 | 30 | 8.0 |
| 9-9-b | (present | 15 | 11.5 |
| 9-9-c | invention) | 11 | 26 |
| 9-9-d | | 8 | 65 |
| 9-9-e | | 4 | 175 |

2) Evaluation of Performance (Storage Stability)

The prepared sample was cut into half-cut size sheets, packed with the following packaging material under an environment of 35° C. and 60% RH followed by preserving for one week. Thereafter, as in Example 9, the exposure and thermal development were carried out, and photographic performance was evaluated.

Packaging Material

The packaging material was a laminated material of PET 10 μm/PE 20 μm/Al foil 9 μm/Ny 15 μm/PE containing 3% by weight of carbon 50 μm and had the following characteristics.

Oxygen transmission rate: 0.02 ml/atm/m$^2$/day at 25° C.

Moisture transmission rate: 0.10 g/atm/m$^2$/day at 25° C.

Sensitivity change and fog density after the preservation under the above conditions were measured and regarded as the measure of the storage stability. The smaller the sensitivity change is, the more excellent the storage stability is. Furthermore, the fog density is preferable to be free from an increase. Results are shown in Table 17.

Δ fog=fog value after the preservation−fog value immediately after coating.

Sensitivity change (%)=(sensitivity after the preservation−sensitivity immediately after coating)/sensitivity immediately after coating.

TABLE 17

| Sample No. | Fog (Dmin) (Immediately after coating) | Change of Fog Density (Δfog) | Sensitivity (immediately after coating) | Change of sensitivity (%) |
|---|---|---|---|---|
| 9-1-a | 0.18 | 0 | 105 | -5 |
| 9-1-b | 0.20 | 0.01 | 100 | -5 |
| 9-1-c | 0.20 | 0.01 | 100 | -5 |

TABLE 17-continued

| Sample No. | Fog (Dmin) (Immediately after coating) | Change of Fog Density (Δfog) | Sensitivity (immediately after coating) | Change of sensitivity (%) |
|---|---|---|---|---|
| 9-1-d | 0.21 | 0.01 | 98 | -7 |
| 9-1-e | 0.22 | 0.02 | 95 | -10 |
| 9-9-a | 0.17 | 0 | 300 | -5 |
| 9-9-b | 0.18 | 0 | 300 | -5 |
| 9-9-c | 0.18 | 0 | 300 | -5 |
| 9-9-d | 0.19 | 0.01 | 294 | -15 |
| 9-9-e | 0.20 | 0.03 | 256 | -32 |

From the results of Table 17, one can see that the effects of the invention are particularly large in a region where an amount of residual solvent is 150 mg/m$^2$ or less, particularly larger in a region where the amount of residual solvent is 40 mg/m$^2$ or less, that is, the storage stability is preferable.

Example 13

Samples were prepared similarly to Example 9 except that dye No. 54 according to the invention was used as a sensitizing dye, then evaluated as in Example 9. As a result, the samples according to the invention exhibited excellent performance similar to Example 9.

What is claimed is:

1. A photothermographic material comprising: a support; and a photosensitive silver halide, a non-photosensitive organic silver salt, a reducing agent for a silver ion and a binder disposed on one surface of the support, wherein a silver behenate-content of the non-photosensitive organic silver salt is 40 to 70 mol %, and the photothermographic material comprises a compound that can be one-electron-oxidized to provide a one-electron oxidation product, which further releases at least 1 electron, during or after a subsequent reaction;

wherein the compound that can be one-electron-oxidized to provide the one-electron oxidation product is selected from compounds of following 1 to 5:

(1) a compound that can be one-electron-oxidized to provide a one-electron oxidation product, which further releases at least 2 electron, one of during and after a subsequent bond cleavage reaction;

(2) a compound that has at least 2 adsorbable groups to the silver halide and can be one-electron-oxidized to provide a one-electron oxidation product, which further releases at least 1 electron, one of during and after a subsequent bond cleavage reaction;

(3) a compound that can be one-electron-oxidized to provide a one-electron oxidation product, which further releases at least 1 electron after a subsequent bond formation;

(4) a compound that can be one-electron-oxidized to provide a one-electron oxidation product, which further releases at least 1 electron after a subsequent ring cleavage reaction; and (5) a compound represented by X—Y, in which X represents a reducing group and Y represents a leaving group, and convertable by one-electron-oxidizing the reducing group to a one-electron oxidation product, which can be converted into an X radical by eliminating the leaving group in a subsequent X—Y bond cleavage reaction, 1 electron being released from the X radical.

2. The photothermographic material according to claim 1, wherein said compounds of 1 to 5 have a sensitizing dye moiety.

3. The photothermographic material according to claim 1, wherein said compounds of 1 and 3 to 5 have a adsorbable group to the silver halide.

4. The photothermographic material according to claim 1, wherein said photothermographic material comprises polyvinylbutyral as said binder, a weight ratio of polyvinylbutyral to the total weight of the binder contained in a photosensitive layer being 50 to 100 weight %.

5. The photothermographic material according to claim 4, wherein an amount of a residual solvent of methyl ethyl ketone is 0.1 to 150 mg/m$^2$.

6. The photothermographic material according to claim 1, wherein said photothermographic material comprises at least one of a compound represented by the following g formula (PO) and a compound represented by the following formula (M):

$$Q\text{-}(Y)_n\text{—}C(Z_1)(Z_2)X \qquad \text{Formula (PO)}$$

wherein Q represents a heterocyclic group; Y represents a divalent linking group; n represents 0 or 1; $Z_1$ and $Z_2$ each represent a halogen atom; and X represents a hydrogen atom or an electron-withdrawing group:

Formula (M)

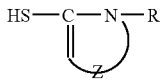

wherein Z represents an atomic group forming a 5- or 6-membered aromatic heterocycle; and R represents a hydrogen atom, an alkyl group, an aralkyl group, an alkoxy group or an aryl group.

7. The photothermographic material according to claim 6, wherein said photothermographic material comprises a compound represented by the following formula (PR):

Formula (PR)

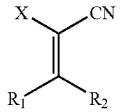

wherein $R_1$ represents a hydroxyl group or a metal salt thereof; $R_2$ represents an alkyl group or an aryl group; and X represents an electron-withdrawing group or forms a ring containing an electron-withdrawing group with $R_2$.

8. The photothermographic material according to claim 1, wherein said photothermographic material comprises a compound represented by the following formula (T) and a heteroatom-containing macrocyclic compound:

Formula (T)

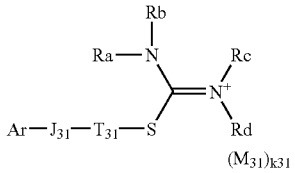

wherein Ar represents an aromatic hydrocarbon group or an aromatic heterocyclic group; $T_{31}$ represents a divalent linking group comprising an aliphatic hydrocarbon group; $J_{31}$ represents a divalent linking group comprising an oxygen atom, a sulfur atom or a nitrogen atom; Ra, Rb, Rc and Rd each represent a hydrogen atom, an acyl group, an aliphatic hydrocarbon group, an aryl group or a heterocyclic group; alternatively, Ra and Rb, Rc and Rd, Ra and Rc, and Rb and Rd may bond together to form a nitrogen-containing heterocyclic group, respectively; $M_{31}$ represents an ion necessary to neutralize a charge of the compound; and k31 represents a number of ions necessary.

9. The photothermographic material according to claim 8, wherein said compounds of 1 to 5 have a sensitizing dye moiety.

10. The photothermographic material according to claim 8, wherein said compounds of 1 and 3 to 5 have a adsorbale group to the silver halide.

11. The photothermographic material according to claim 8, wherein said photothermographic material comprises polyvinylbutyral as said binder, a weight ratio of polyvinylbutyral to the total weight of the binder contained in a photosensitive layer being 50 to 100% by weight.

12. The photothermographic material according to claim 11, wherein an amount of a residual solvent of methyl ethyl ketone is 0.1 to 150 mg/m$^2$.

* * * * *